US005459949A

United States Patent [19]

MacPhail

[11] Patent Number: 5,459,949

[45] Date of Patent: Oct. 24, 1995

[54] FIT AND SUPPORT SYSTEM FOR THE FOOT

[75] Inventor: David M. MacPhail, Whistler, Canada

[73] Assignee: Macpod Enterprises Ltd., Whistler, Canada

[21] Appl. No.: 159,341

[22] Filed: Nov. 29, 1993

Related U.S. Application Data

[63] Continuation-in-part of Ser. No. 831,241, Feb. 3, 1992, Pat. No. 5,265,350, which is a continuation-in-part of Ser. No. 794,674, Nov. 18, 1991, which is a continuation of Ser. No. 511,898, Apr. 23, 1990, abandoned, which is a continuation-in-part of Ser. No. 342,971, Apr. 25, 1989, abandoned, which is a continuation of Ser. No. 633,188, Dec. 28, 1990, abandoned.

[51] Int. Cl.[6] ..... A43B 5/04; A43B 5/00; A43B 23/28

[52] U.S. Cl. ..... 36/117; 36/119; 36/88; 36/69

[58] Field of Search ..... 36/68, 69, 71, 36/88, 92, 93, 97, 117, 119, 155, 160

[56] References Cited

U.S. PATENT DOCUMENTS

| | | | |
|---|---|---|---|
| 3,431,658 | 3/1969 | Finn | 36/97 |
| 3,812,602 | 5/1974 | Gertsch et al. | 36/117 |
| 3,883,964 | 5/1975 | Check | 36/119 |
| 4,083,128 | 4/1978 | Rossman | 36/97 |
| 4,506,460 | 3/1985 | Rudy | 36/69 |
| 4,615,127 | 10/1986 | Delery | 36/117 |
| 4,670,999 | 6/1987 | Olivieri | 36/119 |
| 4,724,626 | 2/1988 | Baggio | 36/117 |
| 4,772,041 | 9/1988 | Klosterman | 36/97 |
| 4,922,634 | 5/1990 | Seidel | 36/119 |
| 4,977,692 | 12/1990 | Iwama et al. | 36/119 |
| 5,001,851 | 3/1991 | Baggio et al. | 36/119 |
| 5,265,350 | 11/1993 | MacPhail | 36/117 |

FOREIGN PATENT DOCUMENTS

| | | | |
|---|---|---|---|
| 0240619 | 10/1987 | European Pat. Off. | 36/69 |
| 530106 | 7/1955 | Italy | 36/69 |

*Primary Examiner*—Steven N. Meyers
*Assistant Examiner*—Marie Denise Patterson
*Attorney, Agent, or Firm*—Elbie R. De Kock

[57] ABSTRACT

A footwear device suitable for interfacing with a sports implement, such as a snow ski, ice skate blade or in-line skate wheel system, is provided. It comprises a rigid base (2100), a heel counter (2300), a medial forefoot counter (2201) and a forefoot/midfoot compression member (2400). In one embodiment, the medial forefoot counter (2201) is adjustable in a direction medially/laterally with respect to the foot of a user into different positions relative to the rigid base. In another embodiment, the heel counter (2300) is adjustable in a direction anteriorly/posteriorly with respect to the foot into different positions relative to the rigid base. In a further embodiment, the forefoot/midfoot compression member (2400) comprises an instep counter (2420) and a support member (2410) for the instep counter. The instep counter (2420) is mounted for pivotal movement about a transverse axis relative to the rigid base (2100) and is also pivotable about a vertical axis centered in the vicinity of the first metatarsal of the foot. In a further embodiment, the footwear device includes a sports implement interface member (2101) which is adjustable in a medial/lateral direction with respect to a user's foot into different positions relative to the rigid base (2100).

17 Claims, 65 Drawing Sheets

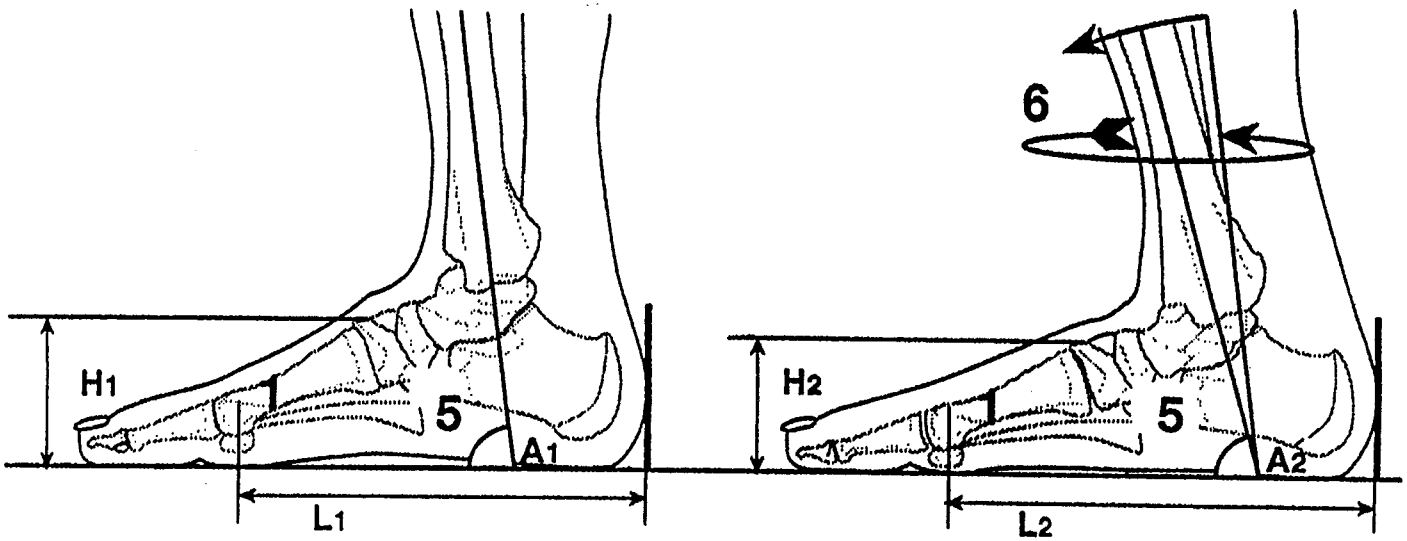
FIG. 22 C
FIG. 22 A
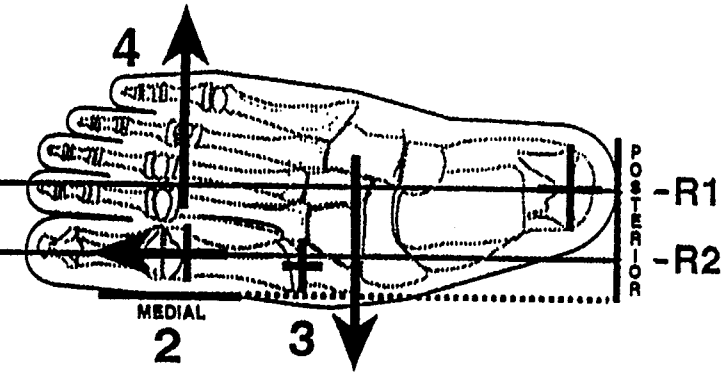
FIG. 22 D
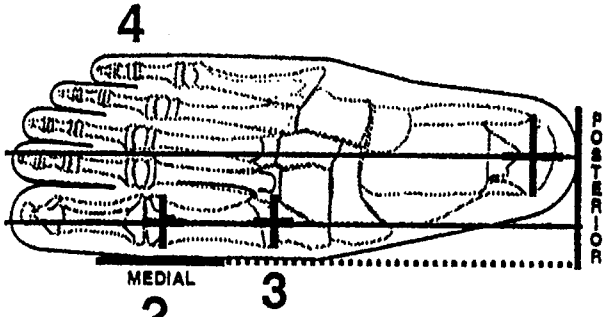
FIG. 22 B

FIT AND SUPPORT SYSTEM FOR THE FOOT

CROSS-REFERENCE TO RELATED APPLICATIONS

This application is a continuation-in-part of U.S. patent application Ser. No. 07/831,241, filed Feb. 3, 1992, now U.S. Pat. No. 5,265,350 the contents of which is incorporated herein by reference; which in turn is a continuation-in-part of co-pending U.S. patent application Ser. No. 07/794,674 filed Nov. 18, 1991; which, in turn, is a continuation of U.S. patent application Ser. No. 07/511,898 filed Apr. 23, 1990, now abandoned; which, in turn, is a continuation-in-part of U.S. patent application Ser. No. 07/342,971 filed Apr. 25, 1989, now abandoned in favour of pending continuation U.S. patent application Ser. No. 07/633,188 filed Dec. 28, 1990.

1. Introduction

This invention relates to a fit and support system for the foot and, more particularly, but not exclusively, to a fit and support system or footwear device suitable for sports footwear, such as ski boots, hockey skates, cycling shoes and the like. Thus, the invention relates in particular, but not exclusively, to applications where the footwear device serves as a connection means between the foot and sports equipment such as a ski, ice skate blade, in-line roller skate wheels or a bicycle pedal.

2. Background of the Invention

The biomechanics of the human muscle and skeletal system as it relates to sports footwear is highly complex. Even for those highly skilled in the art, the state of technology is unsophisticated and poorly developed in cases where the foot is constrained in order to enhance or modify function. For example, while reference material in the form of *Functional Anatomy in Sports* by Juergen Weineck and *The Joints of the Ankle* by Vern T. Inmam M.D., Ph.D. are available to explain the operation of the foot and leg, it does not extend the explanation specifically to the interaction between the foot and leg and the footwear. Bearing this in mind, the explanations which follow are contemplated by the applicant to be correct. However, in the event such explanations are, in the future, found to be incorrect or imprecise, the applicant would not wish to be bound by such explanations which are given solely for the purpose of providing as much information as possible to those knowledgeable in the field.

The interaction between the foot and the footwear necessary to elicit optimum response from the medium to which it is attached is not well understood. Skis, ice skate blades, roller skate wheels and the like represent a medium designed to produce specific performance characteristics when interacting with an appropriate surface. The performance of such mediums is largely dependent on the ability of the user to accurately and consistently apply forces to them as required to produce the desired effect.

In addition, in situations where the user must interact with external forces, for example gravity, the footwear must restrain movements of the user's foot and leg in a manner which maintains the biomechanical references with the medium with which it is interacting. It is proposed that in such circumstances, the footwear must serve as both an adaptive and a linking device in connecting the biomechanics of the user to a specific medium, such as a ski, for example. This connective function is in addition to any type of fixation employed, in this instance, to secure the footwear to the ski.

Alpine ski boots, ice skate footwear and cycling shoes are among the many types of sports footwear known. As with all sports footwear, the objectives in design and construction are to facilitate and enhance performance in the particular sport and to provide comfort to the wearer.

Existing footwear does not provide for the dynamic nature of the architecture of the foot by providing a fit system with dynamic and predictable qualities to substantially match those of the foot and lower leg.

Although somewhat vaguely stated, a generally accepted theme has arisen over the years, one of indiscriminate envelopment and "overall restraint" applied to the foot and leg within the footwear. The stated position of various authorities skilled in the art of the design and fabrication of footwear for skiing is that the foot functions best when movement about its articulations is substantially prevented or restricted.

To serve this end, inner ski boot liners are usually formed around inanimate lasts or, alternatively, the foot and leg are inserted into an inner liner within the ski boot shell and foam is introduced into a bladder in the liner so as to totally occupy any free space between the foot and leg and the outer ski boot shell. The outer shell of the footwear is closed around this inner envelopment forming an encasement with which to secure and substantially immobilize the foot and leg. This is considered the optimum and, therefore, ideal form of envelopment. The perspective is that the physiologic structures of the foot are inherently weak and thus, unsuited for skiing. Enveloping the foot within an enclosure which makes it more rigid is thought to add the necessary strength with which to suitably adapt it for skiing. The reasoning being, that the foot and leg now having being suitably strengthened, can form a solid connection with the ski while the leg, now made more rigid, can better serve as a lever with which to apply edging force to the ski.

To some degree, the prior art has acknowledged a need for the ankle joint to articulate in flexion. However, the prior art has not differentiated exactly how articulation of the ankle joint might be separated from the object of generalized and indiscriminate envelopment and thus made possible. Therefore, the theme of prior art is inconsistent and lacks continuity.

The only disclosure known of a process wherein the separation of envelopment of the foot from articulation of the ankle joint is contained in U.S. Pat. No. 4,534,122, of which the present applicant is also the inventor. This material discloses a supportive structure wherein restrictions to flexion of the ankle joint are essentially removed, support being provided from below the hinge of the ankle joint.

In keeping with the theme of indiscriminate envelopment and overall restraint, the following structures are generally common to all footwear for skiing disclosed by prior art:

(a) a continuous counter system which surrounds the foot and provides for the process of envelopment;

(b) an arrangement of pads or padding with which to envelope the foot;

(c) a substantially rigid outer shell which encases the structures employed for envelopment;

(d) an articulation of the ski boot lower outer shell and the cuff or cuffs which envelope the leg of the user, usually accomplished through a common axis or journal;

(e) a structure to brace and support the leg since prior art considers the ankle joint to be inherently weak and in need of support; and (f) some form of resistance to movement of the cuff.

The inventive technology disclosed by the present application, as will be described in more detail below, teaches the importance of accommodating and enhancing both bipedal and monopedal function by providing for freedom of medial movement of the inside ankle bone. This is in direct contrast with the prior art which teaches, in an indirect manner, that the ideal function for skiing will result from fixing the architecture of the foot in a position closely resembling that of bipedal function, thus preventing monopedal function.

The prior art refers to the importance of a "neutral sub-talar joint". The sub-talar joint is a joint with rotational capability which underlies and supports the ankle joint. The sub-talar joint is substantially "neutral" in bipedal function. That is to say that the foot is neither rolled inward or rolled outward.

If the foot can be substantially maintained in a neutral position with the arch supported and with a broad area of the inner aspect of the foot well padded, there will exist a good degree of comfort. Such a state of comfort exists because the foot is not able to roll inward (pronate) to a degree where significant mechanical forces can be set up which would allow it to bear against the inner surface of the boot shell. In effect, this means that initiation of the transition from a state of bipedal to a state of monopedal function, is prevented. This transition would normally be precipitated by an attempt to balance on one foot. If the foot is contained in a neutral position, traditional supportive footbeds (arch supports) are quite compatible with the mechanisms and philosophies of the prior art.

Problems arise when the foot is attempting a transition from a state of bipedal stance to monopedal stance. If the transition to monopedal stance or function can be completed without interference from the structures of the ski boot, all is fine and well. However, if the transition is allowed to proceed to a point where the mechanics associated with the monopedal function can establish significant horizontal forces, and the further movement of the foot is blocked before the transition can be completed, the skier will experience pain and discomfort at the points where the inner aspect of the foot bears against the structures of the footwear. This is the situation experienced by a majority of the skiers with prior art footwear. It is at this point where arch supports, if employed, also begin to cause discomfort. It should be noted that it is the normal tendency of the foot to pronate when weight bearing on one foot.

Footbeds (arch supports) may work in conventional boots (which traditionally do not allow natural biomechanics or movement of the foot to occur), but in a boot which accommodates and supports natural leg and foot articulation and function, arch supports can be detrimental.

When the foot attempts to pronate inside the ski boot, it is often the case that the ankle bone will come to bear against the inner surface of the boot shell. When contact of this nature occurs, pain and other related complications usually result. Since the consensus of those skilled in the art of ski boot design and modification is that pronation or the rolling inward of the foot is detrimental, and, thus, undesirable, provision is not made to allow for such movement. Rather, the structure of the footwear is intended to resist or even prevent it.

Thus, the problem with existing footwear arises due to the dynamic nature of the architecture of the foot. When the wearer is standing with the weight equally distributed between left and right feet so that the center of mass of the wearer is manifesting itself in the center between the feet, the architecture of the wearer's foot assumes a specific configuration. As the wearer begins to shift his weight towards one foot so that the other foot bears proportionately less weight, the wearer's center of mass moves over the medial aspect to the center of the weighted foot so as to assume a position of balance. In order for this movement of the wearer's center of mass to occur, the architecture of the weighted foot must undergo a progressive re-alignment. Existing footwear does not adequately anticipate this re-alignment of the architecture of the foot and thus such footwear inhibits the wearer's ability to assume a balanced position.

A further problem with existing footwear is the fact that longitudinal relative movement between the foot and the footwear may occur. This happens, for example, when the forefoot/midfoot section of the foot is not adequately restrained under certain conditions, such as when flexion is occurring between the lower leg and the foot. Such longitudinal relative movement contributes to the disruption of biomechanical reference points associated with the dynamics of the ski and, in addition, results in a delay in the transmission of force between the leg and foot and the footwear.

Yet a further problem with existing footwear for skiing, in particular the rear entry type, relates to the obstruction of the leg in forward flexion. A relatively freely flexing gaiter or cuff is necessary in order to permit the posterior muscle groups of the lower leg to modulate external force exerted on the footwear. This requires that the axis of the footwear be allowed to rotate so that small degrees of flexion/extension occur at the foot with the lower leg being relatively passive and that large degrees of flexion/extension occur as coordinated ankle, knee and hip flexion. The construction of the prior art requires flexion/extension to occur primarily at the knee and hip joints which is disadvantageous to the user.

While some types of rear entry boots do disclose gaiters or cuffs which provide a degree of relatively free flexion, there remains numerous problems, the most serious of which is the fact that the device employed to secure the foot of the user exerts, in addition to the downward directed force on the foot, a simultaneous rearward directed force on the leg which acts to resist forward flexion in spite of any free hinging action of the cuff. The result is an interference with the physiologic function of the foot and leg of the user.

Yet another problem resides in buckle or overlap type footwear. In order to provide for entry of the foot of the user and for resistance to flexion, plastic materials are employed for the outer shell which have flexural qualities. This is necessary in order to facilitate the aforementioned requirements. Plastic materials by their very nature tend to resist point loadings by a relaxation of the material at the point where stress is applied. This characteristic creates serious problems for two reasons. First, the teaching of this application is that force must be applied and maintained only to specific areas of the foot and leg of the user while allowing for unrestricted movement of other areas. The application and maintenance of such force by flexible plastic materials in the structures of prior art is necessarily difficult, if it is possible at all.

Second, the plastic materials in relaxing under the application of stress assume a new shape by moving into void areas. Thus, the probability is great that the plastic material will change shape so as to inhabit the very area required for the uninhibited displacement of the structures of the foot and leg. The result of these limitations is interference with the physiologic function of the user.

Top and rear entry footwear for skiing and skating necessarily have interior volumes greater than that required by the wearers foot and leg, particularly in the area over the instep, in order to accommodate entry. This additional volume makes the incorporation of structures designed to provide accurate and consistent support to specific areas necessarily difficult and ineffective. This results in reduced support for the foot and leg.

Another problem with conventional footwear relates to the flex of the lower leg relative to the foot. It is desirable to provide a degree of resistance to such movement to assist in dampening movement of the mass of the skier relative to the ski resulting from, for example, a velocity change due to terrain changes and to assist the user in transferring energy to the ski. Adjustment of such resistance is desirable in order that the user may compensate for different physical makeup and different operating conditions. In present ski footwear, sources of resistance for such purpose are poorly controlled and often produce resistance curves inappropriate for the operating environment thereby adversely affecting the balance and control of the user and creating a need for additional energy to be expended to provide correction. In many applications, resistance is achieved by deformation of shell structures thereby resulting in reduced support for the user's foot and leg. If indeed provision is made for adjustment of flex resistance in the instances cited, it is very limited in terms of ability to suitably modify resistance curves.

Yet a further problem relates to the efficient transfer of torque from the lower leg and foot to the footwear. When the leg is rotated inwardly relative to the foot by muscular effort a torsional load is applied to the foot. Present footwear does not adequately provide support or surfaces on and against which the wearer can transfer biomechanically generated forces such as torque to the footwear. Alternatively, the footwear presents sources of resistance which interfere with the movements necessary to initiate such transfer. It is desirable to provide for appropriate movement and such sources of resistance in order to increase the efficiency of this torque transfer and, in so doing, enhance the turning response of the ski.

SUMMARY OF THE INVENTION

According to the invention, there is provided a footwear device comprising a rigid base for supporting the foot of a user thereon; a heel counter on the rigid base for contact with the foot of a user in a first area of the foot posterior to the posterior aspect of the heel of the foot; a medial forefoot counter associated with the rigid base for contact with the foot of a user in a second area of the foot medial to the medial aspect of the head of the first metatarsal of the foot and wherein said medial forefoot counter is movable in a direction medially/laterally with respect to said foot into different positions relative to said rigid base and including means for selectively locking said medial forefoot counter in one of said positions; and a forefoot/midfoot compression member for contact with the foot of a user in a third area of the foot located on the dorsum of said foot for exerting a downwardly and rearwardly directed force on the dorsum of the foot.

Also according to the invention, there is provided footwear device comprising a rigid base for supporting the foot of a user thereon; a heel counter on the rigid base for contact with the foot of a user in a first area of the foot posterior to the posterior aspect of the heel of the foot; a medial forefoot counter associated with the rigid base for contact with the foot of a user in a second area of the foot medial to the medial aspect of the head of the first metatarsal of the foot; a forefoot/midfoot compression member for contact with the foot of a user in a third area of the foot located on the dorsum of said foot for exerting a downwardly and rearwardly directed force on the dorsum of the foot; and a sports implement interface member on the rigid base for interfacing with a sports implement and including means for attaching a sports implement thereto, wherein said interface member is movable in a medial/lateral direction with respect to a user's foot into different positions relative to said rigid base and including means for selectively locking said interface member in one of said positions relative to said rigid base.

Further according to the invention, there is provided a footwear device comprising a rigid base for supporting the foot of a user thereon; a heel counter on the rigid base for contact with the foot of a user in a first area of the foot posterior to the posterior aspect of the heel of the foot, wherein said heel counter is movable in a direction anteriorly/posteriorly with respect to said foot into different positions relative to said rigid base and including means for selectively locking said heel counter in one of said positions; and a forefoot/midfoot compression member for contact with the foot of a user in a third area of the foot located on the dorsum of said foot for exerting a downwardly and rearwardly directed force on the dorsum of the foot.

Also according to the invention, there is provided a footwear device comprising an elongate rigid base for supporting the foot of a user thereon; a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with said posterior heel counter, wherein said forefoot/midfoot compression member comprises an instep counter, and a support member for said instep counter attached to said rigid base, wherein said instep counter is pivotally connected to said support member about a first pivot axis which is transverse to said rigid base; and wherein said instep counter is further pivotally connected to said support member about a substantially vertical second pivot axis which is located in the vicinity of the head of the first metatarsal of the foot of the user so that the instep counter is supported relative to said rigid base for pivotal movement about a pair of different pivot axes.

The vertical axis is preferably centered over the medial/lateral axis of the first metatarsal.

Further according to the invention, there is provided a footwear device comprising an elongate rigid base for supporting the foot of a user thereon; a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with said posterior heel counter, wherein said forefoot/midfoot compression member comprises an instep counter and a support member for said instep counter attached to said rigid base, wherein said instep counter is pivotally connected to said support member about a pivot axis which is transverse to said rigid base so that the instep counter is pivotally or swivelably supported relative to said rigid base; and wherein said support member is provided with a stop on the posterior side of said pivot axis with reference to the user's foot, said stop being located above said instep counter for limiting the extent of pivotal movement of said instep counter about said pivot axis.

The inventive feature of the technology disclosed in the present application is that the footwear accommodates, supports and enhances physiologic function of the user on both two feet and on one foot. In this specification, the former will be referred to as "bipedal function" or "bipedal stance" and the latter is referred to as "monopedal function" or "monopedal stance". It is intended that either reference pertain to both dynamic and static states. It should also be understood that the footwear also accommodates states, usually transitory, between bipedal and monopedal function.

Monopedal function is a physiologic state wherein balance is achieved with the weight of the body borne on the medial plantar aspect of one foot. It has been recognized that the ability to balance on one foot (usually the one to the outside during a skiing or skating turn) is superior, in terms of balance and control, to balance on two feet, in sports such as skiing and skating wherein an instrument such as a ski or ice blade is affixed to the sole of the footwear. Monopedal function is extremely relevant in such applications for the following reasons:

(i) Balance on one foot, achieved through pronation, provides superior control of the articulations over balance on two feet. This translates to superior control of the ski or skate blade. It also translates into superior dynamic or kinetic balance. The mechanics of monopedal function permit the center of mass of the body to be accurately placed and its relative position maintained, if necessary, with regard to the ski or skate blade affixed to the sole of the footwear.

(ii) A dominant position on the outside foot in the arc of a turn affords more efficient and precise control of the instrument since the inner limb, being relatively passive, is utilized primarily for the purpose of assisting balance.

(iii) The most important source of rotational power with which to apply torque to the footwear is the adductor/rotator muscle groups of the hip joint. In order to optimally link this capability to the footwear, there must be a mechanically stable and competent connection originating at the plantar processes of the foot and extending to the hip joint. Further, the balanced position of the skier's center of mass, relative to the ski edge, must be maintained during the application of both turning and edging forces applied to the ski. Monopedal function accommodates both these processes.

(iv) In skiing, the mechanics of monopedal function provide a down force acting predominantly through the ball of the foot (which is normally almost centered directly over the ski edge). In concert with transverse torque (pronation) arising from weight bearing on the medial aspect of the foot which torque is stabilized by the obligatory internal rotation of the tibia, the combination of these forces results in control of the edge angle of the ski purely as a result of achieving a position of monopedal stance on the outside foot of the turn.

(v) The edge angle can be either increased or decreased in monopedal function by increasing or decreasing the pressure made to bear on the medial aspect of the foot through the main contact points at the heel and ball of the foot via the mechanism of pronation. As medial pressure increases, horizontal torque (relative to the ski) increases through an obligatory increase in the intensity of internal rotation of the tibia. Thus, increasing medial pressure on the plantar aspect of the foot tends to render the edge-set more stable. The ski edge-set will not be lost until either the state of balance is broken or the skier relinquishes the state of monopedal function on the outside ski.

In order to accurately describe the biomechanics of bipedal and monopedal function, it is necessary to employ anatomical terms.

Bipedal function or bipedal stance, in the context of the invention disclosed, is defined as being a weight bearing state wherein the feet are neither supinated (rolled outward) or pronated (rolled inward). This is described as a "neutral" state of the foot. It is usually associated with weight bearing on two feet wherein each foot bears an equal proportion of the weight of the body.

Monopedal function or monopedal stance is defined as being the state achieved at the conclusion of a progressive weight transfer from two feet to the medial aspect of the plantar surface of one foot. As the weight transfer occurs, the foot to which the weight is being transferred undergoes pronation until a physiologic state of balance is achieved on one foot. Monopedal function distinguishes itself from other possible states of balance on one foot in that the ability to mobilize the joints of the body required to re-orient the center of mass relative to the foot is possible while simultaneously maintaining a state of balance in relation to the forces acting on the user.

As an example, one can bear weight on one foot without having that foot pronate and, thus, not assume the position required for monopedal function, thus there is no significant inward movement of the ankle bone. This is done by shifting the weight to bear on the lateral aspect of the foot, and using the extrinsic leg and intrinsic foot musculature to support its medial arch. However, this form of balance produces a relatively static position in terms of ability to re-orient the center of mass of the body relative to the supporting limb. This static quality is typical of states of balance on one foot achieved by other than monopedal function. With monopedal function, medial movement of the inside ankle bone is involved.

The foot articulates in order to facilitate muscle function. Muscles respond in opposition to loads imposed upon the foot. A process ensues wherein the chain of articulations, initiated at the foot, are continuously mobilized so as to maintain a state of balance.

Some of the articulations involve displacements beyond the neutral envelope of the architecture of the foot. Any significant source of interference to these displacements can potentially disrupt the flow of the dynamic chain.

The important characteristic of the footwear device of the present application is that it accommodates monopedal function and, in so doing, couples the foot to the footwear at specific points while providing the remainder of the foot the relative freedom required so that its articulations may respond to loads imposed on it. Thus, related muscle function is also accommodated. Precise coupling of the foot to the footwear is possible because the foot, in weight bearing states, but especially in monopedal function, becomes structurally competent to exert forces in the horizontal plane relative to the sole of the footwear at the points of a triangle formed by the posterior aspect and oblique posterior angles of the heel, the head of the first metatarsal and the head of the fifth metatarsal. In terms of transferring horizontal torsional and vertical forces relative to the sole of the footwear, these points of the triangle become the principal points of contact with the bearing surfaces of the footwear.

In order to accommodate monopedal function and integrate with the mechanics of the foot and leg, the footwear device according to the present invention in its various embodiments utilizes aspects, such as anchor points, control points, restraint points, articulation points, reference points and, in particular applications, also a leg member.

The footwear device utilizes an anchor point in the form of a heel counter. This anchor point serves to prevent rearward movement of the heel relative to the base of the footwear device. The rear portion of the heel of the user is designated as the anchor point for its articulations with the foot which occur during shifting of the user's weight when moving between bipedal stance and monopedal stance.

A control point in the form of a counter set medial to the head of the first metatarsal is used in order to restrain the first metatarsal against medial movement, such as would occur when internal torsional force is applied to the foot.

The footwear device provides restraint to the upper portion of the forefoot/midfoot (instep) of the user's foot in the way of a forefoot/midfoot compression member. The restraint provides a force acting principally downward and rearward so as to maintain the heel of the user in constant contact with the heel counter. Restraint against inward and downward displacement of the medial structures of the foot situated between the heel counter and the counter medial to the medial aspect of the head of the first metatarsal is avoided.

The portions of the foot between the heel counter and the counter medial to the head of the first metatarsal, including the medial and lateral malleolus and lower part of the leg, are free of any restraint, which would preclude the displacement of structures required for monopedal or bipedal function.

Reference points are defined as specific areas of the foot associated with the limit of displacement of key structures relating to bipedal and/or monopedal function. Elements of the footwear device set opposite these points serve to help define the limits of displacement. These elements also serve to assist the function of muscles which facilitate balance by providing a source of resistance. In some instances, reference points can be utilized to transfer turning forces from the foot to the footwear.

A leg member is provided in certain applications to control the movement of the leg of the user relative to the rigid base. The leg member is rotatably connected to the rigid base of the footwear device. The leg member encircles the leg at the top of the footwear device and controls the movement of the leg at this point.

In the area of the malleolus, the leg is free to pivot both laterally and medially from its pivot point at the top of the footwear device. Thus, it is intended that the leg be unrestrained in terms of medial/lateral movement at the malleolus so that there is freedom for the articulations of the ankle/foot complex.

The leg member cooperates with, but is independent in its action from, the forefoot/midfoot compression member.

Provision has been made in the footwear device in order to prevent movement of the leg beyond a predetermined point in both fore and aft movement since movement beyond certain limits is detrimental to skier balance. In addition, such movement can overstress structures of the foot.

An important object of the invention is to provide a footwear device which accommodates the physiology of both bipedal and monopedal function. In this respect, the displacements of the foot associated with pronation, which are required to assume a monopedal stance, are permitted and accommodated. Further, the displacements of the foot required to resume a bipedal stance from a monopedal stance are also permitted and accommodated.

It is also an object of the invention that the elements of the footwear device influence the displacements of the foot associated with a bipedal or monopedal function and, in so doing, cause them to occur relative to the rigid base of the footwear device in a manner which is both consistent and predictable.

The changes which the configuration of the foot and the leg undergo in going from bipedal to a monopedal function and vice-versa involves a complex sequence of events which the elements of the footwear device must accommodate and be perfectly coordinated with. It is an object of the invention to provide the means for such coordination. Any significant source of interference may act to disrupt the sequence of events in which the foot and leg are engaged. Such interference can have profound implications on the entire physiology of the user. Therefore, any interference of this nature is detrimental to the user and undesirable.

In order to accommodate the nature and sequence of the required displacements of the foot and leg, it is an object of the invention that the footwear device be intimately connected to the foot and leg of the user at specific areas only. It is important that all remaining structures of the footwear device be arranged in a manner which ensures that the displacements required for bipedal and monopedal function are in no way obstructed or interfered with.

Further objects and advantages of the invention will become apparent from the description of preferred embodiments of the invention below.

BRIEF DESCRIPTION OF THE DRAWINGS

The invention will now be described, by way of examples, with reference to the accompanying drawings, in which:

FIGS. 22 A to D illustrate plan views and medial elevations of the foot approximating the architecture of bipedal and monopedal functions;

Figure 20:
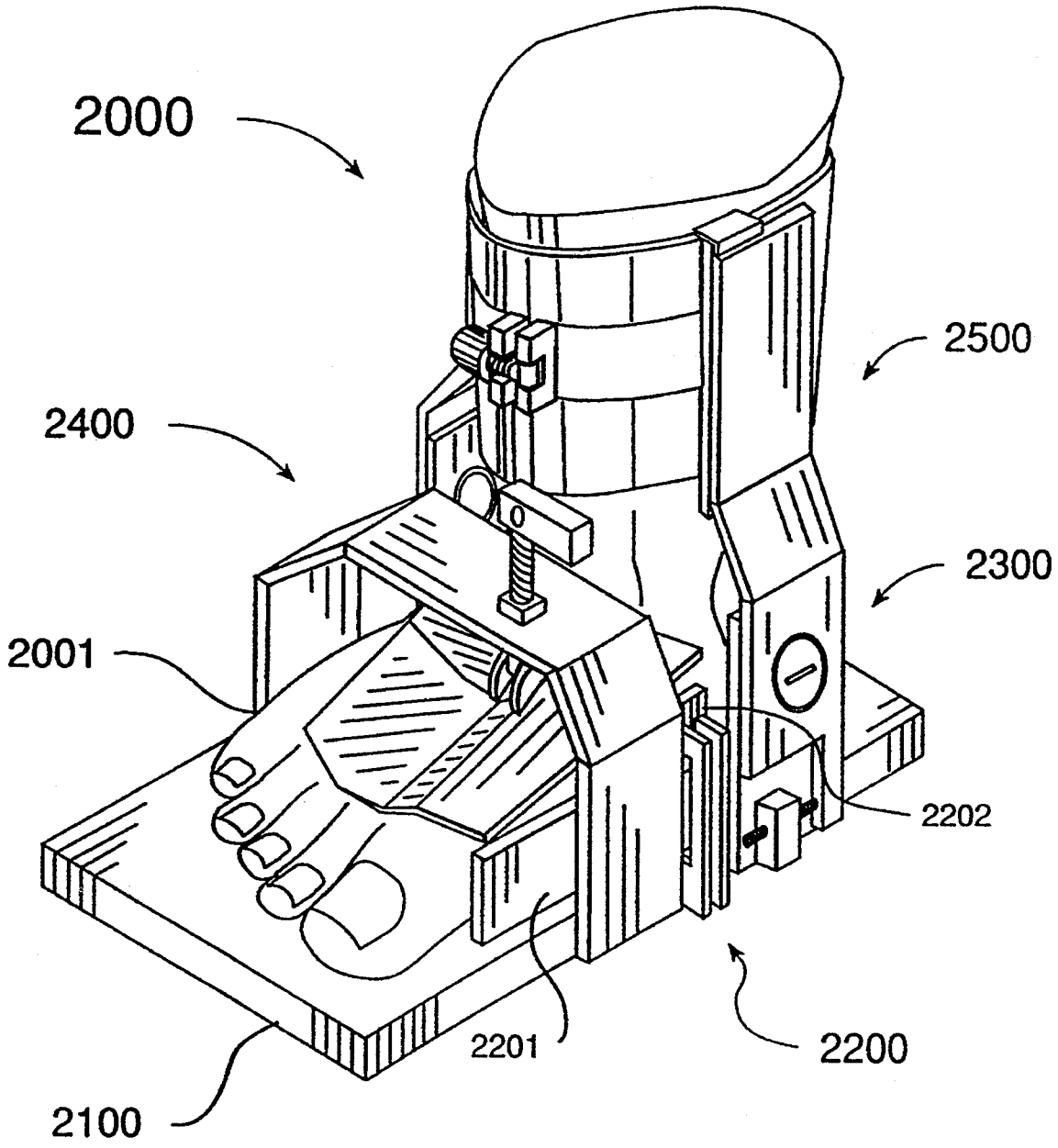
FIG. 20 is a diagrammatical illustration showing the major elements of a fit and support system or footwear device according to the invention.
Figure 47:
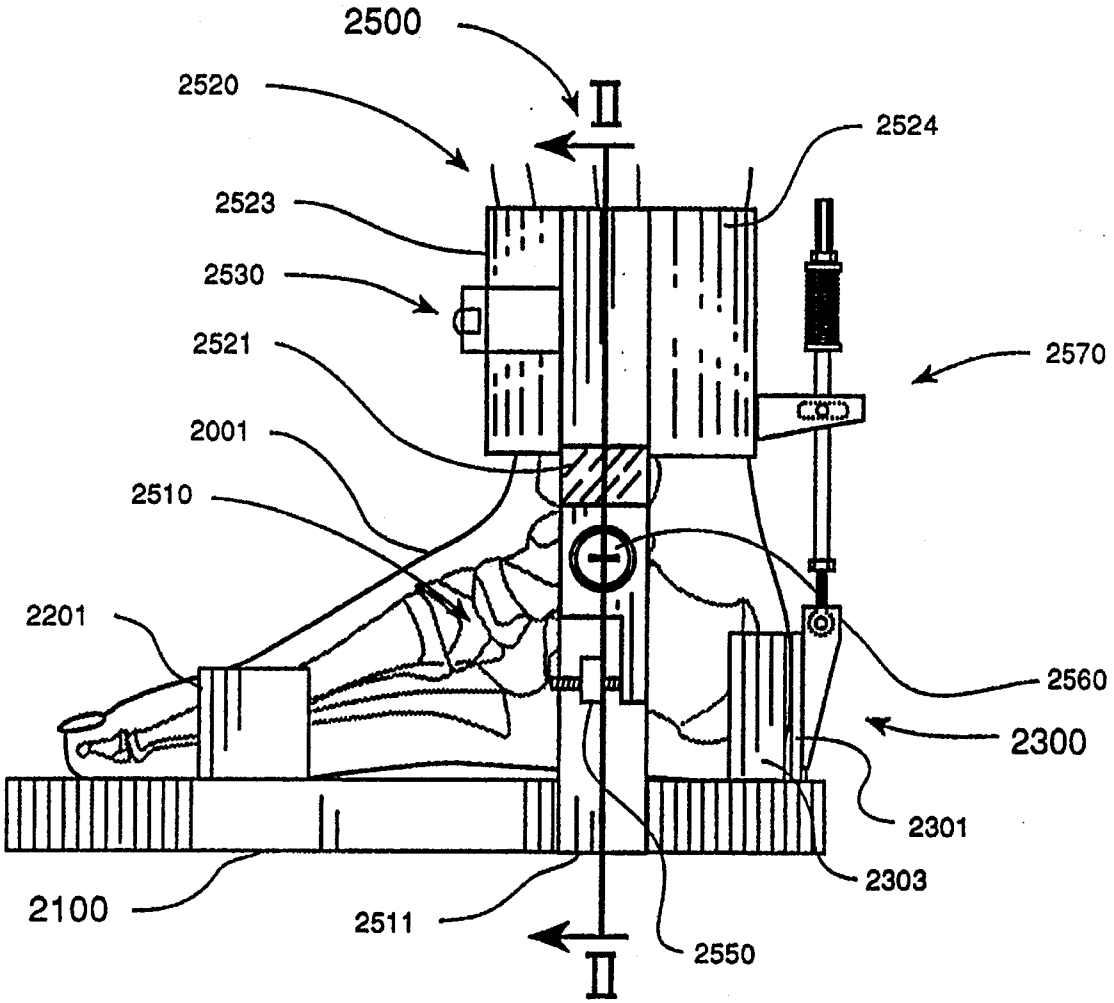
FIG. 47 is a medial elevation illustrating the elements which form a leg member of a footwear device according to the invention.
Figure 54A:
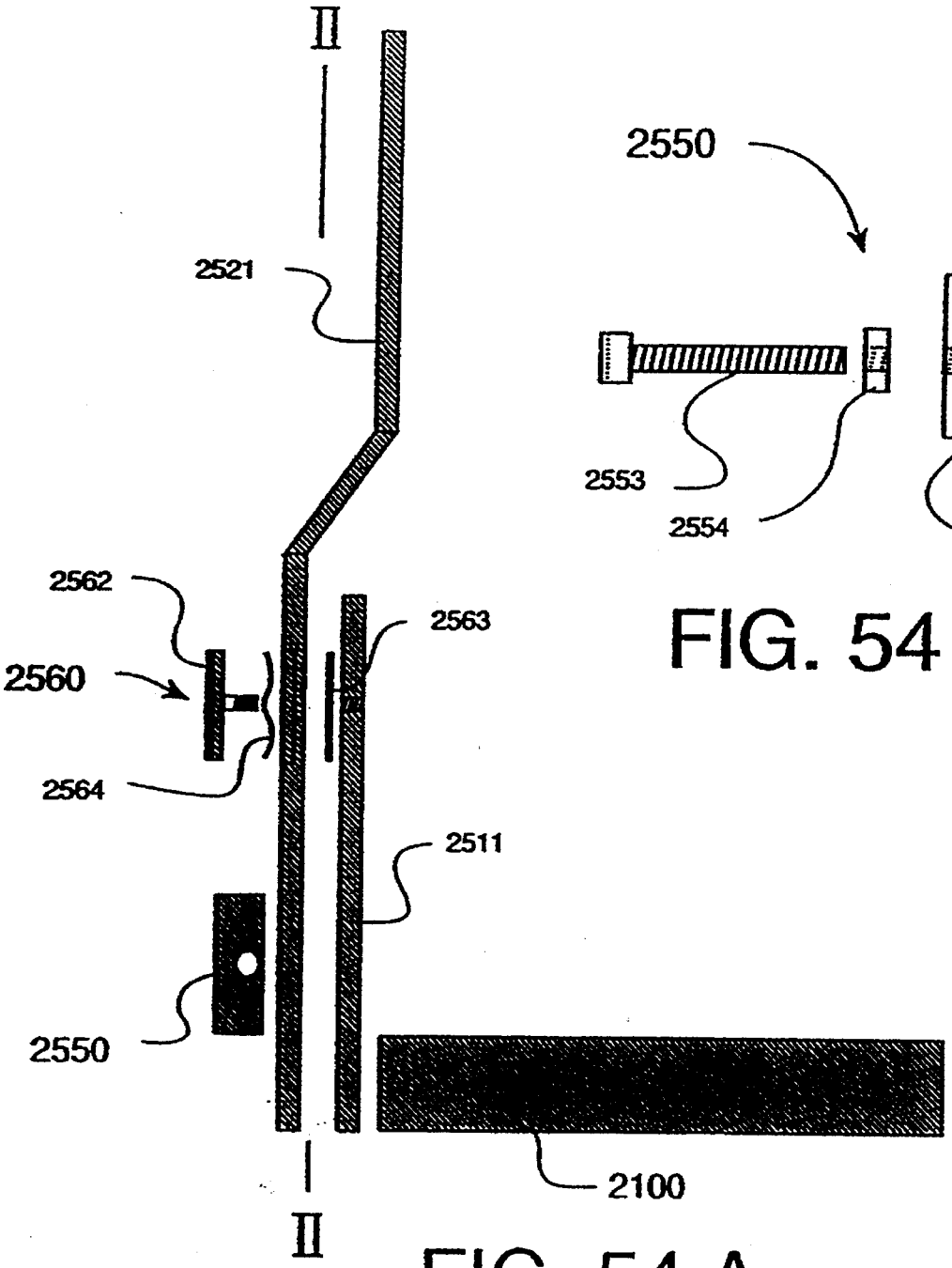
Figure 54B:
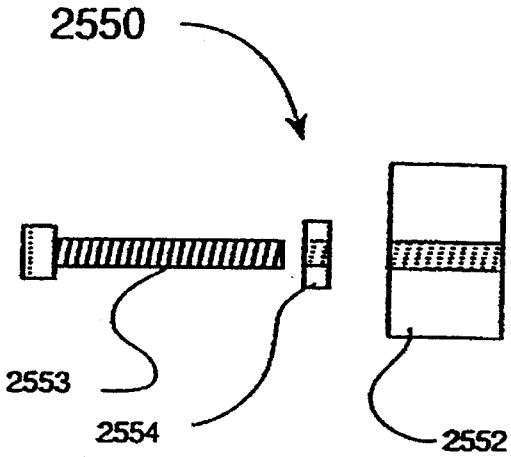
Figure 56:
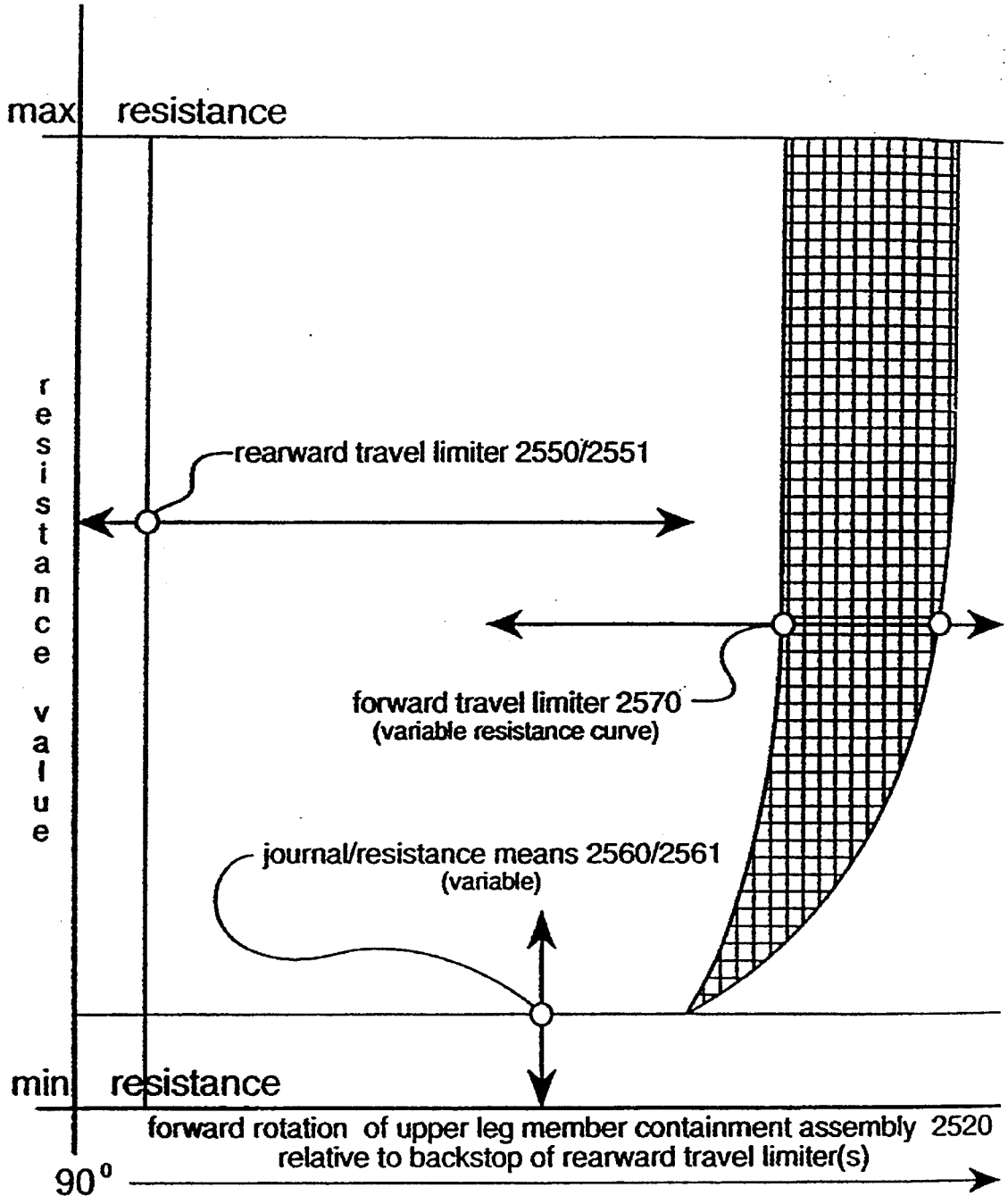
Figure 57C:
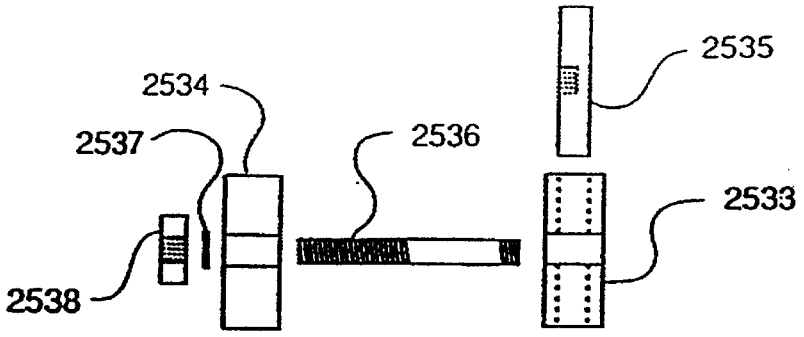
Figure 57B:
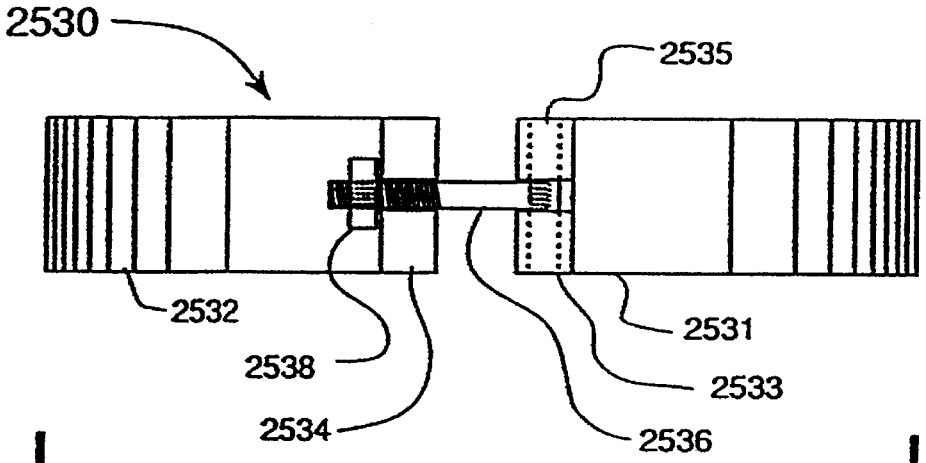
Figure 57A:
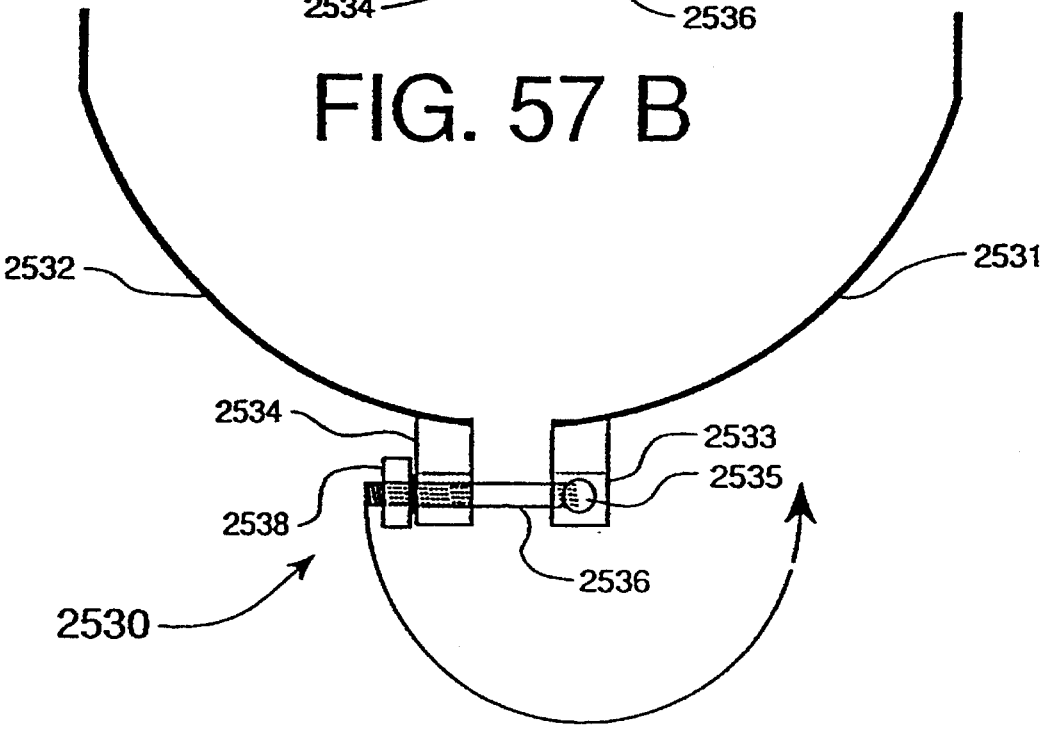
Figure 59:
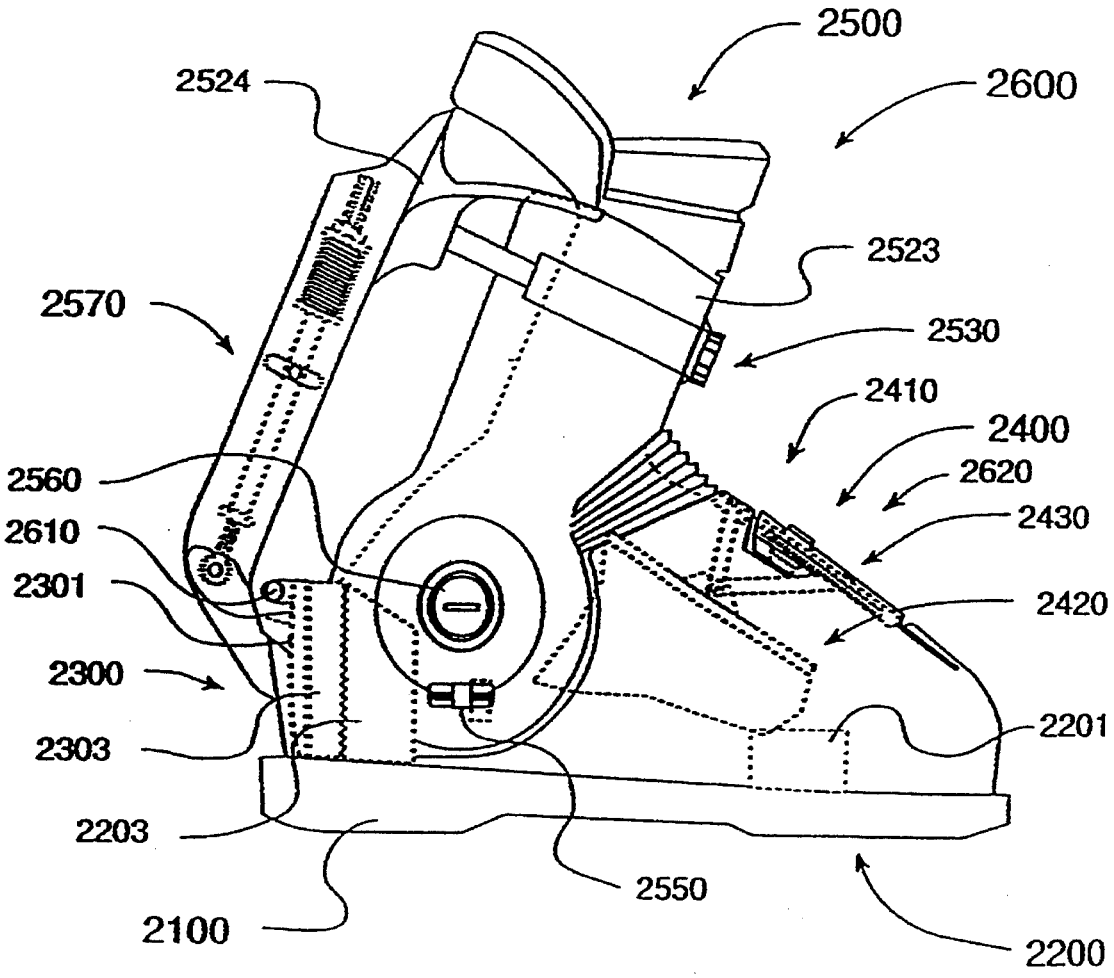
Figure 60B:
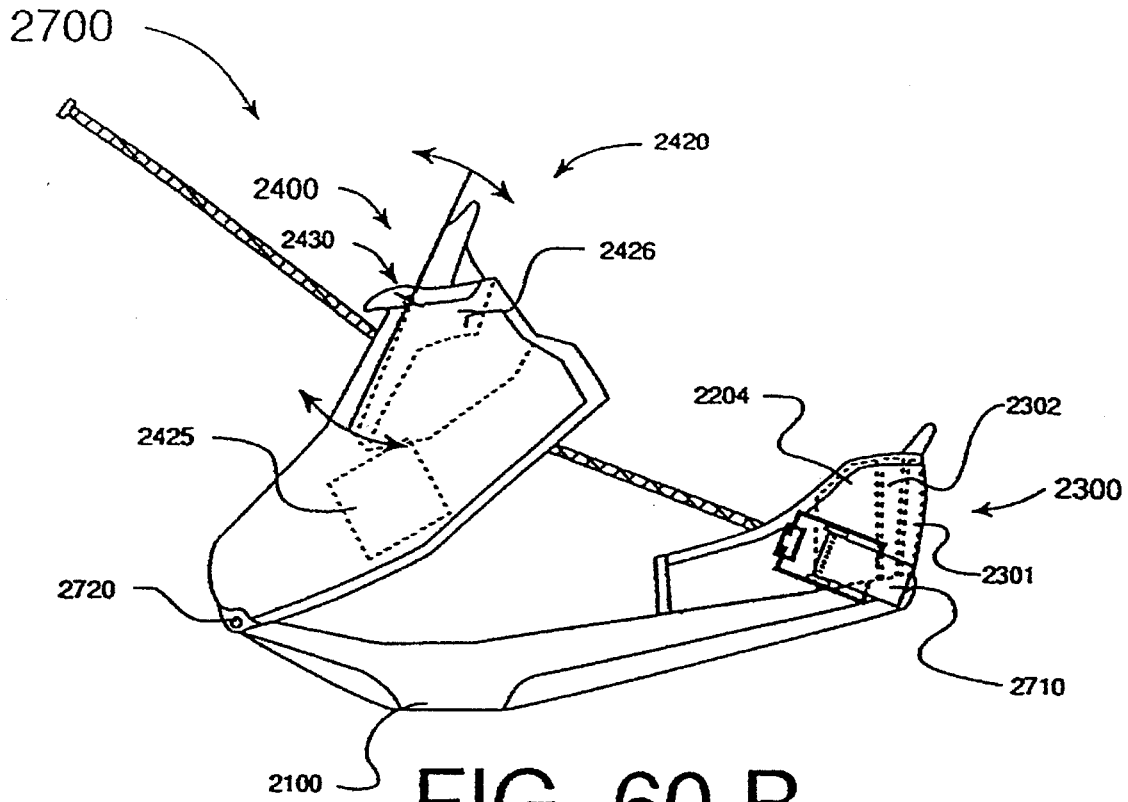
Figure 60A:
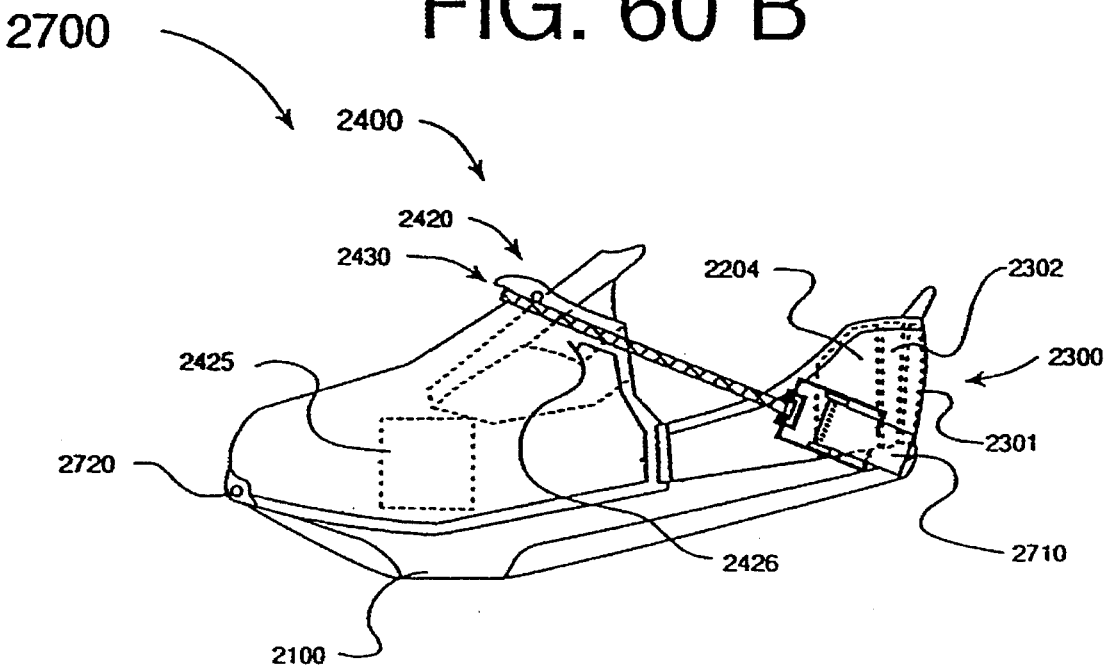
Figure 61B:
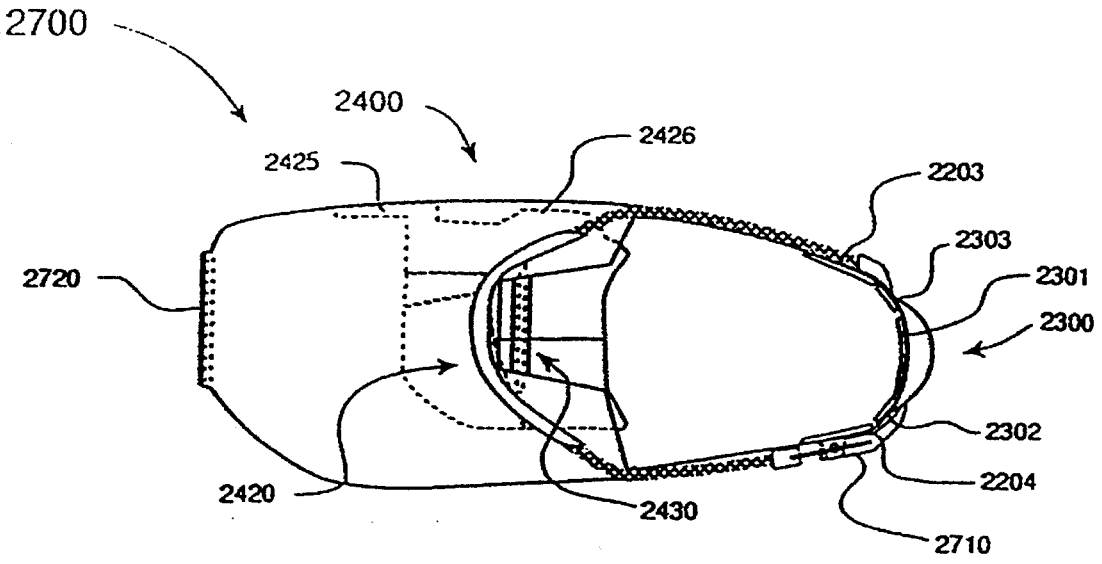
Figure 62B:
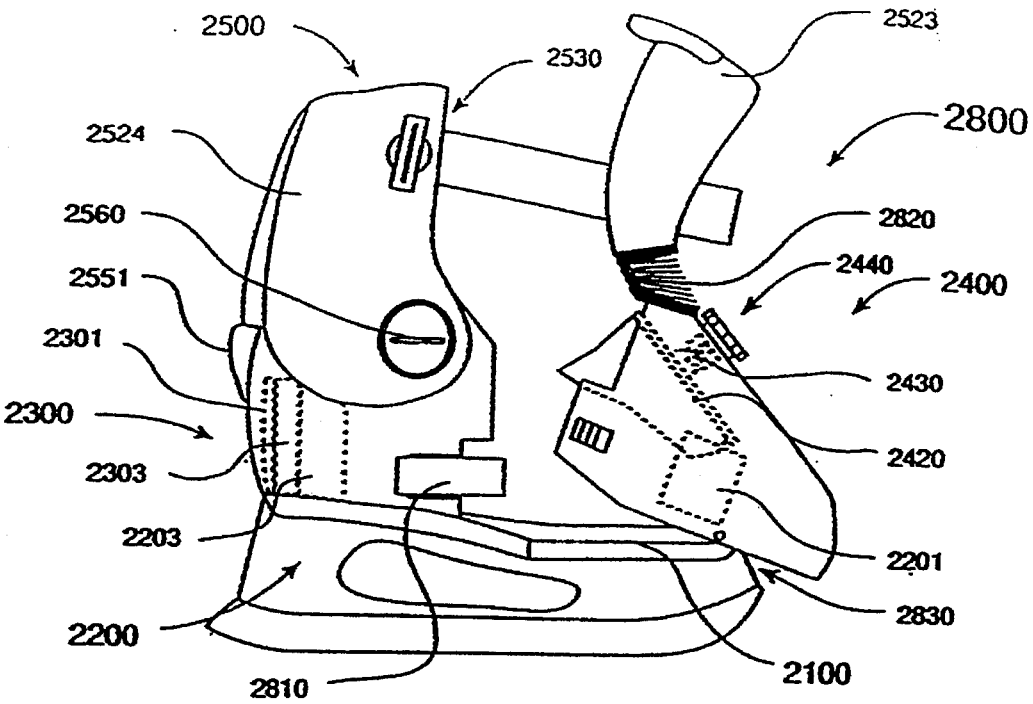
Figure 62A:
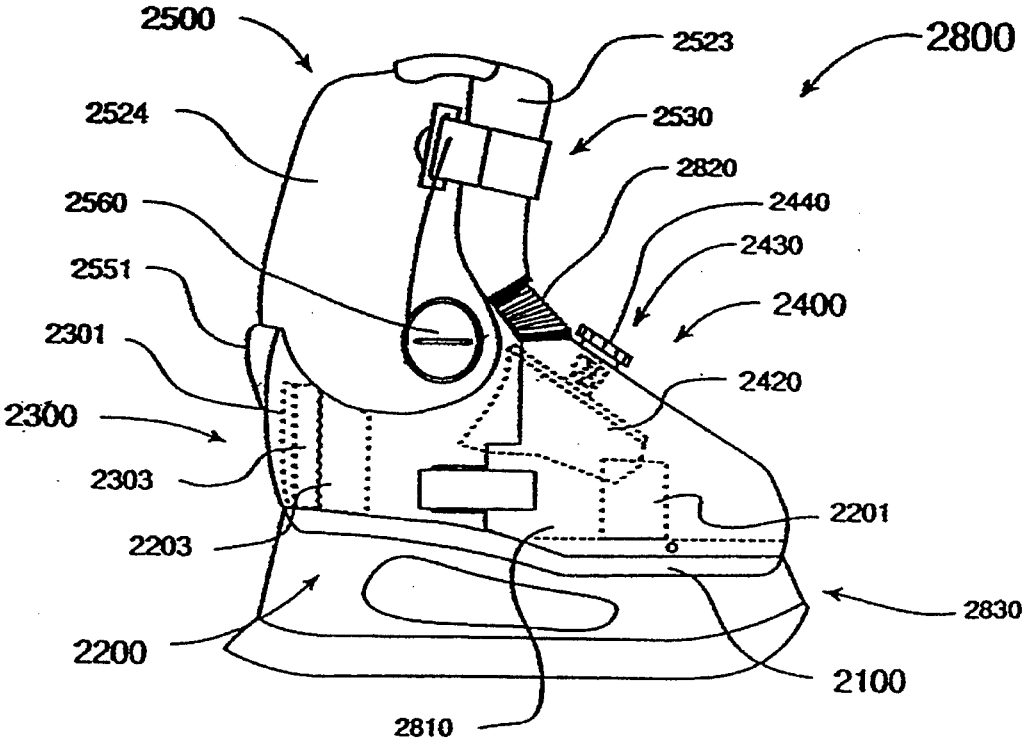
Figure 63:
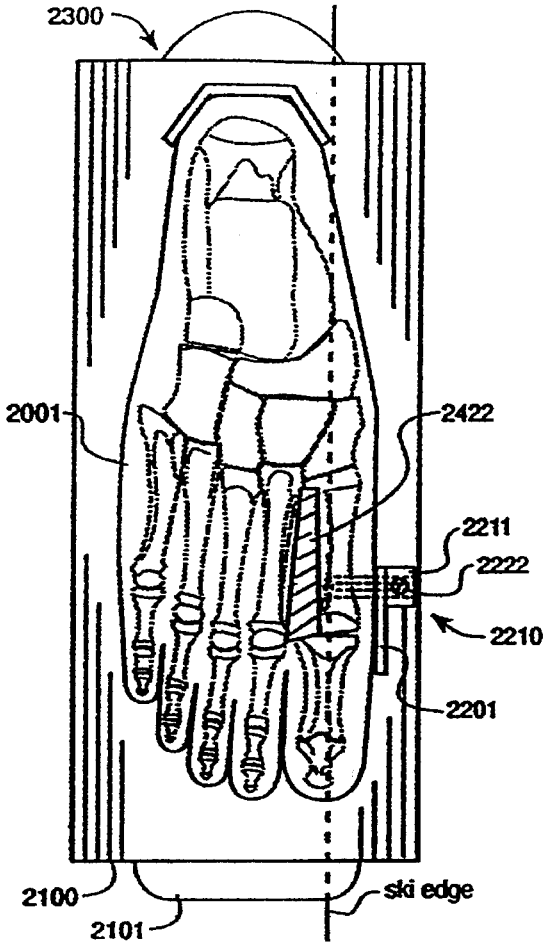
Figure 65:
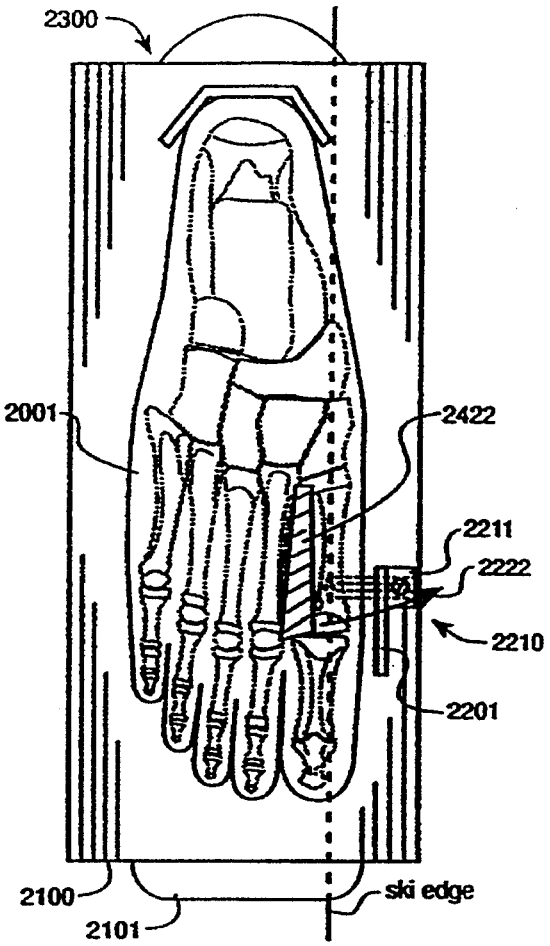
Figure 64:
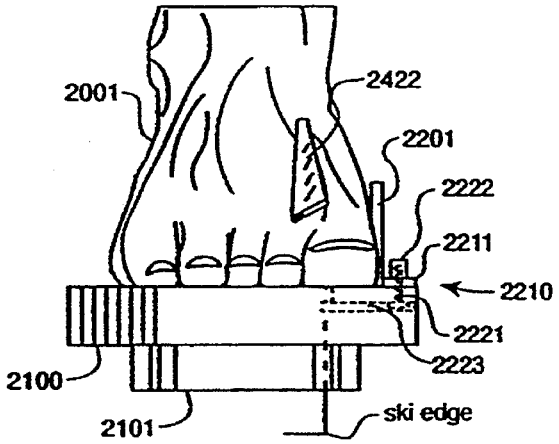
Figure 66:
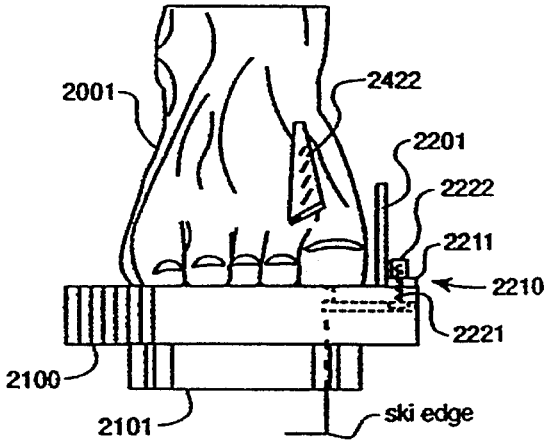
Figure 67:
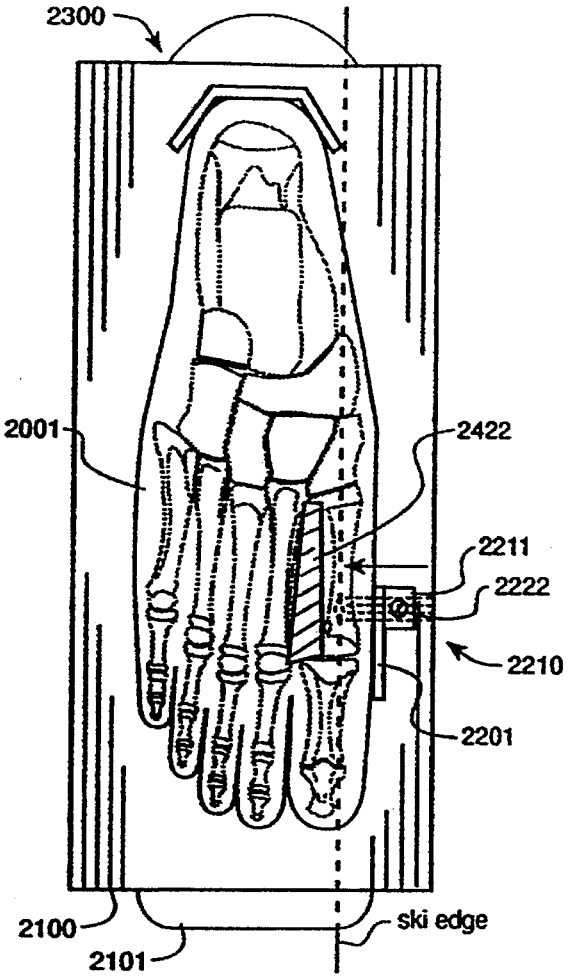
Figure 68:
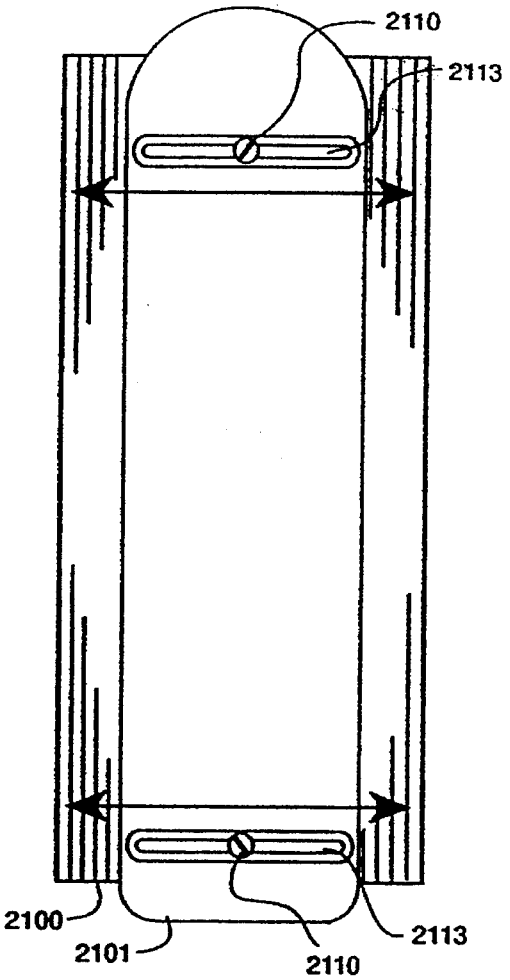
Figure 69:
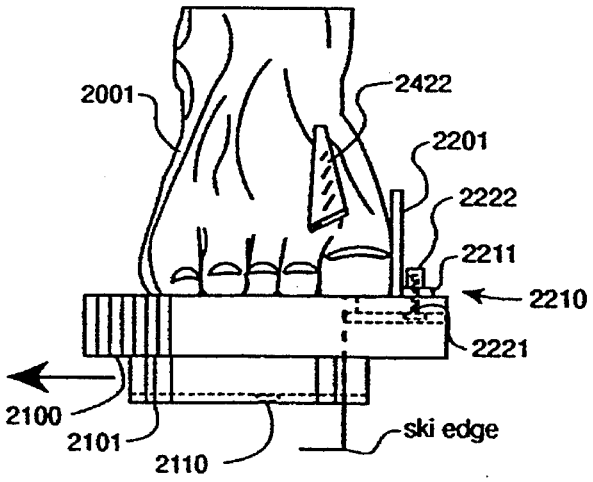
Figure 70:
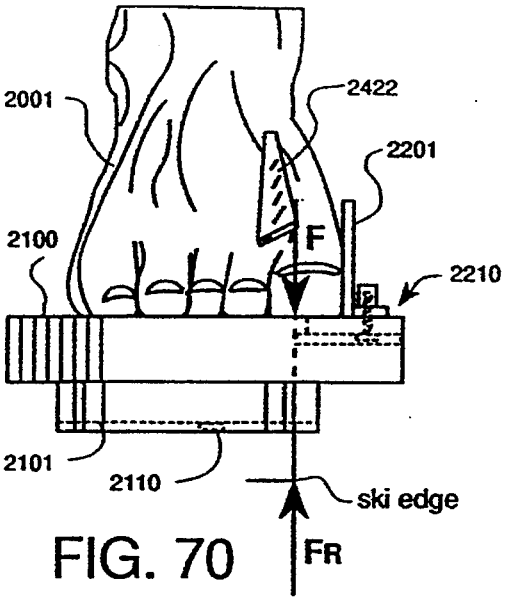
Figure 71:
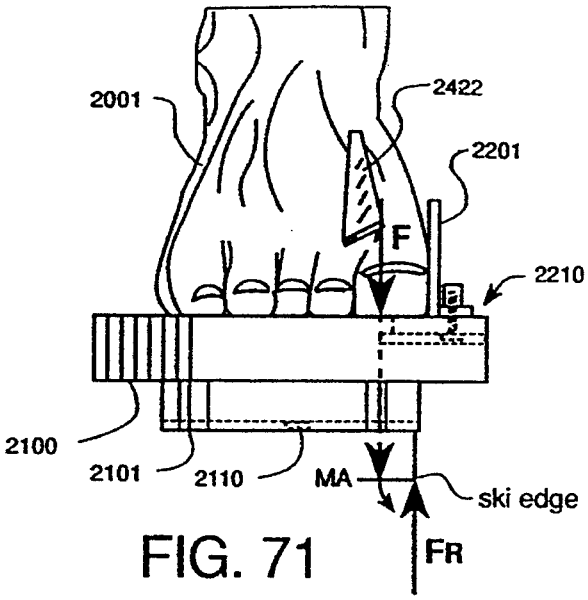
Figure 72:
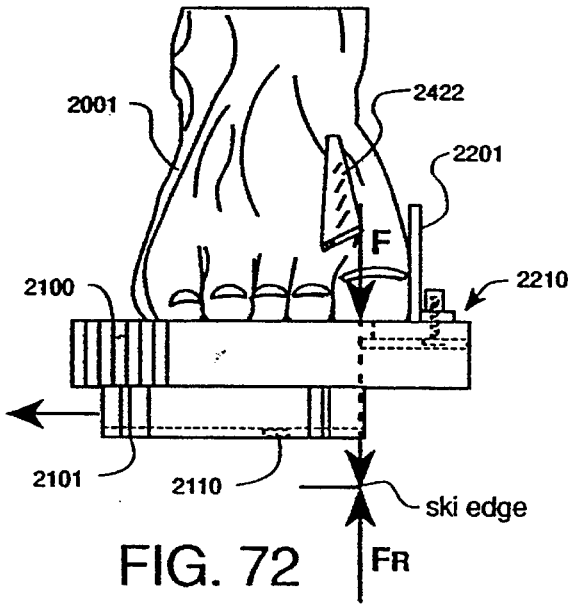
Figure 73:
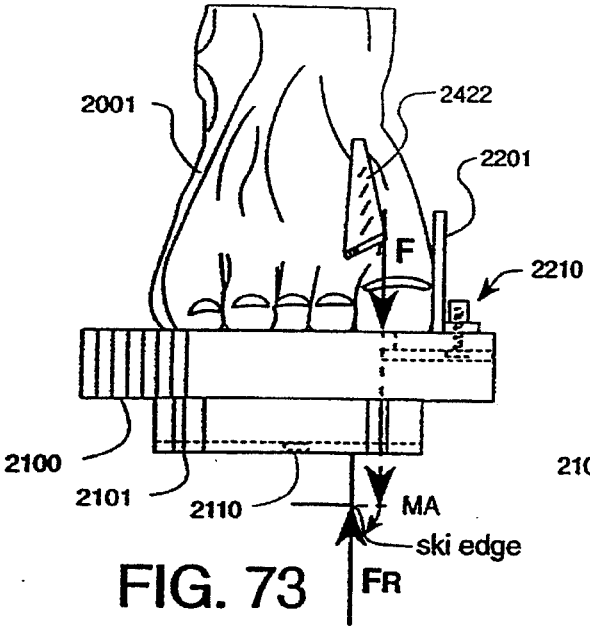
Figure 74:
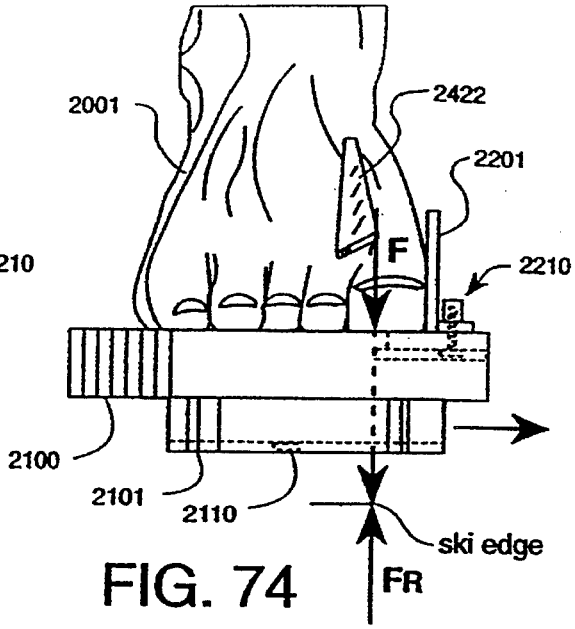
Figure 75:
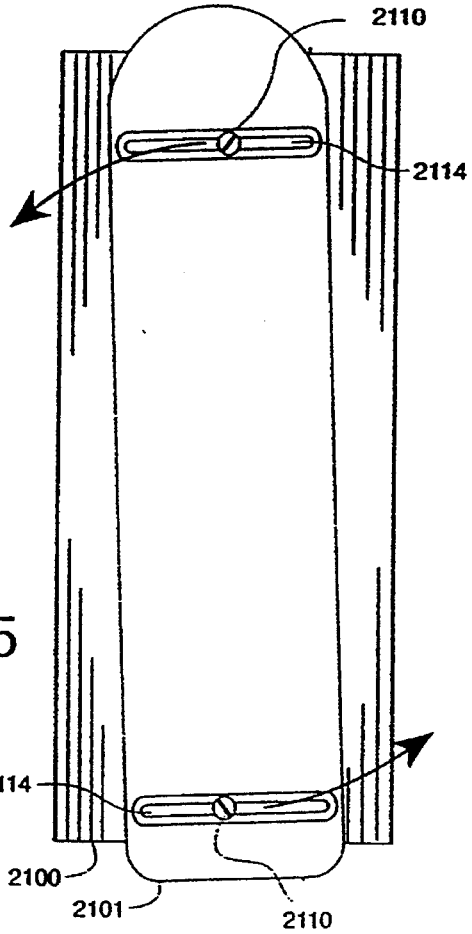
Figure 76:
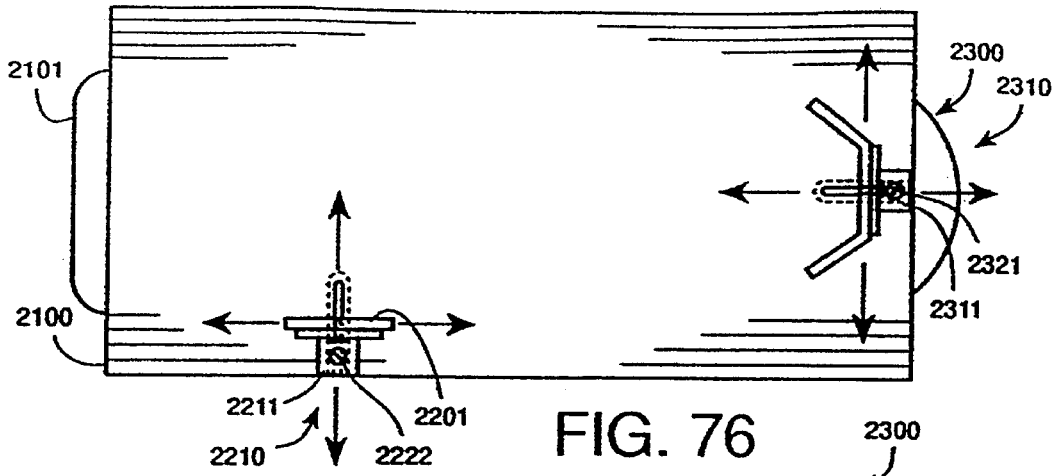
Figure 77:
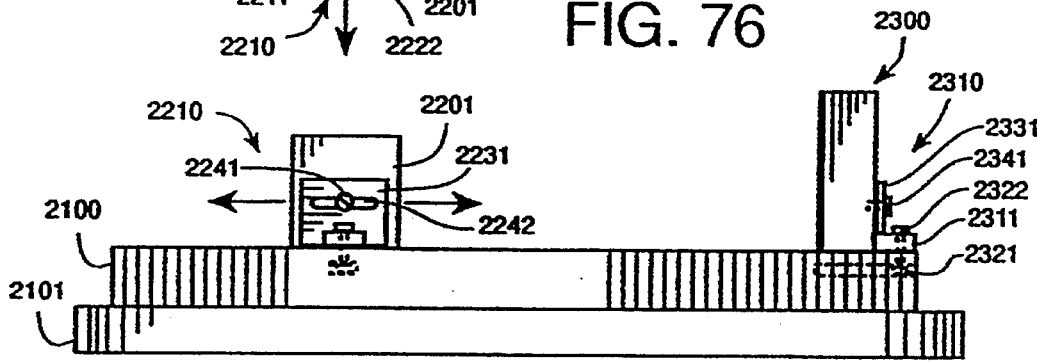
Figure 78:
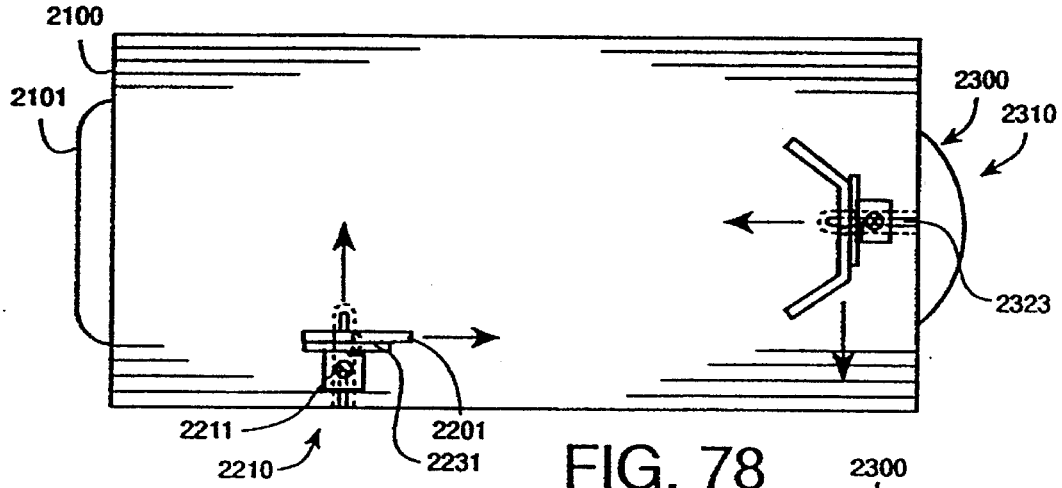
Figure 79:
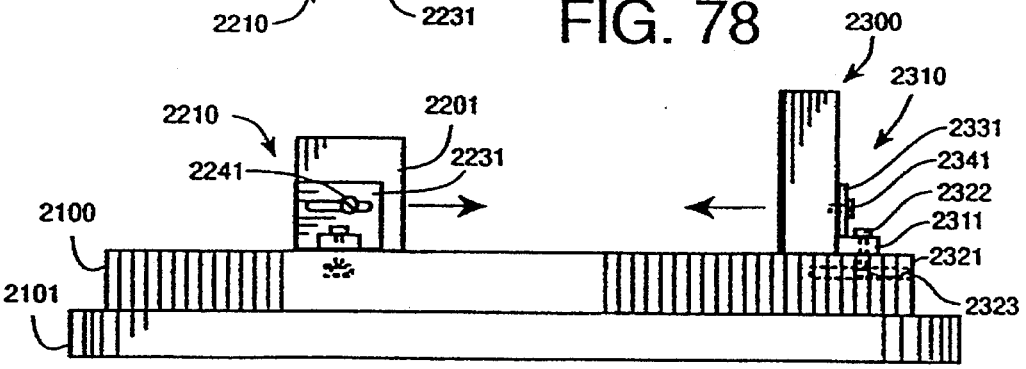
Figure 80:
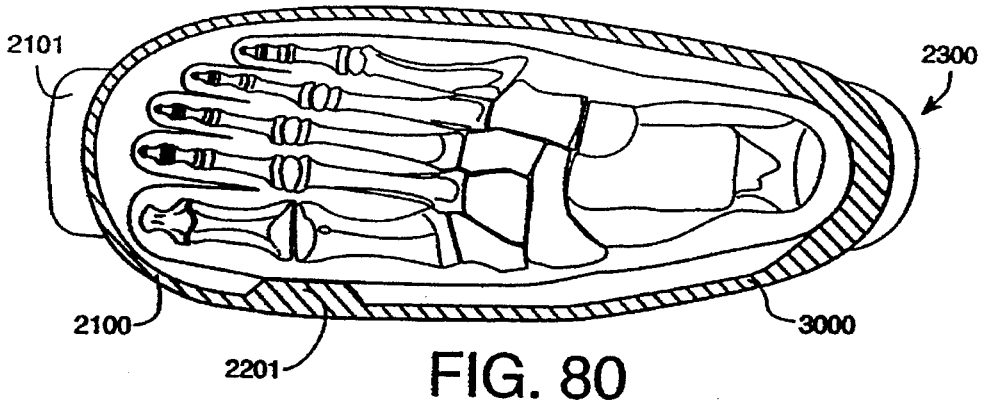
Figure 81:
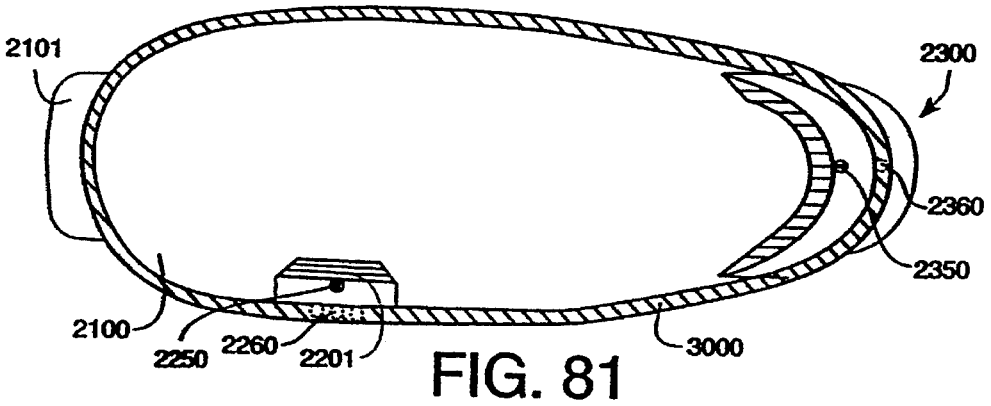
Figure 82:
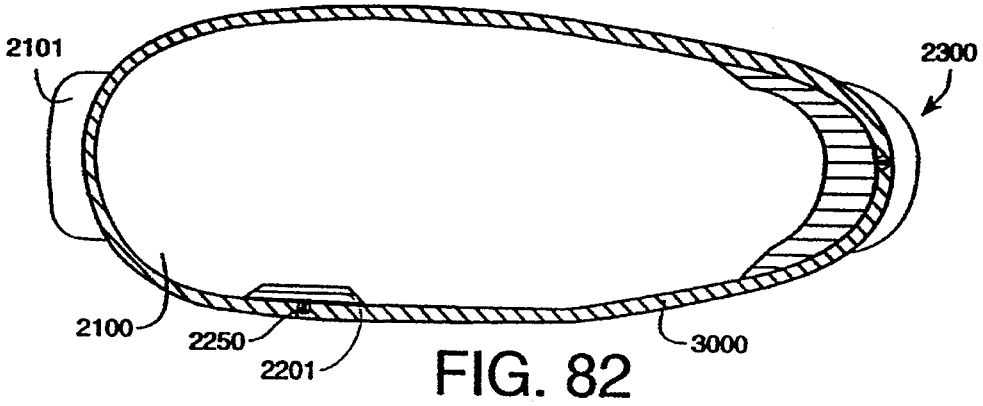
Figure 83:
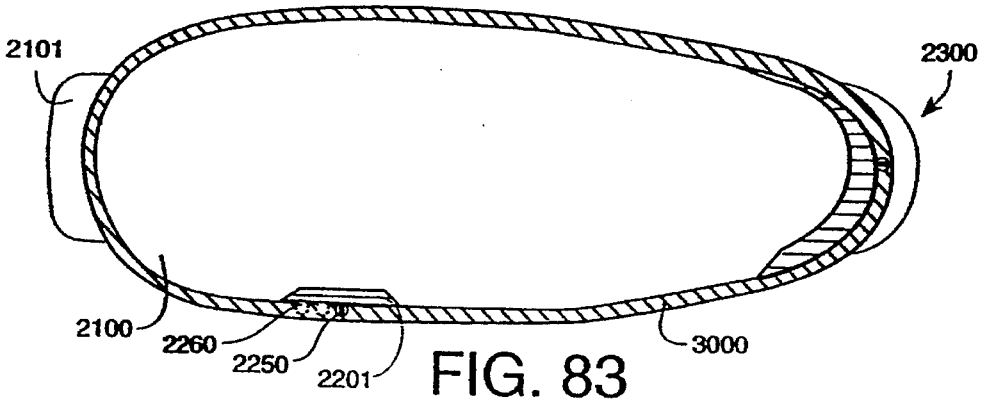
Figure 84:
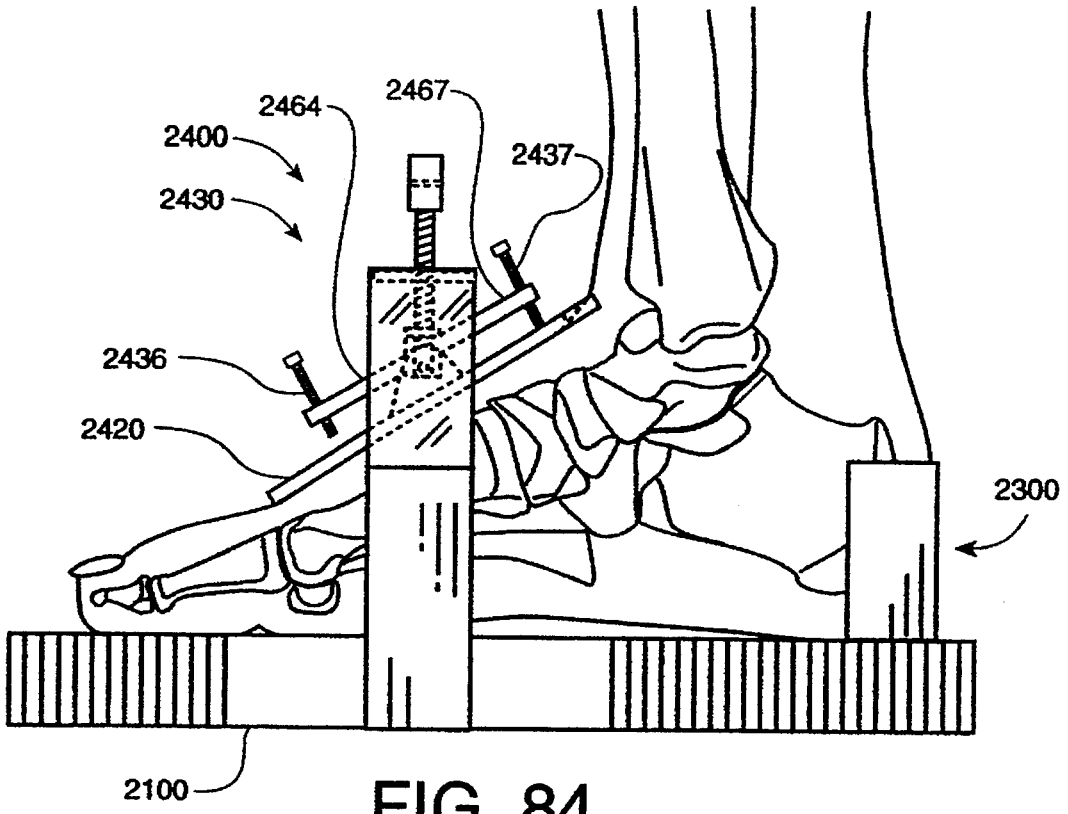
Figure 85:
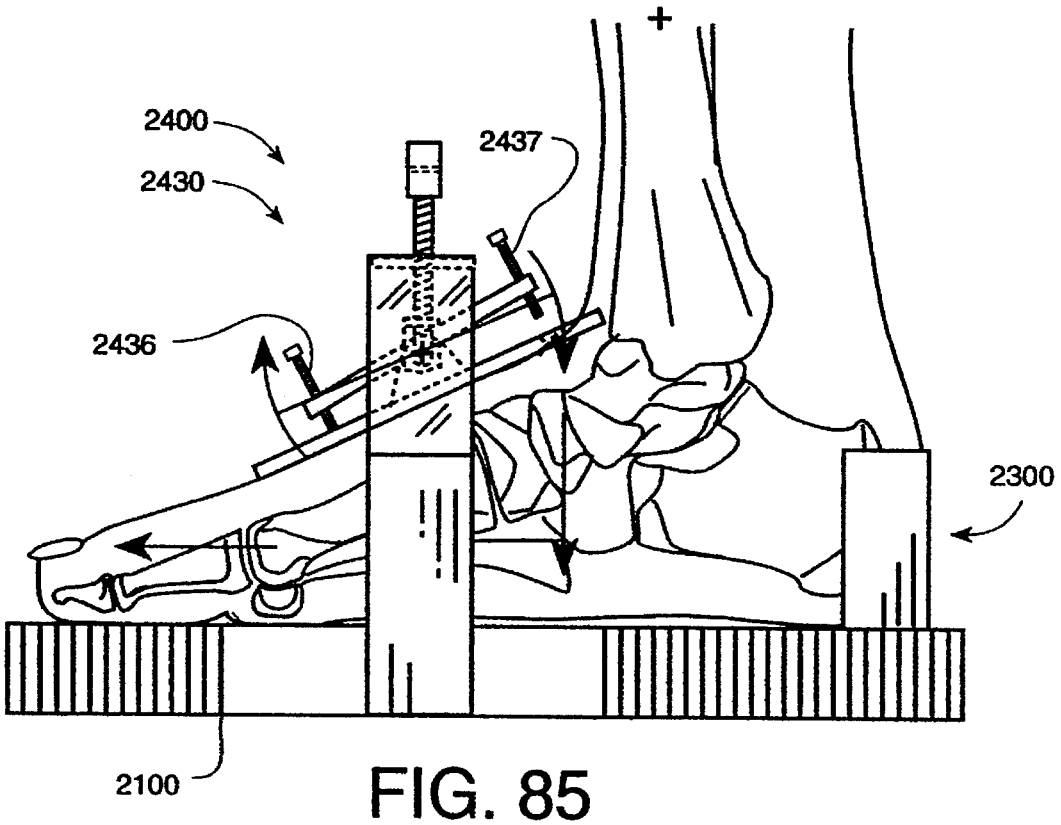
Figure 86:
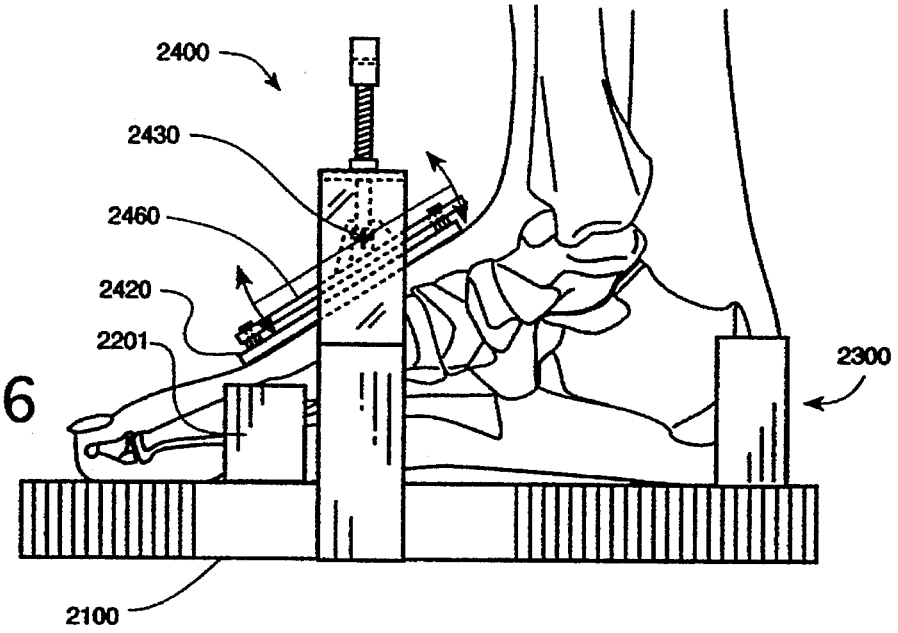
Figure 87:
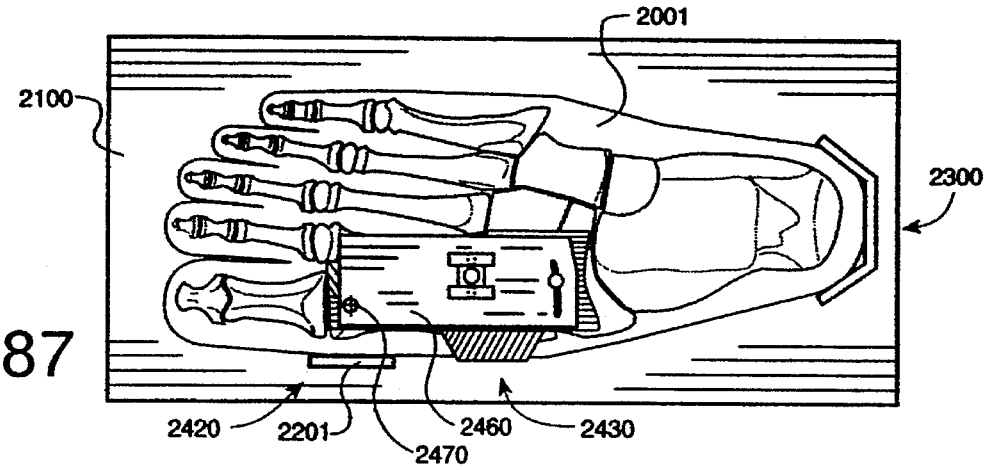
Figure 88:
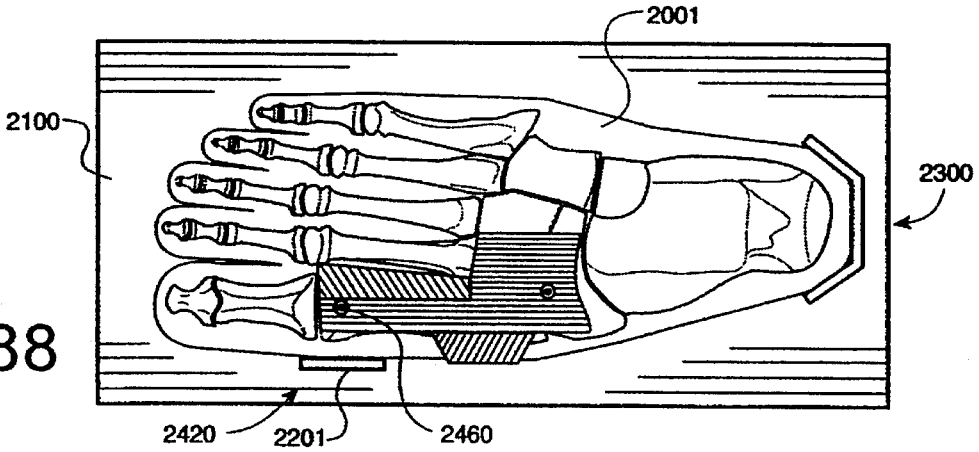
Figure 89:
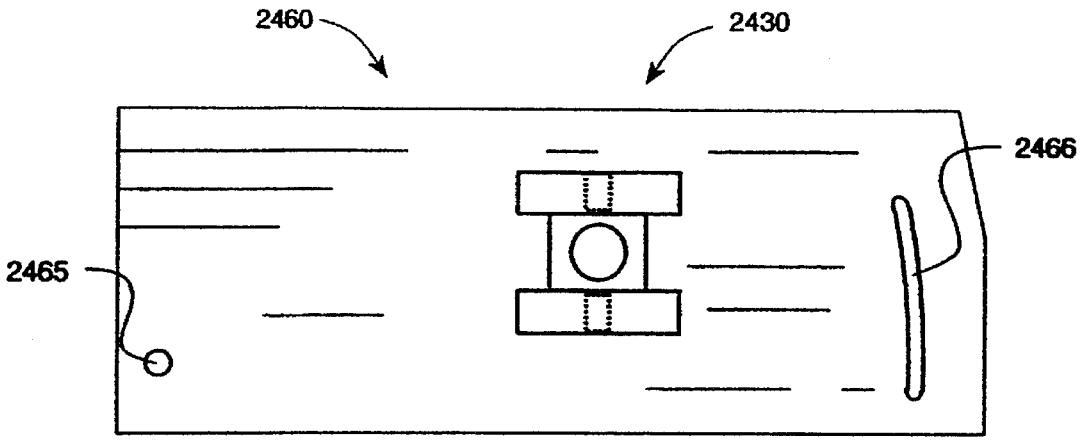
Figure 90:
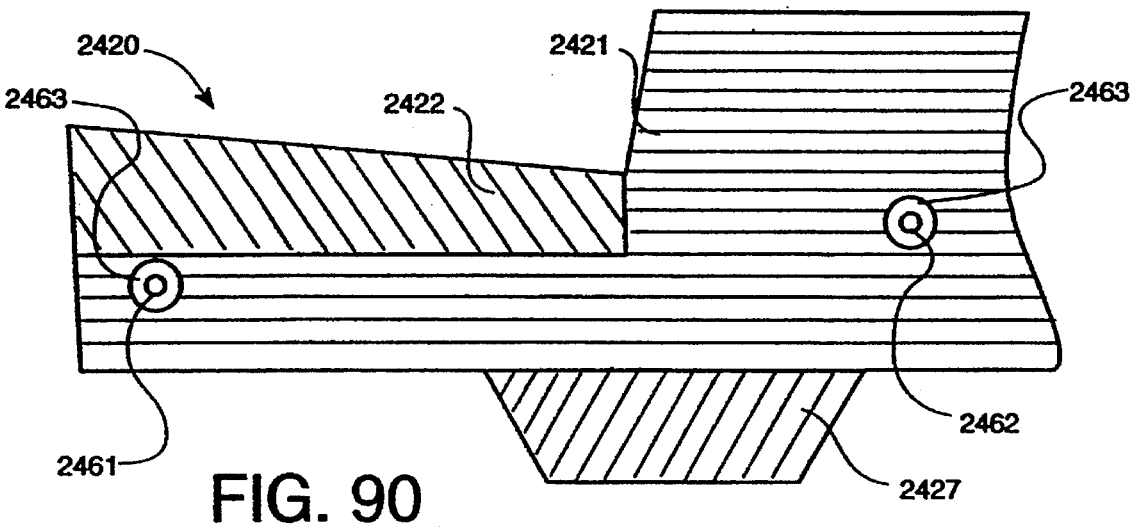
Figure 91:
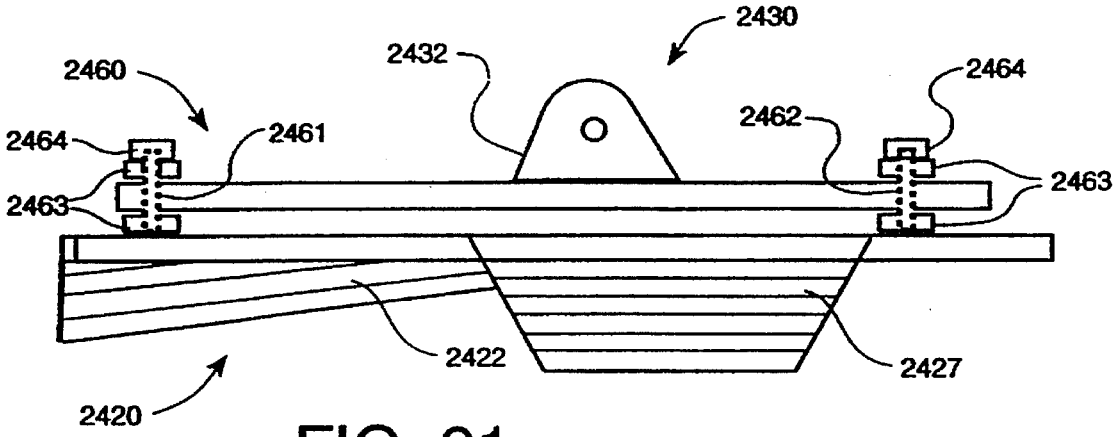
Figure 92:
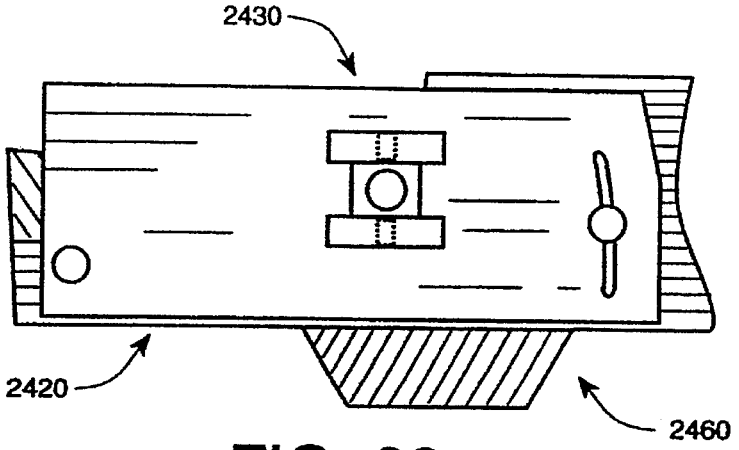
Figure 93:
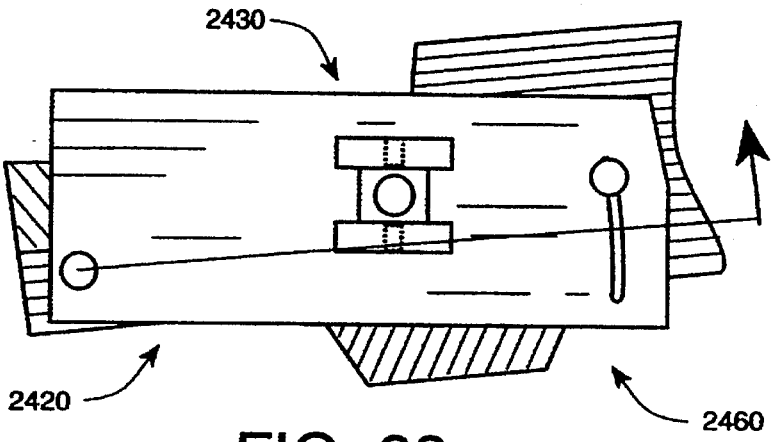
Figure 94:
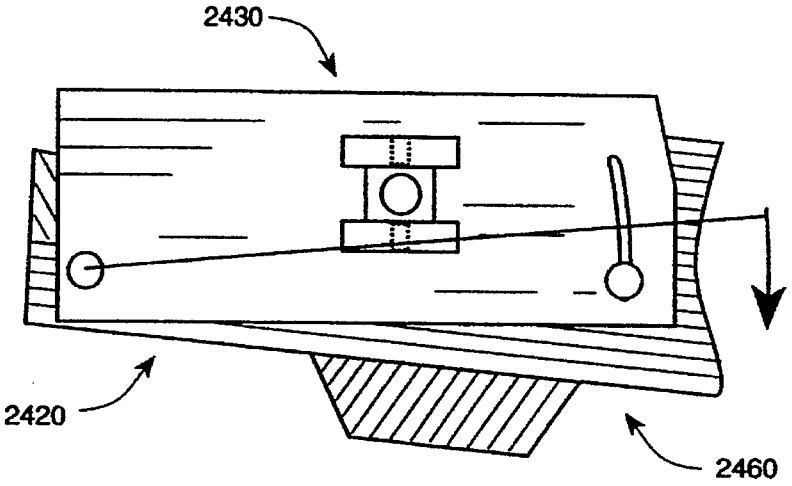

47;

FIG. 54A illustrates the elements of journal tension adjustment means taken along lines A—A in FIG. 47;

FIG. 54B illustrates the elements of rear travel limiters of the leg member of FIG. 47;

FIGS. 55 A to D illustrate the elements of a forward travel limiter of the leg member of FIG. 47;

FIG. 56 is a graphical illustration showing the interaction and influence on the movement of the upper containment assembly of the leg member;

FIGS. 57 A to C illustrate the elements of anterior/posterior containment coupling means of the leg member of FIG. 47;

FIGS. 58 A to C illustrate three views of the posterior aspect of the foot and leg;

FIG. 59 is a side view of a ski boot incorporating the elements of the footwear device of FIG. 20;

FIGS. 60 A and B are side views of a cycling shoe incorporating the elements of the footwear device of FIG. 20, shown in closed and open positions, respectively;

FIGS. 61 A and B are, respectively, side and plan views of the cycling shoe of FIG. 60;

FIGS. 62 A and B are side views of a hockey skate incorporating the elements of the footwear device of FIG. 20, shown in closed and open positions, respectively;

FIG. 63 is a superior plan view of the rigid base, sole and associated counters of the footwear device with the foot of a user positioned thereon in contact with the counters;

FIG. 64 is an anterior elevation of the rigid base, sole and medial and superolateral counters of the footwear device with the foot of a user positioned thereon in contact with the counters;

FIG. 65 is a superior plan view of the rigid base, sole and associated counters of the footwear device with the foot of a user positioned thereon but not in contact with the medial forefoot counter;

FIG. 66 is an anterior elevation of the rigid base, sole and medial and superolateral counters of the footwear device with the foot of a user positioned thereon but not in contact with the medial forefoot counter;

FIG. 67 is a superior plan view of the rigid base, sole and associated counters of the footwear device with the foot of a user positioned thereon in contact with the counters;

FIG. 68 is a inferior plan view of the rigid base and sole of the footwear device showing the facility to shift the transverse position of the sole in relation to the rigid base;

FIG. 69 is an anterior elevation of the rigid base, sole and medial and superolateral counters of the footwear device with the foot of a user positioned thereon and illustrating the facility to shift the transverse position of the sole in relation to the rigid base;

FIG. 70 is an anterior elevation of the rigid base, sole and medial and superolateral counters of the footwear device with the foot of a user in monopedal stance positioned thereon and illustrating the correct transverse position of the force applied to the ski by the foot in relation to the ground reaction force of an edged ski;

FIG. 71 is an anterior elevation of the rigid base, sole and medial and superolateral counters of the footwear device with the foot of a user in monopedal stance positioned thereon and illustrating the moment arm resulting from the force applied to the ski by the foot acting lateral to the ground reaction force of an edged ski;

FIG. 72 is an anterior elevation of the rigid base, sole and medial and superolateral counters of the footwear device with the foot of a user in monopedal stance positioned thereon as in FIG. 71 and illustrating how shifting the transverse position of the sole medially in relation to the rigid base has canceled the moment arm resulting from the force applied to the ski by the foot being positioned lateral to the ground reaction force of an edged ski as shown in FIG. 71;

FIG. 73 is an anterior elevation of the rigid base, sole and medial and superolateral counters of the footwear device with the foot of a user in monopedal stance positioned thereon and illustrating the moment arm resulting from the force applied to the ski by the foot acting medial to the ground reaction force of an edged ski;

FIG. 74 is an anterior elevation of the rigid base, sole and medial and superolateral counters of the footwear device with the foot of a user in monopedal stance positioned thereon as in FIG. 73 and illustrating how adjusting the transverse position of the sole laterally in relation to the rigid base has canceled the moment arm resulting from the foot being positioned medial to the ground reaction force of an edged ski as shown in FIG. 73;

FIG. 75 is an inferior plan view of the rigid base and sole and the footwear device showing the facility to rotate the position of the sole in relation to the rigid base;

FIG. 76 is a superior plan view of the rigid base and sole of the footwear device showing adjustable medial forefoot and heel counters;

FIG. 77 is a medial elevation of the rigid base and sole of the footwear device showing adjustable medial forefoot and heel counters;

FIG. 78 is a superior plan view of the rigid base and sole of the footwear device showing adjustable medial forefoot and heel counters and indicating the direction the counters have been shifted on the rigid base;

FIG. 79 is a medial elevation of the rigid base and sole of the footwear device showing adjustable medial forefoot and heel counters and indicating the direction the counters have been shifted on the rigid base;

FIG. 80 is a superior plan view of the rigid base and sole of the footwear device showing a cutaway portion of the lower outer shell of the footwear with medial forefoot and heel counters incorporated into the molding of the outer shell;

FIG. 81 is a superior plan view of the rigid base and sole of the footwear device showing a cutaway portion of the lower outer shell of the footwear onto which separate medial forefoot and heel counters are about to be attached;

FIG. 82 is a superior plan view of the rigid base and sole of the footwear device showing a cutaway portion of the lower outer shell of the footwear with separate medial forefoot and heel counters attached which are of a different specification that those shown in FIG. 81;

FIG. 83 is a superior plan view of the rigid base and sole of the footwear device showing a cutaway portion of the lower outer shell of the footwear with separate medial forefoot and heel counters attached which are of a different specification that those shown in FIG. 82;

FIG. 84 is a medial elevation of the rigid base, heel counter and the pivotable support showing the addition of a stop means to the instep counter pivot;

FIG. 85 is a medial elevation of the rigid base, heel counter and the pivotable support showing the operation of the stop means for the instep counter pivot;

FIG. 86 is a medial elevation of the rigid base, medial forefoot counter, heel counter and midfoot/forefoot pivotal support with the instep counter connected to an instep counter carriage;

FIG. 87 is a superior plan view of the rigid base, medial forefoot counter, heel counter, instep counter and instep counter carriage;

FIG. 88 is a superior plan view of the rigid base, medial forefoot counter, heel counter and instep counter;

FIG. 89 is a superior plan view of the instep counter carriage;

FIG. 90 is a superior plan view of the instep counter;

FIG. 91 is a medial elevation of the instep counter and instep counter carriage;

FIG. 92 is a superior plan view of the instep counter carriage and instep counter showing the instep counter centered on the instep counter carriage;

FIG. 93 is a superior plan view of the instep counter carriage and instep counter showing the instep counter rotated laterally on the instep counter carriage;

FIG. 94 is a superior plan view of the instep counter carriage and instep counter showing the instep counter rotated medially on the instep counter carriage; and FIGS. 95 to 102 are superior plan views of the rigid base showing different combinations of counters.

DESCRIPTION OF SPECIFIC EMBODIMENT

Figure 1:
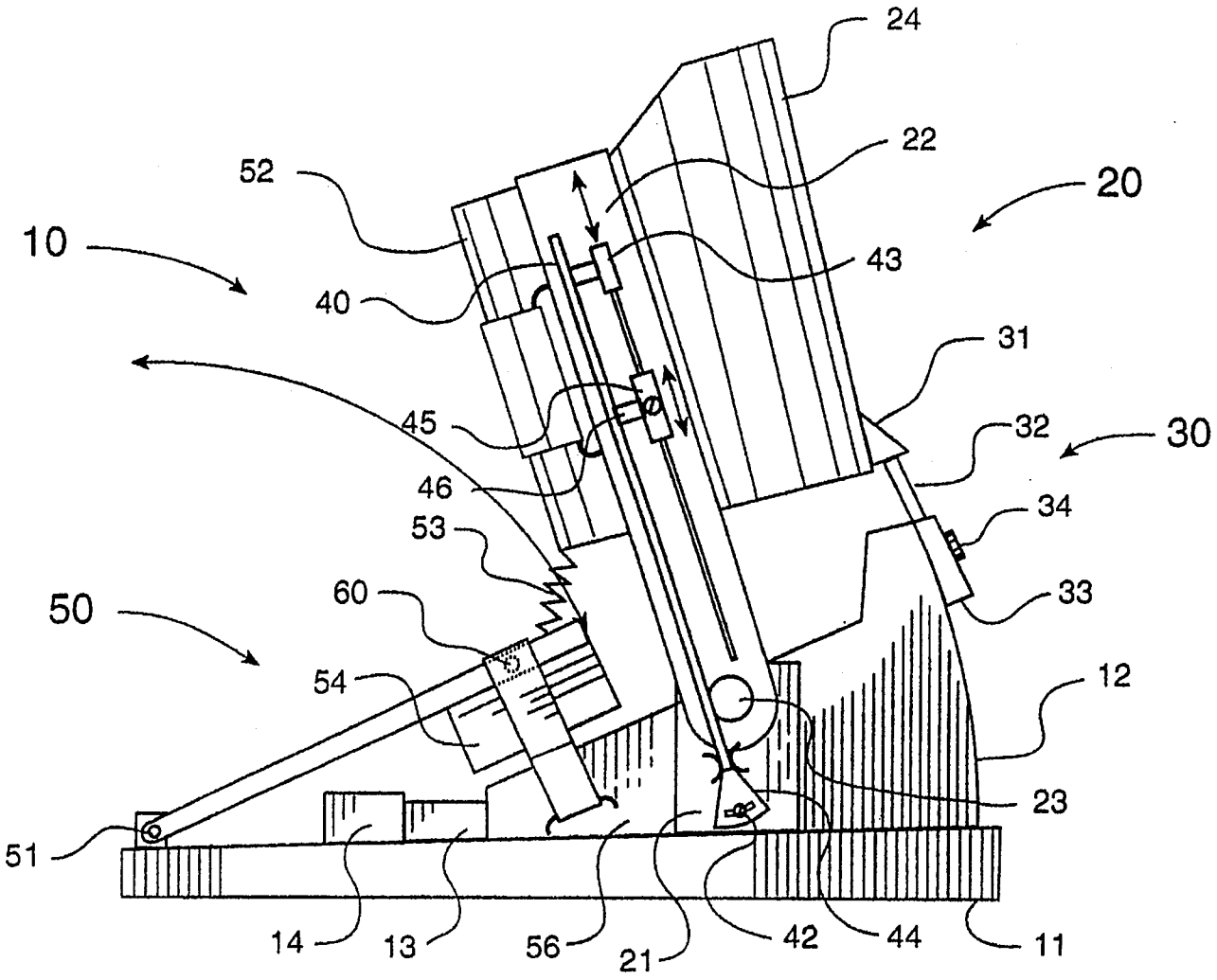
FIG. 1 is a diagrammatic side view of a footwear device in the form of a ski boot according to one embodiment of the invention and showing the boot in a closed position.

Referring to FIG. 1, reference numeral 10 generally indicates a ski boot which comprises a rigid base 11 made from a plastic or other suitable material but preferably composite material, such as CARBONITE, to which are connected a heel counter 12, outside and inside toe counters 13, 14. A brace is generally shown at 20 which comprises a base member 21 rigidly connected to the base 11 and an upper brace member 22 rotatably connected to the base member 21 about an axis 23. The upper brace member 22 is in the form of a segmented cylinder open at the forward portion. The rearward portion 24 of the brace member 22 is designed to comfortably support the rear portion of the lower leg.

A vertically adjustable backstop, generally illustrated at 30, is mounted to the heel counter 12 and extends vertically to a position rearward of the rearward portion 24 of the upper brace member 22. A projection 31 is mounted on the rearward portion 24 and is operable to contact the backstop 30 in a number of different locations to maintain the relationship between the upper brace member 22 and the rigid base 11 when force is exerted on the rearward portion 24.

The backstop 30 consists of two members 32, 33, which telescope and which are retained in their desired relative positions by a clamping mechanism 34.

Twin torsion bars 40 (only one of which is shown in FIG. 1) are each rigidly connected to the base member 21 by connecting screw 42 and extend vertically from the base member 21 in a configuration adapted to smoothly conform to the desired shape of the lower leg of the user. A projection 43 extends from each side of the upper brace member 22 and is operable to continuously contact the torsion bars 40 throughout the range of movement of the upper brace member 22.

The torsion bars 40 each have three adjustments. A first adjustment member 44 allows the angle of each torsion bar 40 to be changed relative to the base member 21 so that each torsion bar 40 maintains contact with the projection 43 throughout the range of movement of the upper brace member 22.

The second adjustment is provided by each projection 43 being movable in the directions indicated. Thus, if the projection 43 is moved downwardly, the force exerted by the torsion bars 40 is increased and if the projection 43 is moved upwardly, the force exerted by the torsion bars 40 on the upper brace member 22 is decreased.

A third adjustment is provided by a movable projection 45 whose contact pad 46 with torsion bars 40 may be adjusted so that contact with the torsion bars 40 is delayed. This adjustment is intended to augment the function of the projection 43. By adjusting the movable projection 45 to a position below projection 43 and then adjusting the contact pad 46 so that contact with the torsion bar is delayed, the rearward force exerted by the torsion bars 40 can be increased after a specific amount of movement.

It will be noted that each torsion bar 40 may be independently adjusted such that the force exerted between each torsion bar 40 and the upper brace member 22 on each side may be different. Likewise, it may be desirable for some users that one of the torsion bars 40 does not contact the projection 43 and this possibility is also provided by independent adjustment of the first adjustment member 44. In a further embodiment, one or both of the torsion bars 40 may be connected not to the base member 21 but, rather, to axis 23 where they may be pivotally mounted.

A yoke member generally illustrated at 50 is rotatably mounted about an axis 51 on either side of the rigid base 11 and pivots about the axis 51 in the directions indicated throughout a range of movement of approximately one hundred twenty degrees. Yoke member 50 has a forefoot/midfoot section 54 which is operable to comfortably provide substantially full contact with the forefoot/midfoot area of the foot. Provision is further made for the midfoot section 54 to be hinged about axis 60 to the yoke member 50 so that it may be angularly movable and adjustable relative to the yoke member 50.

A forward extension or side counter 56 is positioned on each side of the base brace member 21. The yoke member 50, side counters 56 and toe counters 13, 14 operably cooperate. When the yoke member 50 is in operating relationship with the foot, it also overlaps and contacts the side counters 56.

A shin member 52 is hinged to the yoke member 50. The shin member 52 is designed to provide comfortable and substantially full contact with the shin and to maintain its relative position relative to the shin throughout the permitted range of movement of the lower leg relative to the foot and to avoid relative movement between the shin member 52 and the shin such that any abrasion is avoided. The hinge connection is a flex link 53 to which each of the yoke member 50 and the shin member 52 are connected. The shin member 52 is designed to operably interact with the brace member 22 when the boot is closed and to cleanly transfer force between the brace member 22 and the shin member 52.

Figure 2:
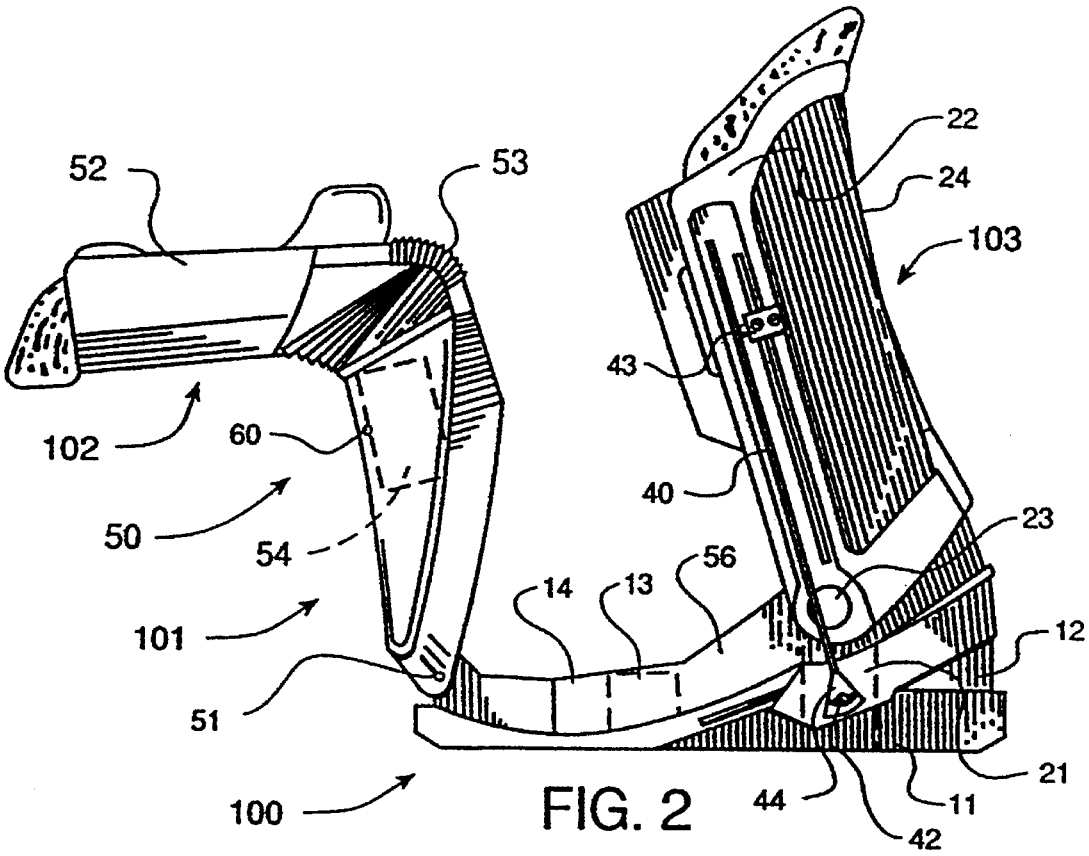
FIG. 2 is a side view of the ski boot similar to that of FIG. 1 illustrating some of the interior components of the boot and showing the boot in an open position.

The ski boot 10 has closure elements which are best illustrated in FIG. 2 and comprise a shell lower assembly, generally illustrated at 100, which comprises upper and lower components. The lower component of the assembly 100 includes the rigid base 11, the heel counter 12, the outside toe counter 13, a forward extension of the side counter 56, the base member of the brace 21, the axis for the brace 23, the connecting screw for the torsion bar 42, the adjustment for the torsion bar 44 and the axis 51 for the upper component of the shell lower assembly generally indicated at 101.

The upper component 101 of the shell lower assembly 100 comprises the yoke member 50 with its associated axis 51, the forefoot/midfoot section 54 and the axis 60 for the forefoot/midfoot member.

The upper component 101 is hinged via a flex link 53 to the shell front cuff component generally shown at 102. The shell front cuff component includes the shin member 52.

Figure 3:
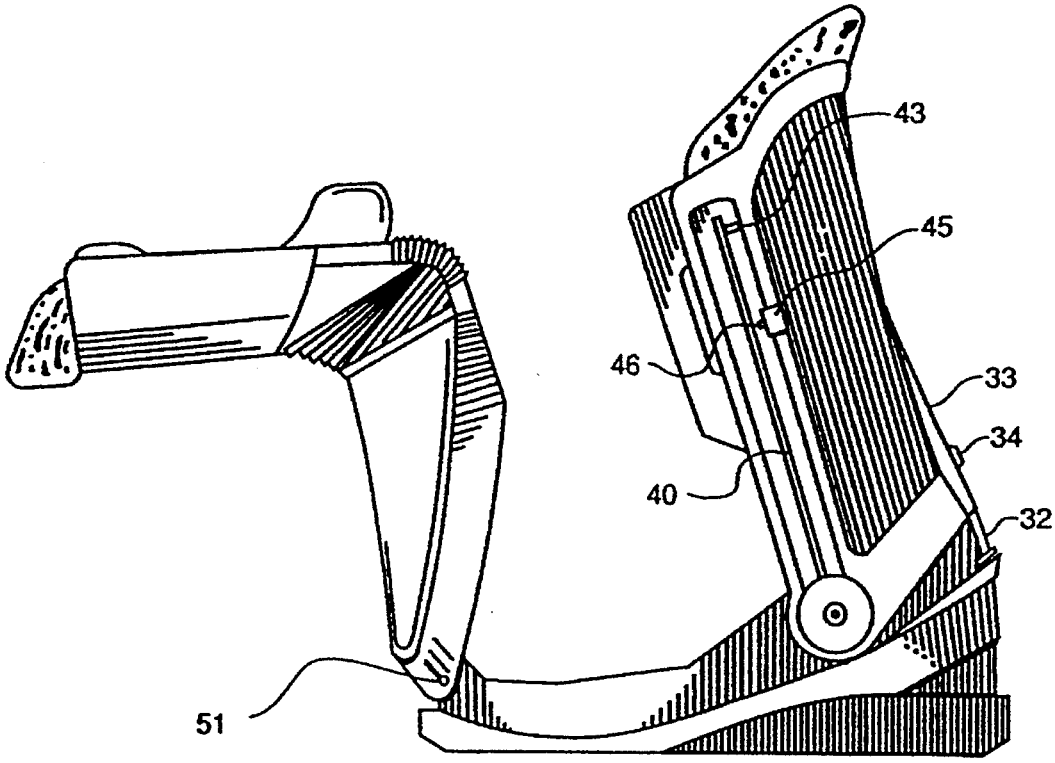
FIG. 3 is a side view of the ski boot of FIG. 2 but without interior components being illustrated.

The shell cuff rear component is generally shown at 103 and comprises the upper brace member 22, the rearward portion of the upper brace member 24, the axis of the brace mender 23, the telescoping members of the backstop 32, 33, the backstop clamping mechanism 34 (FIG. 3), the projection for the torsion bars 43, the movable adjustment member 45 and the contact pad 46.

Figure 5:
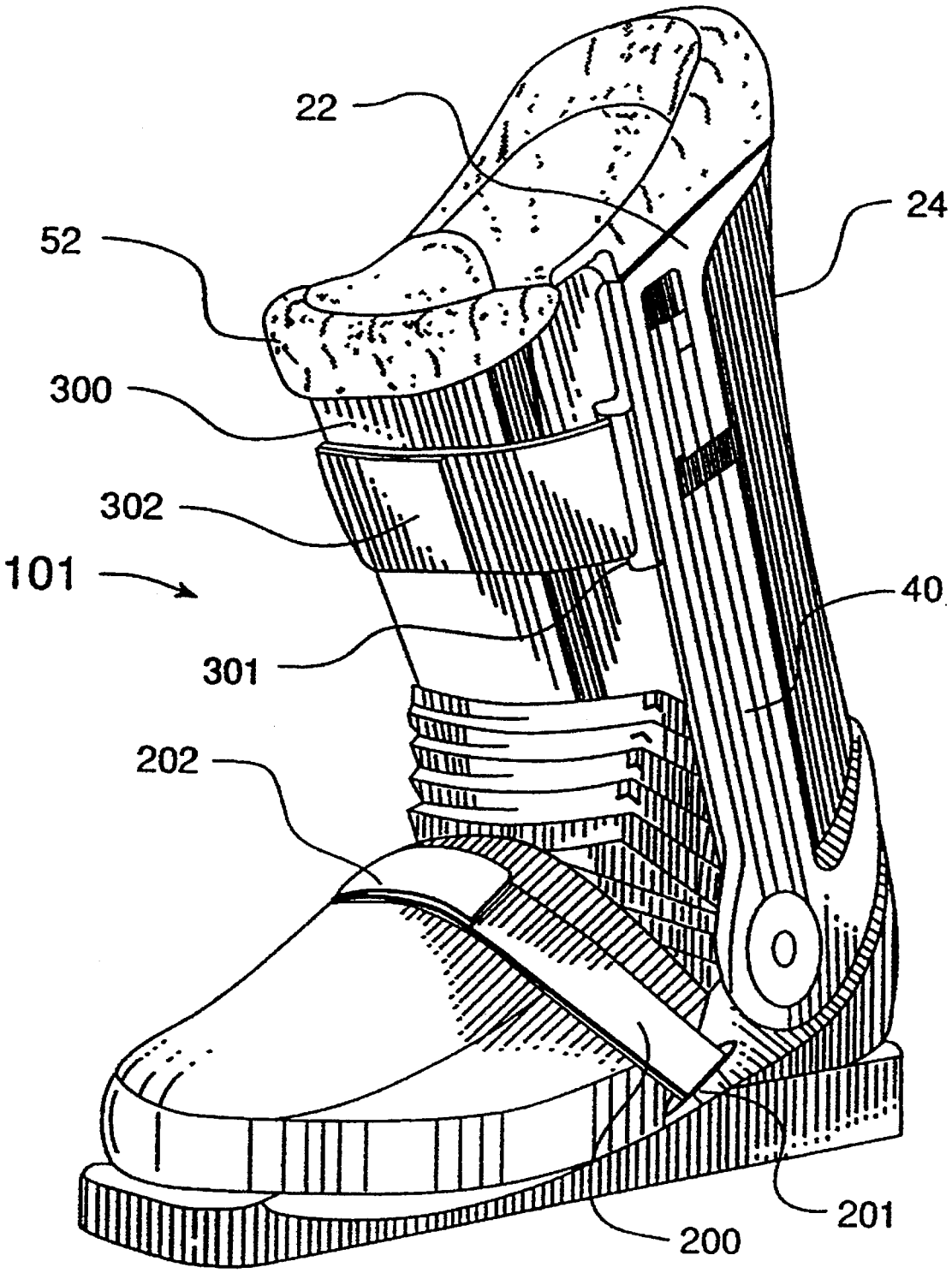
FIG. 5 is an isometric view of the ski boot of FIG. 2, also in a closed position.

The closure system for the shell, the shell lower assembly 100 and the shell lower assembly upper component 101 is shown in FIG. 5. The closure system comprises a woven nylon strap 200 affixed to the side counter on the inside of the ski boot. A hoop 201 is affixed to the side counter 56 on the outside of the boot. The nylon strap 200 is provided with VELCRO™ fastener surfaces 202 which penn, it the strap to be secured.

The closure system for the shin member 52 and the upper brace mender 22 which includes the rearward portion 24 consists of a woven nylon strap 300 affixed to the front portion of the upper brace member 22 on the inside of the boot, a hoop 301 affixed to the front portion of the cuff on the outside of the boot. The nylon strap 300 is provided with VELCRO™ fastener surfaces 302 which permit the strap to be secured.

OPERATION

In operation, it will be assumed that the boot 10 is in the closed position and that the skier or user wishes to insert his foot and lower leg into the boot 10.

The user will initially disengage the two closing devices located on the shin and forefoot/midfoot section of the outer boot. This will allow the yoke member 50 and the shin member 52 together with flex link 53 to be rotated about axis 51 and, thereby, to allow the entrance of the foot of the user.

Figure 4:
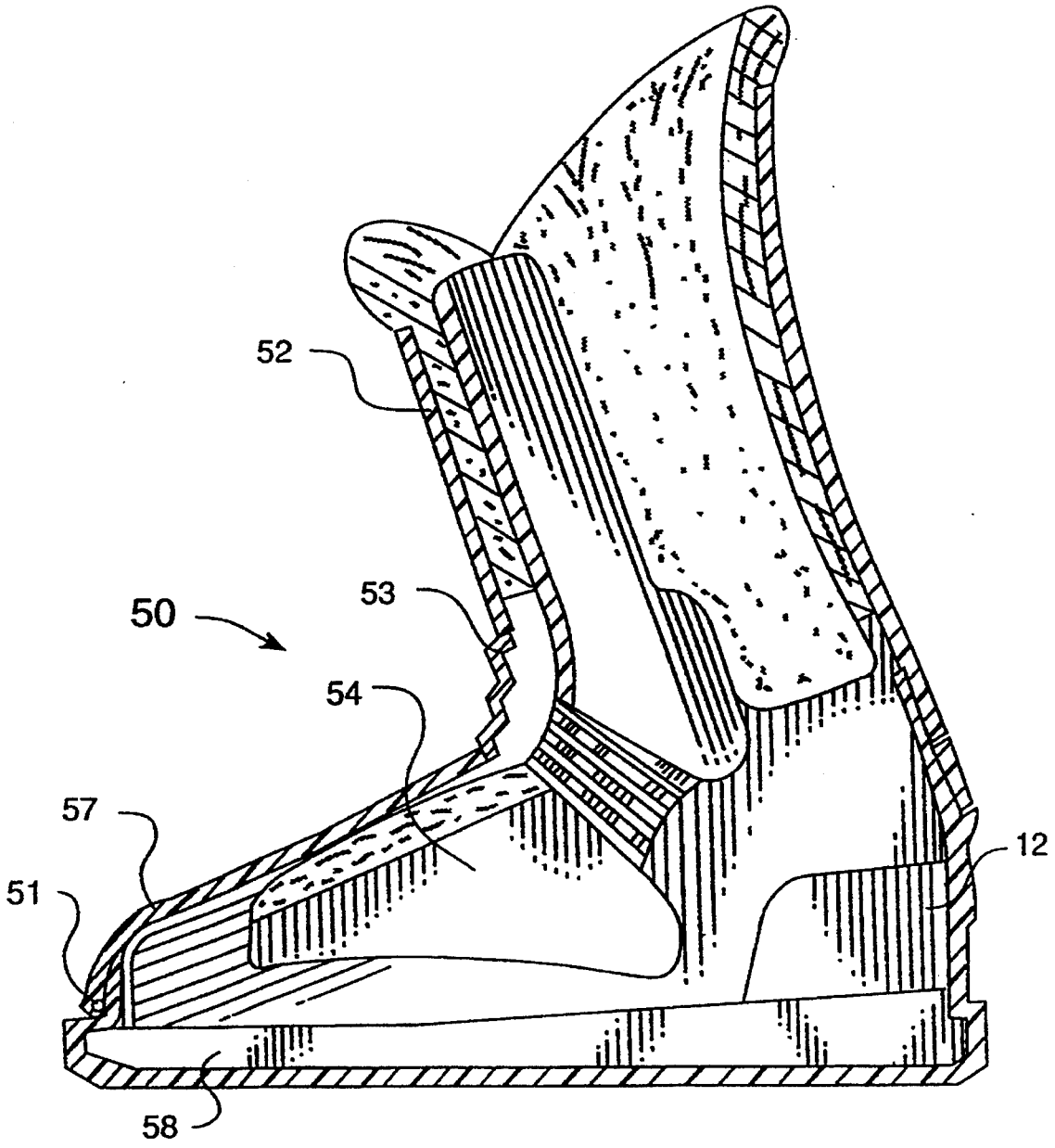
FIG. 4 is a partially cutaway side view of the ski boot of FIG. 2 and showing the boot in a closed position.

The user will insert his toes first into the toe box 57 of the boot 10 such that first his toes and then the remainder of the foot contact the boot base 58 (FIG. 4). The user will then move his heel rearward to bear against the heel counter 12. The yoke member 50 together with the shin member 52 and the flex link 53 are then rotated about the axis 51 until the midfoot section 54 of the yoke member 50 comes into contact with the midfoot area of the foot and the shin member 52 comes into contact with the shin area of the lower leg.

The closing device over the midfoot section 54 is then operated. This closure acts on the yoke member 50 to create a wedge type action between the midfoot section 54 and the heel counter 12. As the heel becomes seated against the heel counter 12, the user may adjust the closure acting on the yoke member 50 and in so doing decrease the wedge volume acting on the midfoot. The closure device over the shin member 52 is also closed. Thus, each of the members 52, 50 are independently brought into firm and comfortable contact with the midfoot and shin, respectively. The skier is then prepared to position and secure his boot on the ski.

There are several adjustments the user may make in the boot which will reflect his personal preferences. The first adjustment relates to the angle the brace member 22 may make relative to the rigid base 11. By adjusting the extension of the backstop 30 such that the distance between the end of the backstop 30 and the projection 31 on the upper brace member 22 is changed, the angle between the upper brace member 22 and the rigid base 11 may be increased or decreased so that the most rearward position of the upper brace member 22 is established.

A second adjustment by way of the torsion bars 40 is also provided as described previously. The skier may wish a larger or smaller rearward directed force on the upper brace member 22 and, to obtain this desired force, he will slide the projections 43 upwardly or downwardly within their sliding surface to obtain the desired force. He may also wish a lesser or greater amount of force at the initial position of the upper brace member 22 and, therefore, he will angularly move the torsion bars 40 with the first adjustment 44 on each side of the boot 10.

Figure 6:
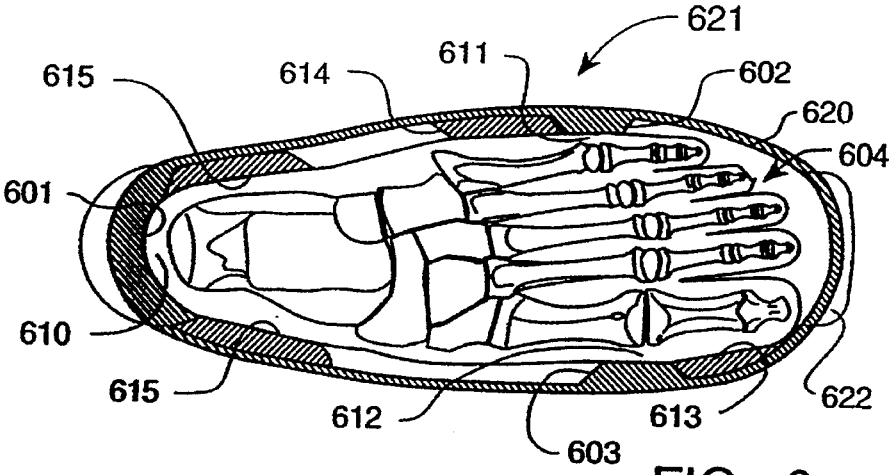
FIG. 6 is a diagrammatic plan view of a footwear device according to the invention and illustrating adjustable counter apparatus and the foot of a user.
Figure 7:
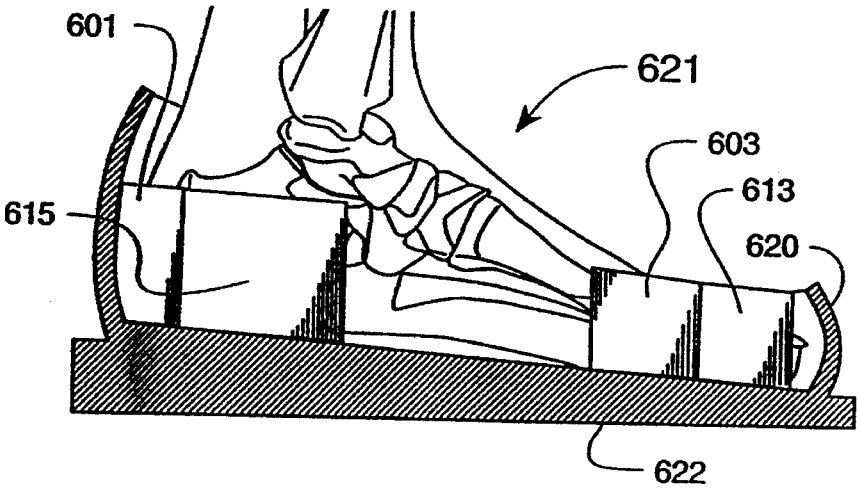
FIG. 7 is a side view of the footwear device and foot of FIG. 6.

A further embodiment of the invention is illustrated in FIGS. 6 and 7. In this embodiment, there are first, second and third counter members in the form of heel counter member 601, outside counter member 602 and inside counter member 603. These counter members 601, 602 and 603 may be referred to as the principal counter members as they are located at the points of principal force transmission locations between the foot generally shown at 604 of the user, namely the heel area 610 of the foot 604, the ball area 611 of the small toe of the foot 604 and the ball 612 of the big toe of the foot 604, respectively.

A plurality of counter adjustment means in the form of adjustment pads 613, 614, 615 for counter members 603, 602 and 601, respectively, are provided. These adjustment pads 613, 614, 615 are removably positioned by, for example, the use of VELCRO™ fastener attachment means within the shell 620 of the footwear generally shown at 621 and they cooperate with and complement the principal counter members 601, 602, 603 to better distribute the forces transmitted from the foot to the footwear 621 through the principal counter members 601, 602, 603. They further act to adjust the fit of the boot for individual foot shapes so that smooth distribution of force may take place without point or contact loading being created on the foot of the user. The counter adjustment 614 for the outside counter 602 may extend, for example, rearward to the 5th metatarsal. The principal counters 601, 602, 603 should be comprised of a material which readily transfers force from the foot of the user to the rigid base member 622 of the footwear 621.

This embodiment is useful for a number of purposes. First, the counters together with the counter adjustment can be used to position and maintain the position of the foot within the footwear at an optimum location for the particular foot of the user. Second, the counters and the counter adjustments can be used as resistance sources for a specific area of the foot of the user to bear against during operation so as to transfer force to the principal counters in an optimum manner. Third, the counters and the counter adjustments can be used to influence the articulation of the heel of the user which is very important for correct force transfer to the ski or skateblade through the footwear.

Each of the complementary counter adjustments 613, 614, 615 may be made up of a plurality of sections depending upon the position desired for the foot of the user in the footwear.

In operation, the footwear 621 will be opened from the top as has been previously described and the foot 604 of the user within a sock or otherwise will be placed on the rigid base member 622 inside the principal counters 601, 602, 603. The foot will then be manually or physically moved until the optimum position for the foot in the footwear 621 is attained. Thereafter, the counter adjustment members will be inserted in the proper positions as required to maintain the foot in the optimum operating and comfort position. In such a position, the other functional elements such as the forefoot/midfoot member 54 shown in FIG. 1 and described earlier will cooperate with the foot and the counters to create the desired force transfer from the foot to the footwear and, thence, to the ski or blade.

The adjustable counter system will also give an increased range of fit for a standard boot shell. The boot shell 620 itself will serve as the basic fit for a larger percentage of the population. Thus, inventories of boot shells may be smaller. The final fit between the foot of the particular user and the basic shell is by use of the adjustable counter pads 613, 614, 615 mounted appropriately to each counter 601, 602, 603. Alternatively, the counters and the counter adjustment members could be preassembled and, thereafter, fitted to the user. Following the custom fit, the counters and counter adjustment members would simply be inserted in the shell in their entirety and maintained there for receiving the foot at an appropriate time.

Figure 8:
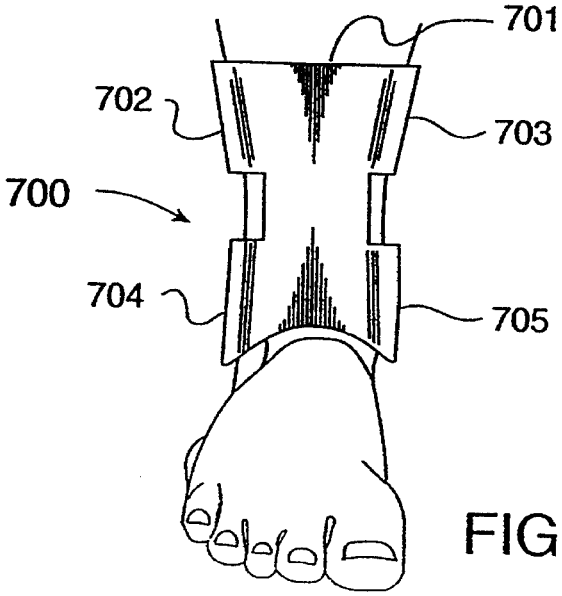
FIG. 8 is a front view of the right leg and foot illustrating shin fit and adjustment elements of a footwear device in relation to the leg.
Figure 9:
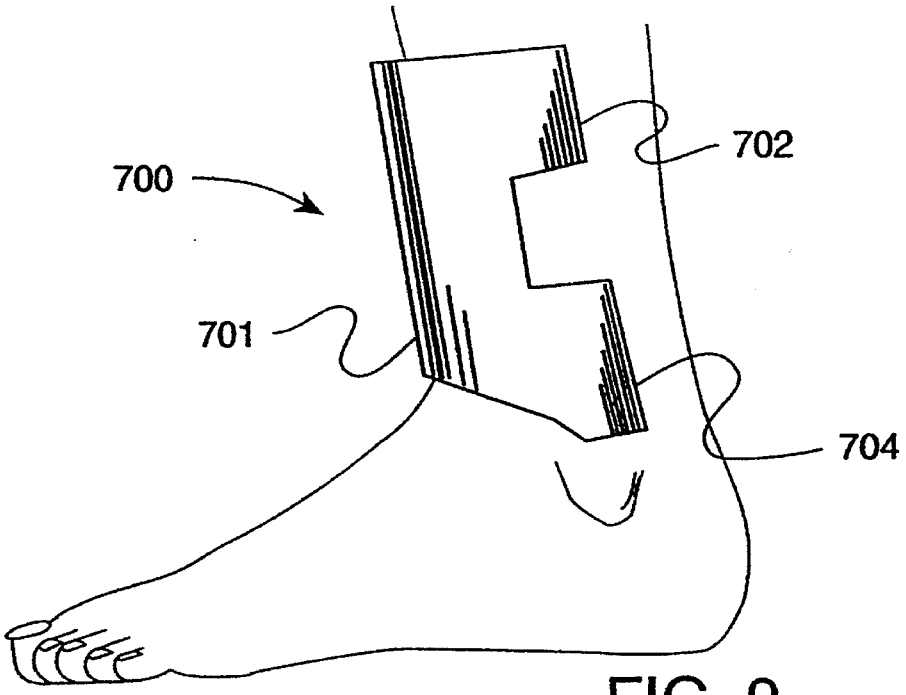
FIG. 9 is an outside view of the left leg and foot illustrating the shin fit and adjustment elements in relation to the leg.
Figure 10:
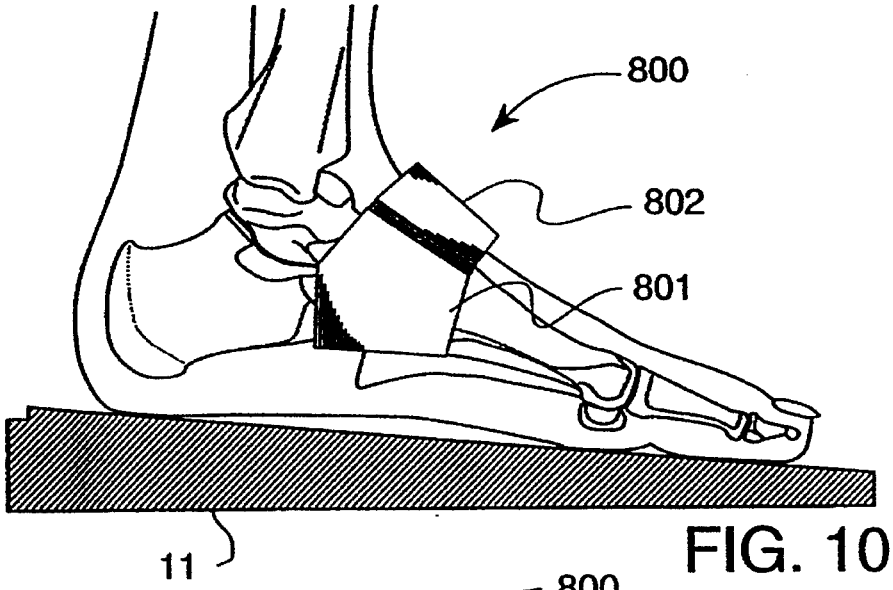
FIG. 10 is an inside view of the left leg and foot on a rigid base and illustrating the position of midfoot principal counter elements in relation to the foot.

Yet a further embodiment of the invention is illustrated in FIGS. 8 and 9. In this embodiment, there is a shin fit and adjustment system generally shown at 700 and comprised of at least one element, or a plurality of elements or combinations thereof. The embodiment as illustrated in FIG. 8 is comprised of five elements; a shin element 701, a shin top outside element 702, a shin top inside element 703, a shin bottom outside ankle element 704 and a shin bottom inside ankle element 705.

This embodiment is useful for a number of purposes. First, a variety of pads, or combinations thereof for the shin element 701, the shin top outside element 702 and shin top inside element 703 can be affixed to the shin member 52, FIG. 1, by the use of, for example, VELCRO™ fasteners so as to permit the shin member 52, FIG. 1, to be modified so as to enable it to be fit to a variety of shin shapes. The same is true of the elements for the shin bottom outside 704 and the shin bottom inside 705. Second, by isolating the top and bottom inside and outside elements of the shin fit system acting on the shin, it is possible to influence the movement of the lower leg relative to the shin member 52. For example, while it is desirable for the leg to be held firmly around the circumference at the top of the shin member 52, FIG. 1, the inside ankle bone must be permitted to move towards the inside of the shin member 52, FIG. 1, in the area substantially adjacent to element 705, during progressive biasing of the user's weight such as occurs when the wearer is seeking to establish a position of balance on one foot. Such movement can be accommodated by a shin bottom inside ankle element 705 which is fabricated, for example, of a material which provides less resistance to compression that of material used to fabricate elements at shin bottom outside 704, shin top outside 702 and shin top inside 703.

In operation, the footwear 621, FIG. 7 will be opened from the top as has been previously described and the foot 604 of the user within a sock or otherwise will be placed on the rigid base member 622 inside the principal counters 601, 602, 603. The yoke member 50, FIG. 1 together with the shin member 52 and the flex link 53 are then rotated about axis 50 until the midfoot section 54 of the yoke mender comes into contact with the midfoot area of the foot and the elements 701, 702, 703, 704 and 705, FIG. 8 of the shin mender 52, FIG. 1 come into contact with the shin area of the lower leg.

Should the wearer desire to alter the fit of the shin member 52, FIG. 1, the elements 701, 702, 703,704 and 705, or combination thereof may be removed and elements of differing shape and dimension substituted. Fixation means for such elements can be achieved, for example, by VELCRO™ fasteners.

Figure 11:
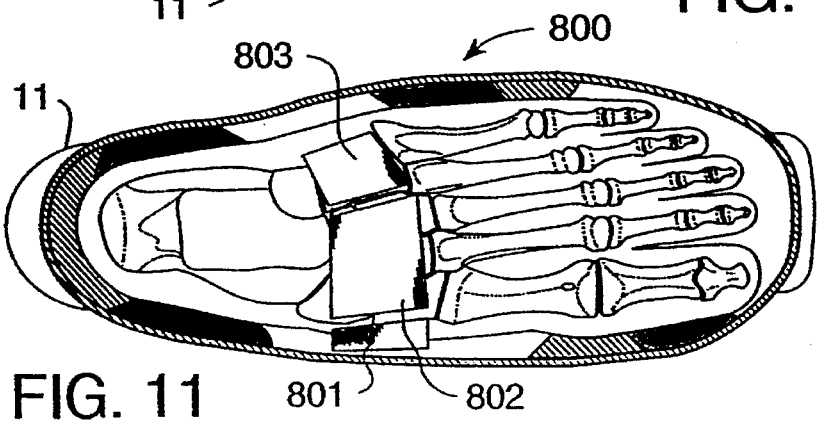
FIG. 11 is a top view of the left foot illustrating the position of a principal instep midfoot counter element in relation to the foot with the associated counters on either side also shown.
Figure 12:
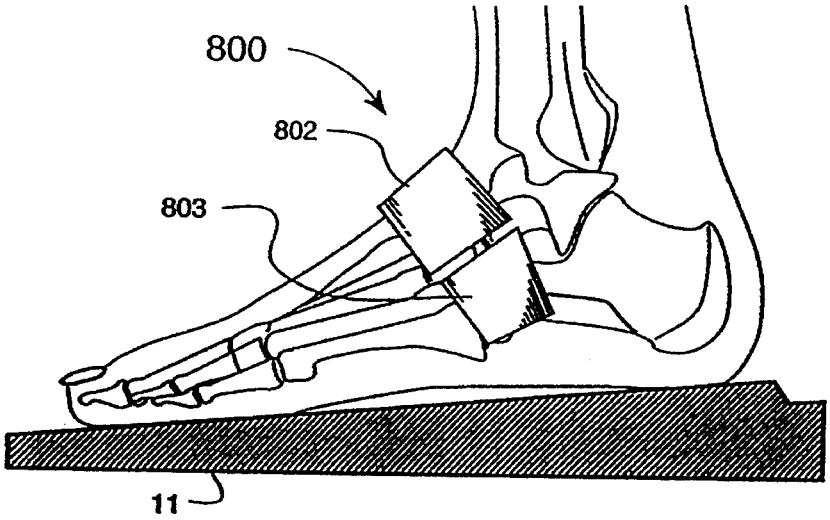
FIG. 12 is an outside view of the left leg and foot illustrating the position the forefoot/midfoot secondary counter and the principal instep midfoot counter elements in relation to the foot.
Figure 13A:
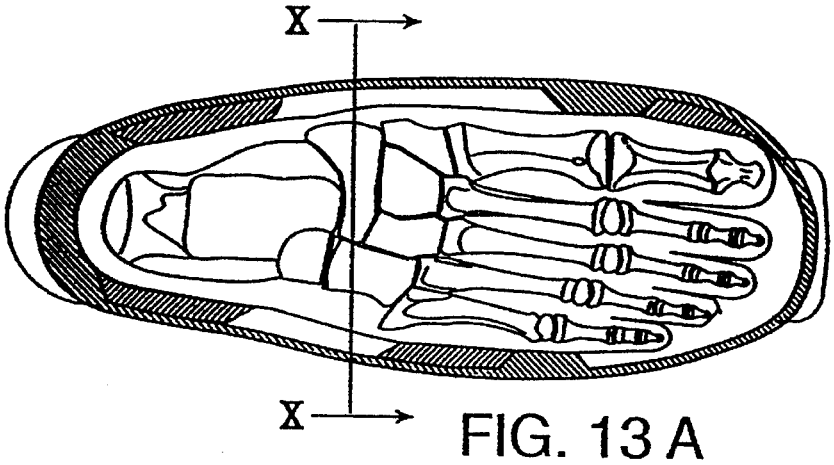
FIG. 13A is a top view of the right foot shown on a rigid base and indicating a cutaway section which is illustrated in FIG. 13B in which the foot shares an even weight distribution with the opposite foot in a bipedal stance and the cutaway section which is illustrated in FIG. 13C in which the foot is fully weighted in a balanced position of monopedal stance.
Figure 13B:
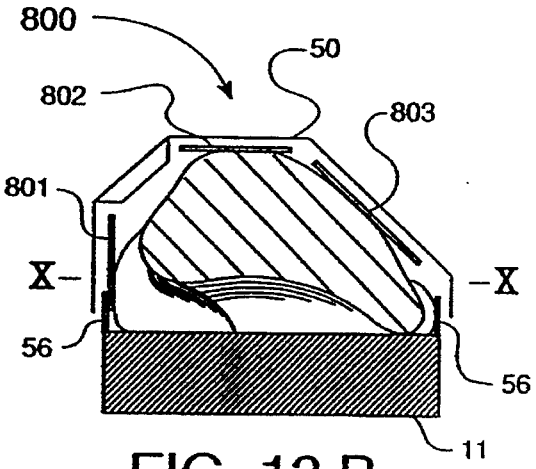
Figure 13C:
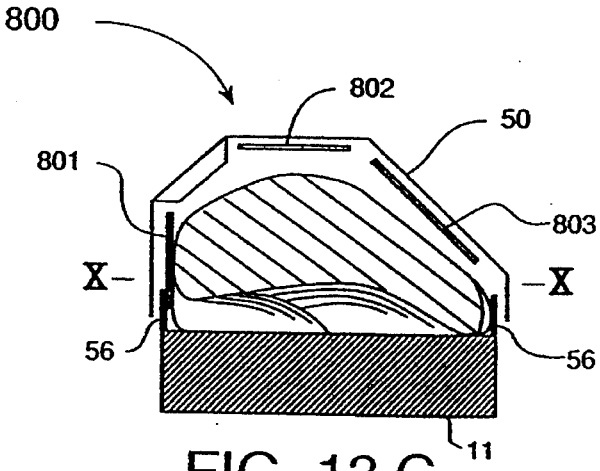

Yet a further embodiment of the invention is illustrated in FIGS. 10, 11, 12 and 13. In this embodiment, there is a forefoot/midfoot reference counter system generally shown at 800 and comprised of at least one element or a plurality of elements or combination thereof. In FIG. 11 the embodiment illustrated comprises three elements; two principal reference counter elements 801 and 802 located at the midfoot inside and midfoot top, or instep, respectively and a secondary reference counter element 803 located at the midfoot outside. These elements 801, 802 and 803 are illustrated affixed to the yoke mender 50, FIG. 1 in FIGS. 13 B and C. FIG. 13A illustrates the cutaway sections shown in 13 B and C. The counter elements 801, 802 and 803 are affixed to yoke mender 50, FIG. 1 by means of, for example, VELCRO™ fasteners.

These counter elements 801, 802 and 803 have several functions one of which is to act as reference points for the architecture of the foot as it pertains to weight bearing. Principal reference counter element 802 is positioned so that the area of the top of the instep of the foot substantially adjacent to element 802 is in contact with element 802 with the closure operated when the wearer assumes a bipedal stance with both feet bearing an equal portion of his weight. Concurrently, the secondary reference counter element 803 is in contact with the outside area of the midfoot substantially adjacent to element 803 while the area of the midfoot substantially adjacent to the principal reference counter element 801 is not in contact with the counter element 801.

When the wearer assumes a position of balance on one foot, as in a monopedal stance, the principal reference counter 801 is in contact with the area of the midfoot substantially adjacent to principal reference counter 801 and the areas of the foot substantially adjacent to principal reference counter 802 and secondary reference counter 803 are not in contact with the areas of the midfoot substantially adjacent to counters 802 and 803.

A second function of elements 801, 802 and 803 relates to the application of resistance points with which to substantially reduce certain movements of the foot. Counter element 802 is positioned directly over the top of the midfoot so as to act in a manner to substantially reduce the lifting off the rigid base 11, FIG. 1 of the wearer's heel such as may occur under conditions of certain force imbalances acting on the wearer. Counter elements 802 and 803 similarly act to substantially reduce foot roll out such as may occur under certain conditions of force imbalances acting on the wearer. Counter element 801 is positioned substantially adjacent to the inside area of the midfoot. Under conditions of certain torsional forces being applied to the foot by the wearer this counter is intended to act in substantially transferring such forces to the footwear in co-operation with counters 603, 613, and 601 FIG. 6.

Adjustment means for counters 801, 802 and 803 is provided for by the substitution of counters of differing shape and dimension affixed to the yoke member 50, FIG. 1, for example, by VELCRO™ fasteners.

Figure 14:
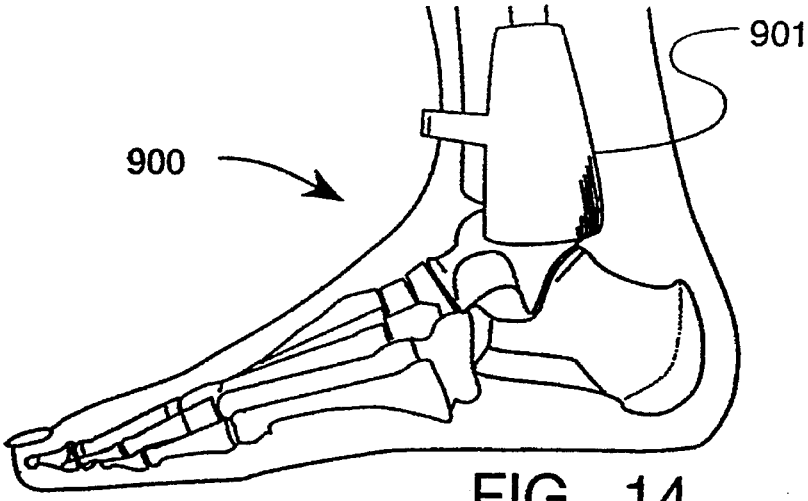
FIG. 14 is an outside view of the left leg and foot showing the relevant element of the shin member dynamic fit system bladder in relation to the lower leg.
Figure 15:
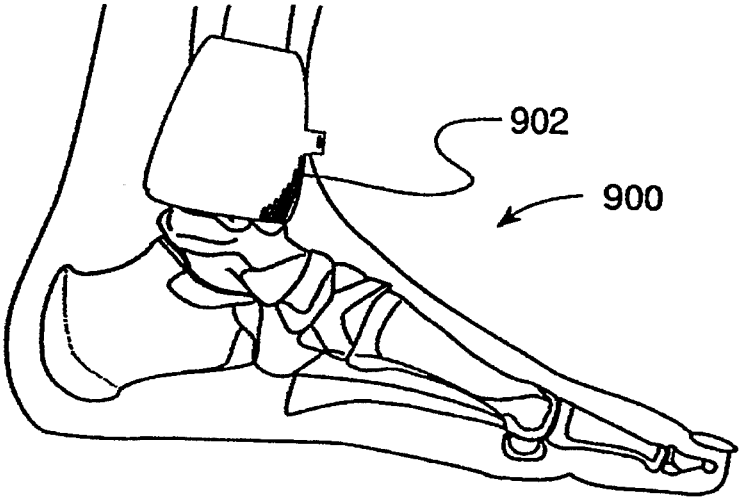
FIG. 15 is an inside view of the left leg and foot showing the relevant element of the dynamic fit system shin member bladder in relation to the lower leg.
Figure 16:
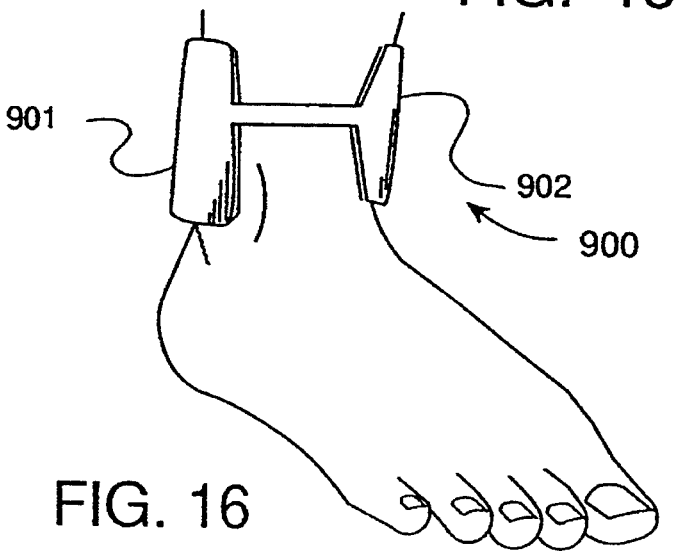
FIG. 16 is an isometric view of the right leg and foot showing the outside element of the shin member dynamic fit system bladder in relation to the leg and also illustrating the transfer connection to the inside element of the bladder.

Yet a further embodiment of the invention is illustrated in FIGS. 14, 15 and 16. In this embodiment, there is a shin mender dynamic fit system generally shown at 900 and comprised of one element or a plurality of elements or combination thereof. In FIG. 16 the embodiment is illustrated as comprised of two elements; a shin member outside ankle bladder element 901 and a shin mender inside ankle bladder element 902. The shin member outside ankle element 901 is illustrated in relation to the leg in FIG. 14 while the shin mender inside ankle element 902 is illustrated in relation to the leg in FIG. 15. In FIG. 16 outside shin mender ankle element 901 and inside shin member inside ankle element 902 are illustrated in relation to the foot in isometric view with the connection between the two elements shown.

In operation the outside shin mender ankle element 901 is intended to be incorporated into the shin member fit and adjustment system 700 so that shin member outside ankle element 901 is associated with the shin mender lower outside element 704 while shin mender inside ankle element 902 is associated with shin mender lower inside element 705. The shin member dynamic fit system 900 is intended to be a closed bladder system in which bladder elements 901 and 902 are of substantially equal volume displacement and in which at least 50 percent of the cumulative volume displacement of the bladder elements 901 and 902 is occupied by a pneumatic or hydraulic medium so that compression applied to one element, for example 901, will cause the medium contained within it to be displaced to the opposite element, in this example, 902.

This embodiment is useful for several purposes. First, it can be used to transfer forces from one area to another area. Being that bladder elements 901 and 902 are of substantially equal volume, when a fit is obtained between the leg in the areas substantially adjacent to the inside bladder element 901 and the outside bladder element 902 with these elements incorporated into the respective shin fit lower ankle elements 705 and 704, and the insides of the brace member 20, FIG. 1, a percentage displacement of medium contained within the dynamic fit system bladder 900 will reflect a substantially equal percentage displacement of the associated area of the leg thereby causing the fit to be maintained during relative lateral displacement.

A second use for this embodiment is for the dampening of movement. Depending on the qualities of the medium contained within the dynamic fit system bladders 901 and 902, for example viscosity, the medium will influence the velocity with which the leg is displaced within the brace member 20, FIG. 1.

Figure 17:
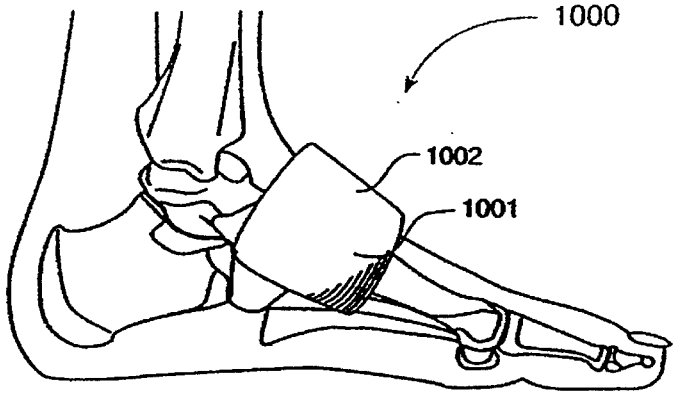
FIG. 17 is an inside view of the left leg and foot showing the relevant element of the midfoot dynamic system bladder in relation to the leg.
Figure 18:
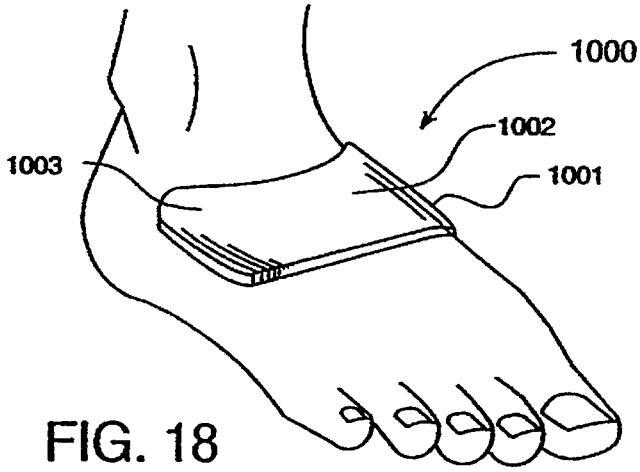
FIG. 18 is an isometric view of the right foot and leg illustrating the instep and outside foot elements of the midfoot dynamic fit system bladder in relation to the leg.

Yet a further embodiment of the invention is illustrated in FIGS. 17, 18 and 19. In this embodiment, there is a midfoot dynamic fit system generally shown at 1000 and comprised of at least one element or a plurality of elements or combination thereof. In FIG. 18, the embodiment is illustrated as comprised of three elements; a midfoot inside bladder element 1001, a midfoot top bladder element 1002 and an outside bladder element 1003.

FIG. 17 is an inside view of the left foot illustrating the midfoot inside bladder element 1001 in relation to the foot.

FIG. 18 is an isometric view illustrating the midfoot outside bladder element 1003, the midfoot top bladder element 1002 and the midfoot inside bladder element 1001 in relation to the foot.

FIGS. 19 A and B are cutaway sections of the midfoot of the right foot looking towards the front of the foot from the rear in which the dynamic fit system elements 1001, 1002 and 1003 are shown as they relate to the reference counter elements 801, 802, and 803 of the reference counter system 800, FIG. 11. Also illustrated is the rigid base 11 and the side counters 56 and the yoke member 50, FIG. 1 in relation to the midfoot and the reference counters 801, 802 and 803 and the bladder elements 1001, 1002 and 1003.

Figure 19A:
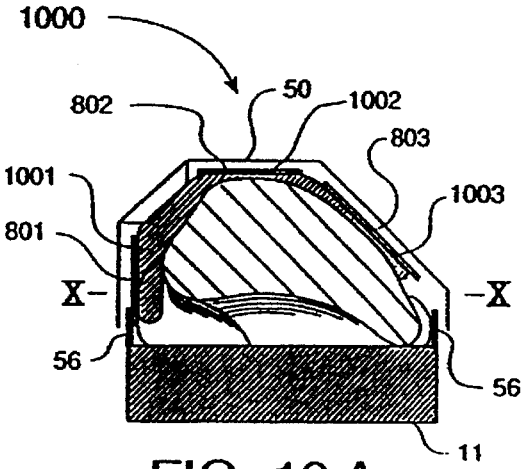
FIGS. 19A and 19B are the same cutaway sections of the midfoot as illustrated in FIGS. 13B and 13C, respectively, in which in FIG. 19A the foot shares an even weight distribution with the opposite foot in a bipedal stance and FIG. 19B in which the foot is fully weighted in a balanced, monopedal stance.
Figure 19B:
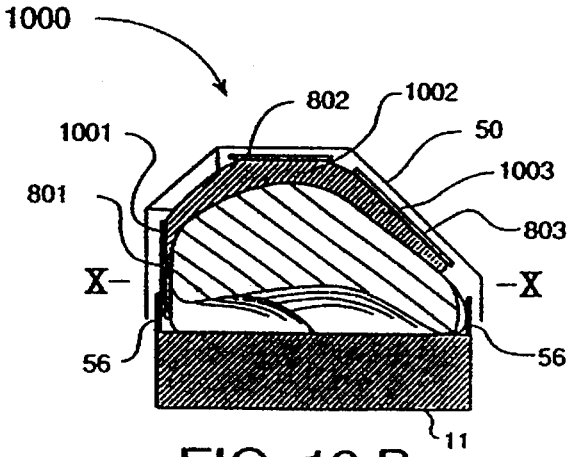

FIG. 19A illustrates a section of the right foot in a configuration approximating that of a wearer assuming a bipedal stance with weight distributed equally between the left and right feet. FIG. 19B illustrates a section of the right foot in a configuration approximating that of a wearer assuming a monopedal stance in a balanced position with the entire weight borne on that foot.

In operation, it is intended that the dynamic fit system bladder 1000 be sealed and that the volume displacement of element 1001 is substantially equal to that of the combined volume displacement of elements 1002 and 1003 and in which at least 50 percent of the cumulative volume displacement of the dynamic fit system bladder 1000 is occupied by a pneumatic or hydraulic medium so that compression applied to one element, for example element 1001, will cause the medium contained within it to be displaced to the remaining element or elements, in this example, 1002 and 1003.

Operation of this embodiment is as follows. With the wearer assuming a bipedal stance with equal weight being borne on the left and right feet and with the right foot placed within the footwear on the rigid base 11, FIG. 1 and with the closure elements of the footwear operated so that the principal reference counter 802 is in contact with the midfoot upper section of the foot and the secondary reference counter 803 in contact with the midfoot outside section of the foot, the medium contained within the dynamic fit system bladder 1000 resides mainly within element 1001. As the wearer begins a progressive weighting towards a position of balance on the right foot, the architecture of the foot begins to rearrange itself so that the midfoot inside section substantially adjacent to the dynamic fit system element 1001 and the principal reference counter 801 begins to displace towards these elements. As this displacement progresses, the bladder element 1001 is compressed and the medium is progressively displaced into elements 1002 and 1003.

FIG. 19B illustrates the architecture of the right foot at the conclusion of the displacement sequence in which the wearer has now assumed a position of balance on that foot. In this position, the medium contained within element 1001 has been substantially displaced into bladder elements 1002 and 1003 so that a force has now been caused to act on the reference counters 802 and 803 by the dynamic fit system elements 1002 and 1003 and, in turn, a force is caused to act on the areas of the foot substantially adjacent to counters 802 and 803. Thus the fit between the area of the midfoot and the yoke member 50 is maintained during relative displacement of the foot. The medium contained within the dynamic fit system bladder will also act to dampen the movement against external forces acting on the wearer.

Many modifications are contemplated which will improve the function of this embodiment. For example, the characteristics of the medium contained within the bladder element 1000 will significantly affect the manner in which the bladder functions. In addition, the flow rate of such a medium can be regulated and controlled by utilizing a plurality of bladders interconnected by valving systems which regulate the direction and rate of flow. In this manner, the elements of the dynamic fit system 1000 may be arranged so that the medium contained within the bladder or bladders displaces to one aspect of the midfoot at a different rate than to another aspect of the midfoot.

Many further modifications to the specific embodiments described are contemplated. For example, a second torsion bar may be added. This would provide for a desirable increase in the resistance adjustment of the flex motion and would provide for engagement with a second projection extending from the boot after a certain angle of the upper brace member 22 relative to the rigid base 11 was reached. Such contact could provide for an increased amount of force commencing at a certain location and continuing until the end of the movement of the upper brace member 22.

DESCRIPTION OF FURTHER SPECIFIC EMBODIMENTS AND OPERATION

Figure 21:
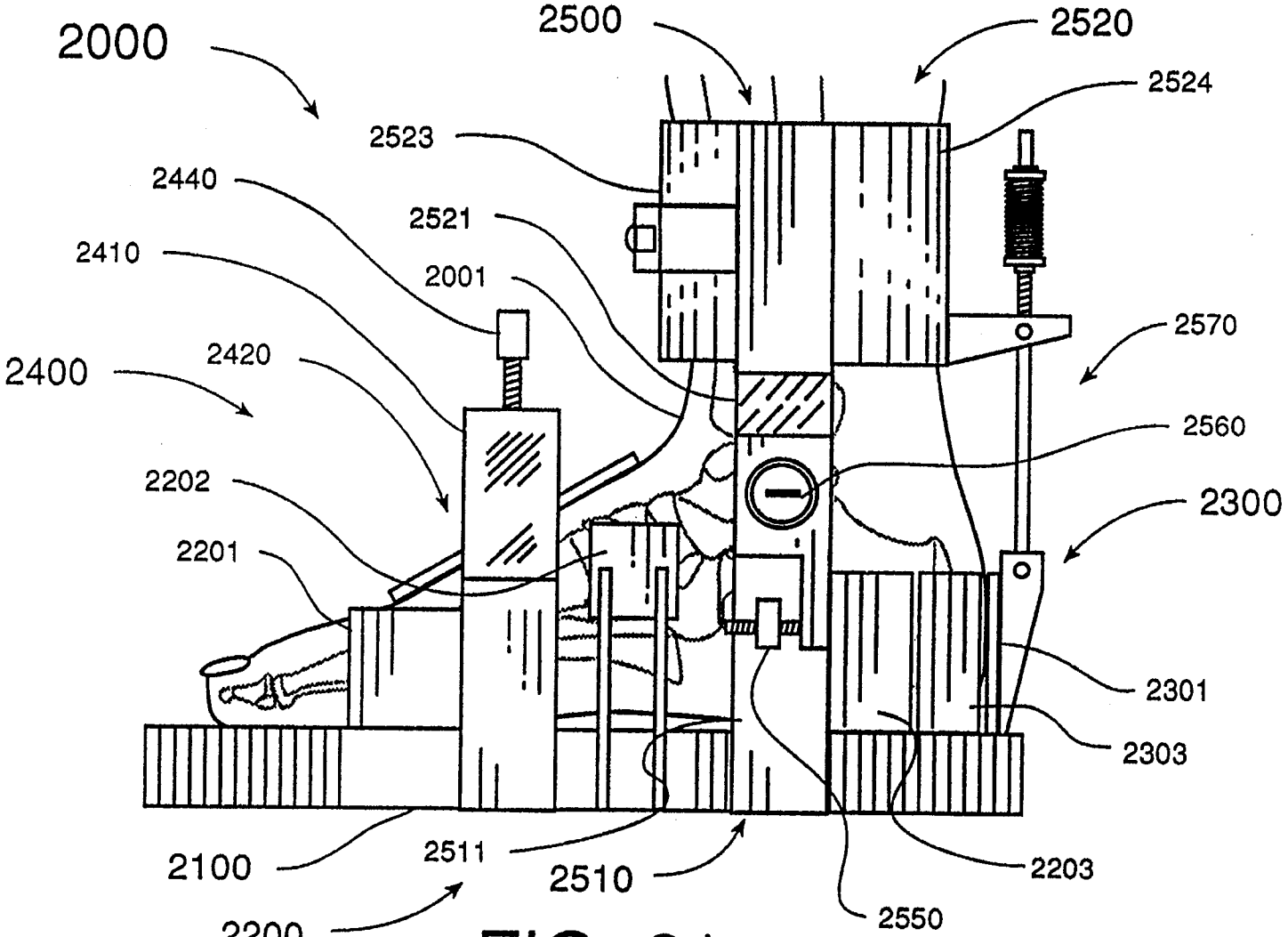
FIG. 21 is a medial elevation of the footwear device of FIG. 20.

Referring to FIGS. 20 and 21, a sports footwear fit and support system or footwear device according to the invention is indicated generally at 2000 with the right foot 2001 of a user inserted therein. The footwear device 2000 comprises five main elements, i.e. a rigid base 2100, a plurality of side counters 2201, 2202, 2203, 2204 and 2205 (collectively referred to by reference numeral 2200), heel counters 2301, 2302 and 2303, collectively referred to by reference numeral 2300, a forefoot/midfoot compression member or forefoot/midfoot pivotal support, generally shown at 2400, and a leg member, generally shown at 2500.

The five main elements are interrelated and interdependent in terms of producing the overall effect relating to the principal object of the invention. In terms of this object, there exists a specificity of the side counters 2200, the heel counter 2300 and the forefoot/midfoot compression member 2400 which act in concert to control the position and displacements of the foot of the user relative to rigid base 2100 while the rigid base 2100 and the leg member 2500 act in concert to control the movement of the leg relative to rigid base 2100. Control of the movement of the leg is important to preserve the physiologic function of the user which the counter structure of the footwear device 2000 associated with the foot is acting to accommodate and enhance. In this respect loss of physiologic function amounts to loss of function of the footwear device 2000. Hence, the interdependency of the elements.

FIG. 21 illustrates the footwear device 2000 in a medial side elevation with the right foot 2001 of a user inserted in the footwear device 2000.

In order to fully appreciate the objects of the invention, a knowledge of the displacements of the foot and leg necessary for the user to make a transition from a bipedal to a monopedal stance is necessary.

FIGS. 22 A to D illustrate four views of the right foot of a user. FIGS. 22A and 22B depict a medial elevation and a plan view, respectively, of the foot in a bipedal function. Anatomically speaking, the foot is said to be in a "neutral" position.

FIGS. 22C and 22D depict a medial elevation and a plan view, respectively, of the foot in a monopedal function. Anatomically speaking, the foot is said to be in a pronated position.

The foot pronates as it makes the transition between bipedal and monopedal function. The bony and ligamentous architecture of the foot enables the foot to change its shape during this transition, while maintaining its structural integrity. FIGS. 22 A and B represent the foot during bipedal function. FIGS. 22 C and D represent the foot during monopedal function. Comparing FIGS. 22 A and B with FIGS. 22 C and D, it can be seen that during pronation:

the ankle (tibio-talar) joint dorsiflexes, and the tibia rotates internally; the amount of internal rotation is proportional to the degree of dorsiflexion;

the horizontal distance L (from the most posterior aspect of the calcaneus to the first metatarsal head (1)) increases in length (i.e. L2>L1);

the vertical distance H (from the most dorsal aspect of the navicular to the supporting surface (the rigid base)) decreases in length (i.e. H2<H1);

as the medial arch of the foot compresses against the rigid base, the head of the first metatarsal (2) is displaced distally in proportion to the degree of compression of the arch;

the bones of the midfoot are displaced infero-medially (3);

the metatarsal bases shift medially with the bones of the midfoot, such that the heads of the metatarsals become angled laterally relative to their respective bases (reference lines R1 and R2 with respect to the first metatarsal base);

as the weight of the superincumbent body shifts anteriorly over the supporting foot, the transverse arch of the foot compresses against the rigid base, causing the metatarsal heads to be displaced laterally (4);

the degree of dorsiflexion at the hinged ankle joint (5), as seen in 22 C, increases; and the tibia/fibula, as seen in 22 C, undergoes a degree of obligatory internal rotation (6) during pronation.

In addition to the above, the center of mass of the user displaces laterally relative to the foot assuming the user's weight until it acts over the medial aspect of the foot.

It should be noted in FIGS. 22 C and 22 D that displacements of the structures of the foot occur distal to the posterior aspect of the heel. In the inventive footwear device the posterior, postero-lateral and postero-medial counters, which address the respective aspects of the heel, are designated as the 'anchor point' for distal displacements of the foot which occur during the operation of the footwear. Medial and lateral displacement of the heel is substantially prevented.

Referring to the same figures it will be noted that the medial aspect of the head of the first metatarsal (2) defines the medial limit of the forefoot such that transverse displacements occur lateral to this face. In the inventive footwear device the lateral face of the medial forefoot counter which address the medial aspect of the head of the first metatarsal serves as the 'control point' for lateral displacements which occur lateral to the head of the first metatarsal during the operation of the invention.

Both the anchor and control points are dependent on the correct functioning of the forefoot/midfoot pivotal support for their operation.

Figures 23A, 23B:
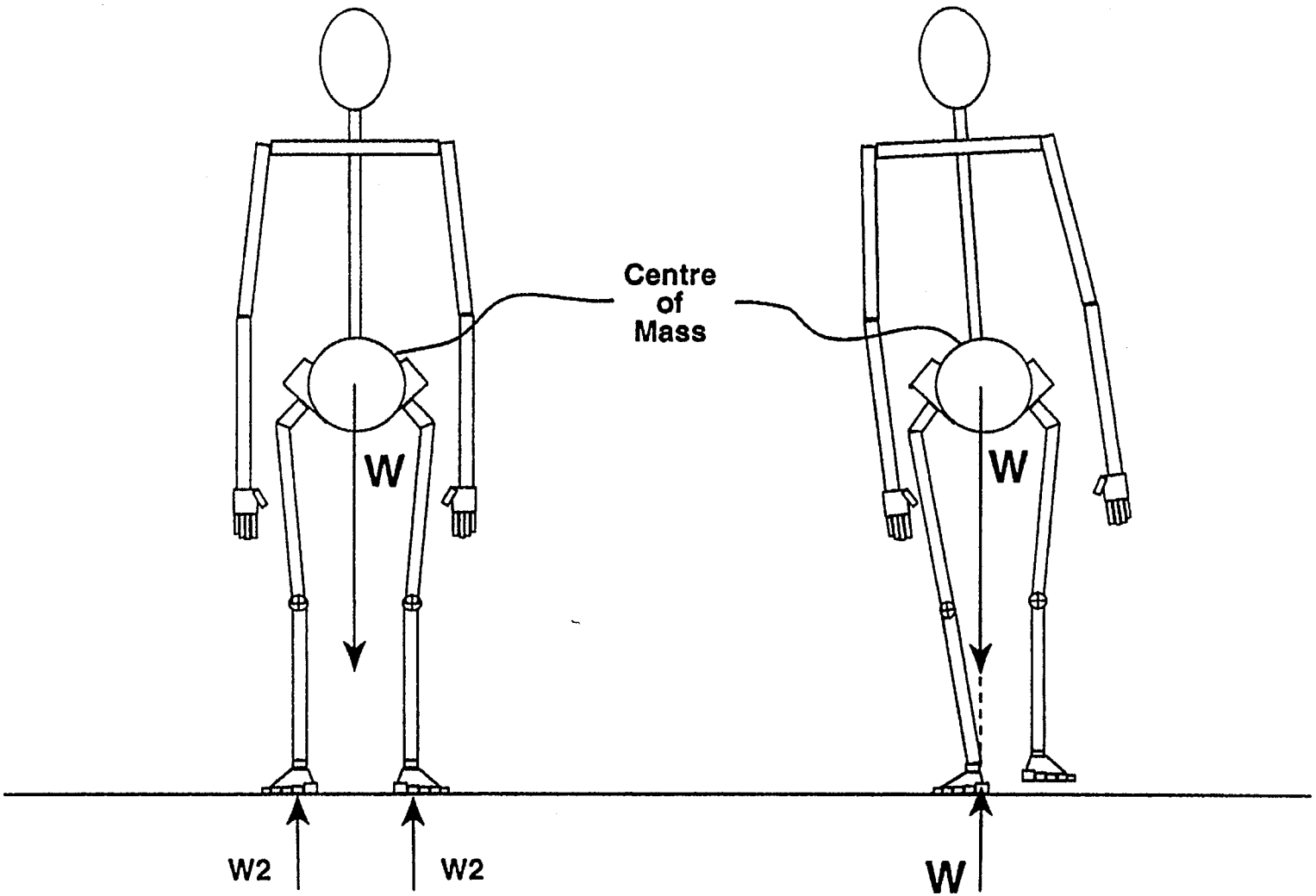
FIGS. 23 A and B illustrate stick drawings showing the forces acting on a person in bipedal and monopedal stances, respectively.

FIGS. 23 A and B, respectively, illustrate stick drawings of a user in a bipedal stance and monopedal stance. It should be noted that the forces shown acting on the user are an approximation only and not entirely accurate since they do not include more complex forces generated at the ankle/foot complex. The purpose of the illustrations is to show the relationship of the more complex forces acting on the foot in a monopedal function where the user is balanced on one foot. In comparing FIG. 23A to FIG. 23B it will be seen that the user's center of mass displaces laterally in moving from a bipedal stance to a monopedal stance until it exerts itself substantially over the medial aspect of the foot. At this point the user is able to assume a balanced, pronated position and is thus in a position of monopedal function.

Pronation of the ankle/foot complex is not a necessary prerequisite for balance on one foot. However, balance on one foot, as in monopedal function, is enhanced by the pronated foot. The degree of displacement of the various foot elements during pronation, as described earlier with reference to FIG. 22, will vary among individuals and will depend upon the shape of the foot and its arches in the foot's neutral position.

In order to describe the location of counters as accurately as possible, anatomic terms have been employed. In many occasions the counter locations are referenced relative to specific bone structures of the foot, for example the "medial aspect of the head of the first metatarsal". It is to be understood that where such reference is made, it does not imply direct contact of the counter with the surface of the bone. Rather, it is intended that the force be directed to the bone structure through the adjoining soft tissue.

It should also be understood that reference to the accommodation of a bipedal and a monopedal function infers that any state between a bipedal or a monopedal function is also accommodated. Further, the architecture of the foot associated with a monopedal function should anticipate further medial displacements, after monopedal function has been attained, which may occur in response to loads imposed on the foot.

In the light of the above, a primary object of the footwear device 2000 according to the invention is to accommodate and control the displacements of, and enhance the function of, the physiology of the foot and leg of the user in a manner which is advantageous in applications wherein an instrument such as a ski, skate blade or the like is connected to rigid base 2100 of the footwear device 2000. In order to achieve this object, the footwear device 2000 provides:

1. means to locate and maintain the position of the posterior, postero-lateral and postero-medial aspects of the heel of a user relative to the rigid base 2100;
2. means to locate and maintain the medial/lateral position of the head of the first metatarsal of a user on an axis substantially parallel to the longitudinal center of the rigid base 2100 such that posterior or anterior displacement of the head of the first metatarsal, which occurs in conjunction with movement in and out of pronation, will occur along this axis;
3. means to substantially maintain the positions defined in objects 1 and 2 while accommodating the physiologic function of the foot and leg in both static and dynamic bipedal and monopedal stances;
4. means to control the displacements of the structures of the midfoot and forefoot in a manner that provides consistency of these displacements which occur relative to the rigid base 2100 while maintaining the objects set out in 1, 2 and 3;
5. means to provide a mechanical advantage so that the forces exerted by various aspects of the foot are directed in a manner that is advantageous to the user in the activity for which the footwear device 2000 is intended;
6. means to control movement of the leg of the user relative to rigid base 2100 in a manner that ensures that the movements are substantially consistent and predictable with regard to the position of the leg member 2500 relative to the rigid base 2100 and further that the manner in which the leg member 2500 influences the leg does not adversely affect the influence on the foot of the rigid base 2100, side counters 2200, heel counter 2300 and the forefoot/midfoot pivotal support 2400; and
7. means to connect the rigid base 2100 of the footwear device 2000 to the principal points of force transfer of the foot in a manner which ensures that forces exerted by the foot will be transferred as directly as possible and without delay to an instrument, such as a ski, connected to the rigid base 2100 of the footwear device 2000.

In the present example, the footwear device 2000 is intended to be used as a ski boot and, therefore, reference will be made to the footwear device 2000 in this context.

The structures of a ski boot are, of necessity, made from rigid materials. Rigid plastics are preferable but metals may also be suitably employed for some structures.

The movements of the foot in both bipedal and monopedal function occur around specific points of the foot. These movements are, therefore, predictable. Since the object of the invention is to permit, accommodate, control and enhance specific functions of the foot and leg, which as previously mentioned are predictable, the footwear device 2000 must possess predictable characteristics if the object is to be obtained. The use of rigid materials and close tolerance axes for movement combined with articulating structures which are essentially free from deformation or distortion relates to the stated object as does the use of rigid counters rigidly connected to a rigid base and set opposite key areas of the foot and leg. An object of the invention being that these rigid counters maintain the position of the foot and leg relative to the structures of the footwear device 2000 while as directly as possible transferring force from the foot and leg to the footwear device 2000 without delay. It is also an object of the invention that forces exerted externally on the footwear device 2000 by the ski be transferred as directly as possible and without delay to the foot of the user.

Figure 34:
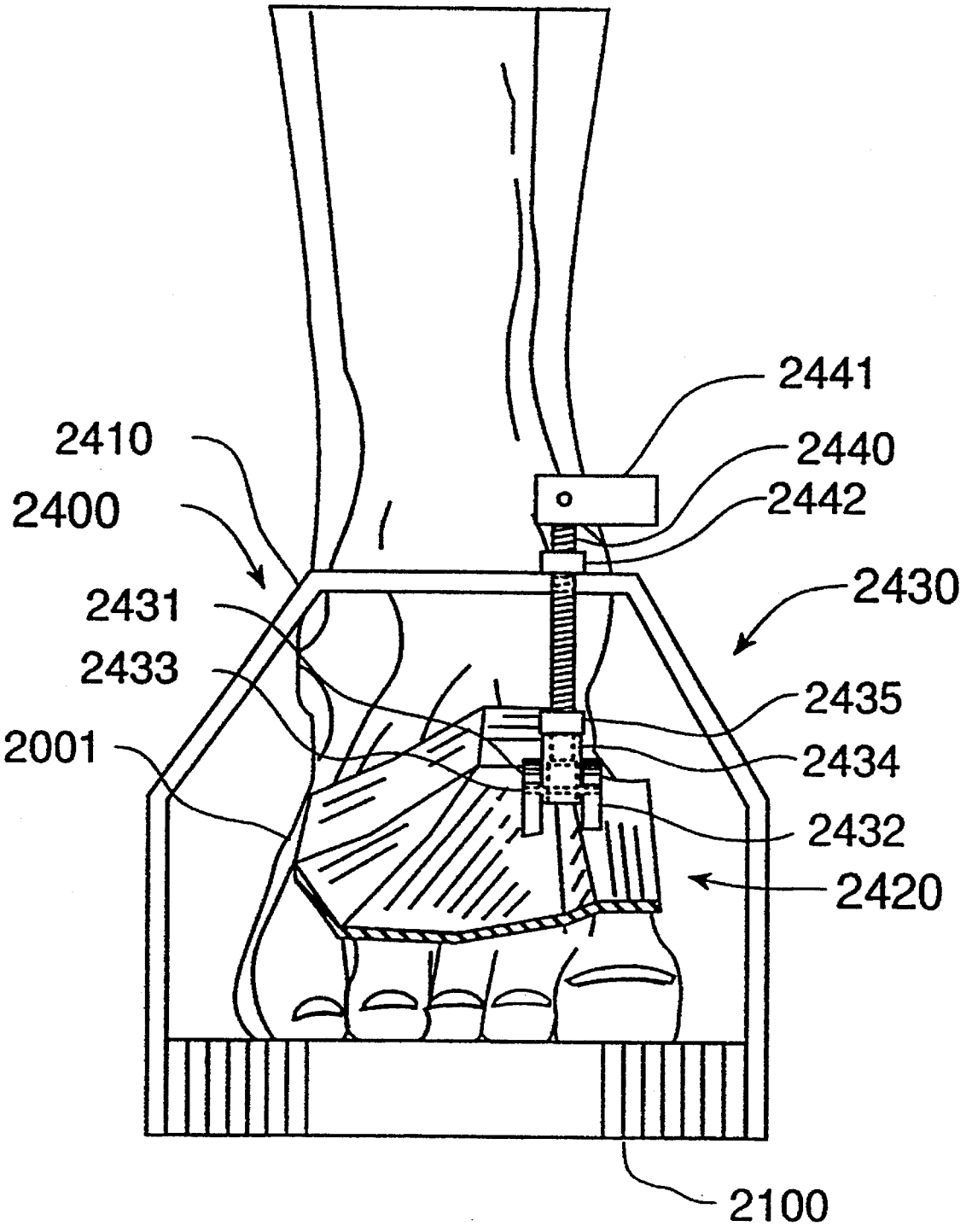
FIG. 34 is a front elevation of the footwear device of FIG. 32.

Referring particularly to FIGS. 21 and 34, the forefoot/midfoot pivotal support 2400 comprises a rigid arch 2410 rigidly connected to the rigid base 2100, an instep counter 2420 and a rod 2440. Rod 2440 is connected to instep counter 2420 via a pivot connection, generally indicated at 2430 in FIG. 34, and connected to arch 2410 by a threaded interface such that the instep counter 2420 can be raised relative to rigid base 2100 by rotating rod 2440 in the appropriate direction to provide for entry of the foot of a user into the footwear device 2000. Once the foot has been positioned on rigid base 2100, instep counter 2420 can then be adjusted downward by rotating rod 2440 in the appropriate direction to bring a suitable downwardly and rearwardly acting force to bear on the dorsum of the foot of the user. Instep counter 2420 should be tensioned with the foot of the user in a bipedal function.

The footwear device 2000 is continuously connected to the peripheral of the foot of a user only at the principal points of force transfer, namely the medial aspect of the head of the first metatarsal, the posterior aspect of the heel, the postero-lateral aspect of the heel and the postero-medial face of the heel.

Not only is it desirable that the peripheral counters of the footwear device 2000 continuously contact the foot of a user and afford rigid resistance to displacement of the foot relative to rigid base 2100 only at these counter surfaces, such limited contact is also necessary for the correct operation of the footwear device 2000. No other contact must occur at the perimeter of the foot which would act to obstruct displacements necessary to assume a monopedal stance once the transition from a bipedal stance to a monopedal stance has been initiated by the user. The avoidance of any obstruction is required in order to ensure that a monopedal stance will be attained without interference or delay. Such interference would be deleterious to the user and is, therefore, undesirable.

If structures are placed in the areas between counters 2201, 2301, 2302 and 2303, the material of which they are composed must be one that yields readily under the slightest pressure so that no significant source of resistance, which would act to obstruct the necessary displacements of the foot, will be introduced.

Other counters, namely 2202, 2203, 2204 and 2205 are located at the perimeter of rigid base 2100. However, contact with the foot of the user by these counters is of an intermittent nature. Further, these counters are located relative to the foot so that they engage their respective areas only at the extreme of displacement of the structures of the foot associated with either a bipedal or a monopedal stance. Hence they do not interfere with these displacements.

Continuous contact is permitted with the dorsum of the foot at particular areas of forefoot/midfoot pivotal support 2400. However, means are provided, for example pivot connection 2430, to ensure that the required displacements of the foot are not obstructed.

Leg member 2500 affords continuous contact with the leg of a user at its medial and lateral aspects only at the superior (upper) portion of the leg member 2500. It is necessary that adequate clearance be provided to ensure that contact with the medial and lateral aspects of the leg inferior (below) to the superior (upper) portion of leg member 2500, which could obstruct or in any way interfere with medial/lateral movement of the malleolus, does not occur. It is especially important that contact by rigid structures of the footwear device 2000 with the malleolus of a user be avoided within the limits of bipedal and monopedal function.

Continuous contact with the anterior (front) and posterior (rear) aspects of the leg of a user with the respective elements 2523 and 2524 of leg member 2500 is permitted and desirable. Such contact is of no consequence provided resistance means 2560 and 2561, mounted in the journal of leg member 2500 and forward travel limiter 2570, are adjusted in a manner which does not restrict the flexion of the leg required for a bipedal or a monopedal function during operation of the footwear device 2000.

Contact with the postero-lateral and postero-medial aspects of the calf of a user is also acceptable and desirable provided the inferior aspects of the surfaces of the leg which are contacted by leg member 2500 are not anatomically conformed to since this could provide interference to the lateral/medial displacement of the malleolus which must be allowed to occur without delay.

The shape of the anterior (front) element of the leg member 2523 is important. It must be of a suitable form to permit internal rotation of the leg of a user when making a transition from a bipedal to a monopedal stance and external rotation when making the transition from a monopedal to a bipedal stance.

The shape of the posterior element 2524 of the leg member 2500 is also important in that it should allow for the same rotation of the leg as the anterior element 2523. However, the shape is less critical since the posterior aspect of the leg at the calf, being soft tissue, is somewhat adaptable to the surface of posterior element 2524.

Of equal importance is the relationship between forefoot/midfoot pivotal support 2400 and leg member 2500. It is necessary that the influence on the structures of the foot and leg associated with these elements be independent of each other. Thus, for example, adjustment of forefoot/midfoot pivotal support 2400 should occur without adverse effect on the operation or influence on the leg of leg member 2500. Further, any means provided to inter-connect forefoot/midfoot pivotal support 2400 and leg member 2500 must be of a material and construction which yields readily under pressure so that movement of leg mender 2500, for example, will not adversely influence or affect forefoot/midfoot pivotal support 2400.

It is an object of the invention that the angle of posterior element 2524 be adjustable so as to provide the correct angle for the calf of the user's leg and that means be provided to render the position of posterior element 2524 rigid relative to rigid base 2100 once the angle is set so that rearward movement of the leg of a user is prevented. An adjustable rear stop 2550 is provided so that the angle of leg member 2500 can be adjusted. Posterior element 2524 provides a rigid surface which ensures that rearward movement of the leg will be prevented once posterior element 2524 contacts rear stop 2550. This function is important for the correct operation of the invention.

A tension adjustment means 2560, 2561 is provided in the journal of leg member 2500. Adjustment means 2560, 2561 employs a mechanism such as BELLEVILLE™ springs which introduces a constant resistance into the leg mender journal. This tension acts to resist rotation of leg mender 2500 about its axis. The effect of tension adjustment means 2560, 2561 is a constant dampening of movement of leg member 2500 throughout its permitted range of rotation. Further, the degree of dampening can be increased or decreased by increasing or decreasing the tension acting on the BELLEVILLE™ springs which in turn act on the journal of leg member 2500. In addition, should a lesser or greater range of tension adjustment be desired by the user, BELLEVILLE™ washers of a suitable specification can be substituted. Should the user desire a relatively free rotating leg member, tension can be minimized on the BELLEVILLE™ springs or, alternatively, they can be removed from the leg member journal.

Another object of the invention is that a means be provided by which the forward rotation of leg member 2500 can be arrested after a specified degree of movement. It is a further object of the invention that the point at which the means employed to arrest forward rotation of leg member 2500 be adjustable. It is a yet a further object of the invention that the rate at which the means employed to arrest the forward rotation of leg member 2500 be adjustable. It is yet a further object that the various means provided to control movement of leg member 2500 be adjustable independently of each other so that the user is able to select the angle at which posterior element 2524 rigidly prevents rearward movement of the leg of a user, the amount of constant resistance in the journal of leg arms 2521 and 2522, the degree of forward rotation of leg member 2500 relative to the position at which it is initially located by posterior leg member 2524, rear stops 2550 and 2551 and finally, the force and duration at which the movement of leg member 2500 is arrested at the termination of its forward rotation, such that the requirements of the morphology, among other things, of a particular user can be provided for.

In order to attain the objects stated above, a forward travel limiter means, generally shown at 2570, is provided which acts to increase the constant resistance provided by tension adjustment means 2560, 2561 after a specified degree of rotation of leg member 2500 about its axis has occurred and to arrest the rotation of leg member 500 after a predetermined degree of rotation. The amount of rotation of leg member 2500 which can occur before forward travel limiter means 2570 engages is adjustable. The tension of the resistance means provided is also adjustable such that the rate at which the movement of leg member 2500 is arrested, once front traveller limiter means 2570 engages, can also be adjusted. Should the user desire a lesser or greater force than afforded by the spring or springs provided in forward travel limiter 2570, springs with a lesser or a greater tension can be substituted.

Thus, it is possible, in employing the aforementioned elements, to provide an infinite number of combinations with which to adapt the function of leg member 2500 to the morphology and physiology of a particular user since means are provided to first establish the angle of leg member 2500 relative to rigid base 2100, second, means are provided to allow for the relatively free rotation of leg member 2500 forwardly of rear stops 2550 and 2551 or to introduce a constant resistance to rotation of the leg member 2500 by tensioning resistance means 2560, 2561, third, means are provided to adjust the relative amount of forward rotation of leg member 2500 permitted to occur before its movement is arrested by adjusting the position at which forward travel limiter 2570 engages, and fourth, means are provided to adjust the force with which forward travel limiter 2570 arrests the movement of leg member 2500.

The various structures of the invention will now be discussed in greater detail because it is important that the perspective of the synergistic and interdependent relationship of these elements be fully understood.

THE RIGID BASE 2100

The rigid base 2100 is an important element of the footwear device 2000 in that it provides the structure which ties the various elements together and ensures continuity and consistency of operation which is an object of the invention. The rigid base acts in combination with the other elements of the footwear device 2000.

SIDE AND REAR PERIPHERAL COUNTERS 2200 AND 2300

Side and rear peripheral counters are of two types, i.e. continuous counters and intermittent counters. Both types of counters are rigid structures rigidly mounted to rigid base 2100. It is an object of the invention that movement of the foot beyond the counters be prevented.

It is the object of the continuous counters that they remain in constant contact with the associated area of the foot in both bipedal and monopedal functions.

The principal useful function of the continuous peripheral counters is in efficiently transferring forces exerted by the foot of a user to rigid base 2100 and thereafter to the device affixed to the rigid base, in this particular example, a ski. In order for the user to enjoy maximum control of the ski, it is important that these forces be transferred as directly as possible and without delay. As previously stated, this is an object of the invention. It is also important that forces exerted by the ski on rigid base 2100 be transferred as directly as possible and without delay to the foot of the user so that appropriate muscle action can be accurately and quickly stimulated which would act to make corrections which influence the relative position of the joints in order to maintain the user's state of balance.

An equally important function of the continuous peripheral counters is that they act in concert with forefoot/midfoot pivotal support 2400 in locating, and maintaining the location of, the principal areas of force transfer of the foot relative to rigid base 2100. This function is extremely useful and important since the characteristics of the ski are dependent for consistent and accurate performance on the consistent application of forces relative to its center. The positioning of, and maintenance of the position of, the foot of a user is an object of the invention.

Hence, the construction of such counters should be of a rigid material and any surface treatment or covering employed for the counter surface adjacent the respective area of the foot should be of a material capable of readily transferring force with minimal loss due to compression. In some instances, for example, where displacement of a structure of the foot must occur parallel to the counter, the counter should be of a material which readily permits such movement while simultaneously preventing displacement of the foot towards the counter. An example of such material would be a dense, thin closed cell, nitrogen filled foam which is specifically designed to permit relative movement.

It is the object of the intermittent counters that they contact the associated area of the foot only during a specific function, for example, during a bipedal or a monopedal function. Since it is intended that these counters receive contact from a structure of the foot which is in motion, the use of materials or surface treatments of counter faces which permit a small degree of compression which can act to "cushion" shock from a momentary displacement beyond the envelope of a bipedal or a monopedal function is desirable. However, it is of the utmost importance that such materials, if employed, not interfere in any way with the displacements of the foot necessary to assume a bipedal or a monopedal stance.

Of great importance are the areas on the medial aspect of the foot situated between intermittent medial midfoot counter 2202 and continuous medial forefoot counter 2201 and between intermittent medial midfoot counter 2202 and intermittent medial hindfoot counter 2203 and continuous postero-medial heel counter 2303 which must remain free of any element(s) which would interfere with the displacements of the foot required for a monopedal function.

Of equal importance is the area on the lateral side of the foot situated between intermittent lateral hindfoot counter 2204 and the distal end of the lateral aspect of the foot which must remain free of any element(s) which would interfere with the displacements of the foot required for a bipedal or a monopedal function.

THE CONTINUOUS COUNTERS 2201, 2301, 2302 AND 2303

Figure 24:
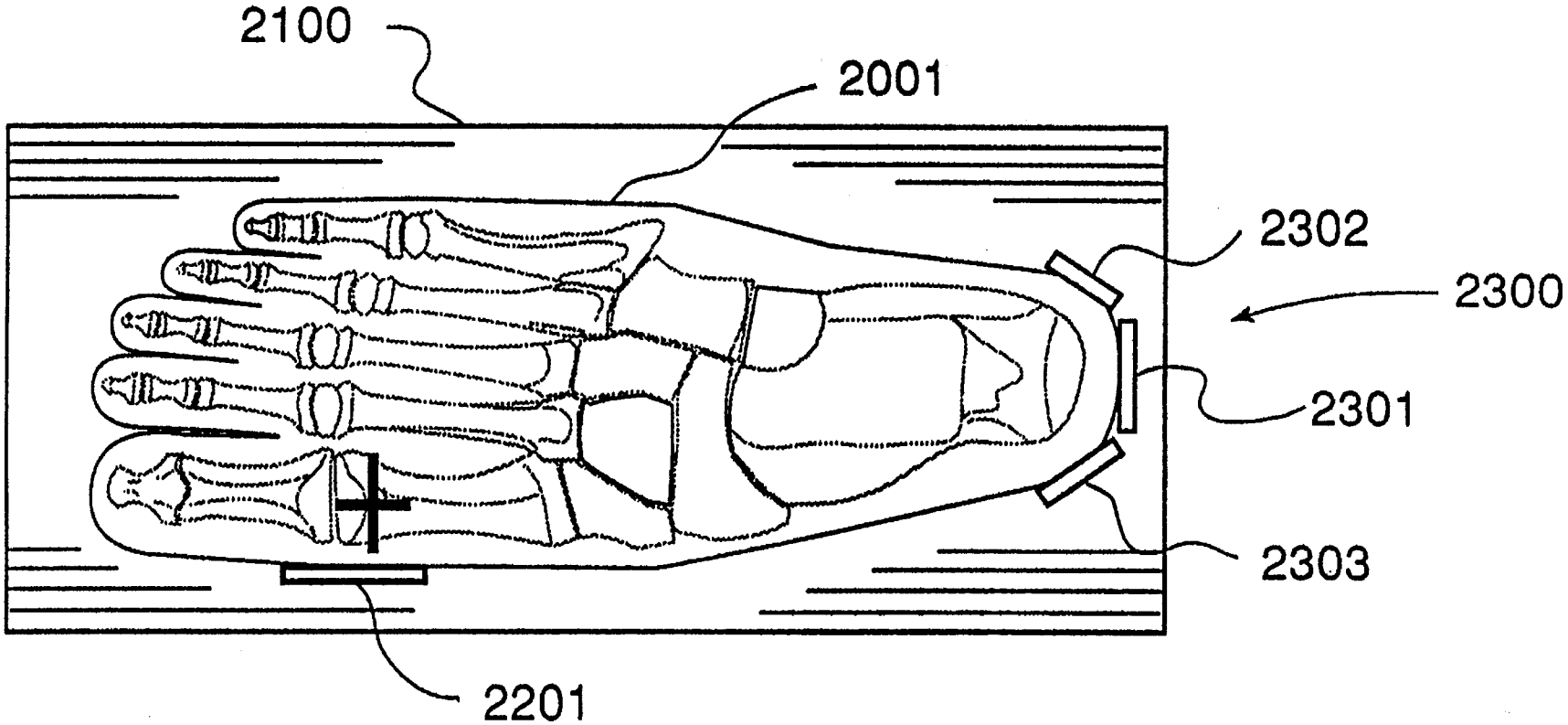
FIG. 24 is a plan view of a rigid base of a footwear device according to the invention with peripheral medial forefoot and heel counter elements mounted on the rigid base.

FIG. 24 is a plan view of the footwear device 2000 with the right foot 2001 of a user in a bipedal function, positioned on rigid base 2100 and showing the location of continuous medial forefoot counter 2201, continuous postero-medial oblique heel counter 2303, continuous postero-lateral oblique heel counter 2302 and continuous posterior heel counter 2301. It should be noted that, with the exception of rigid base 2100, other elements of the footwear device 2000 have been omitted in FIG. 24 for the sake of clarity.

Continuous medial forefoot counter 2201 and continuous postero-medial oblique heel counter 2303 are both continuous rigid medial side counters rigidly mounted to the medial aspect of rigid base 2100. Continuous postero-lateral oblique heel counter 2302 is a continuous rigid lateral counter mounted to the lateral aspect of the posterior end of rigid base 2100. Continuous posterior heel counter 2301 is a continuous rigid posterior counter rigidly mounted to the posterior aspect of rigid base 2100.

Continuous medial forefoot counter 2201 is positioned so as to be substantially medial to the medial aspect of the head of the first metatarsal when the user is in a bipedal or a monopedal stance.

When the user initiates the transition from a bipedal to a monopedal stance, the head of the first metatarsal advances towards the anterior end of rigid base 2100 (FIG. 22 B and 22 D). When the user initiates the transition from a monopedal to a bipedal stance, the head of the first metatarsal recedes towards the posterior end of rigid base 2100.

It is an object of the invention that these movements be permitted and accommodated. Thus, medial forefoot counter 2201 is positioned so as to be medial to the medial aspect of the head of the first metatarsal in a bipedal stance. The counter extends anteriorly at its anterior end so as to also provide for a medial face medial to the head of the first metatarsal in a monopedal stance. Thus, this extension of the counter acts to provide continuous contact in states between a bipedal and a monopedal function.

Figure 25:
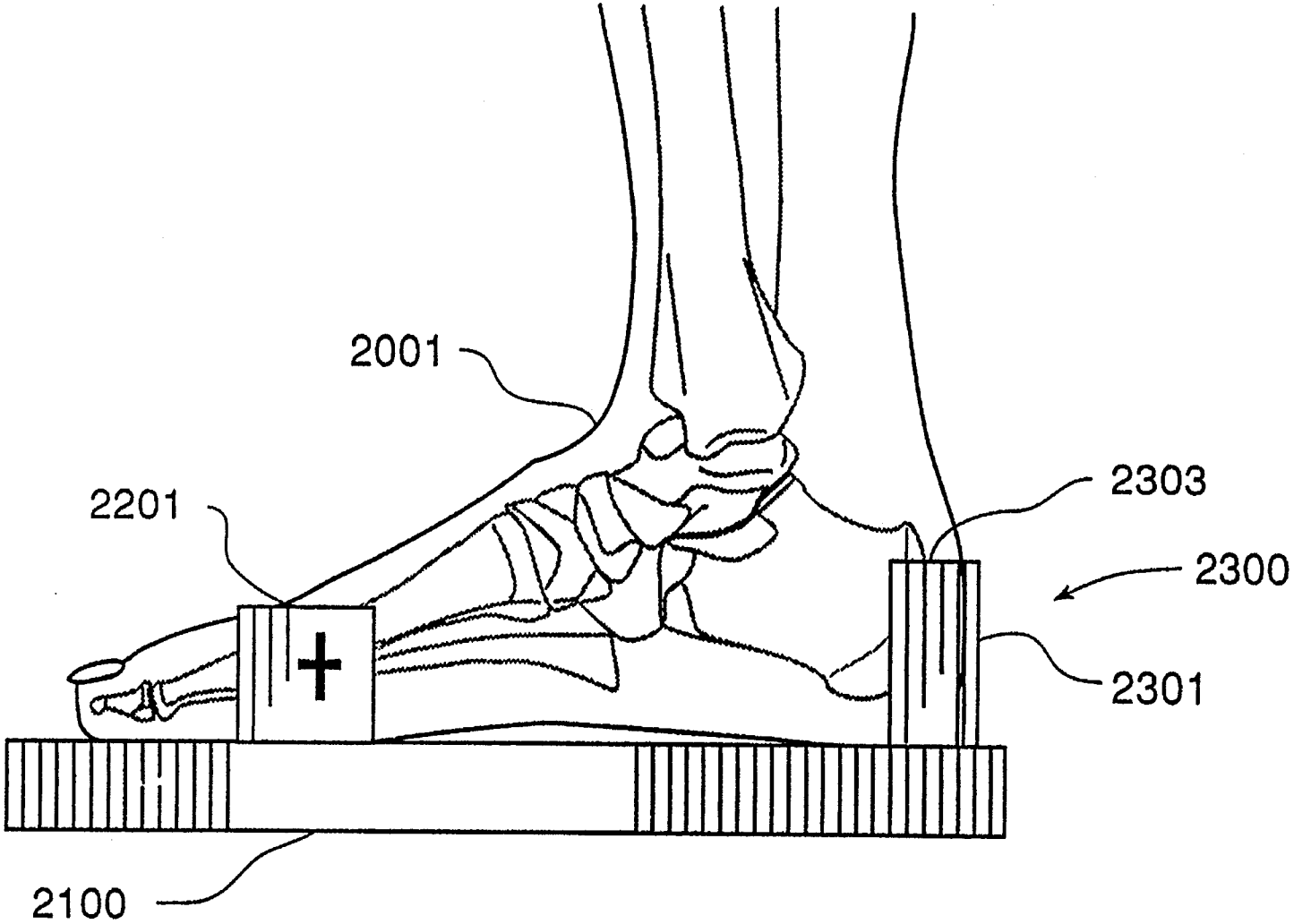
FIG. 25 is a medial elevation of the footwear device of FIG. 24 with the foot of a user in a bipedal function.

FIG. 25 illustrates a medial elevation of the footwear device 2000 with the right foot 2001 of a user positioned on rigid base 2100 and showing the position of continuous medial forefoot counter 2201 mounted to rigid base 2100 relative to the medial aspect of the head of the first metatarsal. The foot is illustrated in a bipedal stance. The approximate center of the medial aspect of the head of the first metatarsal is indicated by a cross.

Figure 26:
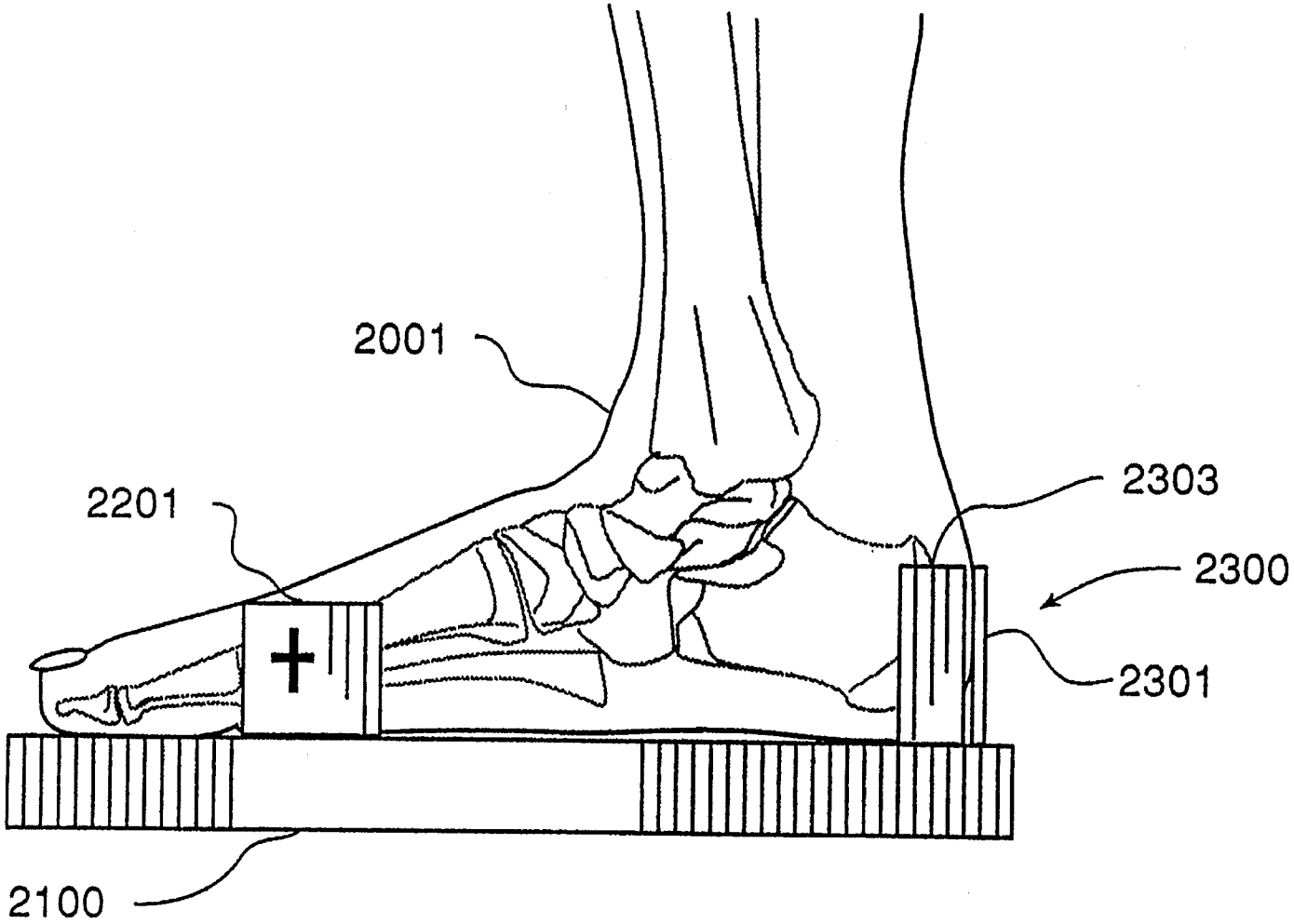
FIG. 26 is a medial elevation of the footwear device of FIG. 24 with the foot of a user in a monopedal function.

FIG. 26 illustrates the position of continuous medial forefoot counter 2201 mounted to rigid base 2100 relative to the medial aspect of the head of the first metatarsal with the foot in a monopedal stance. The approximate center of the medial aspect of the head of the first metatarsal is indicated by a cross. Of great importance is the relative anterior movement of the head of the first metatarsal bone which has occurred in comparison to the position of the medial aspect of the head of the first metatarsal as seen in FIG. 25 and which occurs in conjunction with compression of the arch. It is an object of the invention that both of the changes in the architecture of the foot described above be permitted and accommodated by the footwear device 2000.

It should be noted that, with the exception of rigid base 2100, other elements of the footwear device 2000 have been omitted in FIGS. 25 and 26 for the sake of clarity.

Medial forefoot counter 2201, has several useful functions. First, it acts to prevent medial displacement of the foot such as would occur when an internally directed rotational force is exerted about a center posterior to the head of the first metatarsal which would tend to rotate it medially.

Second it provides a vertical resistance which acts to limit inward rolling of the foot beyond the degree of pronation required for monopedal function. Third, the counter acts to provide resistance for muscles which function to counter horizontal loads exerted in the medial horizontal plane by the medial aspect of the first metatarsal in other than bipedal stance. When the skier is in monopedal stance or in the transition to a monopedal stance from a bipedal stance, an angular relationship of the leg is formed with the footwear device 2000 such that the force exerted by the leg on rigid base 2100 results in a horizontal force being exerted towards the medial counter in addition to the vertical force exerted against rigid base 2100. FIG. 23 illustrates this angular relationship. Medial forefoot counter 2201 acts to resist this horizontal force while simultaneously providing a source of resistance with which to oppose the reaction force exerted horizontally by muscles which act to establish balance.

A fourth and extremely important function of medial forefoot counter 2201 is that it establishes and maintains the medial position of the center of the plantar aspect of the head of the first metatarsal relative to the longitudinal axis of the ski which is essential for effecting control of edge mechanics. The center of the plantar aspect of the head of the first metatarsal is the principal mechanical point of the foot responsible for such control. Therefore, correct placement, and control of the movement of, the center of the plantar aspect of the head of the first metatarsal is a critical factor in obtaining maximum performance from the ski.

Continuous rigid posterior heel counter 2301, illustrated in FIGS. 24, 25, 26 and 27, is rigidly connected to rigid base 2100 posterior to the posterior aspect of the heel of a user. The main useful function of posterior heel counter 2301 is that it acts to prevent rearward movement of the foot at the heel such as would occur when a rearwardly directed force is exerted against the counter by the posterior aspect of the heel of the foot of a user.

Continuous rigid postero-medial oblique heel counter 2303 illustrated in FIGS. 24, 25 and 26 is rigidly connected to rigid base 2100 postero-medially to the oblique postero-medial aspect of the heel of a user. The main useful function of continuous postero-medial oblique heel counter 2303 is that it acts to prevent medial displacement of the heel of a user such as would occur when an externally directed rotational force is exerted on the foot about a center anterior to the heel.

Figure 27:
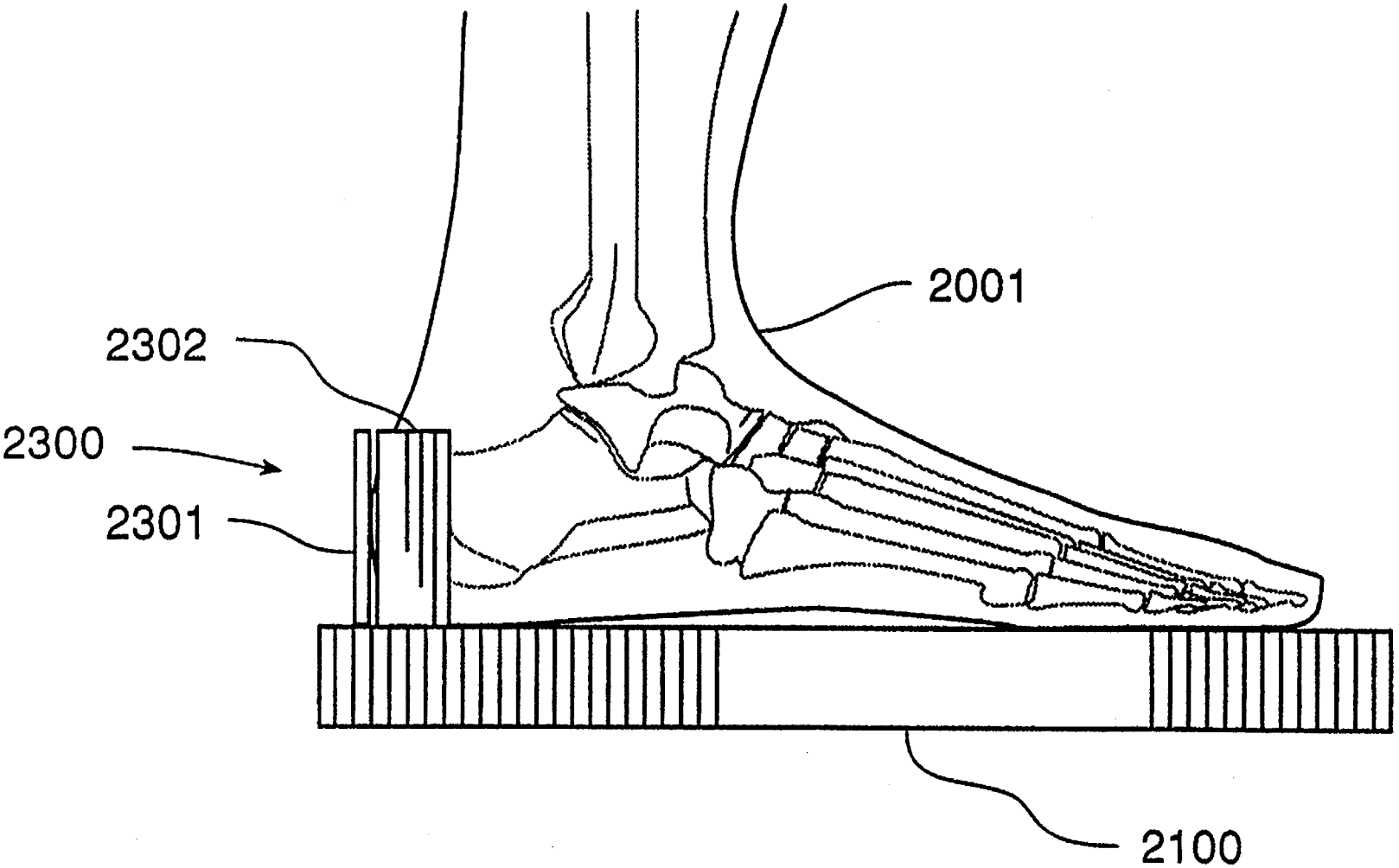
FIG. 27 is a lateral elevation of the footwear device of FIG. 24.

Continuous rigid postero-lateral oblique heel counter 2302 illustrated in FIGS. 24 and 27 is rigidly connected to rigid base 2100 postero-laterally to the oblique postero-lateral aspect of the heel bone of the user. The main useful function of continuous postero-lateral oblique heel counter 2302 is that it acts to prevent lateral displacement of the heel of a user such as would occur when an internally directed rotational force is exerted on the foot about a center anterior to the heel. It should be noted that postero-lateral oblique heel counter 2302 is the sole continuous peripheral counter mounted on the lateral aspect of rigid base 2100.

Collectively, posterior heel counter 2301, postero-lateral oblique heel counter 2302 and postero-medial heel oblique counter 2303 function to establish and maintain the position of the heel of a user relative to rigid base 2100. This function is an object of the invention and is important in that these counters assist to position, and fix the position of, the foot relative to center of the ski which is a critical factor in obtaining maximum performance.

THE INTERMITTENT COUNTERS 2202, 2203, 2204 AND 2205

Figure 28:
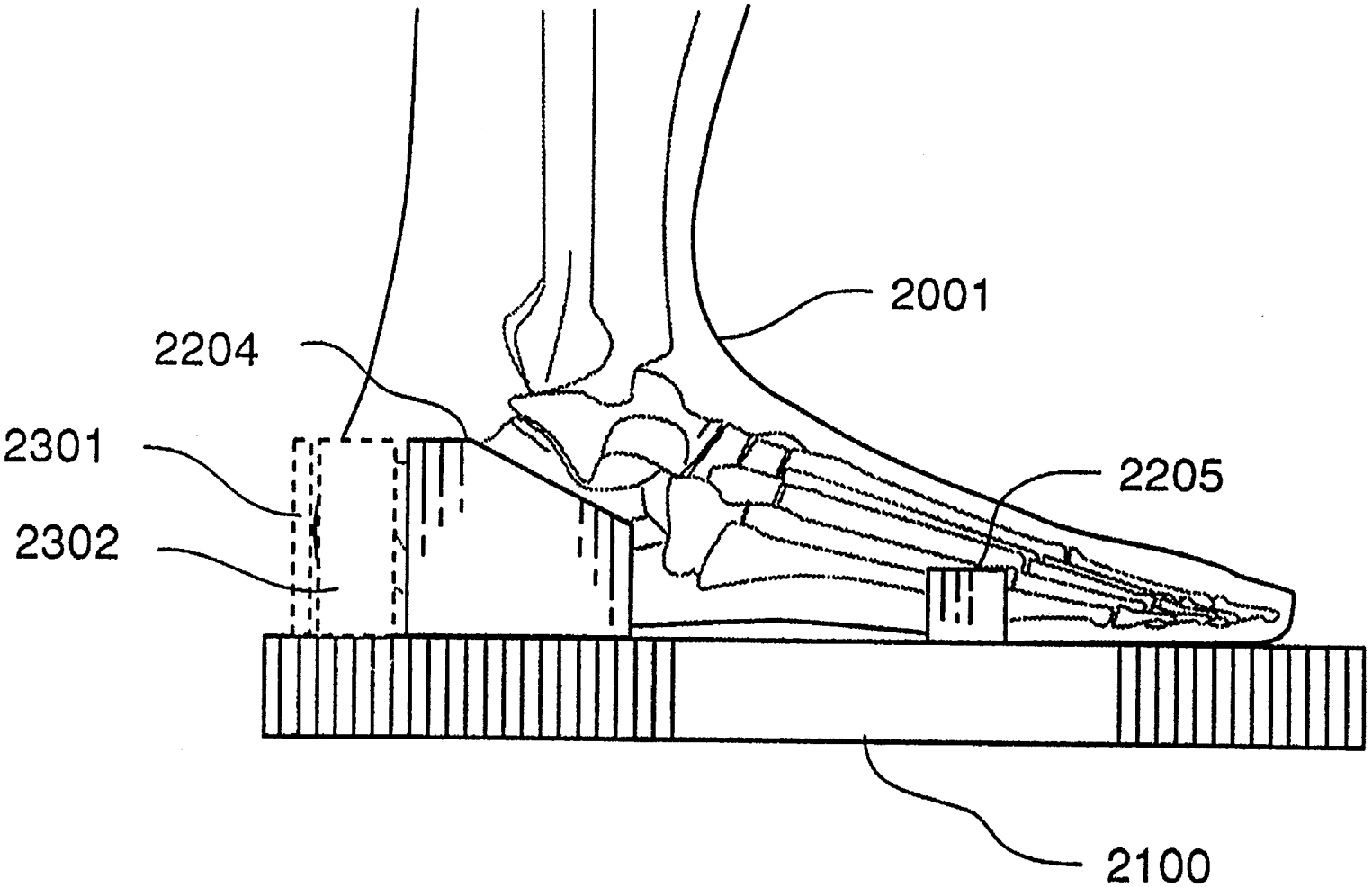
FIG. 28 is a lateral elevation of the footwear device of FIG. 24 with additional lateral forefoot and lateral hindfoot counter elements mounted on the rigid base.

FIG. 28 illustrates intermittent rigid lateral forefoot counter 2205 which is rigidly connected to rigid base 2100 lateral to the lateral aspect of the head of the fifth metatarsal so as to contact the foot of a user in a monopedal stance.

FIG. 22 B illustrates a plan view of the right foot in a bipedal stance without rigid base 2100. FIG. 22 D illustrates a plan view of the right foot in a monopedal stance without rigid base 2100. Reference lines R1 and R2 serve to gauge the relative displacements of various structures of the foot. In FIGS. 22 B and D, a cross indicates the center of the medial aspect of the head of the first metatarsal. It is especially important to note the lateral displacement which occurs at the heads of the second through fifth metatarsals and their associated phalanges. It is an object of the invention that this lateral displacement be permitted and accommodated.

Structures of forefoot/midfoot pivotal support 2400 minimize the role of intermittent rigid lateral forefoot counter 2205 such that it can be eliminated from the footwear device 2000 without adverse effect. However, if lateral forefoot counter 2205 is mounted to rigid base 2100, care should be taken to ensure that it is located so as to contact the lateral aspect of the head of the fifth metatarsal only when the foot of the user is in a monopedal stance with the full anticipated weight of the user, including all additional loads imposed during the activity, applied to rigid base 2100 such that the width between the lateral face of continuous medial forefoot counter 2201 and the medial face of intermittent lateral forefoot counter 2205 is equal to or greater than the maximum distance between the medial aspect of the head of the first metatarsal and the lateral aspect of the head of the fifth metatarsal.

The useful function of intermittent lateral forefoot counter 2205 is in preventing lateral displacement of the forefoot in a monopedal stance. When in contact with the lateral aspect of the head of the fifth metatarsal, intermittent lateral forefoot counter 2205 acts to assist forefoot/midfoot pivotal support 2400 in preventing lateral displacement of the foot such as would occur when an externally directed rotational force, about a center posterior to it, is exerted against the counter by the foot of a user.

Figure 29:
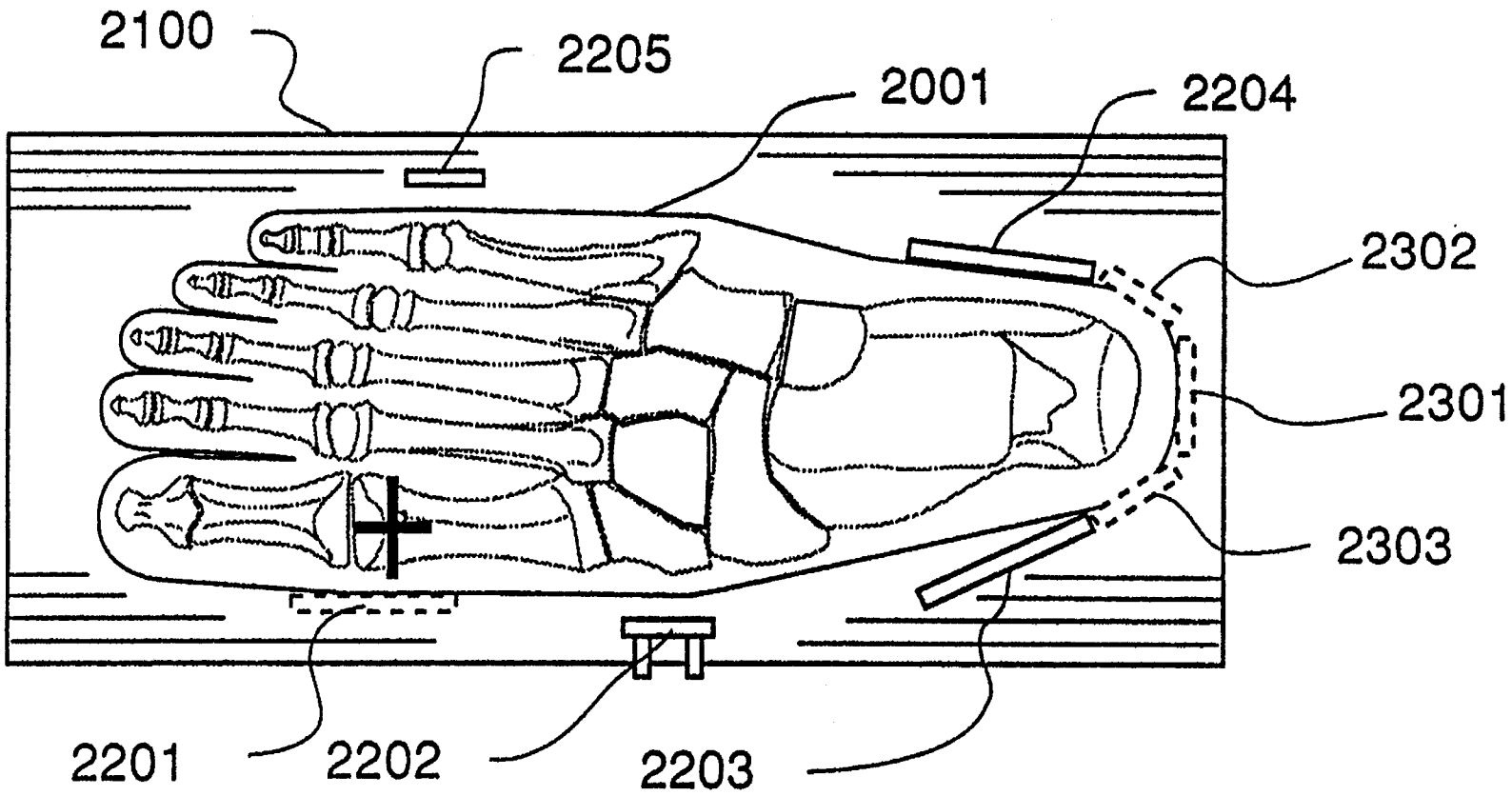
FIG. 29 is a plan view of the rigid base of the footwear device of FIG. 28 with an additional counter element shown and with the foot of a user in a bipedal stance.

FIGS. 28 and 29 illustrate intermittent rigid lateral hindfoot counter 2204 which is rigidly attached to rigid base 2100 lateral to the lateral aspect of the heel bone of a user. It is intended that this counter fully contact the lateral aspect of the heel of a user only in a bipedal stance. Note that FIG. 29 illustrates the foot of a user in a bipedal stance with rigid lateral hindfoot counter 2204 in full contact with the lateral aspect of the heel of a user. Of utmost importance is that intermittent rigid medial counter 2203, with the exception of its posterior end, is not in contact with the medial aspect of the heel in a bipedal stance.

Figure 30:
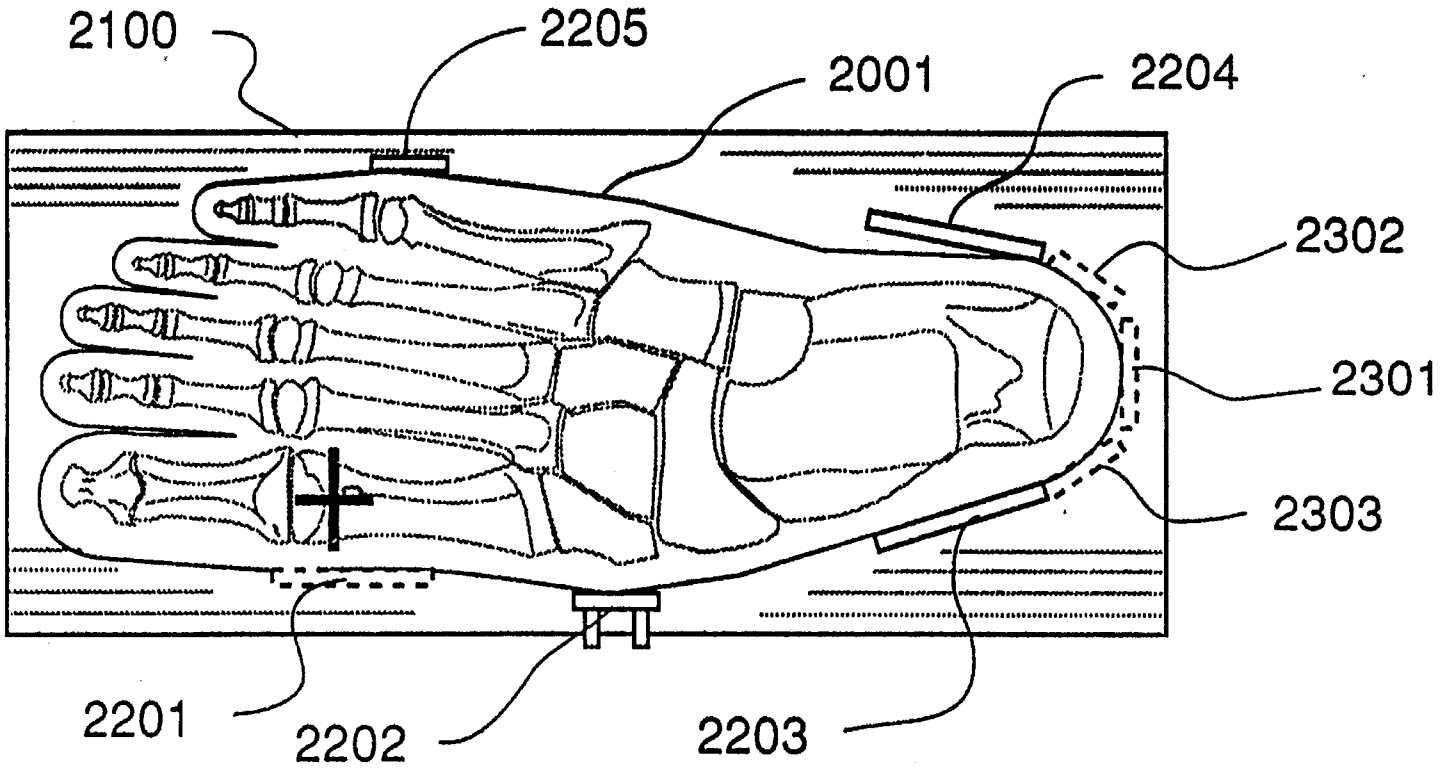
FIG. 30 is a plan view of the footwear device of FIG. 29 but with the foot of a user in a monopedal stance.
Figure 31:
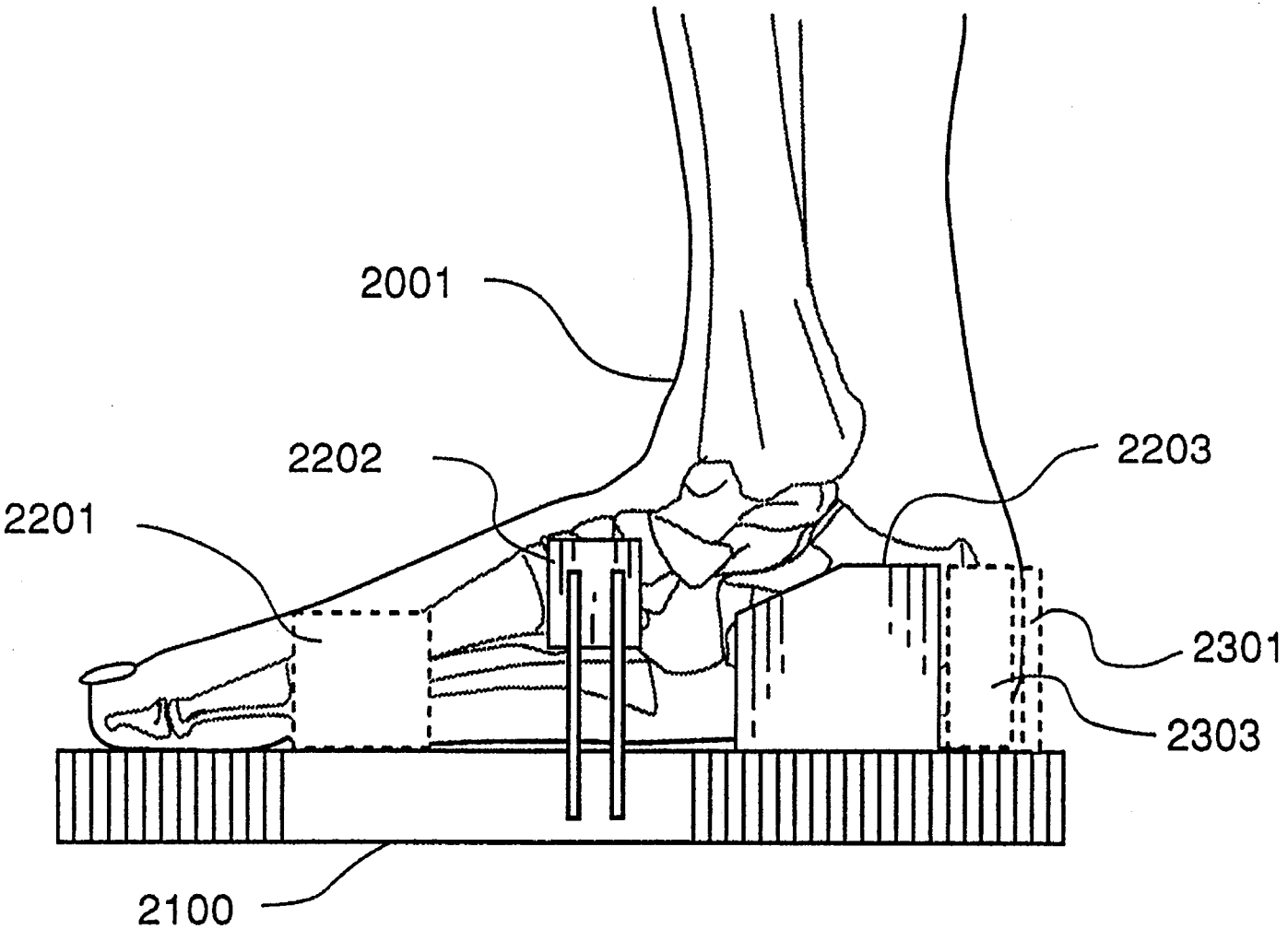
FIG. 31 is a medial elevation of the footwear device of FIG. 29.

FIG. 30 illustrates the foot of a user in a monopedal stance. Of utmost importance is that intermittent rigid lateral hindfoot counter 2204, with the exception of its posterior end, is not in contact with the lateral aspect of the heel while rigid medial hindfoot counter 2203 is in full contact with the medial aspect of the heel of a user. Thus, it is intended that only one of the intermittent medial or lateral rigid hindfoot counters 2203 or 2204 be in full contact with their respective aspects of the heel of a user at any one time. It is also intended that, during states between a bipedal and a monopedal stance, there will be simultaneous partial contact with the heel of a user with both the lateral and medial intermittent rigid hindfoot counters 2204 and 2203 but without full contact with the heel of a user with either of the two counters.

The hindfoot intermittent side counters have several useful functions. First, both intermittent lateral hindfoot counter 2204 and the intermittent medial hindfoot counter 2203 act to define the limits of movement required for the foot of a user to assume the architectural configuration required for either a bipedal or a monopedal function.

In the transition from a monopedal stance to a bipedal stance, it is desirable that the changes in the architecture of the foot be arrested when the architecture associated with a bipedal function is achieved and that the foot not be permitted to supinate substantially beyond this point. In this respect, lateral hindfoot intermittent counter 2204 cooperates with forefoot/midfoot pivotal support 2400 to substantially prevent changes in the architecture of the foot beyond that associated with a bipedal function. Intermittent lateral hindfoot counter 2204 also cooperates with forefoot/midfoot pivotal support 2400 in preventing lateral displacement of the foot, relative to rigid base 2100, such as would occur when a force is exerted on the foot of a user which would tend to cause the foot to move laterally.

Intermittent medial hindfoot counter 2203 acts similarly to lateral hindfoot intermittent counter 2204 in that it cooperates with forefoot/midfoot pivotal support 2400 and forefoot continuous counter 2201 and intermittent midfoot counter 2202 in substantially preventing changes in the architecture of the foot of a user from exceeding the limits associated with that of a monopedal stance when these changes are occurring in the direction of progressive pronation of the foot. Medial hindfoot intermittent counter 2203 provides a vertical resistance which acts to prevent inward rolling of the foot beyond the degree of pronation required for a monopedal stance.

This function is especially important since, in the transition to a monopedal stance from a bipedal stance, a progressively angular relationship is established between the leg of a user and rigid base 2100 such that a horizontal component of force acting medially is exerted by the leg in addition to the vertical force exerted against rigid base 2100 in a bipedal stance.

Thus, it is important that midfoot intermittent counter 2202 and hindfoot intermittent medial counter 2203 be positioned at the limit of medial displacement of structures of the foot associated with a monopedal stance, so they may act to arrest momentary displacement beyond these limits and thus assist the user in establishing a position of monopedal stance without delay.

Intermittent medial hindfoot counter 2203 cooperates with continuous forefoot counter 2201 in preventing medial displacement of the foot of a user such as would occur when a force is exerted which would tend to cause the foot to be displaced medially relative to rigid base 2100.

Medial hindfoot intermittent counter 2303 also cooperates with continuous forefoot counter 2201 in providing a vertical resistance for muscles which function to counter horizontal loads exerted in the medial horizontal plane in other than a bipedal stance. When the skier is in the transition to a monopedal stance from a bipedal stance, an angular relation of the leg is formed with the footwear device 2000 such that the force exerted by the leg on rigid base 2100 results in a horizontal force being exerted towards the intermittent medial hindfoot counter in addition to the vertical force exerted against rigid base 2100. Medial intermittent hindfoot counter 2203 acts to resist this horizontal force while simultaneously providing a source of resistance with which to oppose the reaction force exerted horizontally by muscles which act to establish balance to a user. FIGS. 23 A and 23 B illustrate this relationship.

FIGS. 21 and 30 illustrate intermittent rigid medial midfoot counter 2202 which is rigidly mounted to rigid base 2100 substantially medial to the medial aspect of the first cuneiform of the midfoot of a user. The means by which this rigid counter element is rigidly attached to rigid base 2100 is important in that contact with the foot must be effected only in the area substantially medial to the medial aspect of the first cuneiform. Contact must not occur at other areas of the medial aspect of the foot between intermittent medial midfoot counter 2202 and continuous forefoot medial counter 2201 and medial midfoot counter 2202, intermittent medial hindfoot counter 2203 and continuous medial heel counter 2303 which would interfere with a monopedal function.

Intermittent medial midfoot counter 2202 has two useful functions. It contacts the medial aspect of the first cuneiform bone of a user only when the limit of medial displacement of the first cuneiform is reached associated with a monopedal function. Thus it serves to help define the limit of medial displacement of the architecture of the foot associated with monopedal function.

In a transitory state where the referenced foot is between a bipedal and a monopedal function, medial displacement of the first cuneiform bone may occur when an internally directed rotational force is exerted by the foot of the user against continuous medial forefoot counter 2201 and continuous lateral heel counter 2302. Since the full structural integrity of the foot associated with a monopedal function has not yet been achieved, the internally directed rotational force may cause the bones of the midfoot of the user to be displaced medially. In such an instance, intermittent rigid medial counter 2202 will act to prevent medial displacement beyond the limit of monopedal function and, in so doing, act to assist continuous medial counter 2201 in transferring the internally directed rotational force to rigid base 2100.

THE FOREFOOT/MIDFOOT COMPRESSION MEMBER 2400

Figure 32:
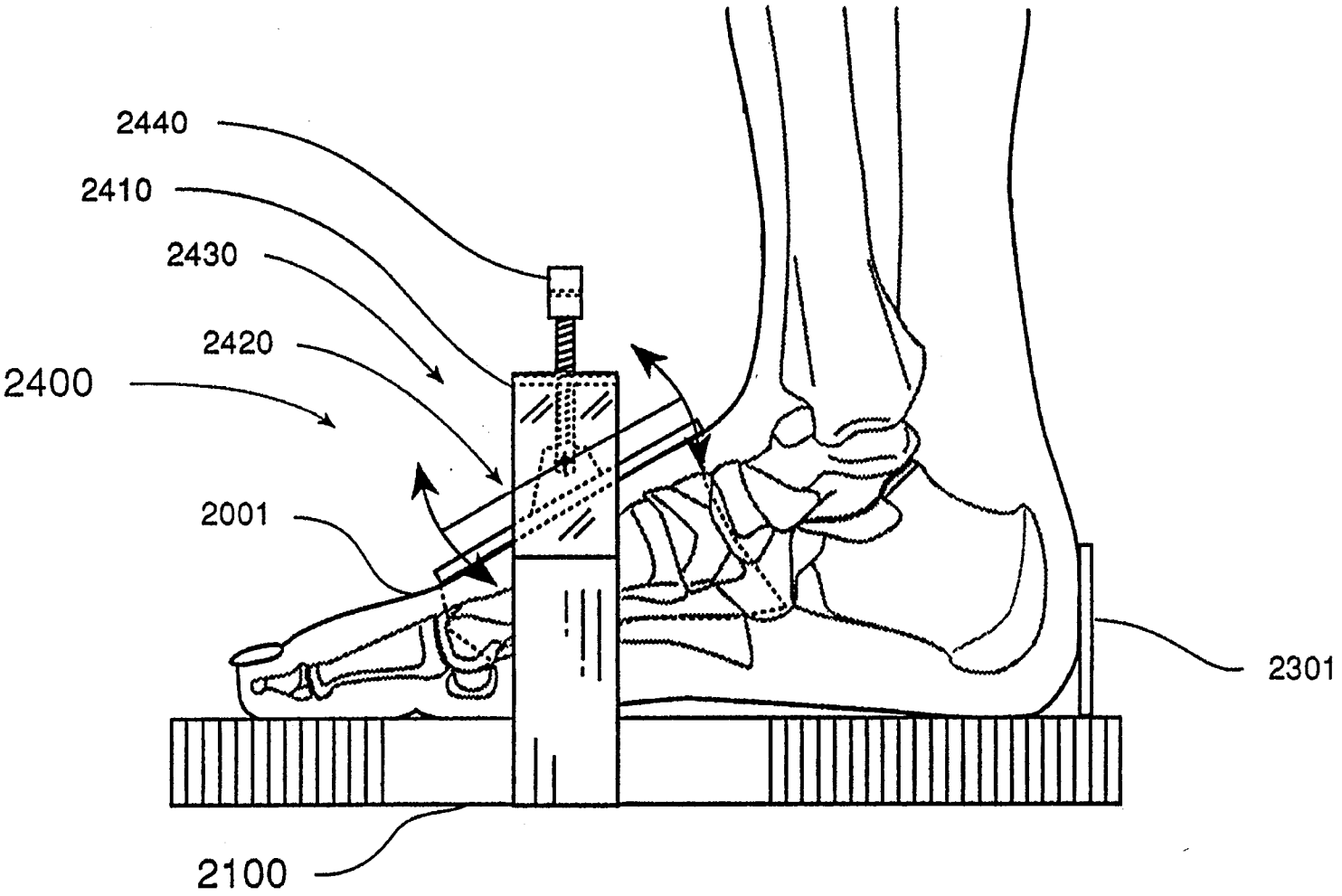
FIG. 32 is a medial elevation of a footwear device according to the invention having a rigid base with a midfoot/forefoot compression member and a heel counter mounted on the rigid base.

FIGS. 20 and 21 illustrate the forefoot/midfoot compression member or forefoot/midfoot pivotal support member, generally shown at 2400, in relation to other elements of the footwear device 2000. FIG. 32 illustrates a medial elevation of footwear device 2000 illustrating forefoot/midfoot pivotal support 2400, which comprises rigid arch 2410, instep counter 2420, instep counter pivot 2430 and rod 2440. The right foot 2001 of a user is shown for reference. Other elements of the invention, with the exception of rigid base 2100 and posterior heel counter 2301, have been omitted for the sake of clarity in FIG. 32.

Figure 33:
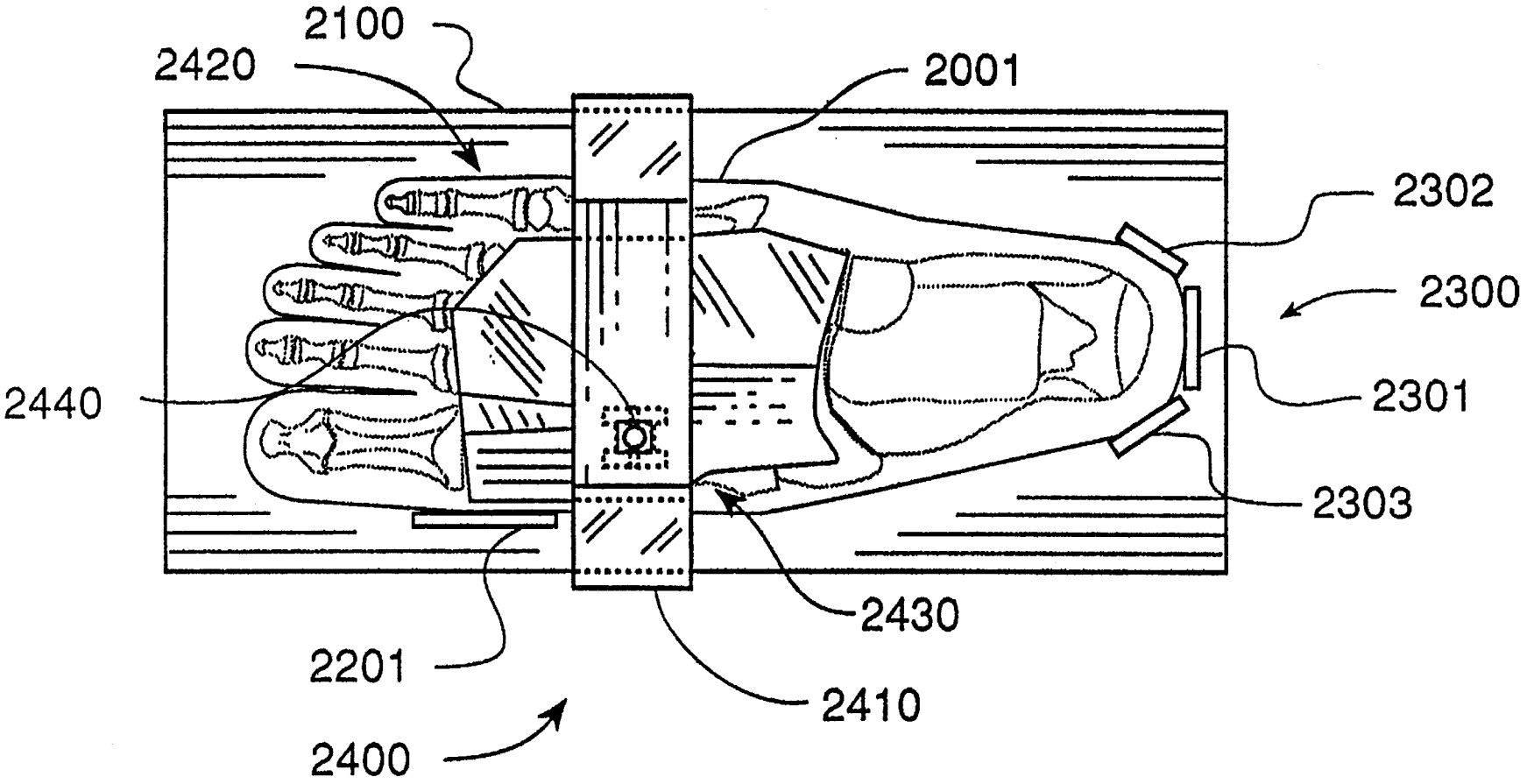
FIG. 33 is a plan view of the footwear device of FIG. 32 but additionally with continuous peripheral counter elements mounted on the rigid base.

FIG. 33 illustrates the footwear device 2000 in a plan view illustrating forefoot/midfoot pivotal support member 2400 comprising rigid arch 2410, instep counter 2420, instep counter pivot 2430 and rod 2440. With the exception of heel counter 2300, medial forefoot counter 2201 and rigid base 2100, other elements of the footwear device 2000 have been omitted for the sake of clarity.

FIG. 34 illustrates the footwear device 2000 in a front elevation illustrating forefoot/midfoot pivotal support 2400. With the exception of rigid base 2100, other elements of the invention have been omitted for the sake of clarity. Attention is drawn to the clearance between the arch 2410 of forefoot/midfoot pivotal support 2400 and the foot of a user which ensures that there will be no contact between these two entities during normal operation of the footwear device 2000. This is an object of the invention which is essential for its correct operation.

In this embodiment, forefoot/midfoot pivotal support 2400 comprises instep counter 2420, pivotably connected to rod 2440 by a pivot means generally shown at 2430. Pivot mounts 2431 and 2432 are connected to instep counter 2420. Connector link 2434 has a pilot hole substantially the same diameter as the rod 2440. A larger diameter hole is bored from the bottom of connector link 2434 so as to form a seat for the lower end of rod 2440. The threaded end of rod 2440 is inserted through a hole in the lower end of connector link 2434 so that the lower end of rod 2440, which is larger in diameter than the remainder of the rod 2440, seats itself on the face of the larger diameter hole in connector link 2434. Lock nut 2435 is threaded down from the top of rod 2440 so that it contacts the top of connector link 2434 and, when tightened, draws the larger diameter end of rod 2440 onto the seat in connector link 2435 and, in so doing, locks and secures rod 2440 to connector link 2434. This prevents rotation between the two elements. Pivot axis pin 2433 is inserted through the holes in pivot mount 2431, connector link 2434 and pivot mount 2432 such that instep counter 2420 is connected to, and rotatable relative to, rod 2440, about a horizontal axis.

Figure 35:
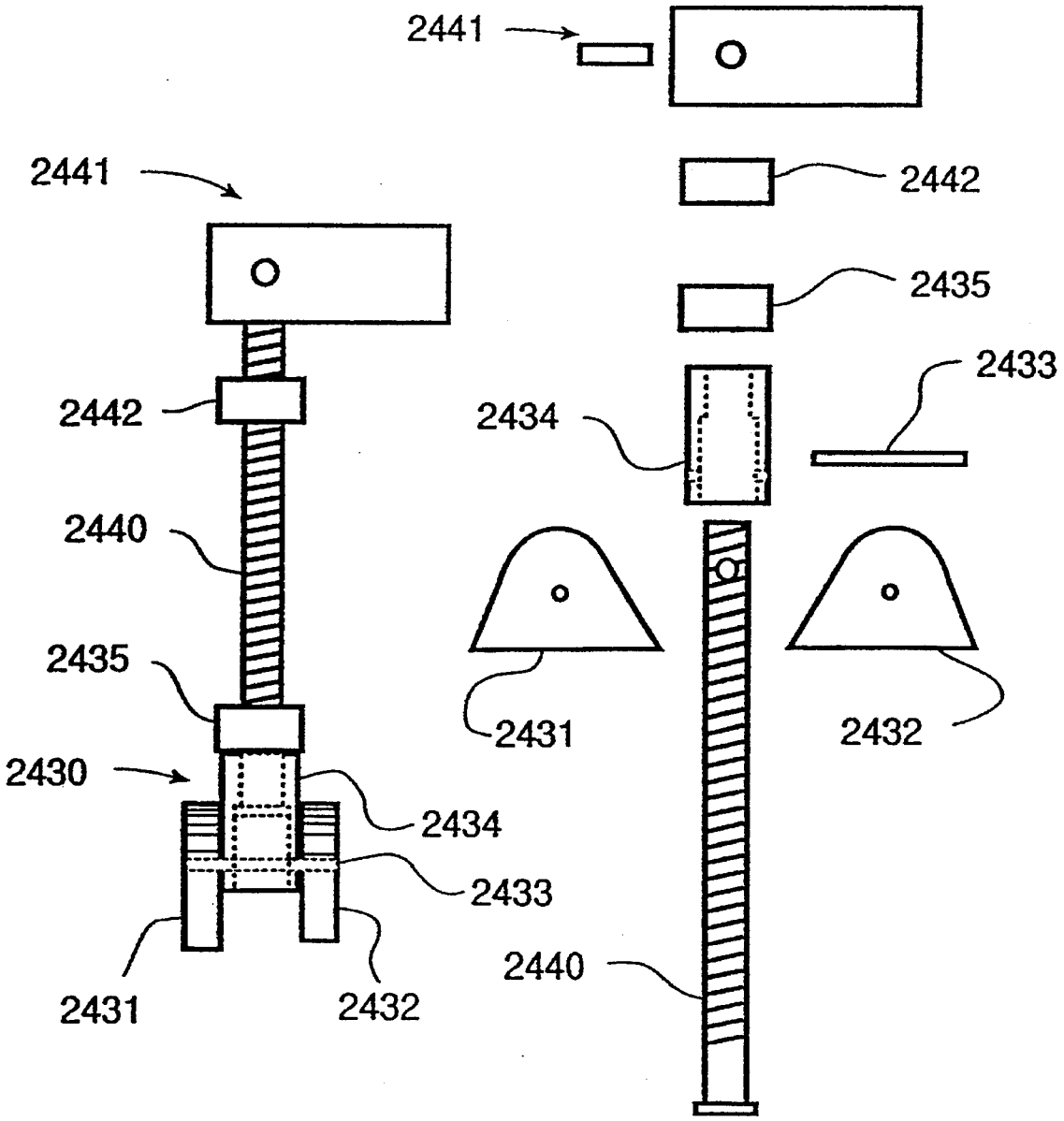
FIG. 35 illustrates the elements of an instep counter pivot and rod assembly of a footwear device according to the invention.

FIG. 35 illustrates an enlarged view of pivot 2430, rod 2440 and the associated elements which connect it to instep counter 2420.

To facilitate assembly, rod 2440 is threaded, and inserts into, a threaded hole in arch 2410 such that rotation of rod 2440 by handle assembly 2441 allows instep counter 2420 to be raised or lowered relative to rigid base 2100. Once the correct adjustment has been effected, lock nut 2442 is tightened so as to rigidly secure, and fix the position of, rod 2440 to arch 2410.

Lock nut 2435 is similarly tensioned so as to fix the position of, and rigidly connect, rod 2440 to connector link 2434. Pivot axis pin 2433 should be of a close tolerance fit to pivot mount 2431, connector link 2434 and pivot mount 2432 such that a substantially rigid connection is made to instep counter 2420 while allowing for free rotation about pivot axis pin 2433.

As a prelude to adjusting the height of instep counter 2420, lock nut 2435 should be slackened so as to allow rotation of the lower end of rod 2440 within connector link 2434. Rod 2440 can then be rotated so as to bring a downwardly and rearwardly force to bear on the dorsum of the foot of a user without instep counter 2420 rotating. Prior to final tensioning of lock nuts 2435 and 2442, instep counter 2420 should be adjusted so that the counter surfaces are correctly aligned with the respective areas of the dorsum of the user's foot.

Lock nuts 2435 and 2442 can then be tensioned so as to make rigid the connection of rod 2440 to arch 2410 and to connector link 2434. This done, the only articulation possible between rigid arch 2410 and instep counter 2420 is about the pivot axis 2433.

Materials employed for the construction of the various elements of forefoot/midfoot pivotal support 2400 should be of a sturdy and rigid nature which guarantee predictable and consistent performance so that the object of the invention which is to permit, accommodate, control and enhance specific functions of the foot and leg can be obtained. Materials and/or surface treatments employed to cover the side of the instep counter 2420 which interfaces with the dorsum of the foot of a user should be of a firm, dense foam, for example, which allows some degree of compression and is adaptive in nature but which has substantially one hundred percent recovery. Other materials or methods may be suitable provided the characteristics are as described. The surface of the material which addresses the dorsum of the foot should be of a low friction nature since there will be some slight relative movement between the foot 2001 and instep counter 2420.

The location and operation of certain elements is also important for the correct functioning of the invention. For example, the apex of the longitudinal arch of the foot of the user is located substantially in the area of the talo-navicular joint. When the head of the first metatarsal advances and recedes longitudinally on rigid base 2100, as it must when the user goes from a bipedal to a monopedal stance and vice-versa, instep counter 2420 must pivot in unison with this movement on its transverse axis so that its anterior end rises and falls in height above rigid base 2100 with the advancing and receding of the head of the first metatarsal. Similarly, the posterior end of instep counter 2420 must rise and fall with the decompression and compression of the arch. Should instep counter 2420 not accommodate the dynamic nature of the arch of the foot, the transition to a monopedal or a bipedal stance could be prevented or delayed. Thus, an object of the invention is that instep counter 2420 permit the changes in the architecture of the foot, described above, to occur substantially without interference or delay.

Since the axis of the center of movement of the aforementioned displacements of the architecture of the foot is the not the mean distance between the base and the head of the first metatarsal but, rather, substantially the mean distance between the head of the first metatarsal and the talo-navicular joint, pivot 2430 mounted on instep counter 2420 must be positioned closer to the base of the first metatarsal so that it will follow, as closely as possible, its sagittal plane movements. Thus, the correct location of pivot 2430 of instep counter 2420 is important for the correct operation of the invention.

Experience to date has shown that it may be desirable that pivot 2430 be positioned so as to be slightly biased towards the posterior end of the distance from the head of the first metatarsal to the talo-navicular joint since biasing the forces exerted on the dorsum of the foot by forefoot/midfoot pivotal support 2400 in this manner appears to afford the most favourable arrangement in terms of maintaining the head of the first metatarsal in constant contact with rigid base 2100 and the posterior aspect of the heel of the user in constant contact with continuous posterior heel counter 2301. However, other arrangements are not precluded and experimentation, bearing in mind the objects of the invention, may result in a configuration superior to the one described above.

Medial displacement of the base of the first metatarsal is another aspect of the displacement of the structures in the area of the midfoot which the footwear device 2000 must accommodate. FIG. 22D illustrates the infero-medial displacement of the first metatarsal which occurs only at its base. There are several alternate ways in which this infero-medial displacement is accommodated by the invention.

It is important to know that it is a weight bearing state in which the foot of a user is progressively pronating towards a monopedal function. Pronation produces infero-medial displacement of the midfoot. Thus, the tendency is for the force exerted by instep counter 2420 on the dorsum of the midfoot to be reduced during pronation, particularly in the area of the base of the first metatarsal since this area is also displacing infero-medially, away from instep counter 2420. Instep counter 2420 is simultaneously being levered upward around its axis at pivot 2430 by the head of the first metatarsal which is advancing anteriorly.

Attention should also be directed to the tendons on the dorsum of the foot, particularly the tendon of the tibialis anterior muscle. This tendon lies along the antero-laterial aspect of the tibia at its inferior end and is prominent at the supero-medial aspect of the first cuneiform. Thus, care should be taken to ensure that instep counter 2420 does not adversely impinge on this tendon or on other smaller tendons which radiate up the anterior aspect of the lower leg. In order to guard against such impingement, it is important that instep counter 2420 be suitably shaped at its posterior end and a covering material employed which provides protection for tendons it may come in contact with.

Forefoot/midfoot pivotal support 2400 has several useful functions which relate to the action of instep counter 2420 on the dorsum of the foot. Before these functions can be appreciated, a basic understanding of the shape and function of the foot is necessary.

The base of the first metatarsal is a key element whose ability to articulate in specific planes, in concert with the structures of the midfoot, largely determines the function of the foot as it relates to a bipedal and monopedal function. The dorsum of the first metatarsal defines the center of the substantially longitudinal ridge of the forefoot, dividing it into lateral and medial halves. Control of the displacements of the first metatarsal, particularly at its articulation with the midfoot, is an important object of the invention.

The description above with reference to FIG. 23 describes the movements and displacements of the foot and leg which the invention permits and accommodates. Forefoot/midfoot pivotal support 2400, particularly instep counter 2420, must permit these displacements to occur while simultaneously maintaining its influence, as it pertains to a rearwardly and downwardly acting force, on the dorsums of the first metatarsal and midfoot.

It should also be appreciated that bipedal and monopedal functions are weight bearing states requiring that the user exert a force with the key points of the plantar aspect of the foot on rigid base 2100 in order to attain the physiologic state, namely; the heel, the head of the first metatarsal and the head of the fifth metatarsal. The phalanges (toes) also play a role in exerting a downward force on rigid base 2100. Among other things, forefoot/midfoot pivotal support 2400 must act to assist the user in achieving a monopedal or a bipedal function by controlling movement of the foot in a manner which defines the limits of the two functional states.

By limiting the attitude of the foot to the configurations associated with these two states, the foot is prevented from assuming configurations detrimental to the mechanics of ski control. At the same time, control of the movements and position of the foot ensures that the sequence of events involved in the transition between states of bipedal and monopedal function becomes repetitive in nature. Repetition of patterns is the way new skills are learned. It has been demonstrated scientifically that patterns of movement which are repeated frequently are assimilated by the neurological system of the user. The invention, which encourages consistent movements, affords a function which is advantageous to the user.

The invention does not directly produce the physiology associated with a bipedal or a monopedal function since these are a product of, and are dependent on, the user. The invention acts in accommodating these functions and in providing elements which make them possible and enhances their physiologic function once the basic states have been attained. Thus, the function and object of the invention relates to its accommodation, enhancement and support of the physiologic function of the user.

The principal use of forefoot/midfoot pivotal support 2400 is in first locating, and constantly maintaining the position of, the posterior aspect of the heel of a user in firm contact with the anterior face of posterior heel counter 2301. Thus, heel counter 2300, particularly posterior heel counter 2301, cooperates with, and is a key element on which forefoot/midfoot pivotal support 2400 is dependent for its correct operation.

The second useful function of forefoot/midfoot pivotal support 2400 relates to its control of the displacements and movement of the foot. Once adjusted to the foot of a user in a bipedal stance, forefoot/midfoot pivotal support 2400 substantially contains the architecture of the foot between the limits of a bipedal and a monopedal function; both of which are weight bearing states. Thus, forces exerted on the user which would tend to cause the foot to move upward, away from rigid base 2100, are prevented if forefoot/midfoot pivotal support 2400 has been correctly adjusted. This being the case, the foot can only substantially assume the position of either a bipedal or a monopedal stance. Containment of the foot in this manner is an object of the invention.

Containment as such is considered desirable since the relationship of the musculature associated with a bipedal function is also preserved. Thus, the user is more readily able to assume a state of monopedal function when shifting his weight to one ski since the movement of the foot, controlled by forefoot/midfoot pivotal support 2400, is vastly more predictable, in terms of movement, than when the foot is relatively uncontrolled or unlimited in this respect. This is particularly true when the foot is allowed to progress beyond a bipedal or "neutral" position into a position of supination.

A third important use of forefoot/midfoot pivotal support 2400 is that it provides a source of resistance to certain movements of the foot. Resistance, in this context, acts to provide a mechanical advantage to certain muscles which exert specific forces on the various counters and to rigid base 2100 of the invention.

For example, a muscular system which acts to exert a downward force on rigid base 2100 at the plantar aspect of the head of the first metatarsal gains mechanical advantage from instep counter 2420 in that it acts to resist the reaction force produced. This force tends to displace the dorsum of the midfoot upwardly. Instep counter 2420, of forefoot/midfoot compression member 2400, is fixed in position relative to rigid base 2100 at axis pin 2433. Thus, it acts to oppose the reaction force. This results in a greater application of force being exerted at the head of the first metatarsal. The invention provides the user with mechanical advantage in terms of supporting physiologic function. This is advantageous to the user and is, therefore, an object of the invention.

A fourth important function of forefoot/midfoot pivotal support 2400 lies in its ability to automatically adapt its longitudinal aspect to longitudinal aspect of the instep of the user.

Pivot 2430 of instep counter 2420 offers several advantages in this respect. First, it permits forefoot/midfoot pivotal support 2400 to align itself with the longitudinal aspect of the dorsum of the forefoot/midfoot portion of the user when rod 2430 is adjusted so as to bring the forefoot/midfoot pivotal support 2400 into contact with the dorsum of the forefoot/midfoot portion of the user's foot. Pivot 2430 acts to allow instep counter 2420 to rotate on its substantially transverse axis and, thus, to adapt to the angle of the longitudinal ridge of the individual foot of each user.

It is important for the correct operation of the invention that the initial adjustment of forefoot/midfoot pivotal support 2400 be made so that a downwardly and rearwardly acting force is exerted sufficient to maintain the plantar aspect of the head of the first metatarsal bone in constant contact with the rigid base 2100 and the posterior aspect of the heel of the user in constant contact with posterior heel counter 2301.

Second, pivot 2430 allows instep counter 2420 to tilt in the fore/aft plane in response to the changes in the state of the medial arch of the foot during the transition between bipedal and monopedal stance. During these transitions, among other things, the medial arch of the foot compresses and the head of the first metatarsal advances towards the anterior end of rigid base 2100 in the transition to monopedal function. The arch of the foot decompresses and the head of the first metatarsal recedes towards the posterior end of rigid base 2100 in the transition to a bipedal function.

A fifth function of forefoot/midfoot pivotal support 2400 lies in its cooperation with peripheral counter members in transferring forces exerted by the foot of a user to rigid base 2100. Such cooperation enhances the effectiveness of forces exerted by the foot which are intended to be transferred to the ski. Cooperation of this nature is an object of the invention.

As an example, in one embodiment the instep counter 2420 comprises a number of plates which act in different planes. One of these plates acts to apply an infero-medially acting force to the supero-lateral aspect of the first metatarsal, particularly at its head. Force applied in this manner acts to maintain contact of the medial aspect of the head of the first metatarsal with the lateral face of continuous medial forefoot counter 2201. The supero-lateral face of instep counter 2420 also cooperates with continuous postero-medial heel counter 2303 in transferring externally directed rotational forces exerted by the foot about a center between the two referenced counters.

The instep counter 2420 has a number of plates which act as counters relative to specific areas of the dorsum of the foot which are defined globally. Instep counter 2420 is comprised of four plates. Three of these plates exert forces on specific areas of the dorsum of the foot while a fourth provides restraint against upward movement without applying a force which would constrict displacement of the area of the foot associated with it.

Yet another useful function of forefoot- midfoot compression member 2400 lies in the means provided for the plates, which act as counters in exerting forces on the dorsum of the foot, to maintain these forces during infero-medial and supero-lateral displacement of the midfoot and proximal aspects of the metatarsals such as occur during the transition to bipedal and monopedal functions. As a prelude to providing a detailed description of this embodiment, specific functions of the plates comprising instep counter 2420 will be discussed.

Figure 36:
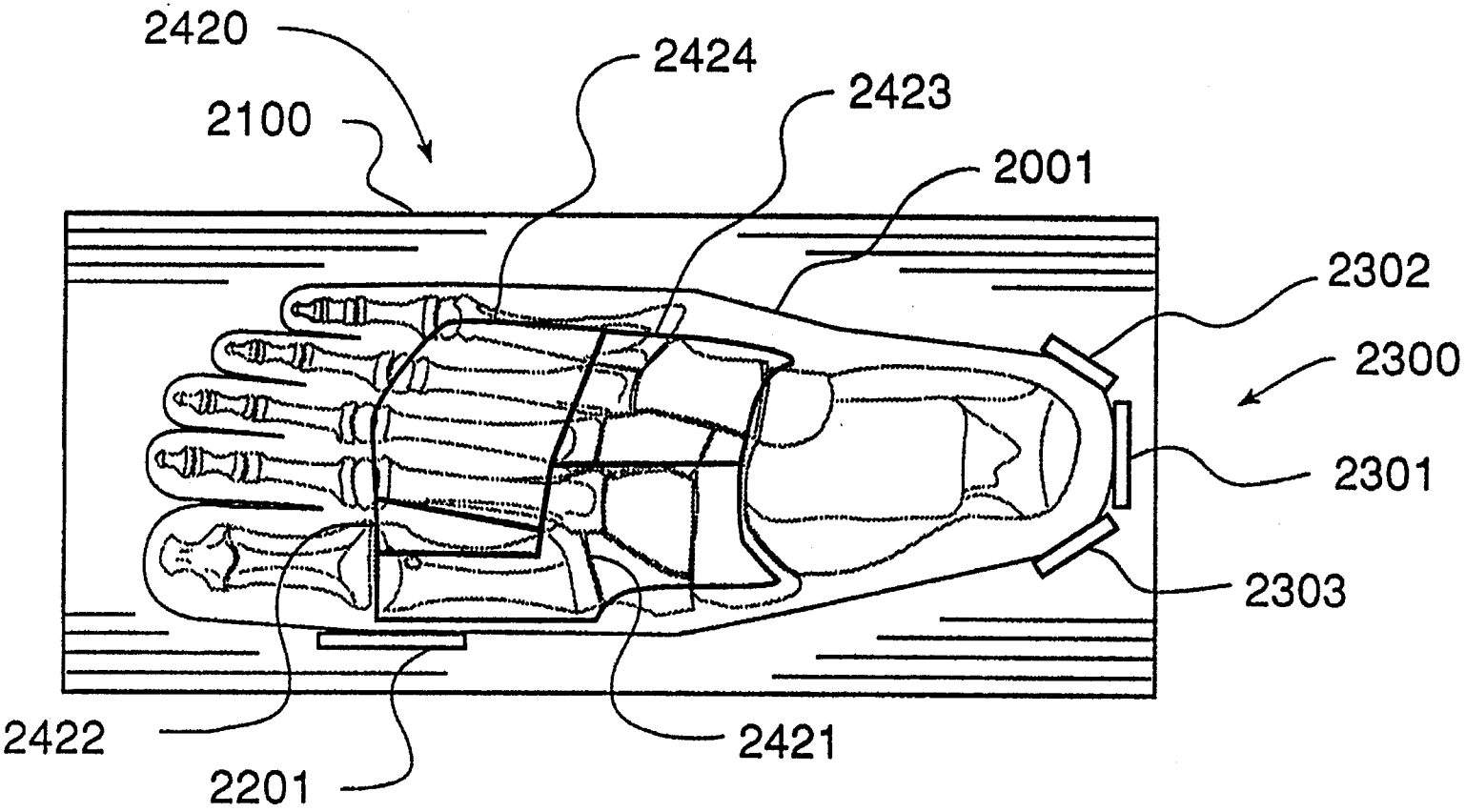
FIG. 36 is a plan view of the footwear device of FIG. 33 showing the outlines of the plates of an instep counter in relation to the areas of the dorsum of the midfoot and forefoot of a user.

FIG. 36 is a plan view illustrating instep counter generally shown at 2420 and comprising dorsum first metatarsal/dorsum midfoot counter 2421, supero-lateral first metatarsal counter 2422, supero-lateral midfoot counter 2423 and second through fifth dorsal metatarsal restraint 2424. In order to relate these plates to the respective areas of the foot 2001 of a user, they are illustrated as outlines only. With the exception of rigid base 2100, heel counter 2300 and continuous medial forefoot counter 2201, other elements of the invention have been omitted for the sake of clarity.

Figure 37:
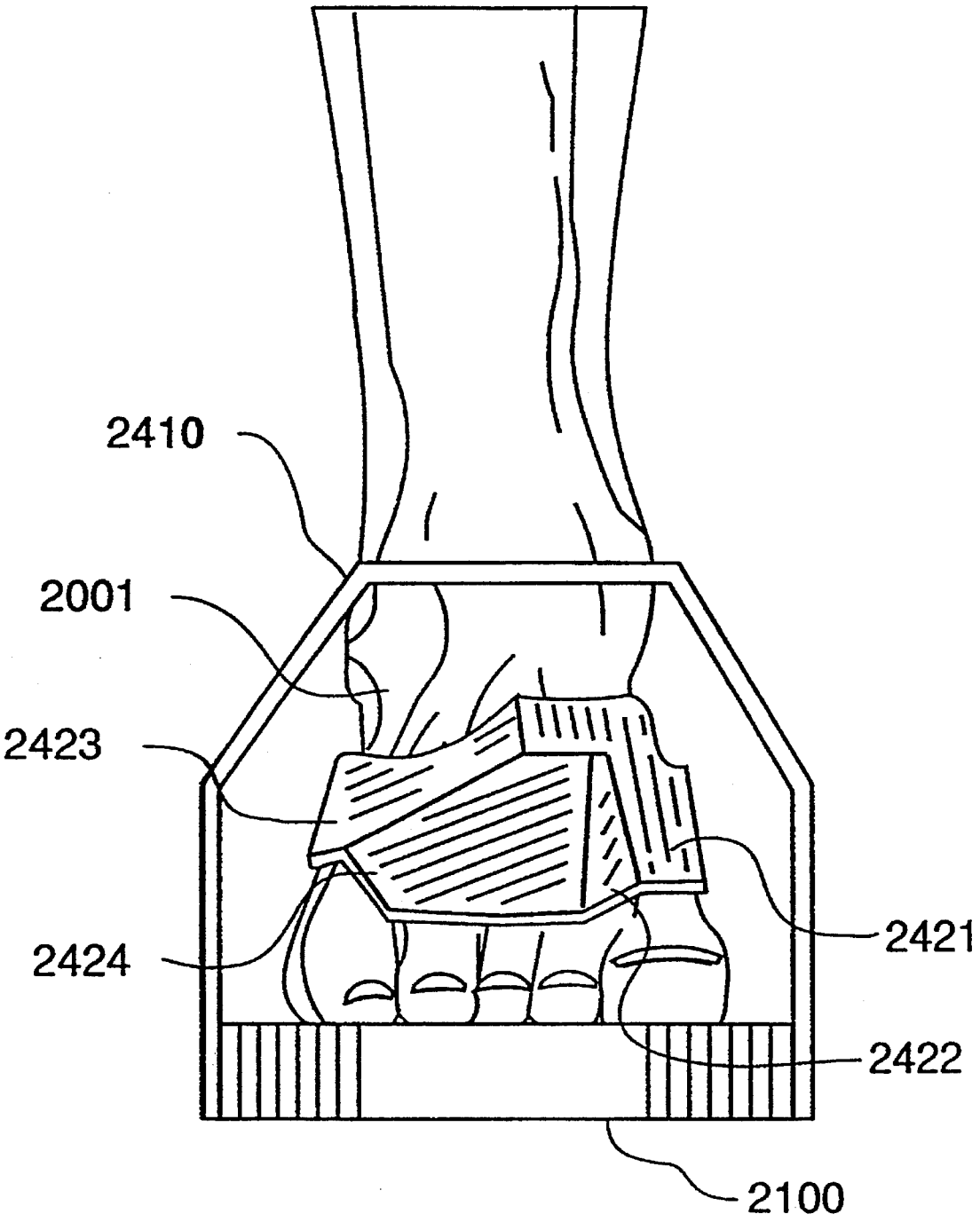
FIG. 37 is a front elevation of the footwear device of FIG. 33 illustrating the instep counter in relation to the foot of a user.

FIG. 37 is a front elevation illustrating the relationship of plates 2421, 2422, 2423, and 2424 to the foot 2001 of a user. Rigid arch 2410 and rigid base 2100 are also shown. Other elements of the footwear device 2000 have been omitted for the sake of clarity.

Figure 38:
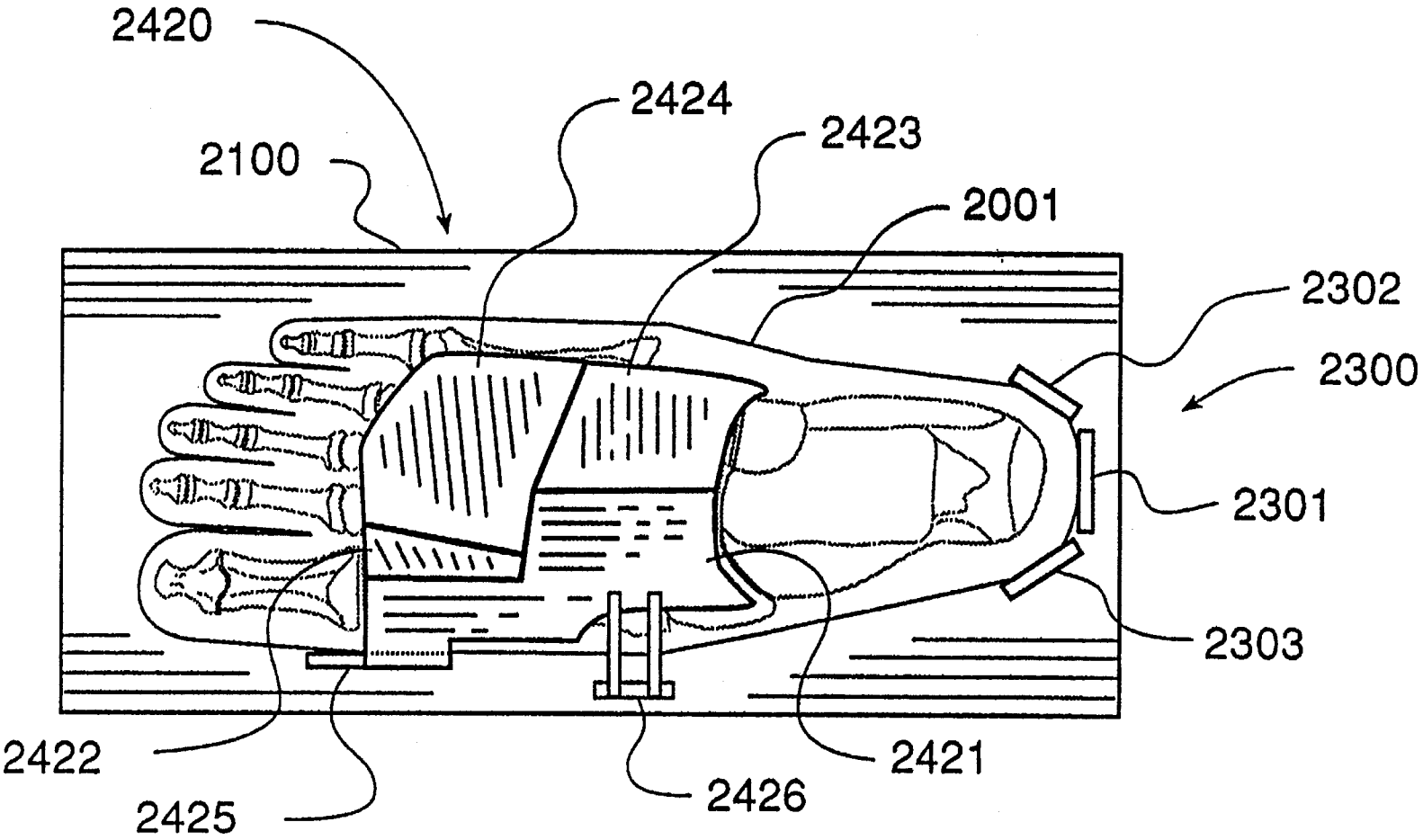
FIG. 38 is a plan view of the footwear device of FIG. 33 illustrating the instep counter with additional counter members mounted.

FIG. 38 is a plan view of the invention as in FIG. 36 with the addition of continuous medial forefoot counter 2425, which, in this instance, replaces continuous medial forefoot counter 2201 which is normally mounted to rigid base 2100. Intermittent medial midfoot counter 2426 is rigidly connected via two rigid arms to dorsum first metatarsal/dorsum midfoot counter 2421. In this instance, medial midfoot counter 2426 replaces continuous medial midfoot counter 2202 which is normally mounted to rigid base 2100. The mounting of counters 2425 and 2426 in place of counters 2201 and 2202 respectively is optional as is the substitution of either one or both of the counters for those mounted to instep counter 2420.

THE DORSUM FIRST METATARSAL/DORSUM MIDFOOT COUNTER 2421

Figure 39:
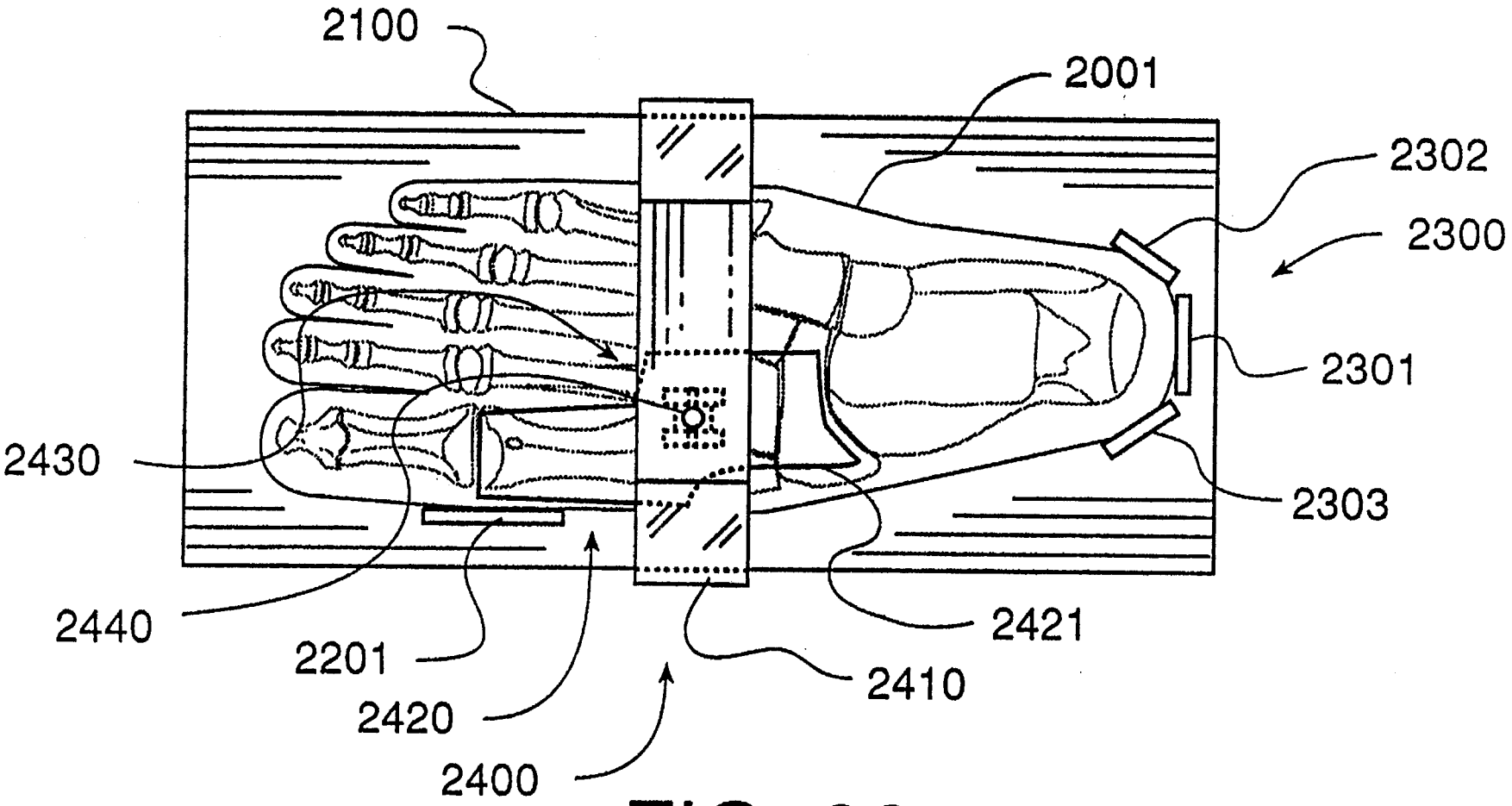
FIG. 39 is a plan view of a footwear device according to another embodiment of the invention having a reduced or abbreviated instep counter.

FIG. 39 is a plan view of another embodiment of the invention illustrating forefoot/midfoot compression member 2400 in which instep counter 2420 consists solely of dorsum first metatarsal/dorsum midfoot counter 2421. Rigid base 2100, rigid arch 2410, pivot 2430, continuous medial forefoot counter 2201 and heel counter 2300 are also shown in order that their relationship with dorsum first metatarsal/dorsum midfoot counter 2421 can be appreciated. Other elements of the invention have been omitted for the sake of clarity.

The area encompassed by counter 2420 involves the dorsum of the first metatarsal, the dorsum of the base of the second metatarsal, the dorsum of the first and second cuneiforms and the dorsum of the navicular. Care should be exercised in ensuring that force applied to these areas is substantially evenly distributed. In particular, special attention should be directed to the accommodation of the tendon of the anterior tibialis muscle, located on the supero-medial aspect of the first cuneiform, to ensure that the surfaces of instep counter 2420 do not impinge on it with adverse effects.

In FIG. 39 the architecture of the foot of the user approximates that of a bipedal function. Dorsum first metatarsal/dorsum midfoot counter 2421 is pivotally connected to rod 2440 via pivot 2430. Rod 2440 is connected to rigid arch 2410 via a threaded hole such that rod 2440 can be rotated to adjust instep counter 2420 downwardly so as to bring it into contact with the dorsum of the foot of a user and thus exert a force acting downwardly and rearwardly applied substantially evenly to the dorsum of the first metatarsal and the dorsum of the midfoot such that the plantar aspect of the head of the first metatarsal is maintained in constant contact with rigid base 2100 and the posterior aspect of the heel of the user is maintained in constant contact with the anterior face of posterior heel counter 2301. In other respects, the operation of forefoot/midfoot pivotal support 2400 is essentially the same as previously discussed in this application.

Figure 40:
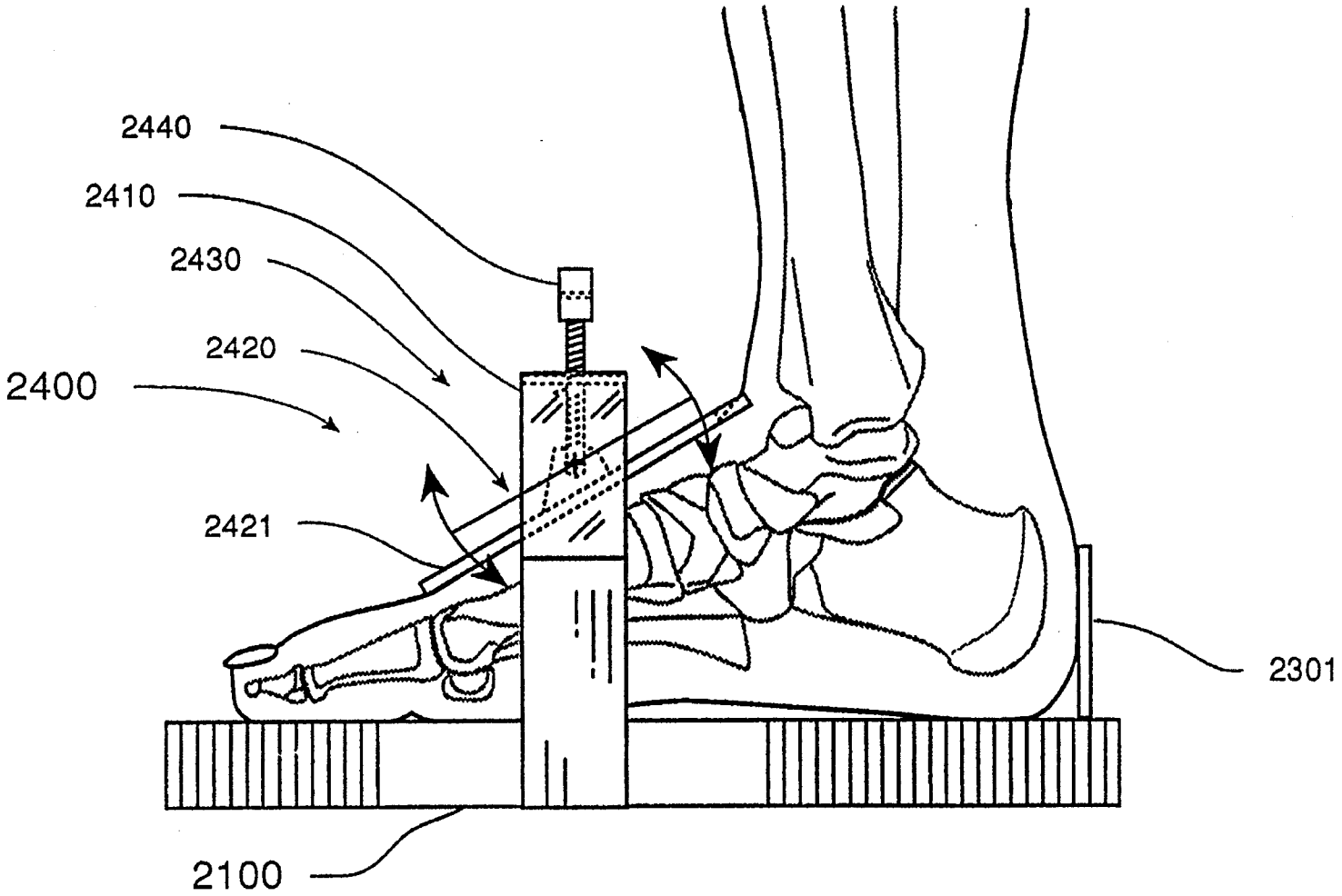
FIG. 40 is a medial elevation, similar to FIG. 32 of the footwear device, illustrating the pivoting action of the instep counter.

FIG. 40 is a medial elevation of the invention illustrating the same elements as shown in FIG. 39. Attention is directed to counter surface of dorsum first metatarsal/dorsum midfoot counter 2421 whose transverse aspects are substantially parallel to rigid base 2100. Attention is also drawn to the axis of rotation of instep counter 2420 about pivot 2430.

As stated previously, the proximal aspect of the dorsum of the first metatarsal and the dorsum of the midfoot represent a key point of displacement wherein the foot can be substantially prevented from progressing beyond a bipedal function, in recovering from the pronated position, and from progressing into supination. The application of a downwardly and rearwardly acting force exerted on this area, in cooperation with heel counter 2301, will substantially prevent such an occurrence. Further, the progression into a monopedal function from a bipedal function, which is an object of the invention, can occur without restriction due to the action of pivot 2430 whose function has previously been explained. Again, because of the action of pivot 2430, the plantar aspect of the head of the first metatarsal is maintained in constant contact with rigid base 2100 and the posterior aspect of the heel of the user is maintained in constant contact with the anterior face of posterior heel counter 2301. In effect, one of the principal objects of forefoot compression member 2400 is obtained with a single counter face.

Control of the displacements of the foot in this manner is considered advantageous to the user and an object of the invention. Thus, an important function and use is afforded by the invention so much so that an acceptable level of performance is obtained with instep counter 2420 comprised solely of dorsum first metatarsal/dorsum midfoot counter 2421.

In order to ensure the transfer of externally directed lateral forces to rigid base 2100 an intermittent lateral forefoot counter should be mounted to rigid base 2100 ensuring that the instructions provided previously in this application for placement are followed.

In order to ensure correct function of the invention with instep counter 2420 rotatable only at pivot 2430, attention is drawn to some important details relating to the construction and alignment relative to the foot of the user.

Figure 41:
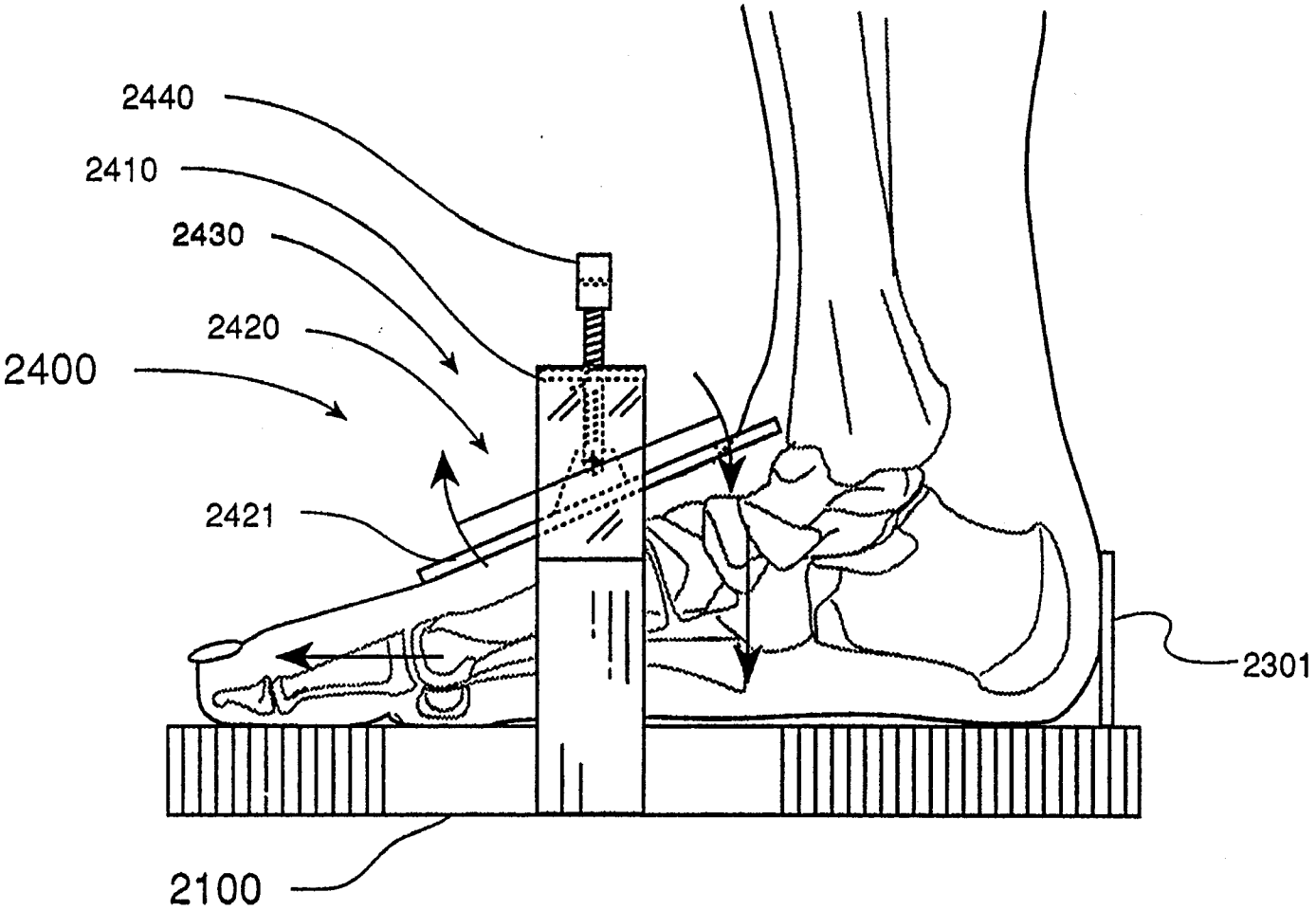
FIG. 41 is a medial elevation of the footwear device illustrating the change in the angle of the instep counter in response to pronation of the foot of a user.

FIG. 41 illustrates a medial elevation as in FIG. 40 except that the architecture of the foot of the user approximates that of a monopedal function. It should be noted, in FIG. 41, that the profile of the arch has become compressed, as compared to that shown in FIG. 40, while the head of the first metatarsal and its associated phalange, has advanced towards the anterior end of rigid base 2100.

It will also be noted that dorsum first metatarsal- dorsum midfoot counter 2421 has rotated progressively on its substantially transverse axis provided by pivot 2430 so that its anterior end has risen while its posterior end has fallen relative to rigid base 2100. These changes occur in conjunction with the anterior advance of the head of the first metatarsal such that dorsum first metatarsal/dorsum midfoot 2421 counter continues to exert a downwardly and rearwardly acting force distributed substantially evenly over the dorsum of the first metatarsal bone and dorsum of the midfoot during the transition from a bipedal to a monopedal stance. The same is true of the reverse sequence.

Figure 42:
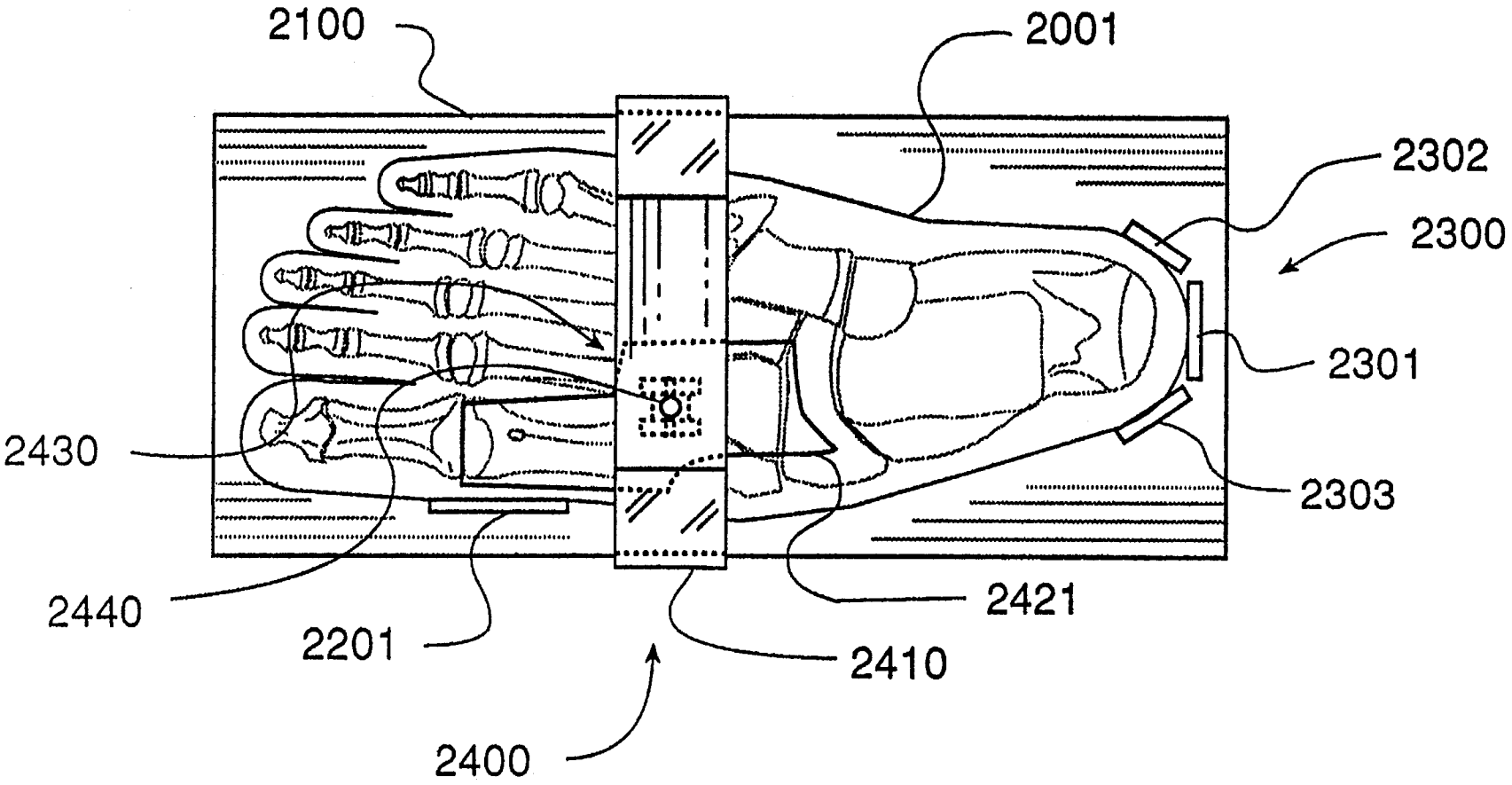
FIG. 42 is a plan view of the footwear device illustrating the outline of a key counter element of the forefoot/midfoot compression member in relation to the right foot of a user.

FIG. 42 illustrates a plan view of the invention as in FIG. 39 except the foot 2001 of a user is now represented in a monopedal stance positioned on rigid base 2100 compared to the bipedal position of FIG. 39. It will be noted that the base of the first metatarsal in this view has displaced medially in conjunction with compression of the arch. The movement is, in reality, infero-medial but only the medial aspect is apparent in plan view. This infero-medial displacement occurs pivotally around a center located substantially at the head of the first metatarsal. Provision is made in dorsum first metatarsal/dorsum midfoot counter 2421 such that sufficient width is provided on the medial aspect of the counter at its posterior end to allow for this medial displacement. In this respect, the width of the counter anticipates the displacement and continues to contact and exert a downwardly and rearwardly acting force on the dorsum of the first metatarsal and midfoot of the user.

Figure 43:
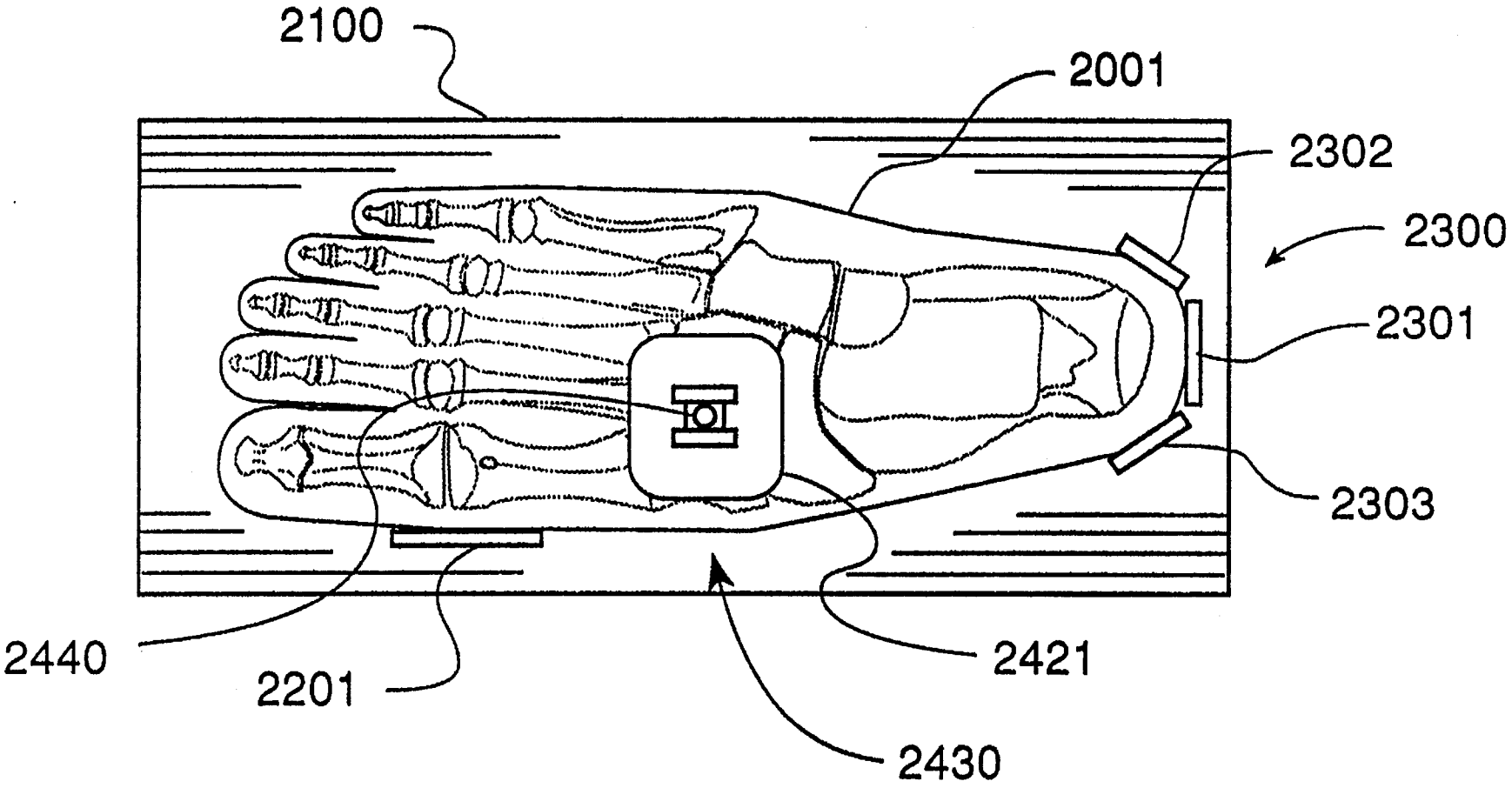
FIG. 43 is a plan view of a footwear device according to another embodiment of the invention having an abbreviated version of the instep counter contacting a key area of the forefoot/midfoot of the right foot of a user.

FIG. 43 illustrates a plan view of another embodiment of the invention comprising an embodiment of forefoot/midfoot compression member 2400 wherein the pivoting facility of pivot 2430 has been eliminated. Further, dorsum first metatarsal/dorsum midfoot counter 2421 has been abbreviated and modified so as to contact the dorsum of the foot in an area substantially centered at the junction of the base of the first and second metatarsals and the first and second cuneiforms. With the exception of continuous medial forefoot counter 2201 and heel counter 2300 other elements of the invention have been omitted for the sake of clarity. Again, it is stressed that contact afforded the dorsum of the foot by dorsum first metatarsal/dorsum midfoot counter 2421 be of a nature which ensures the force is distributed substantially evenly and that the tendon of the tibialis anterior muscle is not adversely affected.

Figure 44A:
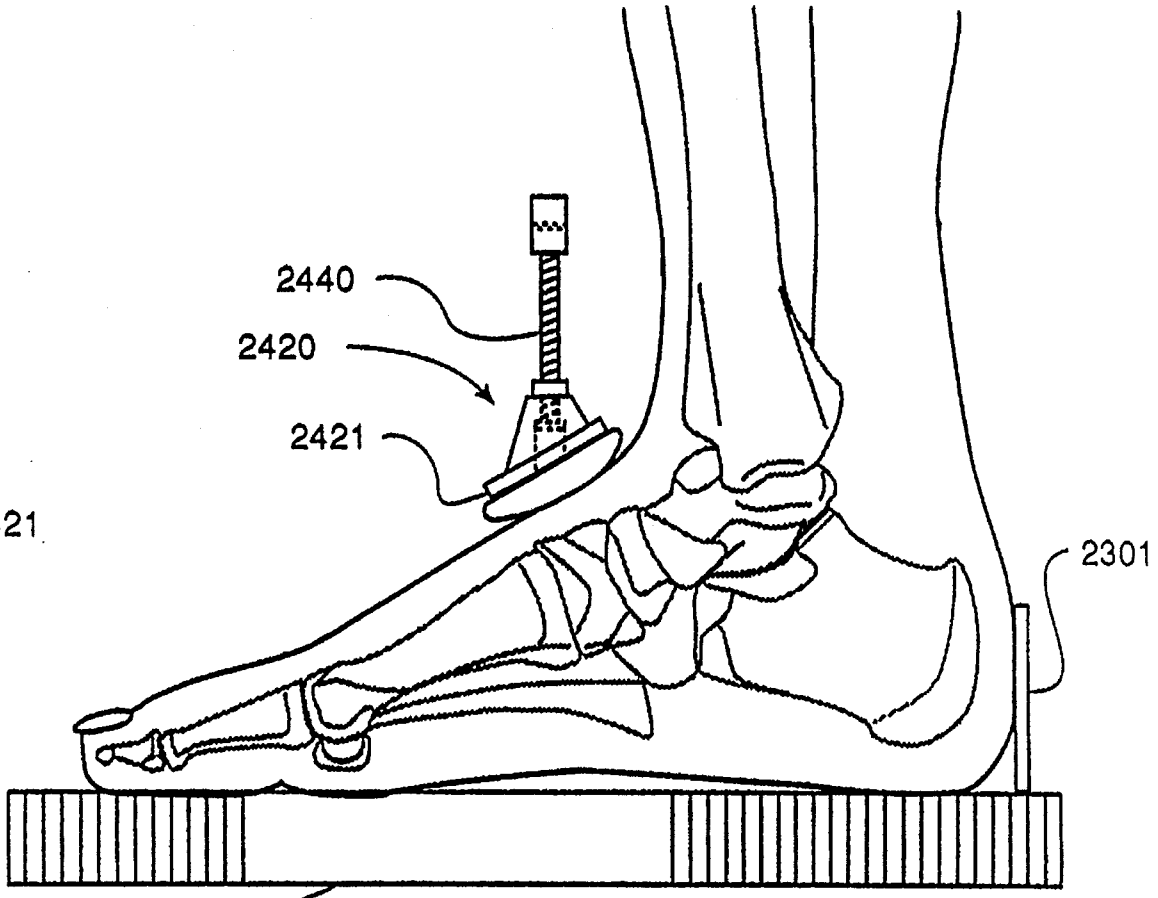
FIG. 44A shows the footwear device of FIG. 43 in a medial elevation.

FIG. 44A illustrates the invention in a medial elevation showing the same embodiment of instep counter 2420 as in FIG. 43. With the exception of rigid base 2100, continuous forefoot counter 2201 and heel counter 2301 other elements of the invention have been omitted for the sake of clarity.

It should be noted that the face 2452 of the counter surface which addresses the foot has been suitably formed so as to avoid edges which would act to form aggressive angles. The shape is such that it affords a degree of adaptability to the variation in the instep angle among different users.

In this particular application, it is important that a suitable material such as a firm, compliant foam which allows some degree of compression and is adaptive in nature but which has substantially one hundred percent recovery be used to cover the surface of the counter which interfaces with the foot of the user. Experience has indicated that a suitable material is one which compresses like a firm "gel" and which yields with some resistance under constant pressure.

Figure 44B:
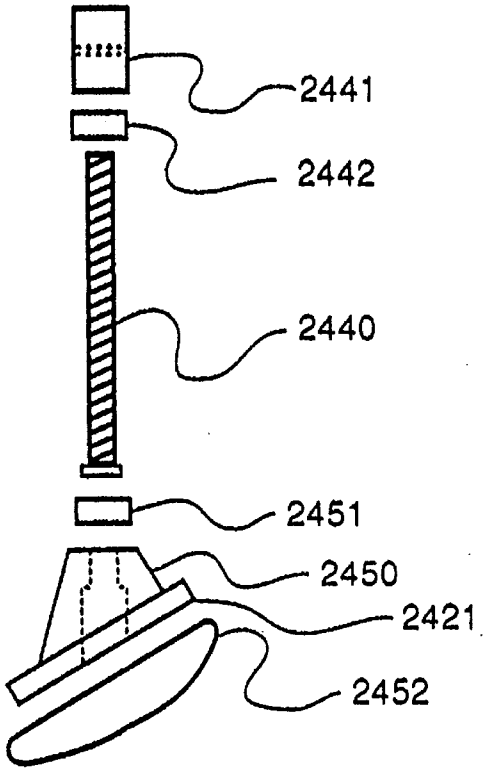
FIG. 44B illustrates the elements which comprise the abbreviated counter shown in FIG. 44A which serve to connect the counter to the rigid arch of the footwear device.

While pivot 2430 has been eliminated, means is provided to permit the threaded portion of rod 2440 to rotate in the threaded hole in rigid arch 2410 without simultaneously rotating instep counter 2421. FIG. 44B illustrates a modification of pivot 2430 wherein pivot mounts 2431 and 2432 and pivot axis pin have been eliminated. Instep counter connector link 2450 is mounted directly to dorsum first metatarsal/dorsum midfoot counter 2421 with rod 2440 inserted and lock nut 2451 installed on instep counter connector link 2450 and adjusted, as previously described for pivot 2430 and rod 2440, so as to permit the downwardly and rearwardly acting force exerted on the dorsum of the foot by forefoot/midfoot compression member 2400 to be adjusted without rotating dorsum first metatarsal/dorsum midfoot counter 2421 relative to the rigid base once it is properly positioned on the foot of the user. Once the required force on the dorsum of the foot of the user has been attained lock nuts 2451 and 2442 should be secured so that instep counter 2421 is rigidly connected to rigid arch 2410.

The abbreviated dorsum first metatarsal/dorsum midfoot counter described is intended for those desirous of fabricating the invention at the lowest possible cost. As such, it only fully meets one object of the invention which is the containment of the architecture of the foot within the limits of bipedal function during the function itself and when recovering from a position of pronation. This, in itself, is a useful and desirable function advantageous to the user. While it is believed that such an application may not be entirely suitable for the expert skier, experience has demonstrated that it is quite adequate for beginning skiers experiencing lower forces exerted by and upon the foot.

The use of a round, rather than a square, shape for instep counter 2421 is possible provided it seats in the center of the designated area. The use of such a shape is advantageous as rod 2440 can remain free to rotate in instep counter connector link 2450 without the necessity of adjusting the position of instep counter connector link 2450 relative to the foot of a user.

THE SUPERO-LATERAL FIRST METATARSAL COUNTER 2422

FIGS. 36 and 38 are plan views of the footwear device 2000 illustrating forefoot/midfoot pivotal support 2400 with supero-lateral first metatarsal counter 2422 positioned lateral to the supero-lateral aspect of the first metatarsal. FIG. 37 is a front elevation showing the position of supero-lateral first metatarsal counter 2422 relative to the foot 2001 of a user.

Supero-lateral first metatarsal counter 2422 acts to exert a substantially infero-medial force on the supero-lateral aspect of the first metatarsal, particularly at its distal aspect where it is prominent relative to the head of the second metatarsal. Force applied in this manner substantially prevents lateral displacement of the head of the first metatarsal. Such displacement would tend to occur, for example, when a force is exerted on the footwear device 2000 which tends to displace the head of the first metatarsal laterally or when an external rotational force is exerted at the head of the first metatarsal about a center posterior to it which, in conjunction with resistance offered by continuous postero-medial oblique heel counter 2303, tends to rotate the head of the first metatarsal laterally. Such displacements are substantially prevented by the action of supero-lateral first metatarsal counter 2422.

While an object of the invention, and useful function of supero-lateral first metatarsal counter 2422, is to prevent lateral displacement of the distal head of the first metatarsal, it is also an object of the invention to permit the head of the first metatarsal to advance and recede during the transition between a monopedal and a bipedal function. Thus, great care should be exercised in constructing, and adjusting the position of, the plates which comprise the counters of instep counter 2420 in order to ensure both objects will be met. In this respect, any covering or treatment applied to continuous medial forefoot counter 2201 and supero-lateral first metatarsal counter 2422 should have a surface material, and be of a nature, which does not resist the necessary longitudinal movement of the head of the first metatarsal.

Yet another object and useful function of supero-lateral first metatarsal counter 2422 is that it cooperates with continuous medial forefoot counter 2201 in maintaining a parallel relationship with the center of the head of the first metatarsal and the longitudinal center of the ski once rigid base 2100 has been correctly aligned and secured to the ski surface The maintenance of alignment of the first metatarsal of a user, as such, is an object of the invention, This is a very useful function in that it causes the head of the first metatarsal, which is a key element in controlling the ski, to move with reference to the center and longitudinal axis of the ski. Phased movement in the manner described is extremely important in that it has positive effects on the transfer of forces to the ski ensuring that it will occur in a predictable manner as well as ensuring that such forces will be transferred as directly as possible, and without delay, both of which are objects of the invention.

THE MIDFOOT SUPERO-LATERAL COUNTER 2423

FIGS. 36 and 38 are plan views of the footwear device 2000 illustrating supero-lateral midfoot counter 2423 positioned over the supero-lateral aspect of the midfoot. FIG. 37 is a front elevation showing the position of supero-lateral midfoot counter 2423 relative to the foot 2001 of a user.

Supero-lateral midfoot counter 2423 acts in concert with the dorsum first metatarsal/dorsum midfoot counter 2421 in exerting a force downwardly and rearwardly substantially evenly to the supero-lateral aspect of the midfoot. In addition, it exerts an infero-medial force which acts to prevent lateral displacement of the foot. The action of supero-lateral midfoot counter 2423 is complementary to that of dorsum first metatarsal/dorsum midfoot counter 2421. It acts mainly in defining the lateral limit of bipedal function and in substantially preventing supero-lateral displacements of the foot such as would tend to occur when the foot is under the influence of forces which tend to make it separate from contact with rigid base 2100.

THE METATARSALS TWO THROUGH FIVE DORSUM RESTRAINT 2424

FIGS. 36 and 38 are plan views of the footwear device 2000 illustrating metatarsals two through five dorsum restraint 2424 positioned substantially over the dorsums of metatarsals two through five of the foot of a user. FIG. 37 is a front elevation showing the position of metatarsals two through five dorsum restraint 2424 relative to the foot 2001 of a user.

The useful function of metatarsals two through five dorsum restraint 2424 is that it acts to restrain the metatarsals lateral to the first metatarsal against upward movement such as would occur if the metatarsals attempted to lift off rigid base 2100. Since metatarsals two through five displace laterally at their heads during the transition from a bipedal to a monopedal stance, metatarsals two through five dorsum restraint 2424 does not exert a force in the normal operation of the footwear device 2000 which would act downwardly since such a force would act to restrict the required lateral displacement.

THE CONTINUOUS MEDIAL FOREFOOT COUNTER 2425

Figure 45:
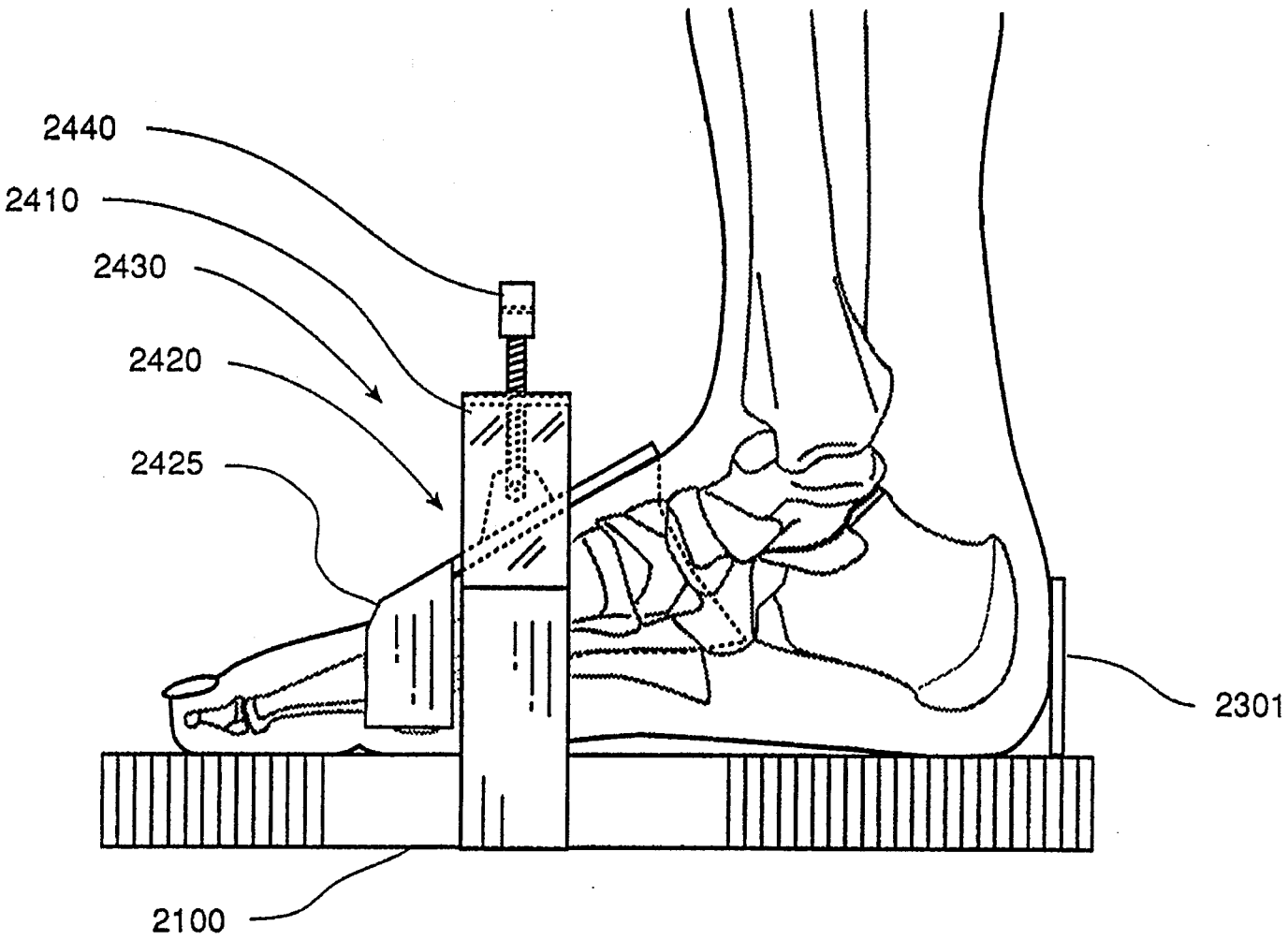
FIG. 45 is a medial elevation of a footwear device according to yet another embodiment of the invention having a forefoot/midfoot compression member with a medial forefoot counter, mounted to the medial aspect of the instep counter.

FIG. 45 illustrates a medial elevation of the invention in which continuous medial forefoot counter 2201, normally rigidly mounted to rigid base 2100, is replaced by continuous medial forefoot counter 2425 rigidly mounted to instep counter 2420. Other than the element to which it is mounted, all other aspects are as previously described in this application for continuous medial forefoot counter 2201.

THE INTERMITTENT MEDIAL MIDFOOT COUNTER 2202

Figure 46:
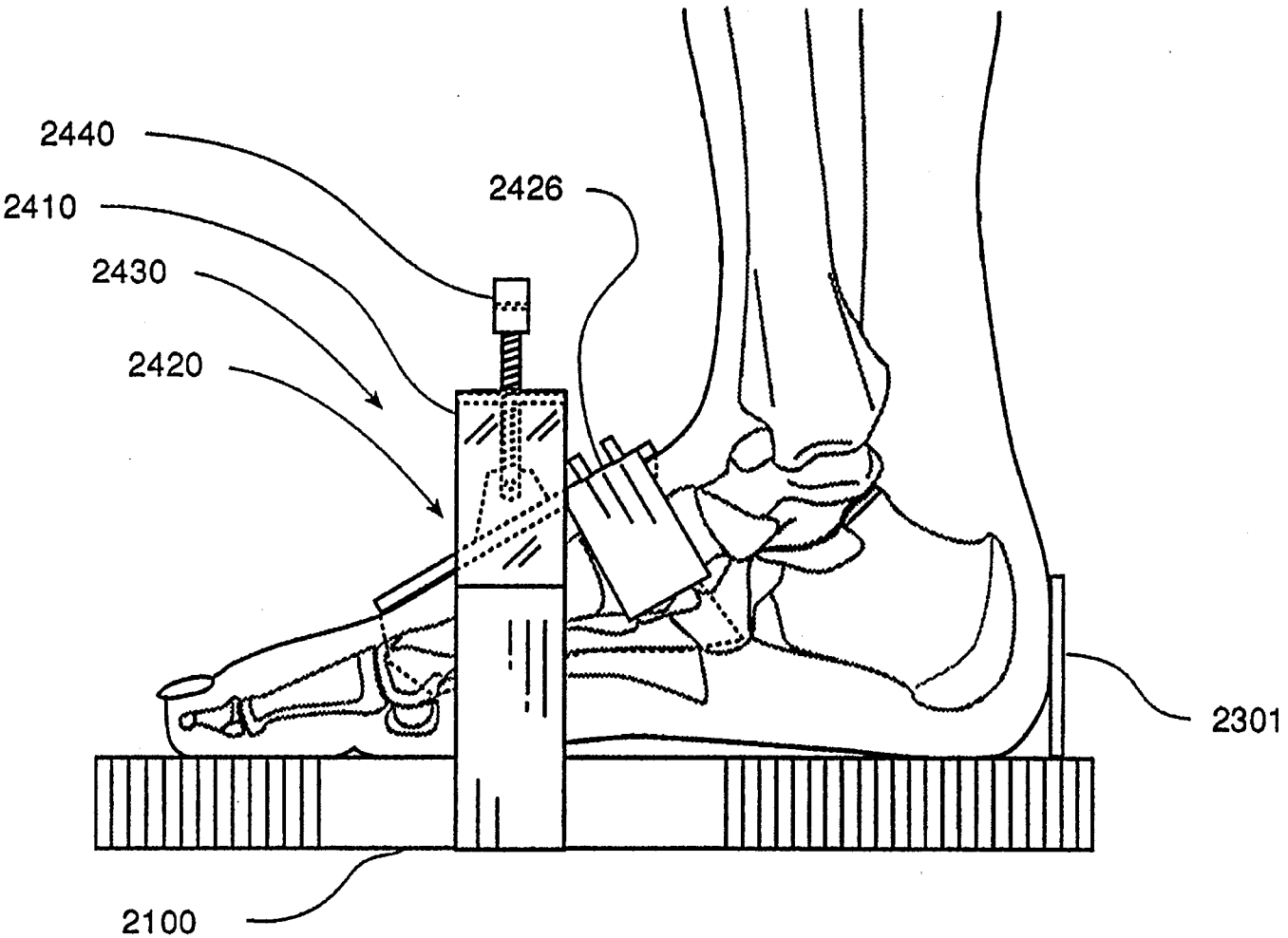
FIG. 46 is a medial elevation of a footwear device according to another embodiment of the invention having a forefoot/midfoot compression member with a medial midfoot counter, mounted to the medial aspect of the instep counter.

FIG. 46 illustrates a medial elevation of the invention in which intermittent medial midfoot counter 2202, normally rigidly mounted to rigid base 2100 by rigid arms, is replaced by intermittent medial midfoot counter 2426 rigidly mounted by rigid arms to instep counter 2420. Other than the element to which it is mounted, all other aspects are as previously described in this application for intermittent medial midfoot counter 2202.

SUMMARY OF INTERRELATIONSHIP AND INTERDEPENDENCY OF COUNTER SYSTEMS

The importance of the interdependent and cooperative nature of the elements of the footwear device 2000, in particular the counter elements of the foot, cannot be overemphasized. The correct function of the footwear device 2000, especially as it relates to the accommodation and maintenance of physiologic function of the user, is dependent on the correct positioning and cooperation of the elements of the footwear device 2000.

In order to define the function of the various counter elements of the foot, titles are assigned to the various elements which are associated with their function. The heel of the user is designated as the "anchor point" of the foot while the medial aspect of the head of the first metatarsal is designated as the "control point" of the foot.

The midfoot, malleolus and lateral aspect of the head of the fifth metatarsal of the user are designated as "articulation points" since displacements of structures of the foot and leg relative to the anchor and control points occur in these areas.

The medial and lateral aspects of the hindfoot and the medial aspect of the midfoot are designated as "reference points" since the limit of displacement relating to a bipedal or a monopedal stance is associated with these areas. The medial aspect of the midfoot can serve as a "transfer point" in addition to its function as an "articulation point" for the transfer of internally directed rotational force when the area comes into contact with intermittent midfoot counter 2202.

The dorsum of the user's foot is designated as a restraint point. Forces directed on the dorsum of the foot by forefoot/midfoot pivotal support 2400 act to secure specific aspects of the dorsum of the foot against the various counter elements connected to rigid base 2100.

One of the primary objects of the counter elements of the footwear device 2000 is to establish the posterior limit of the heel of the foot of the user and the medial limit of the head of the first metatarsal. FIGS. 22B and 22D illustrate the posterior limit of the posterior aspect of the heel of the foot of a user and the medial limit of the medial aspect of the head of the first metatarsal. These limits are defined, in the footwear device 2000, by continuous medial forefoot counter 2201 and continuous heel counter 2300. The function of these counters in providing continuous contact with the respective areas of the foot is dependent on the action of instep counter 2420 of forefoot/midfoot pivotal support 2400.

Continuous heel counter 2300 is particularly dependent on the force exerted on it by dorsum first metatarsal/dorsum midfoot counter 2421 which is principally directed downwardly and rearwardly. Continuous medial forefoot counter 2201 is particularly dependent on the force exerted on the supero-lateral aspect of the first metatarsal by supero-lateral first metatarsal counter 2422 which is principally directed infero-medially. In addition, it should be noted that continuous medial forefoot counter 2201, continuous heel counter 2300 and forefoot/midfoot pivotal support 2400 are all dependent on rigid base 2100.

In the transfer to rigid base 2100 of an internally directed rotational force exerted by the foot of a user, as directly as possible and without delay, continuous heel counter 2300 is dependent on the action of forefoot/midfoot pivotal support 2400 which maintains the heel of the foot in constant contact with this element and, in particular, in contact with continuous postero-lateral oblique counter 2302. Continuous medial forefoot counter 2201 is dependent on supero-lateral first metatarsal counter 2422 to maintain the medial aspect of the head of the first metatarsal in constant contact with it. The internally directed rotational force exerted by the foot of the user is primarily transferred to rigid base 2100 by the cooperation and interdependence of postero-lateral oblique counter 2302 and continuous medial forefoot counter 2201. Continuous posterior heel counter 2301 assists the process by ensuring that the heel of the user is prevented from moving posteriorly relative to rigid base 2100.

In the transfer to rigid base 2100 of an externally directed rotational force exerted by the foot of a user, as directly as possible and without delay, continuous heel counter 2300 is again dependent on the action of forefoot/midfoot pivotal support 2400 which maintains the heel of the foot in constant contact with this element and, in particular, in contact with continuous postero-medial oblique counter 2303. Supero-lateral first metatarsal counter 2422 is dependent on continuous medial forefoot counter 2201 to maintain the lateral aspect of the head of the first metatarsal in constant contact with it. The externally directed rotational force exerted by the foot of the user is primarily transferred to rigid base 2100 by the cooperation and interdependence of postero-medial oblique counter 2303 and supero-lateral first metatarsal counter 2422. Again, continuous posterior heel counter 2301 assists the process by ensuring that the heel of the user is prevented from moving posteriorly relative to rigid base 2100.

In terms of the function of intermittent midfoot counter 2202, intermittent medial hindfoot counter 2203, intermittent lateral hindfoot counter 2204 and intermittent lateral forefoot counter 2205 which is to contact the area of the foot associated with each counter only at the limit of displacement of the structures of the foot relating to a bipedal or a monopedal stance, the function of these counters is dependent on the control of the movements of the foot provided by the interdependent and cooperative relationship of rigid base 2100, continuous medial forefoot counter 2201, continuous heel counter 2300 and forefoot/midfoot pivotal support 2400.

In addition, downward directed force at the head of the metatarsals, in particular, the head of the first metatarsal can be exerted by the contraction of the posterior tibialis muscle which acts to create flexion of the first metatarsal. In this example, a reaction force, directed primarily upward, will be exerted at the base of the first metatarsal. Forefoot/midfoot pivotal support 2400 will act to resist any upward movement of the base of the first metatarsal arising out of the reaction force and thus ensure that the downward force exerted by the foot of the user is transferred to rigid base 2100 as directly as possible and without delay.

THE TAG MEMBER 2500

FIGS. 20 and 21 illustrate the footwear device 2000 with leg member 2500 shown in relation to other elements of the footwear device 2000.

FIG. 47 illustrates a medial elevation illustrating the elements which form the leg member 2500. With the exception of rigid base 2100, continuous medial forefoot counter 2201 and heel counter 2300, other elements of the footwear device 2000 have been omitted for the sake of clarity.

Leg member 2500 comprises two main elements, i.e. a lower leg member mount assembly 2510 and upper leg member containment assembly 2520. Lower leg member mount assembly 2510 is comprised of medial leg member rigid mount 2511 and lateral leg member rigid mount 2512 (FIG. 52), both of which are rigidly connected to rigid base 2100 while upper leg member containment assembly 2520 comprises medial leg member rigid arm 2521 and lateral leg member rigid arm 2522 (FIG. 49), leg member anterior element 2523, leg member posterior element 2524 both of which are connected by anterior/posterior containment coupling means 2530. Lower leg member mount assembly 2510 and upper leg member containment assembly 2520 are rotatably connected to each other by journal or resistance means 2560 and 2561. BELLEVILLE™ washer 2564 can be fitted to either one or both of journal-resistance means 2560 and 2561 should the user require a source of resistance to be added which acts at a constant rate of force to oppose rotation of upper leg member containment assembly 2520 about its axes. Medial leg member rigid arm 2521 and lateral leg member rigid arm 2522 have an area recessed around the hole which receives axis screws 2562 (typical) for receiving a BELLEVILLE™ washer, should it be fitted. (FIG. 54).

Leg member posterior element 2524 is a rigid structure rigidly connected to medial leg member rigid arm 2521 and lateral leg member rigid arm 2522 to form a rigid assembly which, in cooperation with journals 2560 and 2561 and medial leg member rigid mount 2511 and lateral leg member rigid mount 2512, connects the assembly to rigid base 2100 such that when the lower extensions of medial leg member rigid arm 2521 and lateral leg member rigid arm 2522 are in contact with rearward leg member travel limiters 2550 and 2551, rearward movement of the leg of a user beyond the anterior face of leg member posterior element 2524 is prevented. Further, upper leg member containment assembly 2520 is substantially rigid medially and laterally relative to rigid base 2100 such that medial or lateral displacement of the medial and lateral aspects of the leg at the superior portion of the leg member containment assembly beyond the medial and lateral limits is prevented while flexion of the leg between the limits imposed by rear travel limiters 2550 and 2551 and forward travel limiter 2570 is permitted.

At least one rearward travel limiter is provided to arrest rearward movement of the upper leg member containment assembly 2520. In this particular embodiment, two rearward travel limiters, 2550 and 2551, are shown mounted on medial leg member rigid mount 2511 and lateral leg member mount 2512 respectively. A similar effect can be achieved with one rearward travel limiter for the footwear device 2000 and/or alternate mounting arrangements.

Leg member anterior element 2523, illustrated in FIG. 47, is a rigid structure which is secured, in cooperation with leg member posterior element 2524, to the leg of the user by coupling means 2530. The interface of leg member anterior element 2523 and leg member posterior element 2524 is such that the two elements cooperate with each other to form a rigid containment assembly which encircles the leg of a user during operation of the footwear device 2000.

Various means can be employed to ensure that the structure created by the interaction of leg member anterior element 2523 and leg member posterior element 2524 is rigid and that it substantially maintains its form and shape during operation of the footwear device 2000.

Materials employed for construction should be durable and rigid in nature. Rigid plastics are a suitable material for such purpose. Metals may also be employed with good results. Reinforcing by established structural engineering principles should be employed, if necessary, to ensure that upper leg member containment assembly 2520, rotatably connected to lower leg member assembly by close tolerance journals 2560 and 2561, creates, when interacting with the leg of a user, a rigid structure capable of establishing and maintaining a predetermined relationship of its medial/lateral and posterior aspects with rigid base 2100 at various points of rotation of leg member 2500 relative to rigid base 2100.

In this particular embodiment, journals 2560 and 2561 ensure that the medial and lateral faces of upper leg member containment assembly 2520 maintain a parallel relationship with rigid base 2100 during rotation of the assembly about the axes of journals 2560 and 2561. In some instances, it may be advantageous to incorporate cam devices or similar mechanisms in journals 2560 and 2561 which would create non-parallel relationship of the leg member containment assembly with rigid base 2100 during rotation of the assembly about its axes.

Figure 48:
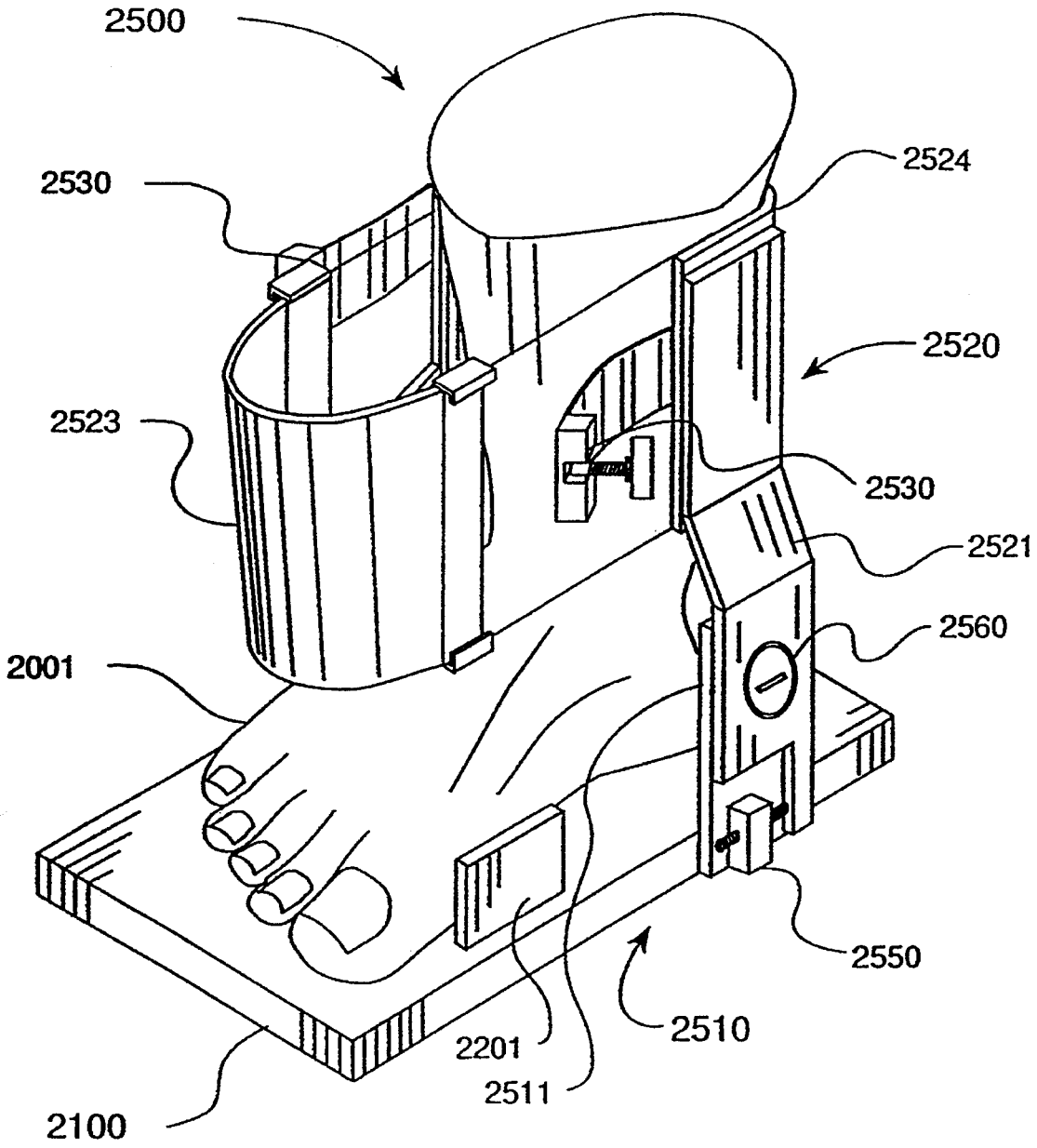
FIG. 48 is an isometric view of the leg member of FIG. 47.

FIG. 48 is an isometric view of the footwear device 2000 illustrating leg member anterior element 2523 in an exploded view about to be inserted into leg member posterior element 2524. Leg member anterior element 2523 is fitted with four flanges (one of which is hidden). These flanges act at the medial and lateral inferior and superior aspects to interlock leg member anterior element 2523 with leg member posterior element 2524 so as to substantially unite the two elements.

Figure 49:
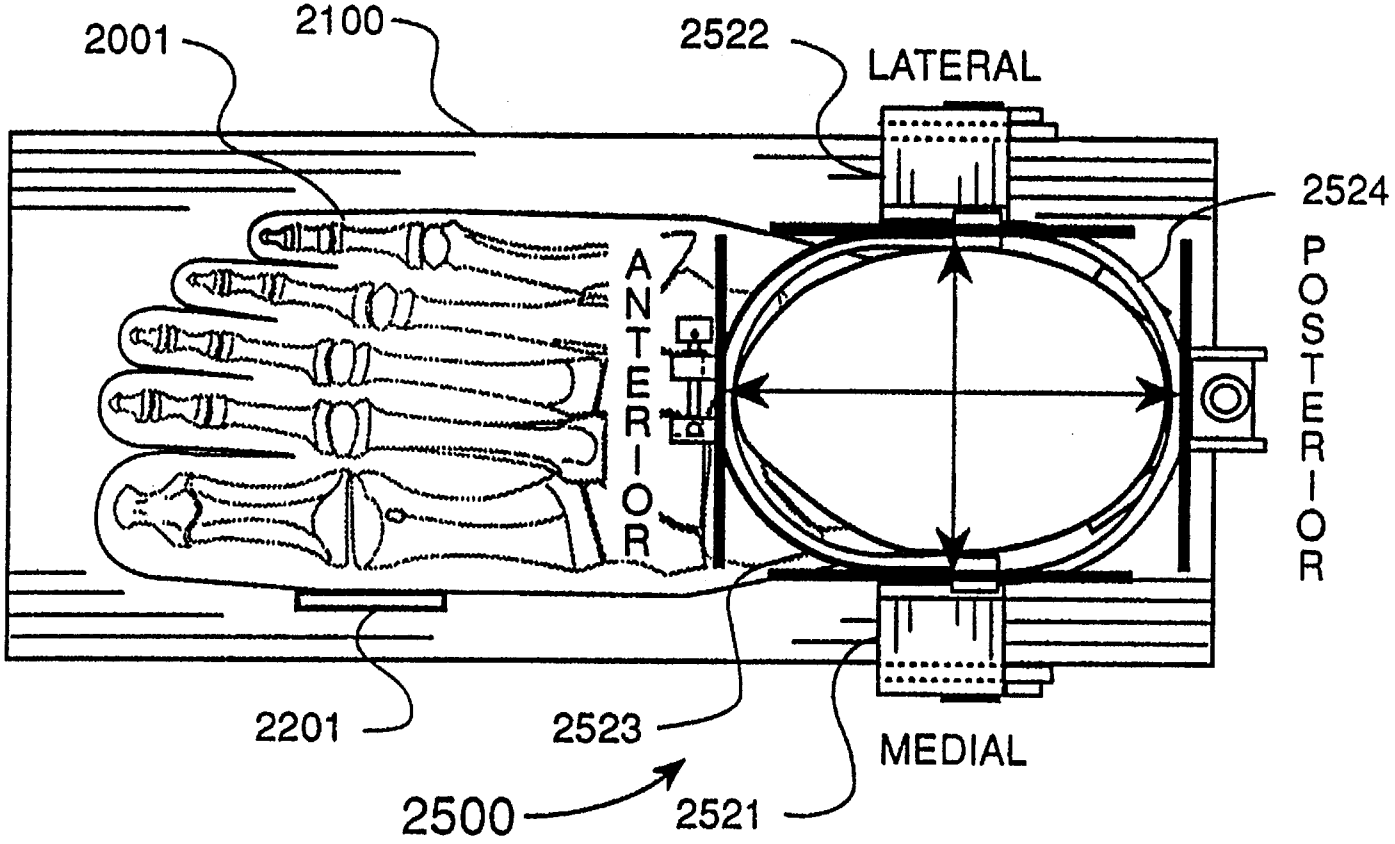
FIG. 49 is a plan view showing the leg member of FIG. 47.

FIG. 49 illustrates leg member 2500 in a plan view with the leg of a user within the encirclement formed by leg member anterior element 2523 and leg member posterior element 2524. Heavy black lines and annotations indicate the medial, lateral, anterior and posterior faces of the leg member containment assembly. Arrows within the assembly indicate the spatial relationship of these opposing faces.

It is an object of the invention that when leg member anterior element 2423 is interfaced with leg member posterior element 2424 so as to contact the leg of the user at the medial, lateral, anterior and posterior aspects of the upper leg member assembly 2520 and the adjustment is secured by anterior/posterior coupling means 2530, the medial/lateral spacing of the leg member assembly faces is substantially maintained during normal operation of the footwear device 2000 and the anterior/posterior spacing is not exceeded.

Further, it is an object of the invention that contact with the anterior aspect of the shin of the user by leg member anterior element 2523 and contact with the calf muscle of the user by leg member posterior element 2524 be substantially maintained during rotation of leg member 2500 about its axes at journals 2560 and 2561 such that the upper leg member containment assembly 2520 responds, as directly as possible, and without delay, to forward or rearward movement of the leg so that the influence on the leg of upper leg member containment assembly 2520 is constantly maintained during normal operation of the footwear device 2000. It is also an object of the invention that contact with the leg by the medial and lateral faces of the superior aspect of upper leg member containment assembly 2520 be similarly maintained during normal operation of the invention.

It is of importance, and an object of the invention, that means be provided to ensure that force applied by the anterior/posterior faces of the upper leg member containment assembly 2520 to the anterior/posterior aspects of the leg of a user is minimized. There are two reasons for this. First excessive force may act to compress the posterior muscles of the leg of the user. Compression of this nature could interfere with physiologic function of the leg and foot of the user. It is an object of the invention to accommodate physiologic function. Therefore, anterior/posterior compression of the leg by the leg member assembly which is deleterious to physiologic function is to be avoided.

The second reason has to do with the necessity of permitting the leg of a user to rotate within the upper leg member containment assembly 2520, FIG. 22C and the accompanying explanatory material previously provided in this disclosure indicate the obligatory internal rotation of the leg, accompanying pronation of the foot, which is required in making a transition from a bipedal to a monopedal stance. External rotation of the leg occurs in making the transition from a monopedal to a bipedal stance. In order to accommodate the physiologic function associated with a bipedal and a monopedal stance, upper leg member containment assembly 2520 must accommodate this rotation of the leg. It is an object of the invention to provide for such rotation. It will also be noted from FIG. 52 that the user's ankle is free to move medially to accommodate the physiologic function associated with movement from a bipedal to a monopedal stance.

In order to ensure correct functioning of the footwear device 2000, the construction of leg member anterior element 2523 and leg member posterior element 2524 must be of a form which anticipates rotation of the leg of a user and a material which does not interfere with or delay this movement. In this respect, design and construction which renders leg member anterior element 2523 "anatomically conforming" should be avoided. As the posterior aspect of the leg of a user is composed of soft tissue, which is somewhat accommodating in nature, some degree of "anatomic conformance" of leg member posterior element 2524 with the calf of the user is of no consequence provided the postero-lateral and postero-medial oblique aspects of the calf are not unduly compressed. However, excessive anterior/posterior compression of the leg, as previously stated, is to be avoided.

Figure 50:
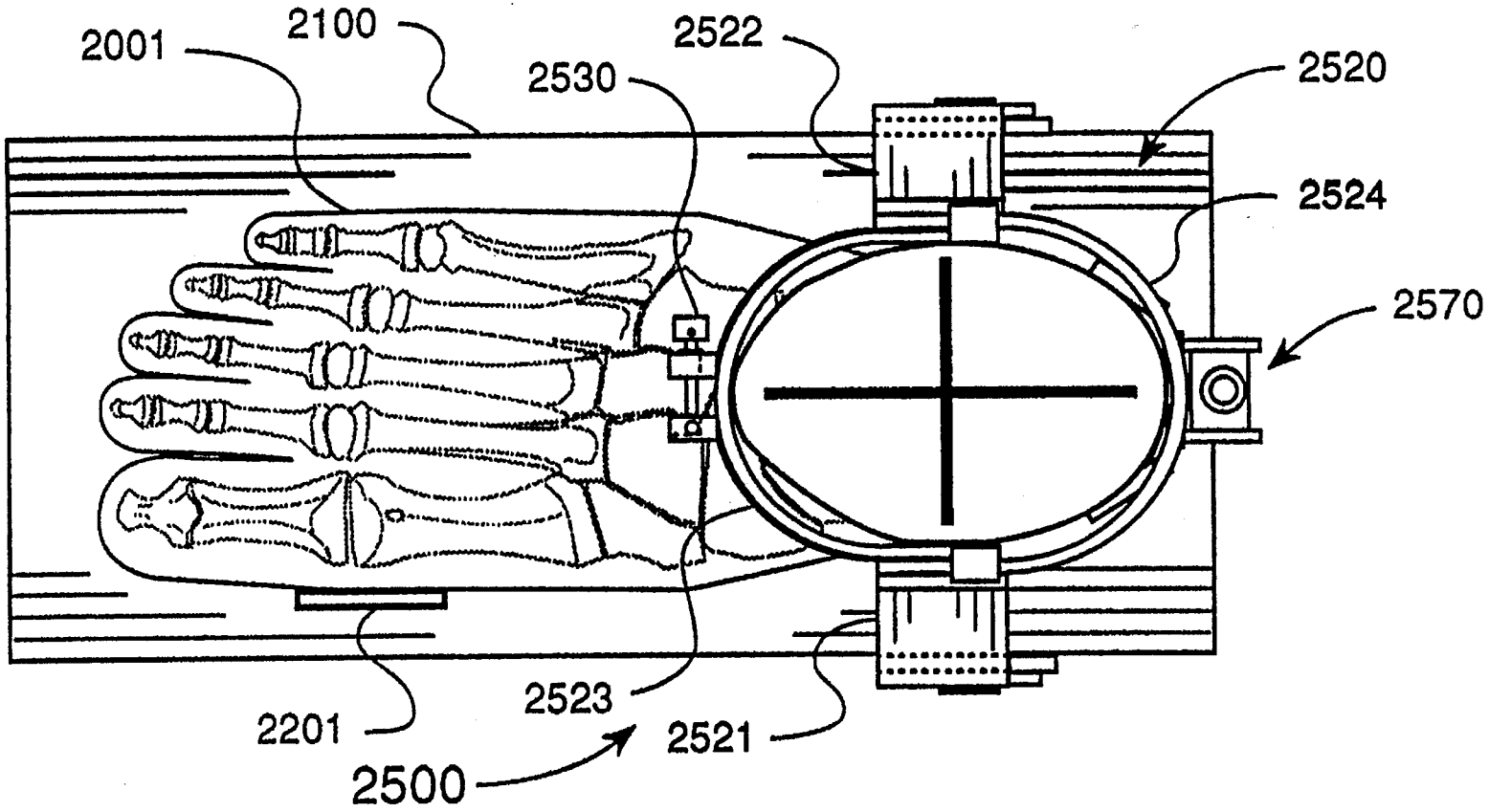
FIG. 50 is a plan view of the leg member of FIG. 47 with the leg of a user in a bipedal stance illustrated within the leg member.

FIG. 50 illustrates a plan view of the footwear device 2000 with the leg of a user in a bipedal stance illustrated within the upper leg member containment assembly 2520. The longitudinal and transverse axes of the leg of a user are indicated with a cross.

Figure 51:
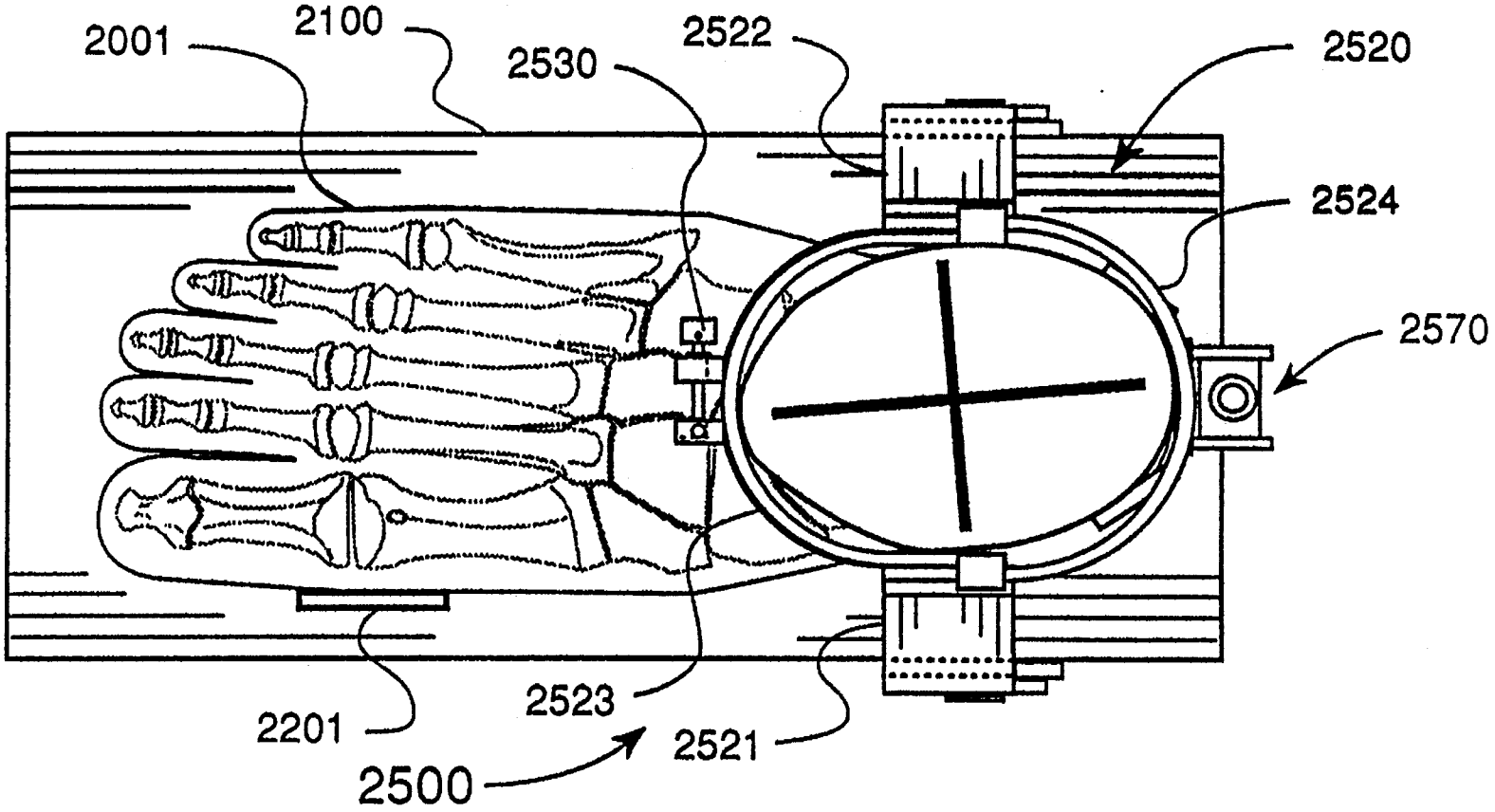
FIG. 51 is a plan view of the leg member, similar to FIG. 50, but with the leg of a user in a monopedal stance.

FIG. 51 illustrates a plan view of the footwear device 2000 with the leg of a user in a monopedal stance illustrated within the leg member containment assembly. Note the rotation of the leg, indicated by a heavy black cross, which has occurred relative to rigid base 2100 as compared to its position in FIG. 50.

In FIGS. 50 and 51, with the exception of rigid base 2100 and continuous medial forefoot counter 2201, other elements of the footwear device 2000 have been omitted for the sake of clarity.

Figure 52:
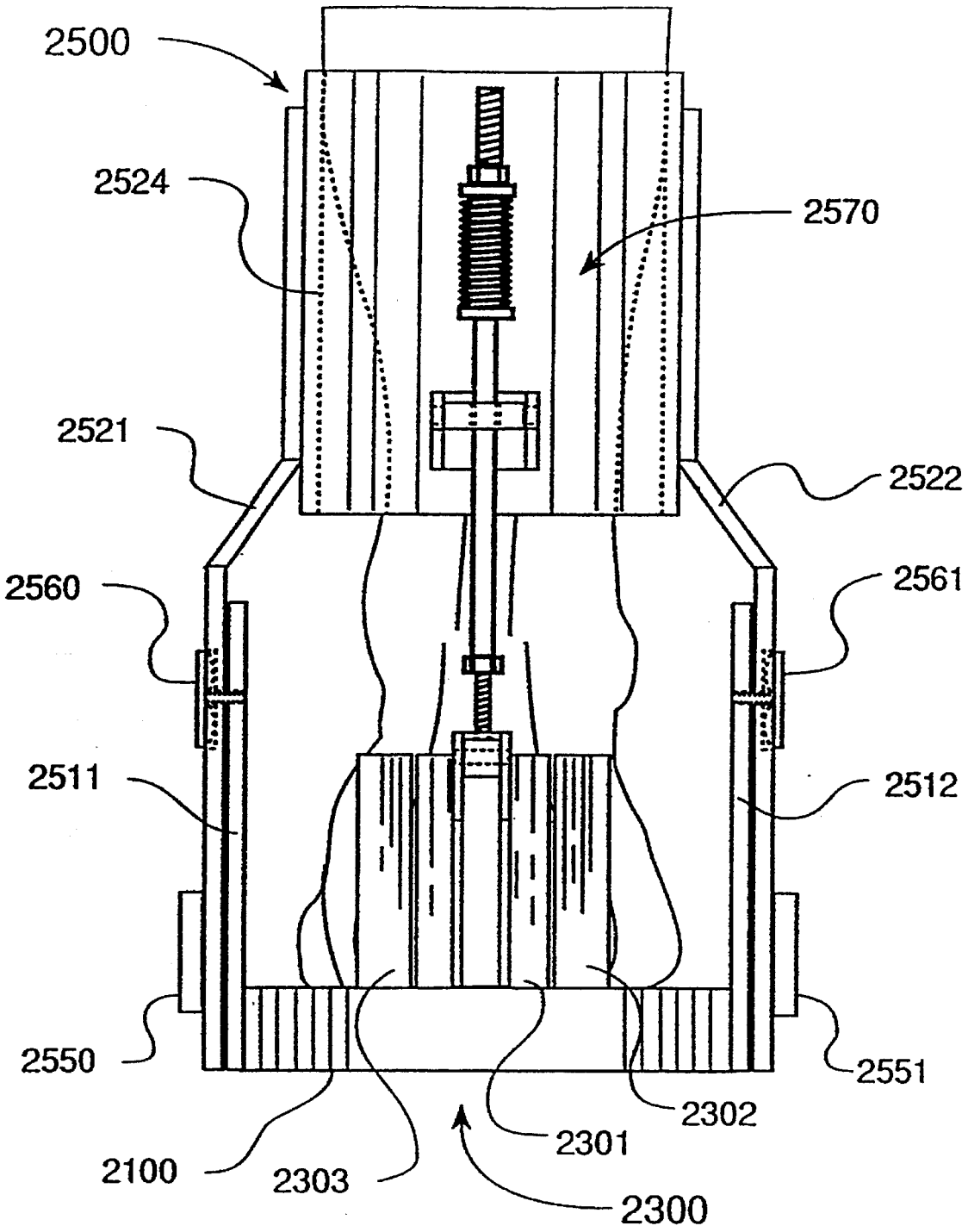
FIG. 52 is a posterior elevation of the leg member of FIG. 47.

FIG. 52 illustrates a posterior elevation of the footwear device 2000 illustrating the elements of leg member 2500. The leg of a user in a bipedal stance is illustrated positioned within the leg member assembly. With the exception of rigid base 2100 and heel counter 2300 other elements of the invention have been omitted for the sake of clarity. Attention is drawn to the dashed lines indicating the medial and lateral aspects of the leg of a user. Note that contact of the leg with the medial and lateral face of the upper leg member containment assembly 2520 occurs only at its superior aspect. Careful examination of the medial and lateral areas of the leg situated between the superior aspect of the leg member containment assembly and heel counter 2300 will reveal that clearance is provided between the leg of a user and medial leg member rigid mount 2511, lateral leg member rigid mount 2512, medial leg member arm 2521 and lateral leg member arm 2522, such that contact with the leg by these structures, particularly the malleolus, during the normal operation of the footwear device 2000 is avoided.

Figure 53:
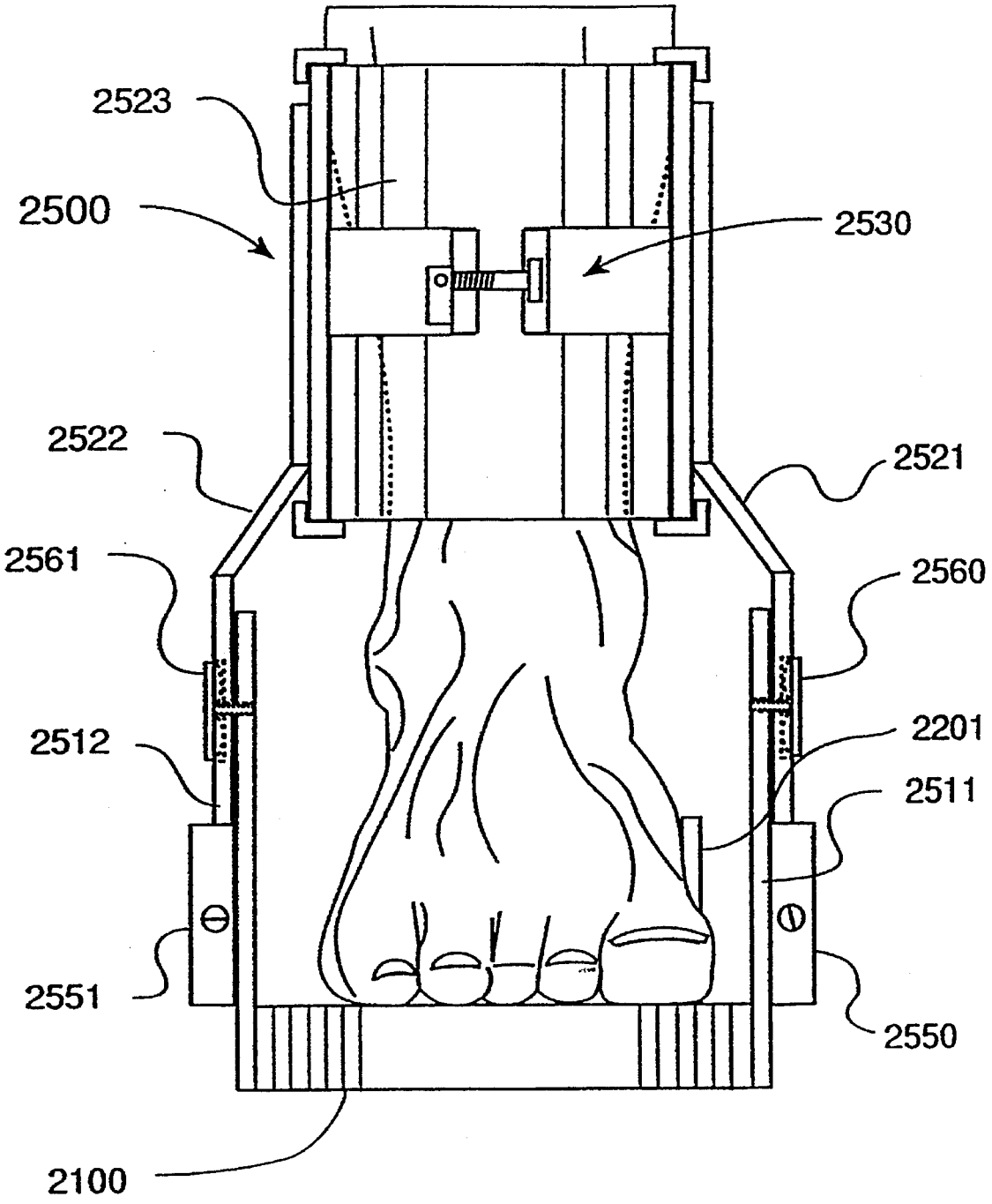
FIG. 53 is an anterior elevation of the leg member of FIG.

FIG. 53 illustrates an anterior elevation of the footwear device 2000 illustrating the elements of leg member 2500 with the leg of a user in a bipedal stance in position within the footwear device 2000. With the exception of rigid base 2100 and continuous medial forefoot counter 2201 other elements of the invention have been omitted for the sake of clarity. As in FIG. 52 attention is directed to the dashed lines indicating the medial and lateral aspects of the leg of a user. Again, clearance provided which ensures that contact of the malleolus with structures of the leg member will be avoided during normal operation of the footwear device 2000 should be noted by the reader.

Leg mender 2500 is fitted with three mechanisms for controlling the movement of the leg member containment assembly; medial rear travel limiter 2550 and lateral rear travel limiter 2551, medial journal/resistance means 2560 and lateral journal/resistance means 2561 with optional BELLEVILLE™ washer 2564, and forward travel limiter 2570.

In the case of medial rear travel limiter 2550 and lateral rear travel limiter 2551 at least one of these elements is to be provided. In this particular embodiment, both medial and lateral rear travel limiters, 2550 and 2551 are provided.

In the case of medial journal/resistance means 2560 and lateral journal/resistance means 2561, at least one of the journals is to be fitted with a resistance means such as BELLEVILLE™ washer 2564.

FIG. 54A illustrates the elements of journal tension adjustment means 2560 and 2561 in Section A—A (see FIG. 47) while FIG. 54B illustrates the elements of rear travel limiters 2550 and 2551.

Rear travel limiters 2550 and 2551 comprise travel limiter mounting base 2552 (typical), travel limiter adjustment screw 2553 and lock nut 2554. A travel limiter mounting base is connected to medial leg member rigid mount 2511 and lateral leg mender rigid mount 2512 opposite the extensions of medial leg mender rigid arm 2521 and lateral leg mender rigid arm 2522. Lock nuts 2554 are threaded onto each of the two travel limiter adjustment screws 2553 which are then threaded into the receiving threads in the two travel limiter mounting bases 2552. Travel limiter adjustment screws 2553 are adjusted so as to contact the extensions on medial leg member rigid arm 2521 and lateral leg mender rigid arm 2522 and establish the rearmost position of leg member posterior element 2524. Lock nuts 2554 are then tightened so as to secure the adjustments of travel limiter adjustment screws 2553.

Journal/resistance means 2560 and 2561 are comprised of axis screw(s) 2562 (typical), which rotatably connect medial leg member rigid mount 2511 to medial leg member rigid arm 2521 and lateral leg member rigid mount 2512 to lateral leg member rigid arm 2522, and flat washer(s) 2563 which are positioned between medial leg member rigid mount 2511 and medial leg member rigid arm 2521 and lateral leg member rigid mount 2512 and lateral leg member rigid arm 2522 so as to establish a specific contact area between the two sets of members.

For a relatively free hinging section, axis screw(s) 2562 are typically inserted through medial/lateral leg member rigid arms 2511 and 2512. The male threaded end of axis screws 2562 are then threaded into the receiving threads of medial/lateral leg member rigid mounts 2521 and 2522 until the leg member rigid arms are drawn into close contact with medial and lateral leg member rigid mounts 2511 and 2512. Care should be taken to ensure that medial and lateral leg member rigid arms 2521 and 2522 rotate with relative freedom. In order to maintain adjustments, some type of lock setting agent or threaded lock setting insert should be employed on the screw threads.

If additional resistance to the rotation of leg member rigid arms 2521 and 2522 about leg member rigid mounts 2511 and 2512 is required, axis screw(s) 2562 are removed and a BELLEVILLE™ washer(s) 2564 is placed in either one or both of the medial and lateral leg member rigid arms on the seat recessed into the arms. Axis screw(s) 2562 are then re-inserted as previously described and tightened until the desired tension is exerted by axis screw(s) 2562 on BELLEVILLE™ washer(s) 2564 to exert the force on medial leg member rigid mount 2511/medial leg member rigid arm 2521 and lateral leg member rigid mount 2512/medial leg member rigid arm 2522 required to resist rotation of these assemblies about their axis.

Figure 55A:
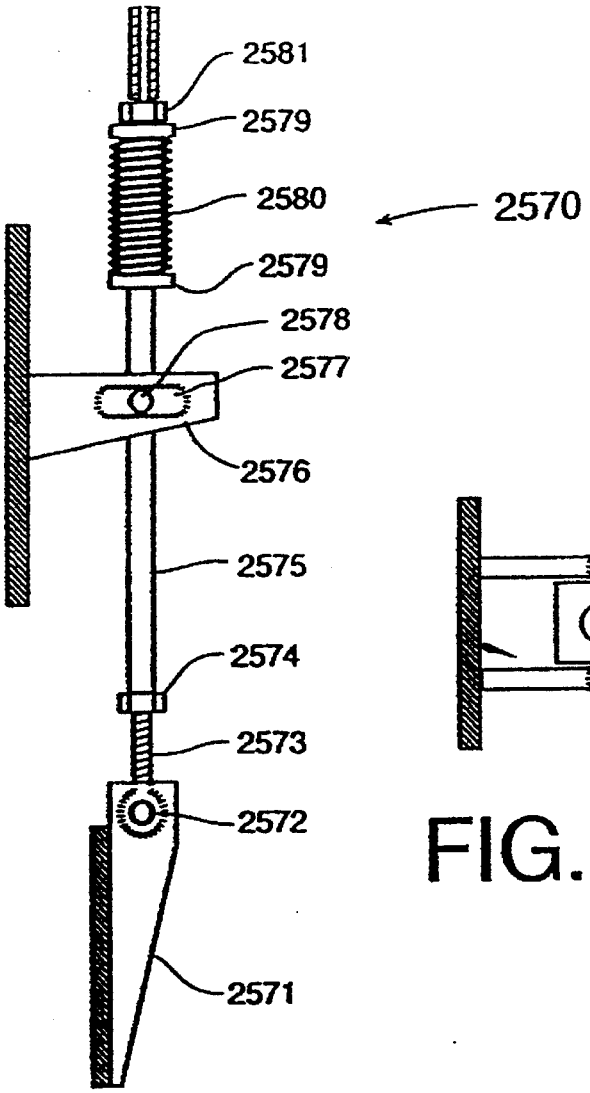
Figure 55B:
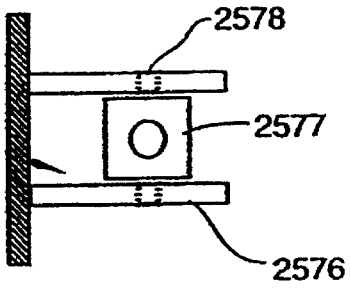
Figure 55C:
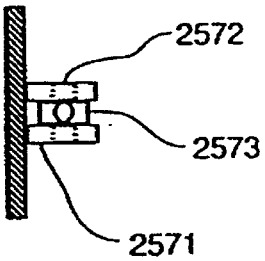
Figure 55D:
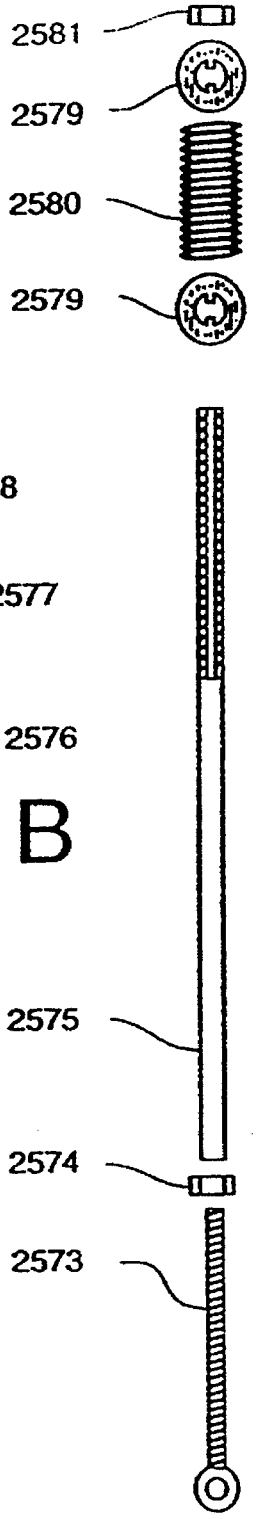

FIGS. 55A, B, C and D illustrate forward travel limiter 2570 comprised of lower rod mount 2571, lower rod pivot 2572, lower rod 2573, lock nut 2574, upper rod 2575, upper rod guide mount 2576, upper guide spring stop 2577, rod guide pivot 2578, keyed washers (2) 2579, spring 2580 and spring tension adjustment nut 2581.

Lower rod mount 2571 is rigidly mounted to the posterior aspect of posterior heel counter 2301 and to rigid base 2100. Lower rod 2573 is connected to lower rod mount 2571 by lower rod pivot 2572. Lock nut 2574 is threaded onto the upper section of lower rod 2573. Upper rod 2575, which is hollow and threaded internally, is threaded onto lower rod 2573 such that an assembly is created which can be shortened or lengthened so as to effect adjustment of the position of the spring assembly mounted on the superior aspect of the assembly.

Upper rod guide mount 2576 is rigidly mounted to the posterior aspect of leg mender posterior element 2524. The hole in upper guide spring stop 2578, intended to receive upper rod is 2575, is inserted over upper rod 2575. Rod guide pivot pin 2578 is then inserted through upper rod guide mount 2576 and upper guide spring stop 2577 such that the movement of upper rod 2575 is guided by upper guide spring stop 2577.

Keyed washer 2579 is then fitted into the guide slots in the upper portion of upper rod 2575, which is threaded so as to receive spring tension adjustment nut 2581, so as seat at the lower end of the guide slots. Spring 2580 and keyed washer 2579 are positioned on upper rod 2575 and spring tension adjustment nut 2581 is threaded onto upper rod 2575 so as to exert a force on the top of keyed washer 2579 which acts to compress spring 2580.

The adjustment of the means controlling the movement of the upper leg member containment assembly 2520 is as follows. As a first adjustment the user will ascertain the angle at which leg member posterior element 2524 is required to engage the posterior aspect of the leg. Lock nuts 2554 of medial and lateral rearward travel limiters will be loosened. Travel limiter adjustment screws 2552 (typical) will then be adjusted until the screws contact the extensions of medial and lateral leg member rigid arms 2521 and 2522. Lock nuts 2554 of medial and lateral rearward travel limiters will be tightened so as to secure the adjustment.

The user will then proceed to adjust the position at which forward travel limiter 2570 arrests the forward movement of upper leg member containment assembly 2520. This is accomplished by first loosening lock nut 2574 and then rotating upper rod 2575 about lower rod 2573 until such time as keyed washer 2579 engages upper guide spring stop 2577 at the approximate limit of forward travel of upper leg member containment assembly 2520. Further forward movement of the leg member containment assembly causes spring 2580 to be compressed so that movement is eventually arrested. The force at which forward movement of upper leg member containment assembly 2520 is arrested can be adjusted by adjusting the force brought to bear on spring 2580 by spring tension nut 2581. If the specification of spring 2580 is insufficient, springs of different tension may be substituted. Once the correct tension has been established on spring 2580, the forward limit of upper leg member containment assembly 2520 should be verified and further adjustment made, if required.

Forward travel limiter 2570 functions to arrest the movement of the leg of the user in forward flexion just prior to the limit of the natural range of motion of the ankle joint. When correctly adjusted the action of forward travel limiter 2570 permits the user to utilize substantially the full range of motion of the ankle joint. This is particularly advantageous when the ankle joint is used for flexion/extension in combination with the knee and hip joints. In some applications, the user may wish to limit forward flexion of the ankle joint. This being the case, forward travel limiter 2570 can be adjusted to arrest forward flexion of the leg after a specified amount of rotation of upper leg member containment assembly 2520 about its axis with lower leg member mount assembly 2510.

FIG. 56 is a graphical illustration showing the interaction and influence on the movement of leg member upper containment assembly 2520 about its axes of rear travel limiters 2550 (and 2551), journal tension means 2560 (and 2561) and forward travel limiter 2570. Arrows indicate the adjustment potential of the three mechanisms.

FIG. 57 illustrates the elements of anterior/posterior containment coupling means generally shown at 2530 and comprised of medial spring steel band 2531, lateral spring steel band 2532, closure rod pivot mount 2533, rod closure receptor mount 2534, rod pivot pin 2535, threaded closure rod 2536, flat washer 2537 and rod closure nut 2538.

FIG. 57 A illustrates a plan view of anterior-posterior containment coupling means 2530 illustrating the elements of which it is comprised. The pivoting action of threaded closure rod 2536 about closure rod pivot 2533 allows it to engage and disengage the notch of rod closure receptor mount 2534.

FIG. 57 B illustrates an anterior elevation of anterior-posterior containment coupling means 2530 illustrating the elements of which it is comprised.

FIG. 57 C illustrates the individual elements of anterior-posterior containment coupling means 2530.

Medial spring steel band 2531 is connected to the interior aspect of the medial aspect of leg member posterior element 2524 at the approximate inferior/superior center. Lateral spring steel band 2532 is similarly connected to the lateral aspect of leg member posterior element 2524. Closure rod pivot mount 2533 is connected to the anterior end of medial spring steel band 2531 while closure rod receptor mount is connected to the anterior end of lateral spring steel band 2532.

Rod pivot pin 2535 is inserted down through the receiving hole in the top of closure rod pivot mount 2533. Threaded closure rod 2536 is then screwed into the receiving threads in closure rod pivot pin 2535 so that threaded closure rod 2536 is now pivotally connected to medial spring steel band 2531 by closure rod pivot mount 2533.

Flat washer 2537 is positioned on threaded closure rod 2536 and rod closure nut 2538 is threaded onto threaded closure rod 2536.

The operation of anterior/posterior containment coupling means 2530 is as follows: With the leg of a user positioned on the rigid base and forefoot/midfoot pivotal support 2400 adjusted as previously described, the calf of the leg is positioned against the anterior face of leg member posterior element 2524. The flanges of leg member anterior element 2523 are engaged with leg member posterior element 2524 and the posterior aspect of leg member anterior element 2523 brought into contact with the anterior aspect of the leg of the user.

Closure rod pivot mount 2533 and closure rod receptor mount 2534 are then brought into proximity with each other so that threaded closure rod 2536 can be rotated on the axis of closure rod pivot pin 2535 so as to engage in the receiving notch of closure rod receptor mount 2534 with flat washer 2537 and closure rod nut 2538 situated medial of the lateral aspect of closure rod receptor mount 2534. Closure rod receptor nut 2538 is then rotated about the threads of threaded closure rod 2536 such that closure rod pivot mount 2533 is drawn together with closure rod receptor mount 2534.

Medial and lateral spring steel bands 2531 and 2532 are drawn together by their connections to closure rod pivot mount 2533 and closure rod receptor mount 2534 such that leg member anterior element 2523 is drawn together with leg member posterior element 2524. As previously mentioned, care should be exercised in adjusting the anterior/posterior spacing of leg member anterior element 2523 and leg member posterior element 2524 in order to ensure that excessive compression force is not applied to the leg of the user which would adversely affect the posterior muscles.

Leg member 2500 has several useful functions. Its principal function relates to the maintenance of physiologic function of the user. In this respect, the functions of leg member 2500 pertain mainly to the control of position, and movement of, the leg of the user at the superior aspect of upper leg member containment assembly 2520 relative to rigid base 2100.

Leg member 2500 serves to augment the function of, and is dependent on, the lower assembly of the footwear device 2000 comprised of rigid base 2100, side counters 2200, heel counter 2300 and forefoot/midfoot pivotal support 2400. In order for leg member 2500 to influence the leg of a user in a manner which supports the objects of the invention, the position and displacements of the foot relative to rigid base 2100 must be controlled by the aforementioned elements as a requisite for correct functioning of leg member 2500.

Leg member 2500 acts to define the position of the medial and lateral aspects of the leg at the superior aspects of upper leg member containment assembly 2520 relative to rigid base 2100 during rotation of the leg member about its axes. That is to say, at predetermined positions of the upper leg member containment assembly 2520, the medial/lateral, anterior/posterior aspects of the leg at the superior aspect of upper leg member containment assembly 2520 will have specific positions relative to rigid base 2100.

This function is useful for several reasons. First, a pronated or supinated position of the foot relates, to a large degree, to the position of the center of the inferior head of the tibia relative to a line bisecting the center of the heel and the center of the leg at the superior aspect of the footwear device 2000. FIG. 58 illustrates three views of the posterior aspect of the foot and leg.

Figures 58A, 58B, 58C:
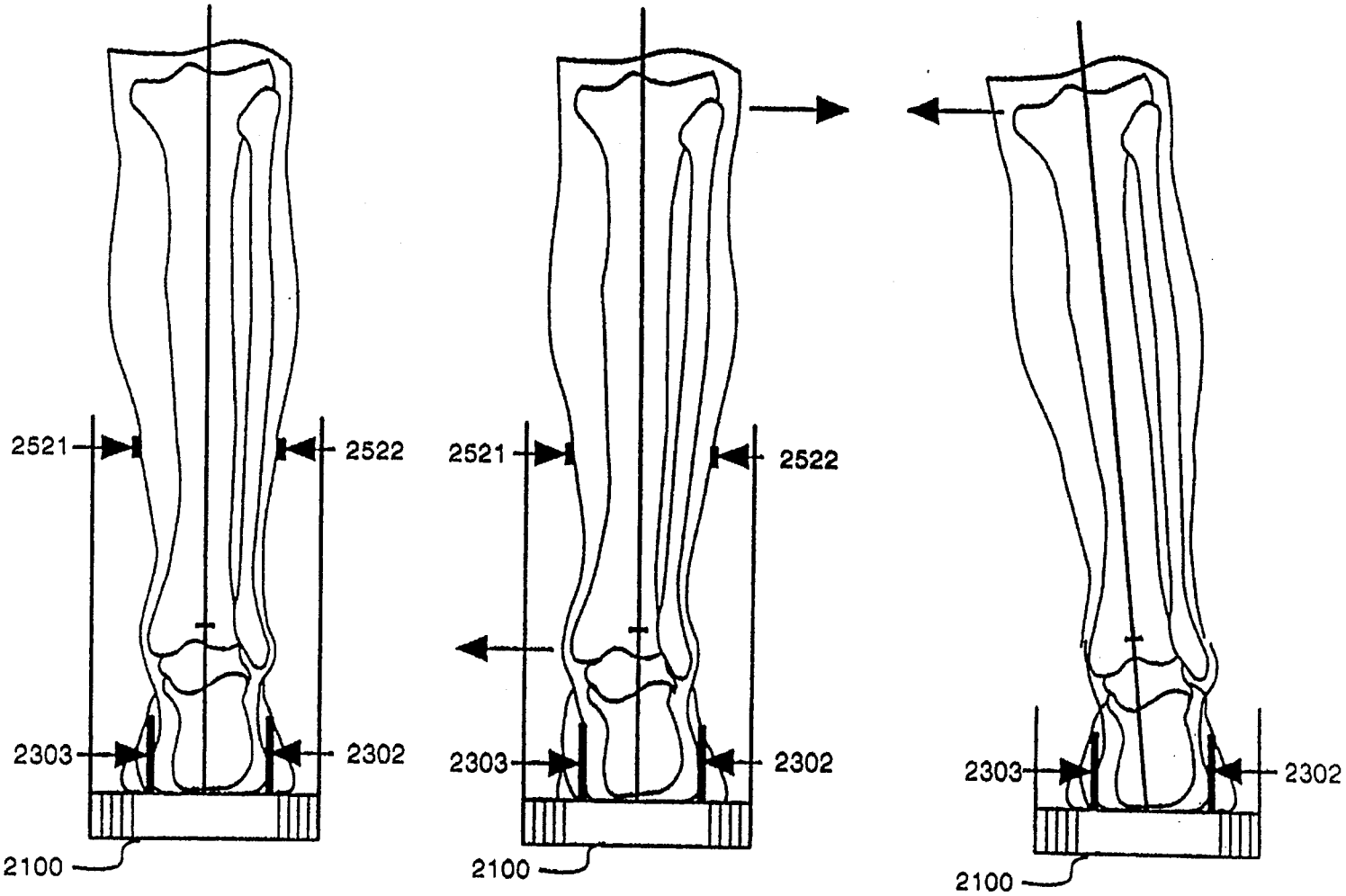

FIG. 58A depicts the foot in a neutral or bipedal stance. Arrows indicate the influence of postero-medial and postero-lateral heel counters 2301 and 2302 and the medial and lateral aspects of upper leg member containment assembly 2520 in maintaining the position of the corresponding aspects of the heel and leg of a user relative to rigid base 2100. A vertical axis is drawn to indicate the approximate center of the inferior head of the tibia. In this figure, the three reference points are approximately centered on the vertical axis.

FIG. 58B depicts the foot in a pronated or bipedal stance. Arrows indicate the influence of postero-medial and postero-lateral heel counters 2301 and 2302 and the medial and lateral aspects of upper leg member containment assembly 2520 in maintaining the position of the corresponding aspects of the heel and leg of a user relative to rigid base 2100. A vertical axis is drawn to indicate approximate center of the inferior head of the tibia. In this figure, the center of the inferior head of the tibia now lies medial to the vertical axis.

FIG. 58C depicts the foot in a position that appears to be neutral or in a bipedal stance in terms of the relation of the foot to rigid base 2100 but supinated in terms of the relation of the superior aspect of the lower leg relative to rigid base 2100. Note that in this figure the arrows representing the influence of upper leg member containment assembly 2320 on the lower leg have been deleted indicating that this element has been omitted. In certain situations, external forces exerted on the footwear device 2000 without the inclusion of leg member 2500 could act to disrupt the relationship of the three reference points of the foot and leg as illustrated in FIG. 58A, bipedal stance, and FIG. 58B, monopedal stance. The result could be a disruption of the relationship of the three reference points as illustrated in FIG. 58C. In terms of the objects of the footwear device 2000, such disruption interferes with the physiologic function of a bipedal or monopedal stance.

Leg member 2500 acts in cooperation with rigid base 2100, side counters 2200, heel counter 2300 and forefoot/midfoot pivotal support 2400 in controlling the position of the leg of a user at the superior aspect of upper leg member containment assembly 2520 relative to rigid base 2100. In this respect, leg member 2500 assists other elements of the footwear device 2000 in maintaining the physiologic function of the user.

The medial and lateral control of the associated aspects of the leg of a user serves an additional function. An object of the invention is to control movement of the foot and leg so as to render key aspects of such movement predictable and consistent relative to rigid base 2100. In cooperation with heel counter 2300, leg member 2500 serves to establish "reference points" which serve to define the medial/lateral shifting of the malleolus which occurs during the transition between bipedal and monopedal stances. The limitations imposed on the foot and leg tend to make many of the movements which accompany the medial/lateral shifting of the malleolus, repetitive in nature. Repetition is essential for learning new skills. Thus, control of medial/lateral shifting of the malleolus in conjunction with control of other movements of the foot by the elements of the footwear device 2000 is advantageous to the user in developing competence in the activity relating to the application of the footwear device 2000.

When the user makes the transition from a bipedal to a monopedal stance or vice versa, the influence and cooperation of forefoot/midfoot pivotal support 2400 and leg member 2500 ensures that lateral/medial displacement within the footwear device 2000 relative to rigid base 2100 will occur primarily at the malleolus. Control of the movements of the leg in this manner assists the user in orienting the position of the upper body in attaining a balanced position in a bipedal or monopedal stance.

The function of leg member 2500 in influencing medial/lateral shifting of the malleolus of the user is dependent on several things. First, it is essential that no materials are introduced between the medial/lateral influence on the leg at the superior aspect of upper leg member containment 2520 and the postero-medial, postero-lateral and posterior influences on the heel of the user at heel counter 2300 which would interfere with the medial/lateral shifting of the leg between these two points. This is particularly true of the areas adjacent to the malleolus. Second, the function of leg member 2500 is dependent on the action of forefoot/midfoot pivotal support 2400 in maintaining the heel of the user in constant contact with heel counter 2300, in particular, in contact with posterior heel counter 2301.

Another function relates to providing a source of resistance to counter reaction forces arising out of the action resulting from the contraction posterior muscles of the lower leg. The accommodation of the physiologic states associated with bipedal and monopedal functions encompasses the use of the powerful posterior muscles of the lower leg. These muscles act primarily as extensors in isometric contraction exerting a downward force at the forefoot which assists in maintaining the body in balance in an upright stance. The posterior muscles also function as active extensors in plantar-flexing the foot to provide for propulsion.

In order to maintain a person in an upright, balanced stance on a flat surface, the weight of the body must exert itself anterior to the anterior aspect of the inferior head of the tibia but posterior to the head of the first metatarsal. In this state, the posterior muscles act in isometric contraction to lock the ankle joint by exerting a downward acting force at the heads of the metatarsals. This action balances the force exerted by the weight of the human body. This is one of the primary elements of fore/aft balance in both bipedal and monopedal function.

In the application to activities such as skating and, in particular, skiing, the posterior muscles act in both isometric contraction and active extension to both exert internal downward acting forces on rigid base 2100 and to neutralize external forces acting on the skier so as to maintain the user in substantially upright bipedal or monopedal balanced stance. The posterior muscles also act to exert a downward acting force to the front of the ski by exerting a downward force on rigid base 2100 at the heads of the metatarsals.

Sports such as skating and skiing are dynamic in nature. The ability of the user to efficiently exert a downward directed force on the front of the ski during specific moments is advantageous in asserting control of the device. Such force is best exerted by the posterior muscles acting to exert a downward directed force at the heads of the metatarsals. The availability of these muscles for such purpose is reliant on the physiologic function pertaining to a bipedal or monopedal stance both of which are accommodated and supported by the footwear device 2000.

A downward directed force as described involves an increase in the isometric contraction of the posterior muscles of the leg of the user beyond the force required to be exerted on the heads of the metatarsals for the maintenance of an upright stance. The increase in the intensity of isometric contraction of the posterior muscles will result in active extension of the foot, that is to say, the foot will become more aligned with the lower leg. Since the heads of the metatarsals of the user are maintained in constant contact with rigid base 2100 and the heel is maintained in constant contact with heel counter 2300, the reaction force arising out of the downward directed force at the heads of the metatarsals will tend to drive the posterior aspect of the leg of the user posteriorly. Leg member posterior element 2524, which is rigidly braced against such movement by rearward travel limiters 2550 and 2551, will act to resist such movement and thus counter the reaction force arising out of the action of the posterior muscles in exerting a downward directed force on rigid base 2100 at the heads of the metatarsals. Thus, leg member 2500 acts to increase the effectiveness of the isometric contraction of the posterior muscles in exerting downward directed forces on rigid base 2100 by resisting the reaction force arising out of such action.

The influence on the foot and leg of the user of footwear device 2000 which accommodates and supports physiologic function, and, in particular, the cooperative influence of forefoot/midfoot pivotal support 2400 in maintaining the heads of the metatarsals in constant contact with rigid base 2100 and the heel in constant contact with heel counter 2300, the relatively free hinging action of leg member 2500 in controlling movement of the leg in dorsiflexion/plantarflexion, the resistance to rearward movement of the leg at leg member posterior element 2524 beyond the limit established by medial and lateral rearward travel limiters 2550 and 2551 and the containment of the dorsum of the foot against upward movement provided by forefoot/midfoot pivotal support 2400, in combination, permits the modulation of external upward forces exerted against rigid base 2100 by the action of the posterior muscles of the leg in flexion/extension of the ankle joint or the action of the ankle joint in combination with the knee and hip joints in flexion/extension. The modulation of upward directed external forces exerted on rigid base 2100 by the use of these mechanisms allows the user to substantially maintain the position where the weight of his body exerts itself on rigid base 2100. This mechanism utilizes the ankle joint of the foot to modulate fore/aft forces acting upward on rigid base 2100 in a manner similar to that of a person pressing and releasing the gas pedal of an automobile.

By the same mechanism, the user is able to utilize muscles of the foot and leg to resist forces, when necessary, by rendering the leg substantially vertically rigid through the isometric contraction of extensors. The ability to employ such mechanisms is particularly advantageous to a user in activities such as alpine skiing where the ski, which acts as a long lever in extending the effective length of the foot, is connected to rigid base 2100 by a ski binding device.

FIG. 59 illustrates the application of the elements comprising footwear device 2000 in a ski boot generally shown at 2600. Elements of the footwear device 2000 are indicated at the appropriate areas and using the same reference numerals as before.

In this particular application, leg member 2500 comprises upper leg member containment assembly in which the leg member posterior element 2524 is pivotally connected to the inferior posterior aspect of anterior leg member element 2523 by pivot 2610. Leg member posterior element 2524 is rotated about pivot 2610 so as to open the posterior aspect of the upper leg member containment assembly to provide for entry of the foot of a user. When leg member posterior element 2524 is rotated into position so as to contact the posterior aspect of the leg of the user, its position is secured with anterior/posterior containment coupling means 2530.

Forefoot/midfoot pivotal support means 2400 is pivotally connected to rigid arch 2410 by pivot 2430. Pivot 2430 is connected to a jack device 2620. The proximal end of the jack device 2620 is connected to the shell of the footwear in the midfoot area while the distal end is connected to a track on a lever. The track is driven by a screw adjustment which allows the instep counter 2420 to be lowered so as to contact the foot of the user. The lever of jack device 2620 is pivotally connected to the shell of the footwear at its distal end such that when the lever is raised the distal leg of the jack 2620 moves upward and, in so doing, causes instep counter 2420 to be drawn upward against the top of the shell of the footwear. This action provides clearance for the entry of the foot of the user into the footwear. The arrangement and action of jack device 2620 is particularly advantageous to the user in that it moves instep counter posteriorly in conjunction with its downward movement. This movement ensures that instep counter 2420 is positioned progressively towards the posterior aspect of the footwear device as it is lowered to accommodate users with a lower instep.

FIGS. 60 A and B and 61 A and B illustrate the application of the elements comprising footwear device 2000 in a cycling shoe generally shown at 2700. The forefoot/midfoot pivotal support 2400 is pivotally connected to rigid base 2100 as shown in FIG. 1. Forefoot/midfoot pivotal support member 2400 is secured to the heel of the rigid base 2100 by lever means 2710. Lever means 2710 is comprised of a buckle arrangement connected to the rigid base 2100 in the area of postero-lateral heel counter 2302 with a seat intended to receive a lug fixed on the free end of a braided stainless steel cable the other end of which is connected to the medial aspect of the rigid base 2100 in the area of the postero-medial heel counter 2303.

In operation, the foot of the user is positioned within the footwear against heel counters 2300 and forefoot/midfoot pivotal support 2400 rotated about its axis 2720 so as to bring instep counter 2420 into contact with the dorsum of the foot. The braided cable of lever means 2710 is drawn around a cable guide located slightly distal to pivot 2430 which acts as a capstan. The lug on the end of the cable is inserted into the receiving notch on the buckle of lever means 2710 and the buckle is operated so as to effectively tension forefoot/midfoot pivotal support member 2400 on the dorsum of the foot of the user such that a downward and rearward acting force is exerted on the foot which acts to maintain the heel in constant contact with heel counters 2300 and the heads of the metatarsals in constant contact with rigid base 2100.

The application of the footwear device 2000 to a cycling shoe offers several advantages over the prior art. Effective and efficient cycling requires thrusting of the foot in forward motion, rearward motion and up stroke as well as in down stroke. While the prior art provides for containment of the foot in downstroke, it does not provide for maintaining the position of the foot on the base of the shoe so that forces exerted by the leg and foot in forward movement, rearward movement and upward movement will be transferred to the pedal as directly as possible and without delay. As previously explained in the specification and operation of the footwear device 2000, the heel of the foot is maintained in constant in contact with heel counters 2300 while the heads of the metatarsals are maintained in constant contact with the rigid base 2100. These properties of the footwear device 2000 ensure the direct transfer of force in the application to cycle shoe 2700 in all aspects of stroke.

Figure 61A:
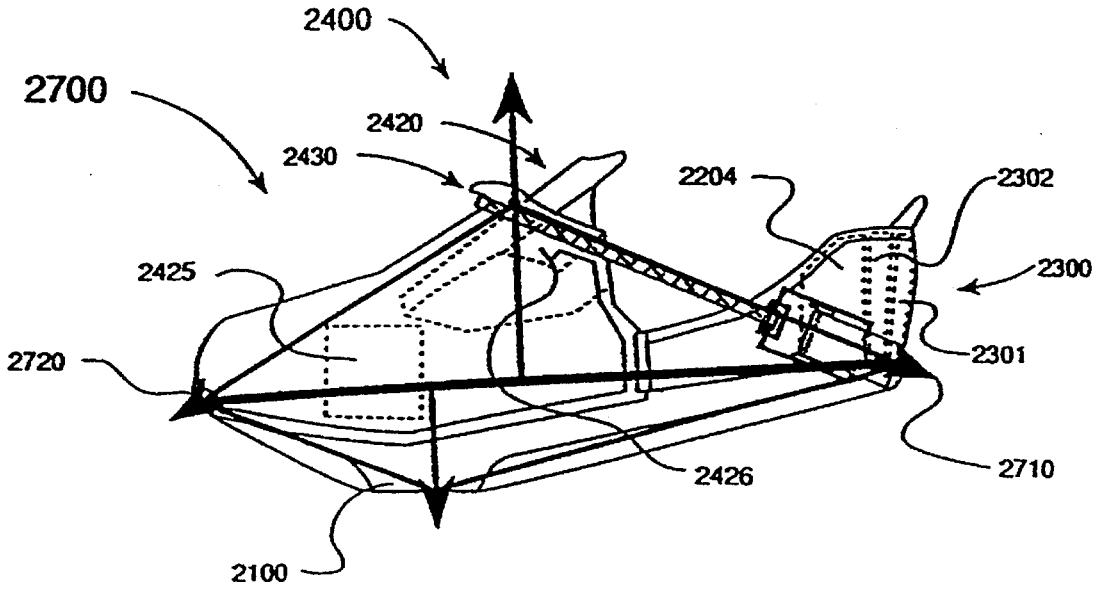

FIG. 61A illustrates the construction of rigid base 2100 and the arrangement of forefoot/midfoot pivotal support 2400 and heel counters 2300 necessary to achieve the aforementioned effect. Rigid base 2100 must be suitably stiffened against longitudinal flexing so that it acts like a truss in resisting upward movement of instep counter 2420 at pivot 2430. Similarly, forefoot/midfoot pivotal support member 2400 must be of a rigid nature which ensures that tension drawn from the distal and proximal ends of rigid base 2100 will result in 2 opposing rigid triangles.

FIG. 62 illustrates the application of the elements comprising footwear device 2000 in a hockey skate generally shown at 2800. Elements of the footwear device 2000 are indicated at the appropriate areas.

Forefoot/midfoot pivotal support mender 2400 and continuous medial forefoot counter 2201 form an integral part of the forward shell of the hockey skate which is pivotally connected to rigid base 2100 on a track located in the area of the forefoot. A buckle 2810 is located on the lateral and medial aspects of the skate which acts to secure the forward portion to the rearward portion.

Leg member 2500 and heel counters 2300 form an integral part of the rearward portion of hockey skate 2800. Rearward travel limiter 2551 is adjustable as is the tension of journal/resistance means 2560. A forward travel limiter 2570 is not fitted to this particular application of footwear device 2000.

In operation, the buckles on the lateral and medial aspects of hockey skate 2800 are disengaged and the forward portion of the skate moved forward on its track until it is disengaged with its interface with the rearward portion of the skate. At this point it can be pivoted around its axis at pivot 2830. The foot of the user can now be positioned within the footwear. Once this is done, the forward portion of the skate is pivoted back into its horizontal position and moved rearward until it is again in position in relation to the rearward portion of the skate. The lateral and medial buckles are operated so as to effect closure of the two elements.

Anterior/posterior containment coupling means 2530 is in the form of a VELCRO™ fastener strap secured on the medial aspect of leg member posterior element 2524 and drawn through a hoop on its lateral aspect. Leg member anterior element 2523 of interlocks with leg member posterior element 2524 through a flange interface fitted to the superior aspect of the two elements. Relative movement of the upper leg member containment assembly with forefoot/midfoot pivotal support member 2400 is effected with a flex link connection means 2820.

Vertical adjustment of instep counter 2420 is effected with rod 2440 which employs a non-rising stem.

ADDITIONAL DESCRIPTION OF SPECIFIC EMBODIMENTS AND OPERATION

In the application of footwear device 2000 to footwear in which an external appliance such as a skate ice blade, in-line skate wheel system, snow ski or the like is affixed in some manner to the sole of the footwear, the need arises to position the foot of the user in relation to the external appliance. This need arises because the user must be able to balance specific forces and moments acting on the external appliance while simultaneously directing force to the appliance. The affixing of such appliances to the sole of the footwear in a known manner can create problems for the user since the point of contact of the appliance with the interactive surface, be it asphalt, ice or snow, can act as a fulcrum and, in so acting, establish moment arms which the physiology of the user must counteract if an upright posture is to be established and maintained. Correct alignment of the foot in relation to such appliances is one of the objects of the embodiments which follow, since such facility is important in footwear for ice skating, in-line skating and snow skiing and is thus advantageous to the user.

There also exists a need in the economical production of footwear to adapt, and thus utilize, components, in particular those which make up the outer shell, to a broad application in terms of the consumer. However, structures utilized to allow such broad application, while predicated on economy of production cost, must also provide for the correct and satisfactory operation of the footwear. It is particularly desirous, in the case of the alpine ski boot, for example, whose outer shell is typically molded of a substantially rigid plastic of sorts, to utilize outer shells for a broad range of foot and leg sizes and yet still provide for the correct and satisfactory operation of the footwear. Thus, the invention provides means to allow the position of structures within the outer shell of the footwear, for example, medial forefoot counter 2201, heel counter 2300 and instep counter 2420, to be readily adjusted so as to make contact with the relevant discrete aspects of the foot of the individual user while leaving other areas of the foot and leg relatively free of restraint. Means is also provided to allow for the substitution or modification of structures of a form more suited to the individual user.

PERIPHERAL COUNTERS

FIG. 63 shows a plan view of the rigid base 2100 with the foot of a user 2001 positioned thereon so as to contact the heel counter 2300, medial forefoot counter 2201 and superolateral first metatarsal counter 2422. The sole of the footwear, which serves as the interface for the attachment by known means to snow skis, skate ice blades, in-line skate wheel systems and the like, is shown at 2101. Other parts of the footwear device 2000 have been omitted for the sake of clarity. A dashed line running longitudinally substantially through the center of the head of the first metatarsal represents the position of the inside edge of a snow ski in the event one were to be affixed to sole 2101.

Medial forefoot counter 2201 is fitted with a retention means generally shown at 2210 which incorporates a base plate 2211. Base plate 2211 acts as a mounting device to affix medial forefoot counter 2201 to the superior surface of rigid base 2100. An inverted threaded flat head screw 2221 (FIG. 64) can move within a slot 2223 formed in the side of rigid base 2100 and which extends mediolaterally in the interior of rigid base 2100. The threaded portion of flat head screw 2221 extends superiorly through the superior surface of rigid base 2100. Base plate 2211 has a receiving hole through which flat head screw 2221 extends when base plate 2211 is positioned on rigid base 2100. Threaded cap 2222 threads onto the receiving threads of flat head screw 2221 such that medial forefoot counter 2201 is secured to rigid base 2100 and its position fixed when threaded cap 2222 is tensioned against flat head screw 2221.

FIG. 64 shows an anterior elevation of the foot. The structure of footwear device 2000 is as shown in FIG. 63. The adjustment slot 2223 in which the inverted flat head screw 2221 can move within rigid base 2100 is shown with dashed lines as is flat head screw 2221. A separate dashed line represents substantially the position where the inside edge of a snow ski would be located in the event one were affixed to sole 2101.

When tension is released on base plate 2211 by backing off threaded cap 2222, retention means 2210 along with medial forefoot counter 2201 can be shifted medially or laterally on rigid base 2100 to the desired location within the range of adjustment provided by the slot 2223. The advantage of such an arrangement being that medial forefoot counter 2201 is now independent of rigid base 2100. It can thus be removed and replaced with a medial forefoot counter of different specification or adjustments can be made to the counter's position on rigid base 2100.

FIG. 65 shows the same view as FIG. 63 except that the foot 2001 of the user positioned on rigid base 2100 is narrower in width than the foot 2001 of the user shown in FIG. 63 with the effect that, with the foot correctly aligned longitudinally on rigid base 2100, the medial aspect of the head of the first metatarsal is not in contact with the lateral face of medial forefoot counter 2201. For the medial aspect of the head of the first metatarsal to contact the lateral face of medial forefoot counter 2201 requires that the foot rotate medially. An arrow indicates the required direction of rotation of the forefoot of the user. Rotating the foot on rigid base 2100 in order to allow the medial aspect of the first metatarsal to contact the lateral face of medial forefoot counter 2201 is disadvantageous and potentially stressful to the user since such a manoeuvre will result in an inverted position of the foot in relation to the correct alignment of the foot on rigid base 2100 shown in FIG. 63.

FIG. 66 shows an anterior elevation of the foot 2001 of a user positioned on rigid base 2100 of footwear device 2000 showing the space between the lateral face of medial forefoot counter 2201 and the medial aspect of the head of the first metatarsal.

FIG. 67 shows substantially the same view as FIG. 65 except that in FIG. 67 medial forefoot counter 2201 has been shifted laterally so as to contact the medial aspect of the head of the first metatarsal of the foot 2001 of the user with the foot correctly aligned longitudinally on rigid base 2100. An arrow indicates the direction medial forefoot counter has been shifted on rigid base 2100.

SOLE ADJUSTMENT

While the adjustment of medial forefoot counter 2201 enables the foot 2001 of the user to be correctly aligned on rigid base 2100 yet another problem has arisen. The alignment of the head of the first metatarsal of the foot 2001 of the user has been altered in relation to the appliance affixed to the sole of the footwear, in this instance, a snow ski, in comparison with the alignment of the appliance in relation to the head of the first metatarsal as shown in FIG. 63.

Alignment of the center of the head of the first metatarsal is an important factor influencing physiological mechanisms which balance pronation/supination moments acting transversely across inside edge of appliances such as snow skis. The contact point of such an appliance with the surface on which it is acting can act as a fulcrum and, in so acting, establish a moment arm pivot in situations where the ground reaction force and the force applied by the user are not acting linearly in opposition to each other. In monopedal stance the weight of the body acts substantially through the center of the head of the first metatarsal.

It is important, in activities such as snow skiing, that means be provided to allow the center of the head of the first metatarsal to be positioned so that the force applied by the user can be aligned in opposition to the ground reaction force when the snow ski is placed on its inside edge. If opposing ground reaction and applied forces can not be aligned, a moment arm will be created with the effect that the force applied by the user will tend to rotate the foot in the direction of either supination or pronation. The location of the inside edge of a snow ski tends to favour a supination moment arm since the ski edge generally lies medial of the center of the head of the second metatarsal. If the force applied by the user is sufficient in the presence of a moment arm to rotate the foot in the direction of either supination or pronation, the long axis of the tibia will also be caused to rotate through an intrinsic mechanism within the tarsus of the foot. The means to adjust the transverse position of the foot in relation to the inside edge of a snow ski while maintaining the means to independently adjust the position of the foot on the longitudinal axis of the sole of the footwear is important and advantageous to the user and is thus an object of the present invention.

FIG. 68 shows an inferior plan view of the rigid base 2100 and sole 2101. In this particular embodiment sole 2101 is secured to rigid base 2100 with at least one flat head screw 2110 in a manner which permits sole 2101 to be removed from rigid base 2100. The advantage of such an arrangement being that soles of different specification can be secured to rigid base 2100 in order to meet the particular needs of the user, in this instance, the need to position the foot transversely relative to the appliance affixed to sole 2101.

At least one transverse slot runs inferosuperiorly through sole 2101 which allows the sole to be shifted transversely on rigid base 2100. In the present embodiment two slots 2113, one at each end of the sole 2101, are provided. Flat head screws 2110, at each end of sole 2101, are threaded into rigid base 2100 such that the screws act as studs or guide pins for sole 2101 to move in the slots 2113.

In operation the cohesive tension between sole 2101 and rigid base 2100 is relieved by partially withdrawing the flat head screws 2110 from their receiving threads in rigid base 2100. Sole 2101 can then be shifted medially or laterally within the adjustment range afforded by the slots 2113 until it is located in the desired position. Flat head screws 2110 are then tightened onto their associate d threads in rigid base 2100 so as to secure sole 2101 to rigid base 2100 and fix the relationship of the two components.

FIG. 69 shows an anterior elevation similar to FIG. 66 except that medial forefoot counter 2201 and sole 2101 have been shifted so as to correctly position the narrow foot in relation to the inside edge of a snow ski. Arrows indicate the direction in which the counters have been shifted on rigid base 2100.

FIG. 70 shows substantially the same view as FIG. 69 except that the ground reaction force FR and the force applied by the user F are shown substantially as they would be when the user is in monopedal stance with the foot correctly positioned in relation to the inside edge of a snow ski affixed to sole 2101.

FIG. 71 shows substantially the same view as FIG. 70 except that the snow ski shown affixed to sole 2101 is wider on its medial aspect in comparison to the snow ski affixed to sole 2101 as shown in FIG. 70. The position of the inside edge of the snow ski in relation to force F applied by the user is such that the ground reaction force FR and the force F applied by the user are not acting linearly in opposition to each other. The transverse offset between the ground reaction force FR and the force F applied by the user creates a moment arm MA which acts lateral of the ski edge with the result that force F applied by the user acting on the moment arm MA will tend to rotate the foot in the direction of supination when the ski is placed on its inside edge.

FIG. 72 shows substantially the same view as FIG. 71 except that sole 2101 has been shifted laterally in relation to rigid base 2100 so that the ground reaction force FR and the force F applied by the user are now acting linearly in opposition to each other with the result that the moment arm MA as shown in FIG. 71 has been cancelled.

FIG. 73 shows substantially the same view as FIG. 70 except that the snow ski affixed to sole 2101 is narrow on its medial aspect in comparison to the snow ski affixed to sole 2101 as shown in FIG. 70. The position of the inside edge of the snow ski in relation to the force F applied by the user is such that the ground reaction force FR and the force F applied by the user are not acting linearly in opposition to each other. The transverse offset between the ground reaction force FR and the force F applied by the user creates a moment arm MA which acts medial of the ski edge with the result that force F applied by the user acting on the moment arm MA will tend to rotate the foot in the direction of pronation when the ski is placed on its inside edge.

FIG. 74 shows substantially the same view as FIG. 73 except that sole 2101 has been shifted medially in relation to rigid base 2100 so that the ground reaction force FR and the force F applied by the user are now acting linearly in opposition to each other with the result that the moment arm MA shown as shown in FIG. 73 has been cancelled.

FIG. 75 shows an inferior plan view similar to FIG. 68 where at least one transverse slot is running inferosuperiorly through sole 2101 of sufficient width to permit sole 2101 to be rotated relative to rigid base 2100 about the shank of flat head screw 2110 in addition to the facility to be adjusted transversely as shown in FIG. 68 and in the manner previously described. In the embodiment shown in FIG. 75, two slots 2114 are provided. These facilities are advantageous for aligning the user's foot when skate ice blades, in-line wheel systems, snow skis or the like are mounted to the sole of the footwear.

There are several alternate methods of aligning the foot in relation to the inside edge of a snow ski. For example, a plate or adjustment system which allows the position of the safety binding to be shifted either medially or laterally in relation to the ski in a manner similar to that previously described can be mounted on the top surface of a snow ski. Or, adjustment means can be incorporated into the mounting base of a release binding which allows the binding to be shifted medially or laterally once the base has been mounted to the top of a snow ski. Similar systems which allow the binding to be shifted anteriorly or posteriorly on snow skis presently exist. However, these systems do not anticipate or provide the means for transverse adjustment of the release binding. Yet a further possibility is that binding mounting lugs which permit the release binding to be shifted medially or laterally after it has been mounted to the snow ski can be incorporated within the construction of the snow ski itself.

FIG. 76 is a superior plan view of rigid base 2100 and sole 2101 with medial forefoot counter 2201 and heel counter 2300 mounted. Other parts of the footwear device 2000 have been omitted for the sake of clarity.

Medial forefoot counter 2201 has been fitted with retention means 2210 whose operation has been previously described. Heel counter 2300 is fitted with retention means 2310 whose operation is substantially the same as retention means 2210. These means provide for adjustment of the position of medial forefoot counter 2201 and heel counter 2300 on rigid base 2100 in the direction indicated by the arrows.

FIG. 77 shows a medial elevation of the rigid base 2100 and sole 2101 with medial forefoot counter 2201 and heel counter 2300 as in FIG. 76. Base plate 2211 of medial forefoot counter 2201 has been fitted with a vertical mounting plate 2231. Medial forefoot counter 2201 is mounted to vertical mounting plate 2231 by flat head screw 2241 which passes through an oblong slot 2242 in vertical mounting plate 2231 and screws into a threaded hole in the medial face of medial forefoot counter 2201. In this configuration the arrangement of medial forefoot counter with retention means 2210 is such that medal forefoot counter 2201 can be removed from retention means 2210 and replaced with a medial forefoot counter of different specification.

When mounted to the vertical mounting plate 2231 of retention means 2210, medial forefoot counter 2201 can be shifted anteriorly or posteriorly in addition to the facility to shift the counter medially or laterally previously described. In operation, tension is backed off flat head screw 2241 and medial forefoot counter 2201 is shifted either anteriorly or posteriorly within the limit of adjustment of the slot 2242. The shank of flat head screw 2241 travels in the oblong slot 2242 provided in vertical mounting plate 2231. When the desired position of medial forefoot counter is established flat head screw 2241 is tightened against the receiving threads in medial forefoot counter 2201 so as to secure and fix the position of the medial forefoot counter 2201 on vertical mounting plate 2231.

In a similar fashion to medial forefoot counter 2201, heel counter 2300 is fitted with base plate 2311 which allows heel counter 2300 to be affixed to the superior surface of rigid base 2100 by retention means 2310. Inverted threaded flat head screw 2321 can move within a slot 2323 formed in the side of rigid base 2100 and which extends posteroanteriorly in the interior of rigid base 2100. The adjustment slot 2323 in which inverted flat head screw 2321 can move within rigid base 2100 is shown with dashed lines as is flat head screw 2321.

The threaded portion of flat head screw 2321 extends superiorly through the superior surface of rigid base 2100 and continues through a receiving hole in base plate 2311. Threaded cap 2322 threads onto the receiving threads of flat head screw 2321 such that retention means 2310 secures and fixes the location of heel counter 2300 on rigid base 2100 when threaded cap 2322 is tensioned against flat head screw 2321.

When tension is released on base plate 2311 by backing off threaded cap 2322, retention means 2310, along with heel counter 2301, can be shifted anteriorly or posteriorly on rigid base 2100 to the desired location within the range of adjustment in the slot 2323. The advantage of such an arrangement being that heel counter 2300 is now independent of rigid base 2100. It can thus be removed and replaced with a heel counter of different specification or adjustments can be made to the counter's position on rigid base 2100.

The retention means 2310 further includes a vertical member 2331 connected at right angles to the base plate 2311. The member 2331 is provided with a horizontal slot (not shown) through which an adjustment screw 2341 extends which screws into the heel counter 2300, as shown in FIG. 79. Thus, by loosening the screw 2341, the heel counter 2300 can be adjusted medially/laterally with respect to the foot along the horizontal slot.

FIG. 78 is similar to FIG. 76 except that medial forefoot counter 2210 and heel counter 2300 have been repositioned on rigid base 2100 in the directions indicted by the arrows. Medial forefoot counter 2201 has been shifted laterally and posteriorly. Heel counter 2300 has been shifted anteriorly and medially.

FIG. 79 is similar to FIG. 77 except that medial forefoot counter 2201 and heel counter 2300 have been shifted on rigid base 2100 as shown in FIG. 78. Arrows indicate the posterior shift of medial forefoot counter 2201 and the anterior shift of heel counter 2300.

FIG. 80 shows a superior plan view of the lower outer lower shell component 3000, rigid base 2100 and sole 2101 of a ski boot. The lower outer shell has been cut horizontally just above the top of heel counter 2300 so as to expose rigid base 2100. Medial forefoot counter 2201 and heel counter 2300 have been incorporated into the shape of outer lower shell component 3000 in a manner which provides for the necessary operating clearance between the counters for the changing form or architecture of the foot when moving between bipedal and monopedal stances.

While the incorporation of medial forefoot counter 2201 and heel counter 2300 into outer lower shell component 3000 shown in FIG. 80 is advantageous so far as economy of production it does not provide for adjustment of the counters as previously described. Contact of discrete aspects of the user's foot with the appropriate structures of footwear device 2000 is important to the correct operation of the device.

FIG. 81 shows the same view as FIG. 80 except that medial forefoot counter 2201 and heel counter 2300 are separate structures and thus independent from outer lower shell component 3000. The counters are shown ready to be attached to the wall of lower outer shell component 3000. The counters snap into place by way of production lugs 2250, 2350 molded onto the counter surface which contacts the inner surface of outer lower shell component 3000. Receiving holes 2260, 2360 for the production lugs are molded into the appropriate location of the wall of outer lower shell component 3000. Receiving holes can also be provided in rigid base 2100. The advantage of such an arrangement being that medial forefoot counter 2201 and heel counter 2300 can be removed from outer lower shell component 3000 and replaced with counters of a different specification.

FIG. 82 is similar to FIG. 81 except that medial forefoot counter 2201 and heel counter 2300 are of a different specification than those shown in FIG. 81. Multiple receiving holes 2250 are provided for medial forefoot counter 2201 to enable the counter to be shifted anteriorly or posteriorly in relation to rigid base 2100. Heel counter 2300 has the effect of shifting the foot of the user anteriorly while the medial face of medial forefoot counter 2201 is thinner mediolaterally than the equivalent counter as shown in FIG. 80. The effect is that the lateral face of medial forefoot counter 2201 has shifted medially. By utilizing counters of other specification, the foot can be positioned on rigid base 2100 in a similar manner to the means previously described to adjust medial forefoot counter 2201 and heel counter 2300.

FIG. 83 is similar to FIG. 82 except that heel counter 2300 is now thinner on its lateral face and wider on its medial face with the result that the foot of a user is offset laterally on rigid base 2100. Medial forefoot counter 2201 is the same form as that of FIG. 82 except that the counter has been inserted to the most posterior mounting hole in the wall of lower outer shell component 3000.

There are several advantages to footwear employing either removable or adjustable medial forefoot and heel counters or counters which affix to the outer shell of the footwear. Outer shell components can be satisfactorily used for a broad range of foot sizes because the structure of the outer shell component can be extended so as to contact discrete areas of the foot in a manner which maintains the correct position of the user's foot on the rigid base of the footwear.

A further advantage is that removable modular counters can be designed in conjunction with the outer shell components so the same counters can be utilized in both left and right shell components thereby halving production costs. In the case of asymmetrical heel counters intended to offset the heel of the user either medially or laterally in order to effect the correct position on the rigid base the asymmetrical heel counters can be interchanged between left and right outer shell components so as to reverse the offset.

INSTEP COUNTER—PIVOT STOP

The compression and decompression of the arch of the foot which occur when the user moves between bipedal and monopedal stances is accommodated by the pivoting of instep counter 2420 about its horizontal pivot axis on pivot 2430. Under normal operating conditions the foot can be maintained in good contact with the rigid base 2100 and the heel counter 2300. However, under higher loads imposed by the activity of the elite skier the instep counter 2420 may have to be secured in contact with the dorsum of the foot with proportionally higher force in order to maintain the same level of connection enjoyed by the less demanding skier. While the level of comfort may still be regarded as good, the object of footwear device 2000 is to maximize user comfort by minimizing as much as possible, the application of force to the foot and leg.

When forces act on the user, in particular, inferoanteriorly acting forces, which tend to cause a reduction in the force applied to rigid base 2100 by the foot, compression of the soft tissue of the dorsum of the foot and/or compression of any surface treatment of instep counter 2420 may occur as the force applied to instep counter 2420 by the dorsum of the foot increases. Compression of these materials may allow instep counter 2420 to be levered upward at its posterior aspect with resultant reduction of the contact area of the heel with the rigid base 2100.

Although less likely, a similar situation may arise where the skier encounters a sudden anteroposteriorly acting resistance or a force which tends to cause the foot to move anteriorly on rigid base 2100. Levering of instep counter 2420 at its limits of bipedal and monopedal stance can be significantly reduced without the necessity of applying high force to the dorsum of the foot by fitting at least one stop means to pivot 2430 to arrest the pivoting of instep counter 2420 at the limits of either bipedal and/or monopedal stances.

FIG. 84 shows a medial elevation of the right foot of a user in bipedal stance positioned on rigid base 2100. Rigid base 2100, heel counter 2300 and forefoot/midfoot pivotal support 2400 are shown. Other elements of the footwear device 2000 have been deleted for the sake of clarity.

The connector link 2434 of pivot 2430 has been fitted with arms 2464, 2467 extending anteriorly and posteriorly above instep counter 2420. The posterior arm has a threaded hole to receive an adjustable posterior stop screw 2437. The anterior arm has a threaded hole to receive an adjustable anterior stop screw 2436.

In FIG. 84 posterior stop 2437 is in contact with the posterior superior aspect of instep counter 2420 as the foot of the user is in the architecture associated with bipedal stance. For the same reason, anterior stop 2436 has clearance between its inferior end and the anterior superior aspect of instep counter 2420 to permit sufficient rotation of instep counter 2420 about its axis with pivot 2430 to allow the user to assume a position of monopedal stance.

FIG. 85 is a similar view to FIG. 84 with the same elements shown. In this figure, the foot of the user is shown in monopedal stance. Counter stop 2436 is now in contact with the anterior superior aspect of instep counter 2420 due to the rotation which has taken place about its axis with pivot 2430. For the same reason, counter stop 2437 now has clearance between its inferior end and the posterior superior aspect of instep counter 2420 sufficient to permit the user to assume a position of bipedal stance.

In operation counter stops 2436 and 2437 will initially be backed off to ensure instep counter 2420 has adequate rotation about its axis with pivot 2430 to permit the counter to assume the angle of the dorsum of the user's foot and for the user to assume both bipedal and monopedal stances.

Instep counter 2420 is first adjusted as previously described with the foot of the user in bipedal stance. Counter stop 2437 is now adjusted so as to contact instep counter 2420.

Once counter stop 2437 has been adjusted the user should assume a position of monopedal stance. Counter stop 2436 is then adjusted so as to contact instep counter 2420. Further adjustment may be required once the user has engaged in the skiing activity. If desired, counter stop 2436 may be omitted, the stop 2437 on posterior arm 2467 being the more important one.

INSTEP COUNTER

Instep counter 2420, as previously described, consists of a number of plates or planes oriented so as to direct force to specific areas of dorsum of the foot of the user. Instep counter 2420 acts in concert with the foot Of the user and heel counter 2300 and medial forefoot counter 2201 both of which are mounted to rigid base 2100 in this embodiment.

While the previously disclosed structures of instep counter 2420 are effective in maintaining the application of force to the dorsum of the first metatarsal and midfoot and the superolateral and medial aspects of the first metatarsal when moving between bipedal and monopedal stances, these structures do not provide for continuous contact with the superolateral and supero-medial aspects of the midfoot when moving between bipedal and monopedal stances since such contact would interfere with the inferomedial movement of this aspect of the foot. The structures of the following embodiments overcome this limitation and allow for continuous superolateral and superomedial or medial contact of the midfoot when moving between bipedal and monopedal stances.

Another embodiment is shown in FIG. 86, which shows a medial view of rigid base 2100, medial forefoot counter 2201, heel counter 2300 and forefoot/midfoot pivotal support 2430 with instep counter 2420 mounted thereon. The right foot 2001 of a user is positioned on rigid base 2100. Other elements of the footwear device 2000 have been omitted for the sake of clarity. In this particular embodiment instep counter 2420 is mounted to an instep counter carriage 2460 in a manner which allows it to rotate about a vertical axis 2470 substantially centered over the medial/lateral axis of the head of the first metatarsal. Instep counter carriage 2460 is mounted to pivot 2430.

FIG. 87 shows the same structure as FIG. 86 in a superior plan view except that rigid arch 2410 of forefoot/midfoot compression member 2400 has been omitted for the sake of clarity.

FIG. 88 shows the same structure as FIG. 87 except that instep counter carriage 2460 has been omitted to show the structure of instep counter 2420.

FIG. 89 is a superior plan view of instep counter carriage 2460 with pivot 2430 mounted. A hole 2465 at the anteromedial aspect of instep counter carriage 2460 is provided so that an axis pin 2461 on instep counter 2420 can be inserted through the hole in a manner which allows instep counter 2420 to rotate about instep counter carriage 2460 about the vertical axis 2470. A slot 2466 at the posterior end of instep counter carriage 2460 is provided to allow a guide stud 2462 mounted on instep counter 2420 to extend through the slot 2466 and guide instep counter 2420 as it rotates about axis pin 2461, which coincides with the pivotal axis 2470.

FIG. 90 shows a superior plan view of instep counter 2420. Axis pin 2461 is shown mounted on anteromedial aspect of instep counter 2420. Guide stud 2462 is shown mounted on the posterior aspect of instep counter 2420. Washers 2463 (typical) are set at the base of axis pin 2461 and guide stud 2462 where they serve as spacers to control the contact area between instep counter 2420 and instep counter carriage 2460.

FIG. 91 shows a medial elevation of instep counter 2420 and instep counter carriage 2460 with pivot mount 2432 shown mounted to instep counter carriage 2460. Axis pin 2461 and guide stud 2462 are shown with washers 2463 (typical) set at the base of the axis pin 2461 and guide stud 2462 and on top of instep counter 2420 in each instance. Axis pin 2461 and guide stud 2462 are each fitted with a keeper 2464 (typical) which maintains instep counter carriage 2460 in its relationship with instep counter 2420.

FIG. 92 is a superior plan view of instep counter carriage 2460, instep counter 2420 and pivot 2430 showing instep counter 2420 aligned longitudinally with instep counter carriage 2460.

FIG. 93 is a superior plan view of instep counter carriage 2460, instep counter 2420 and pivot 2430 showing instep counter 2420 rotated laterally about its axis with instep counter carriage 2460.

FIG. 94 is a superior plan view of instep counter carriage 2460, instep counter 2420 and pivot 2430 showing instep counter 2420 rotated medially about its axis with instep counter carriage 2460.

In combination with pivot 2430 which accommodates inferior/superior movements of the midfoot and instep counter carriage 2460 which accommodates medial/lateral movements of the midfoot, instep counter 2420 is able to maintain contact with the dorsum of the foot during the inferomedial and superolateral movement of the midfoot which occurs when moving between bipedal and monopedal stances. The facility for instep counter 2420 to simultaneously pivot on two axes makes possible new arrangements of counter plates or planes.

Figure 95:
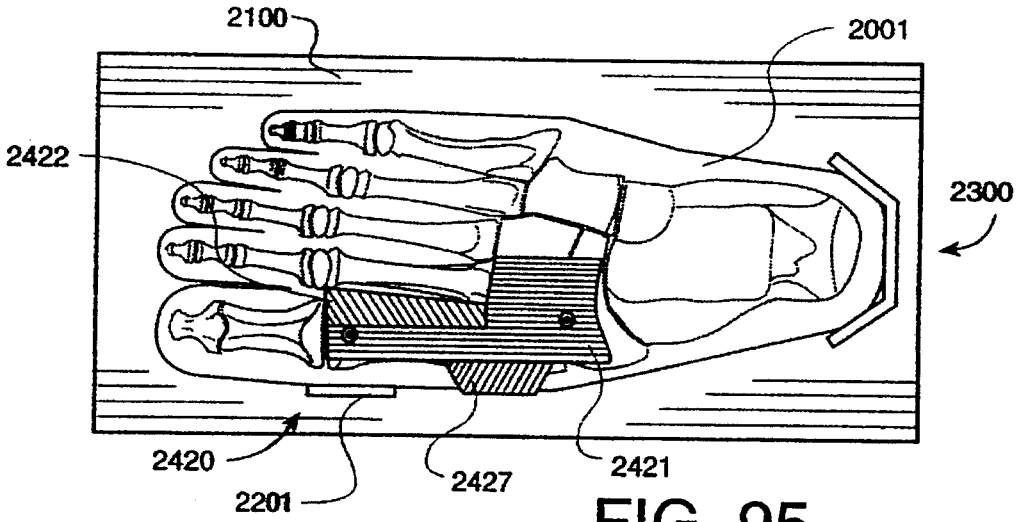

FIG. 95 is superior plan view of rigid base 2100, medial forefoot counter 2201 and instep counter 2420. Other elements of the footwear device 2000 have been omitted for the sake of clarity.

In this particular embodiment of instep counter 2420 the counter comprises three plates or planes; dorsum first metatarsal/dorsum midfoot counter 2421, superolateral first metatarsal counter 2422 and superolateral midfoot counter 2427 all of which are intended to provide substantially continuous contact with the associated aspect of the dorsum of the foot.

Figure 96:
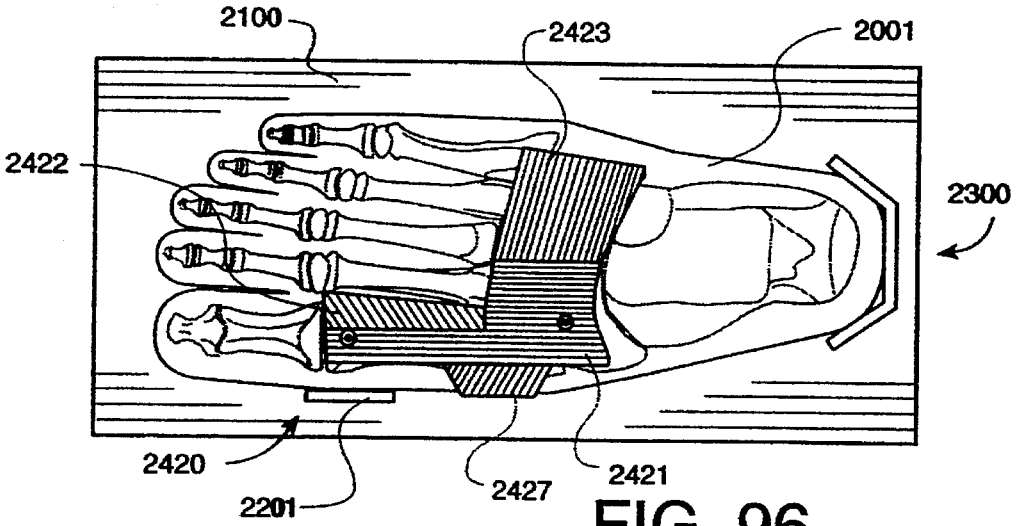

FIG. 96 is the same view as shown in FIG. 95 except that superolateral midfoot counter 2423 has been added to instep counter 2420.

Figure 97:
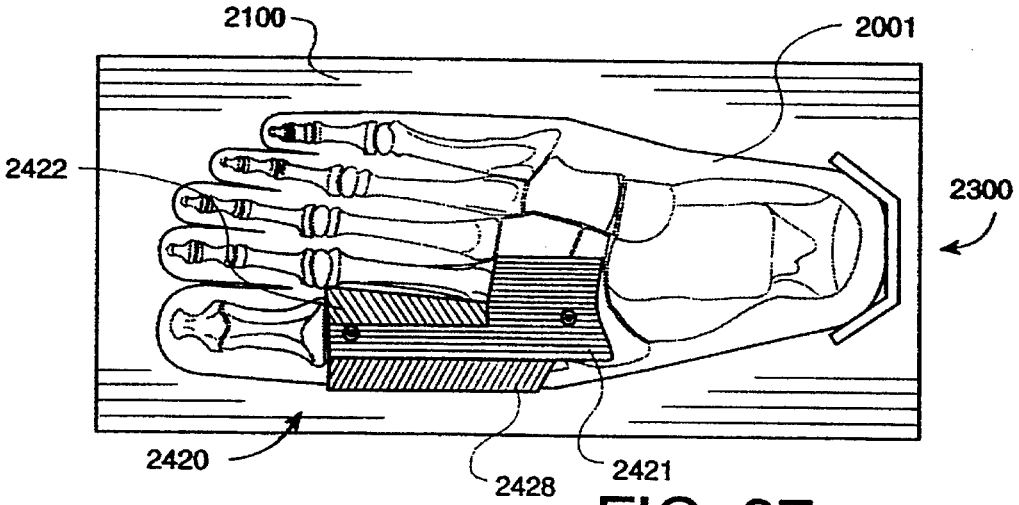

FIG. 97 is the same view as shown in FIG. 95 except that medial forefoot counter 2201 has been replaced by superomedial counter 2428 which is located on instep counter 2420.

Figure 98:
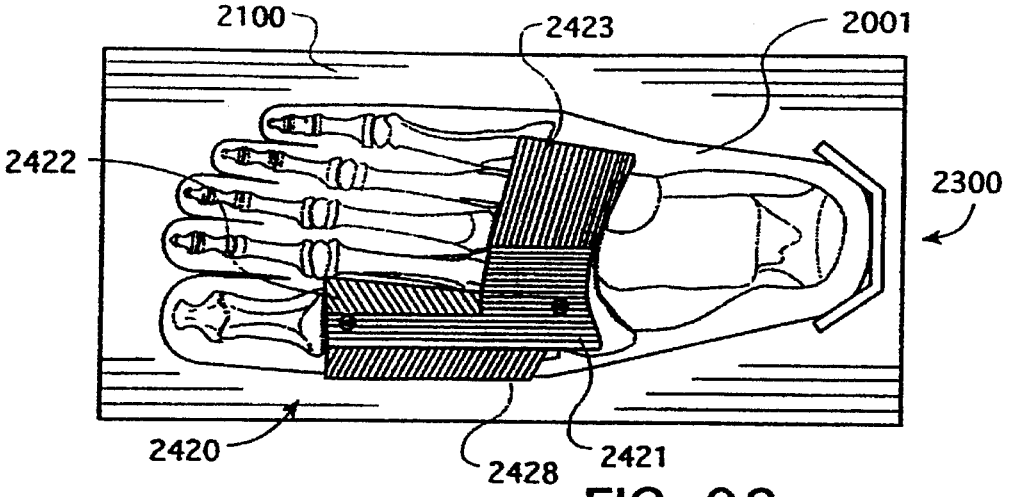

FIG. 98 is the same view as shown in FIG. 97 except that superolateral midfoot counter 2423 has been added to instep counter 2420.

Figure 99:
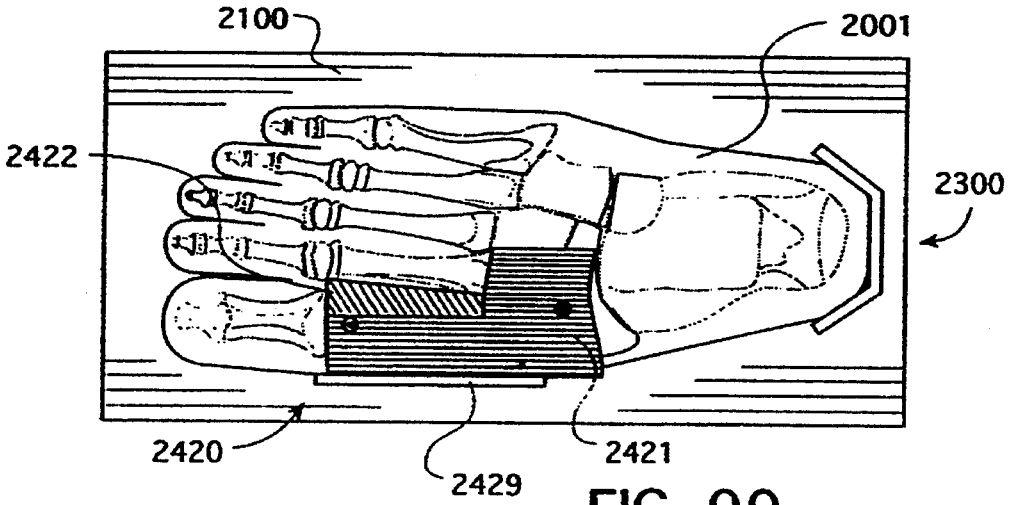

FIG. 99 is similar to FIG. 97 except that superomedial counter 2428 has been replaced by medial counter 2429.

Figure 100:
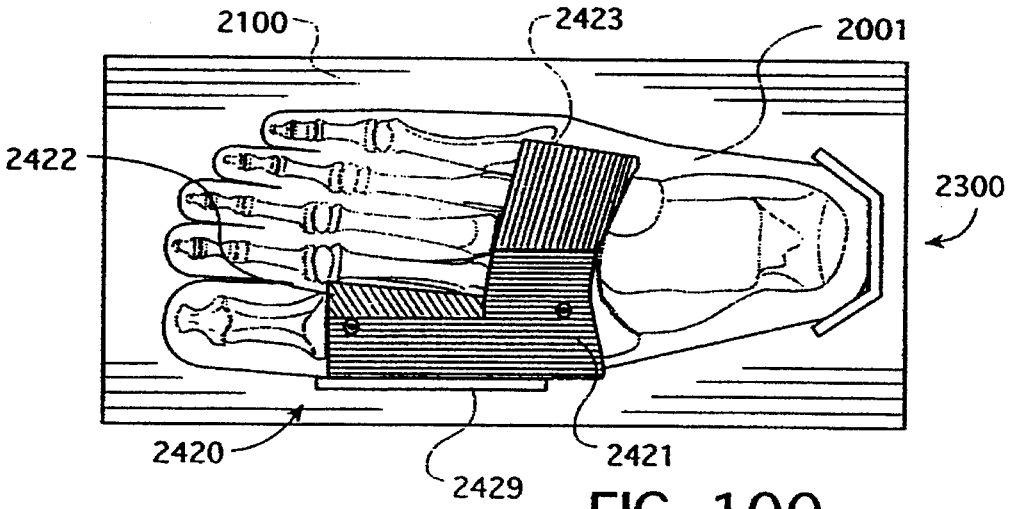

FIG. 100 is the same view as shown in FIG. 99 except that superolateral midfoot counter 2423 has been added to instep counter 2420.

Figure 101:
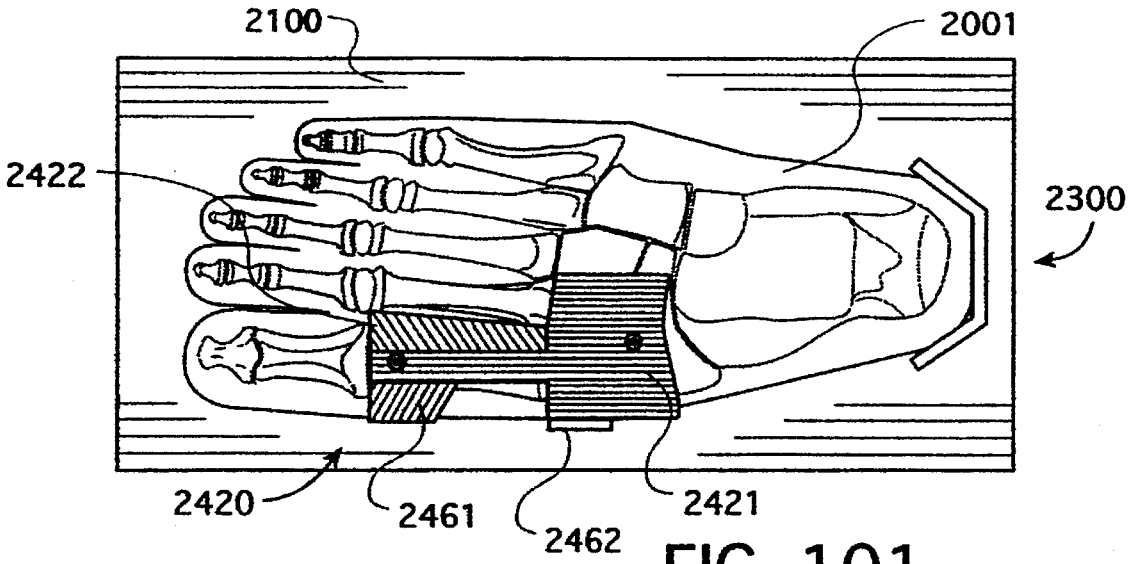
Figure 102:
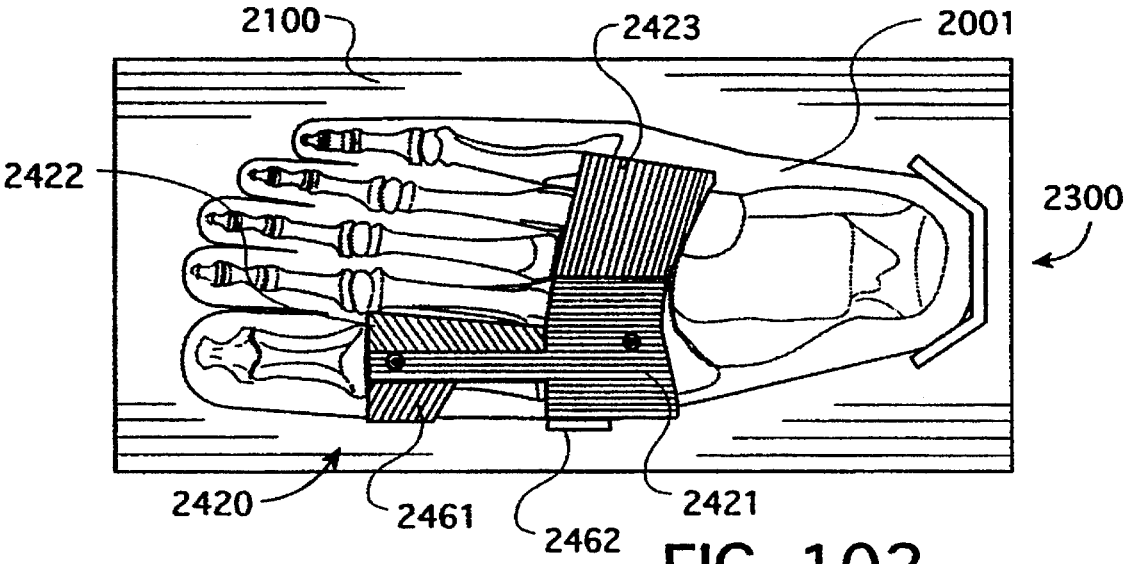

FIG. 101 shows instep counter 2420 comprised of dorsum first metatarsal/dorsum midfoot counter 2421, superolateral first metatarsal counter 2422, superomedial first metatarsal counter 2461 and medial midfoot counter 2462.

The operation of forefoot/midfoot compression member 2400 with instep counter carriage 2460 incorporated is essentially the same as previously described except that the longitudinal axis of counter carriage 2460 should be aligned with the longitudinal axis of rigid base 2100 when securing the position of instep counter 2420 on arch 2410.

There are several advantages afforded by the use of instep counter carriage 2460 in conjunction with pivot 2430 on instep counter 2420. Instep counter carriage 2460 allows the structure of instep counter 2420 to apply force to the dorsum of the foot including its superolateral and superomedial or medial aspects while accommodating the displacement of elements of the foot associated with movement between bipedal and monopedal stances. Instep counter carriage 2460 also enables instep counter 2420 to seek the medial/lateral center of the midfoot of the user which can be slightly different between users. This facility is advantageous because it allows for the more or less automatic adjustment of the instep counter to this aspect of the foot.

The medial forefoot counter 2201, heel counter 2300 and instep counter 2420, are preferably all of a rigid material but they may be covered with a padding material for comfort.

While only preferred embodiments of the invention have been described herein in detail, the invention is not limited thereby and modifications can be made within the scope of the attached claims.

What is claimed is:

1. A footwear device comprising:

a rigid base for supporting the foot of a user thereon;

a heel counter on the rigid base for contact with the foot of a user in a first area of the foot posterior to the posterior aspect of the heel of the foot;

a medial forefoot counter for contact with the foot of a user in a second area of the foot medial to the medial aspect of the head of the first metatarsal of the foot;

a forefoot/midfoot compression member for contact with the foot of a user in a third area of the foot located on the dorsum of said foot for exerting a downwardly and rearwardly directed force on the dorsum of the foot; and a sports implement interface member on the rigid base, said interface member being located beneath the rigid base, for interfacing with a sports implement and including means for attaching a sports implement thereto and adjustment means for maintaining the relative positions of the interface member and rigid base in a longitudinal direction relative to a user's foot, while permitting adjustment of the relative positions in a medial/lateral direction relative to the user's foot and including means for locking said interface member and said rigid base in selected relative positions.

2. The footwear device according to claim 1, wherein said adjustment means comprises at least one slot in said interface member for guiding said interface member.

3. The footwear device according to claim 2, having a pair of opposite ends which are anterior and posterior with respect to a user's foot and wherein two of said slots are provided, one each respectively, at said anterior and posterior ends.

4. The footwear device according to claim 1, wherein said sports implement comprises a snow ski.

5. The footwear device according to claim 1, wherein said sports implement comprises a skate ice blade.

6. The footwear device according to claim 1, wherein said sports implement comprises an in-line skate wheel system.

7. The footwear device according to claim 1, wherein said medial forefoot counter is located on said forefoot/midfoot compression member.

8. A footwear device comprising:

an elongate rigid base for supporting the foot of a user thereon;

a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with said posterior heel counter, wherein said forefoot/midfoot compression member comprises an instep counter, and a support member for said instep counter attached to said rigid base, wherein said instep counter is pivotally connected to said support member about a first pivot axis which is transverse to said rigid base; and wherein said instep counter is further pivotally connected to said support member about a substantially vertical second pivot axis which is located in the vicinity of the head of the first metatarsal of the foot of the user so that the instep counter is supported relative to said rigid base for pivotal movement about a pair of different pivot axes.

9. The footwear device according to claim 8, wherein said instep counter includes a plate in the form of a supero-lateral first metatarsal counter for applying a substantially inferomedially acting force on the supero-lateral aspect of the first metatarsal.

10. A footwear device comprising:

an elongate rigid base for supporting the foot of a user thereon;

a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with said posterior heel counter, wherein said forefoot/midfoot compression member comprises an instep counter and a support member for said instep counter attached to said rigid base, wherein said instep counter is pivotally connected to said support member about a pivot axis which is transverse to said rigid base so that the instep counter is pivotally or swivelably supported relative to said rigid base;

and wherein said support member is provided with a stop which is located above said instep counter for limiting the extent of pivotal movement of said instep counter about said pivot axis.

11. The footwear device according to claim 10, wherein a further stop on the anterior side of said pivot axis is provided.

12. The footwear device according to claim 11, wherein each of said stops is independently adjustable relative to said instep counter for independently limiting the extent of clockwise and anti-clockwise pivotal movement about said pivot axis.

13. The footwear device according to claim 12, wherein said stops each comprise a screw-threaded member supported in screw threads on said support member and each screw-threaded member projecting towards said instep counter, whereby rotation of the screw-threaded member advances or retracts the screw-threaded member relative to said instep counter.

14. A footwear device comprising:

a rigid base for supporting the foot of a user thereon;

a heel counter on the rigid base for contact with the foot of a user in a first area of the foot posterior to the posterior aspect of the heel of the foot;

a medial forefoot counter for contact with the foot of a user in a second area of the foot medial to the medial aspect of the head of the first metatarsal of the foot, first adjusting means for adjusting said medial forefoot counter in a direction medially/laterally with respect to said foot into different first positions relative to said rigid base, first locking means for selectively locking said medial forefoot counter in one of said first positions, second adjusting means for adjusting the medial forefoot counter in a direction anteriorly/posteriorly of the foot of a user into different second positions with respect to said rigid base and second locking means for selectively locking said medial forefoot counter in one of said second positions; and a forefoot/midfoot compression member for contact with the foot of a user in a third area of the foot located on the dorsum of said foot for exerting a downwardly and rearwardly directed force on the dorsum of the foot.

15. The footwear device according to claim 14, wherein said second adjusting means comprises a connection member connecting said medial forefoot counter to said rigid base and a slot in said connection member for guiding said medial forefoot counter.

16. A footwear device comprising:

a rigid base for supporting the foot of a user thereon;

a heel counter on the rigid base for contact with the foot of a user in a first area of the foot posterior to the posterior aspect of the heel of the foot, first adjusting means for adjusting said heel counter in a direction anteriorly/posteriorly with respect to said foot into different first positions relative to said rigid base, first locking means for selectively locking said heel counter in one of said first positions, second adjusting means for adjusting the heel counter in a direction medially/laterally of said foot into different second positions with respect to said rigid base and second locking means for selectively locking said heel counter in one of said second positions; and a forefoot/midfoot compression member for contact with the foot of a user in a third area of the foot located on the dorsum of said foot for exerting a downwardly and rearwardly directed force on the dorsum of the foot.

17. The footwear device according to claim 16, wherein said second adjusting means comprises a connection member connecting said heel counter to said rigid base and a slot in said connection member for guiding said heel counter.

* * * * *